US009687077B2

(12) United States Patent
Parker et al.

(10) Patent No.: US 9,687,077 B2
(45) Date of Patent: Jun. 27, 2017

(54) CHAIR AND SUPPORTS

(71) Applicant: FORMWAY FURNITURE LIMITED, Lower Hutt, Wellington (NZ)

(72) Inventors: Kent Wallace Parker, Lower Hutt (NZ); Gregory William Baum, Raumati South (NZ); Lyall Douglas Stewart, Porirua (NZ); Gavin James Bateman, Wellington (NZ); Leon Harley Craze, Wellington (NZ); Jon Leonard Fifield, Wellington (NZ); Mark Rundle Pennington, Wellington (NZ); Wayne Douglas O'Hara, Lower Hutt (NZ); Martyn Walter Goodwin Collings, Wellington (NZ); Paul James Stevenson, Wellington (NZ)

(73) Assignee: Formway Furniture Limited, Wellington (NZ)

( * ) Notice: Subject to any disclaimer, the term of this patent is extended or adjusted under 35 U.S.C. 154(b) by 298 days.

(21) Appl. No.: 14/348,874

(22) PCT Filed: Oct. 4, 2012

(86) PCT No.: PCT/NZ2012/000179
§ 371 (c)(1),
(2) Date: Mar. 31, 2014

(87) PCT Pub. No.: WO2013/051951
PCT Pub. Date: Apr. 11, 2013

(65) Prior Publication Data

US 2014/0292052 A1 Oct. 2, 2014

Related U.S. Application Data

(60) Provisional application No. 61/543,088, filed on Oct. 4, 2011.

(51) Int. Cl.
*A47C 1/032* (2006.01)
*A47C 7/38* (2006.01)
(Continued)

(52) U.S. Cl.
CPC ..... *A47C 1/03294* (2013.01); *A47C 1/032* (2013.01); *A47C 1/0342* (2013.01);
(Continued)

(58) Field of Classification Search
CPC ... A47C 1/03294; A47C 1/032; A47C 1/0342; A47C 3/02; A47C 3/0255; A47C 7/02;
(Continued)

(56) References Cited

U.S. PATENT DOCUMENTS 2,240,850 A 5/1941 Knabusch et al.
4,452,486 A 6/1984 Zapf et al.
(Continued)

FOREIGN PATENT DOCUMENTS

CN 101390690 A 3/2009
CN 201602399 U 10/2010
(Continued)

OTHER PUBLICATIONS

Chinese Search Report dated Jun. 14, 2016 issued in Chinese Application No. 2012800492452, filed Oct. 4, 2012.
(Continued)

*Primary Examiner* — Anthony D Barfield
(74) *Attorney, Agent, or Firm* — Workman Nydegger

(57) ABSTRACT

A chair has a supporting frame 1, a seat portion 101, a back portion 201 that has an upper end, a lower end, and is pivotally mounted relative to the supporting frame at a position above its lower end, and a recline mechanism 601. The recline mechanism 601 lifts the seat portion 101 upon a reclining action of the back portion 201, and has an operative connection 603, 611 between the seat portion and
(Continued)

the supporting frame and a drag link 602 pivotally connected to the seat portion 101 and pivotally connected to the back portion 201 at a position below the pivotal mounting of the back portion relative to the supporting frame. As the back portion 201 of the chair is reclined, the lower end of the back portion 201 moves forward and the drag link 602 pulls the seat portion 101 upward relative to the supporting frame 1.

16 Claims, 103 Drawing Sheets

(51) Int. Cl.

| | |
|---|---|
| ***A47C 7/54*** | (2006.01) |
| ***A47C 3/025*** | (2006.01) |
| ***A47C 7/50*** | (2006.01) |
| ***A47C 3/02*** | (2006.01) |
| ***A47C 7/02*** | (2006.01) |
| ***A47C 7/40*** | (2006.01) |
| ***A47C 7/44*** | (2006.01) |
| ***A47C 1/034*** | (2006.01) |

(52) U.S. Cl.
CPC ..... *A47C 3/02* (2013.01); *A47C 3/0255* (2013.01); *A47C 7/02* (2013.01); *A47C 7/38* (2013.01); *A47C 7/40* (2013.01); *A47C 7/44* (2013.01); *A47C 7/445* (2013.01); *A47C 7/506* (2013.01); *A47C 7/54* (2013.01)

(58) Field of Classification Search
CPC .... A47C 7/38; A47C 7/40; A47C 7/44; A47C 7/445; A47C 7/506; A47C 7/54
USPC ..... 297/321
See application file for complete search history.

(56) References Cited

U.S. PATENT DOCUMENTS

| | | | |
|---|---|---|---|
| 4,762,367 | A | 8/1988 | Denton |
| 4,887,866 | A | 12/1989 | Rusin |
| 5,486,035 | A | 1/1996 | Koepke et al. |
| 5,527,095 | A | 6/1996 | Marshall et al. |
| 5,765,913 | A | 6/1998 | LaPointe et al. |
| 5,775,775 | A | 7/1998 | Hoffman |
| 5,782,535 | A | 7/1998 | Lafer |
| 5,860,701 | A | 1/1999 | Jungjohann et al. |
| 6,733,071 | B2 | 5/2004 | Guillot et al. |
| 6,742,840 | B2 | 6/2004 | Bentley |
| 6,899,393 | B2 | 5/2005 | Garland |
| 6,959,965 | B2 | 11/2005 | Diffrient |
| 7,114,777 | B2 | 10/2006 | Knoblock et al. |
| 7,249,802 | B2 | 7/2007 | Schmitz et al. |
| 7,669,936 | B2 | 3/2010 | Aubriet et al. |
| 7,703,851 | B2 | 4/2010 | Nakaya et al. |
| 7,762,625 | B2 | 7/2010 | Hoffman et al. |
| 7,794,017 | B2 | 9/2010 | Kan et al. |
| 7,871,130 | B2 | 1/2011 | De Silva Netto et al. |
| 7,992,939 | B2 | 8/2011 | Pozzi |
| 2003/0015900 | A1 | 1/2003 | Lu |
| 2004/0262974 | A1 | 12/2004 | Terada et al. |
| 2008/0136239 | A1 | 6/2008 | Bock |
| 2008/0179934 | A1 | 7/2008 | Ahearn |
| 2009/0072593 | A1 | 3/2009 | Hoffman et al. |
| 2009/0267394 | A1 | 10/2009 | Bock |
| 2010/0127538 | A1 | 5/2010 | Hoffman et al. |
| 2010/0127548 | A1 | 5/2010 | Truckenbrodt et al. |
| 2010/0164263 | A1 | 7/2010 | Malenotti |
| 2010/0253125 | A1 | 10/2010 | Le Texier et al. |
| 2011/0074197 | A1 | 3/2011 | Okamoto |
| 2011/0089737 | A1 | 4/2011 | Tscherbner et al. |
| 2012/0112517 | A1 | 5/2012 | Hoffman et al. |

FOREIGN PATENT DOCUMENTS

| | | | |
|---|---|---|---|
| CN | 102056512 | A | 5/2011 |
| DE | 202006010382 | U1 | 11/2006 |
| EP | 0611536 | A1 | 2/1994 |
| EP | 1256294 | A2 | 11/2002 |
| EP | 0836820 | B1 | 6/2003 |
| EP | 1911371 | A1 | 4/2008 |
| EP | 1 987 739 | A1 | 11/2008 |
| EP | 2481316 | A1 | 8/2012 |
| GB | 316092 | A | 7/1929 |
| IT | TO940234 | A1 | 10/1995 |
| WO | 98/04171 | A1 | 2/1998 |
| WO | 01/03969 | A1 | 1/2001 |
| WO | 2008/043574 | A1 | 4/2008 |
| WO | 2008/092562 | A1 | 8/2008 |
| WO | 2008/149224 | A1 | 12/2008 |
| WO | 2012/041448 | A1 | 4/2012 |

OTHER PUBLICATIONS

European Search Report dated Jun. 10, 2015, issued in EP Application No. EP 2763569, filed Aug. 13, 2014.

International Preliminary Report on Patentability dated Sep. 27, 2013, issued in PCT Application No. PCT/NZ2012/000179, filed Oct. 4, 2012.

Written Opinion dated Mar. 18, 2013, issued in PCT Application No. PCT/NZ2012/000179, filed Oct. 4, 2012.

International Search Report dated Mar. 18, 2013, issued in PCT Application No. PCT/NZ2012/000179, filed Oct. 4, 2012.

CHAIR AND SUPPORTS

FIELD OF THE INVENTION

The invention relates generally to chairs and supports for use in chairs. More particularly, although not exclusively, the invention relates to reclining and rocking chairs suitable for domestic lounge use.

BACKGROUND TO THE INVENTION

Traditional reclining and/or rocking chairs are often large, heavy chairs that take up significant room. They also often have large housings that extend substantially to the floor to hide bulky mechanisms that provide the rocking and/or reclining action of the chairs. Such chairs often have extendible leg rests or supports which have bulky mechanisms, which again must be hidden in the large housings of the chair for aesthetic purposes and to hide potential pinch points from users.

In more recent times, lighter weight reclining lounge chairs have become available that do not have the large housings. Such chairs are generally mounted on pedestals. However, those chairs often have basic mechanisms that only provide limited functionality in the chair. Those reclining chairs have a less than optimal relationship between the seat and back. When the back of the chair is reclined, the relationship between the seat and back will generally be such that the user will not be comfortable in the chair, particularly over long periods. Such chairs also do not have built in extendible leg rests or supports, due to the lack of housing to hide the mechanisms of such supports. A purchaser generally needs to buy a separate stool or ottoman, if they want a leg support to match their chair.

Typical recliner mechanisms move the seat predominantly forward, so require a tension adjustment of the recline mechanism or a user activated recline lever to suit different user body sizes.

Some chairs have head rests or supports that are adjustable in position to suit a user. Most head rests can be raised or lowered in height relative to a chair back. Some can also be adjusted horizontally. Traditional head rests require the use of two separate actuators to initially adjust the vertical position of the head rest and then adjust the horizontal position of the head rest. This means the head rest adjustment is a two step process, and reduces the likelihood of the headrest position being adjusted. As a result, people may be inclined to use the head rests in a less than optimal position. Often, the user will not be able to adjust the head rest whilst seated due to high friction mechanisms and twin action adjusters, which means the user cannot switch between different head rest positions as needed when moving the chair between upright and reclined positions or when changing between tasks such as watching television and working on a laptop computer.

Some chairs have adjustable foot or leg rest arrangements. However, those arrangements typically only provide two or three discrete adjustment positions. A user may not be provided with optimal comfort with that restricted number of adjustment positions.

It is an object of at least preferred embodiments of the present invention to provide a chair or support that addresses at least one of the disadvantages outlined above, or that at least provides the public with a useful choice.

SUMMARY OF THE INVENTION

In accordance with a first aspect of the present invention, there is provided a chair comprising: a supporting frame; a seat portion for supporting an occupant; a back portion for supporting the back of a seated occupant that has an upper end, a lower end, and is pivotally mounted relative to the supporting frame at a position above its lower end; and a recline mechanism configured to lift the seat portion upon a reclining action of the back portion, the recline mechanism comprising an operative connection between the seat portion and the supporting frame, and a drag link pivotally connected to the seat portion and pivotally connected to the back portion at a position below the pivotal mounting of the back portion relative to the supporting frame, the recline mechanism configured such that as the back portion of the chair is reclined, the lower end of the back portion moves forward and the drag link pulls the seat portion upward relative to the supporting frame.

In an embodiment, the chair comprises a front operative connection between a relatively forward portion of the seat portion and the supporting frame. In an embodiment, the front operative connection comprises a slide arrangement comprising a track on one of the seat portion and the supporting frame, and a follower on the other of the seat portion and the supporting frame, with the follower arranged to travel in the track as the seat portion is moved upward upon recline of the back portion. In an embodiment, the chair comprises two front operative connections, one at or adjacent each side of the seat portion, and wherein each front operative connection comprises a slide arrangement comprising a track on one of the seat portion and the supporting frame, and a follower on the other of the seat portion and the supporting frame, with the follower arranged to travel in the track as the seat portion is moved upward upon recline of the back portion.

In an embodiment, the chair comprises a rear operative connection between a relatively rearward portion of the seat portion and the supporting frame. In an embodiment, the rear operative connection comprises a forward link that is pivotally connected to the supporting frame, a rearward link that is pivotally connected to the supporting frame, and a carrier link that is pivotally connected to the forward link and to the rearward link, wherein the carrier link is pivotally connected to the seat portion. In an embodiment, when the back portion is in an upright configuration, the forward link hangs downwardly and rearwardly from its pivot connection to the supporting frame, and the rearward link hangs downwardly and forwardly from its pivot connection to the supporting frame, and when the back portion is fully reclined, the forward link hangs generally downwardly from its pivot connection to the supporting frame, and the rearward link extends generally forwardly from its pivot connection to the supporting frame.

In an embodiment, the pivot connection of the carrier link to the seat portion is positioned rearwardly of the pivot connections of the forward link and rearward link to the carrier link.

In an embodiment, the pivot connection of the drag link to the seat portion is positioned generally above and generally behind the pivot connection of carrier link and the seat portion, when the back portion of the chair is not reclined. In an embodiment, the pivot connection of the drag link to the seat portion is positioned upwardly and rearwardly of the pivot connection of the carrier link and the seat portion, when the back portion of the chair is fully reclined.

In an embodiment, the chair comprises two rear operative connections, one at or adjacent each side of the seat portion, and wherein each rear operative connection comprises a forward link that is pivotally connected to the supporting frame, a rearward link that is pivotally connected to the supporting frame, and a carrier link that is pivotally connected to the forward link and to the rearward link, and that is pivotally connected to the seat portion.

In an embodiment, the operative connection(s) between the seat portion and the supporting frame is/are arranged such that the relatively forward and relatively rearward portions of the seat portion move upward and forward with a substantially linear movement as the back portion is reclined, with the amount of movement of the relatively rearward portion being greater than the amount of movement of the relatively forward portion, to provide a forward tilt of the seat portion as the back portion is reclined. The seat portion may have a rearward tilt angle when the back portion is upright, and the seat portion may have a smaller rearward tilt angle when the back portion is fully reclined.

In an embodiment, the upward movement of the relatively rearward portion of the seat portion may be greater than that of the relatively forward portion of the seat portion.

In an embodiment, the back portion comprises a central spine, and a compliant support surface supported by the spine for supporting the back of a seated occupant, wherein a lower portion of the spine is pivotally connected to the supporting frame, with a bottom portion of the spine pivotally connected to the drag link. The compliant support surface may comprise a resiliently flexible shell supported by the spine and a cushion supported by the shell. In an embodiment, the spine is resiliently flexible such that an upper end of the spine can be flexed rearwardly relative to a portion of the spine adjacent the pivot connection of the spine to the supporting frame.

In an embodiment, the spine is resiliently flexible so it can twist with a torsional action around a longitudinal axis of the spine, upon application of a suitable force by a seated occupant to the compliant support surface.

In an embodiment, the supporting frame comprises an intermediate support with a generally horizontally extending portion and a pair of rearward uprights, with the lower portion of the spine positioned between and pivotally connected to the uprights. In an embodiment, the seat portion comprises a seat frame and a support surface mounted to the seat frame for supporting a seated occupant, wherein the operative connection(s) between the seat portion and the supporting frame are connected between the intermediate support and the seat frame.

In an embodiment, the supporting frame comprises a main transom, an intermediate support, and a rocker mechanism that operatively connects the main transom and the intermediate support to provide a rocking motion therebetween, wherein the front and rear operative connections between the seat portion and the supporting frame are connected to the intermediate support. In an embodiment, the intermediate support, and thereby the seat portion, can be rocked between a rearwardly angled rearward rocked position and a forward rocked position. In an embodiment, the rocker mechanism comprises a front rocker arm pivotally connected to the main transom and to the intermediate support, and a rear rocker arm pivotally connected to the main transom and to the intermediate support. The front rocker arm and the rear rocker arm may hang downwardly, from their pivot connections to the main transom, at least when the rocker mechanism is in a neutral position. In an embodiment, when the intermediate support is in the rearward rocked position, the front rocker arm extends generally rearwardly from its pivot connection to the main transom, and the rear rocker arm extends generally downwardly from its pivot connection to the main transom, and when the intermediate support is in the forward rocked position, the front rocker arm extends generally downwardly from its pivot connection to the main transom, and the rear rocker am extends downwardly and forwardly from its pivot connection to the main transom.

In an embodiment, the front rocker arm is longer than the rear rocker arm. The pivot connection of the front rocker arm to the main transom may be positioned vertically higher than the pivot connection of the rear rocker arm to the main transom.

In an embodiment, the rocker mechanism comprises two front rocker arms and two rear rocker arms, positioned at or adjacent respective sides of the seat portion.

In an embodiment, the chair further comprises: an extendable foot or leg support assembly pivotally connected to the seat portion; and a rocking inhibitor arrangement to inhibit forward rocking of the intermediate support relative to the main transom when the foot or leg support assembly is extended.

In an embodiment, the rocking inhibitor arrangement is configured to automatically engage to inhibit forward rocking of the intermediate support when the foot or leg support assembly is extended, and to automatically disengage to allow forward rocking of the intermediate support when the foot or leg support assembly is retracted.

In an embodiment, the main transom or the intermediate support comprises one or more resiliently compressible stop(s) and the other of the main transom or intermediate support comprises one or more respective abutment surface(s) configured such that when the intermediate support is rocked sufficiently forward and/or rearward, the stop(s) are compressed against the respective abutment surface(s) to damp and limit the forward and/or rearward rock of the support.

In accordance with a second aspect of the present invention, there is provided a chair comprising: a supporting frame; a seat portion for supporting an occupant; a back portion for supporting the back of a seated occupant and that is reclinable from an upright position to a reclined position; and a pair of arm assemblies positioned one on either side of the seat portion, each arm assembly comprising an arm rest support and an arm rest that is slidably mounted to the arm rest support, wherein the arm rests are operatively connected to the back portion such that as the back portion is reclined, the arm rests slide rearwardly on the arm rest supports.

In an embodiment, the back portion comprises a central spine, and a support surface supported by the spine for supporting the back of a seated occupant.

In an embodiment, the chair comprises a recline mechanism configured to lift the seat portion upon a reclining action of the back portion, and the arm rest supports are mounted to the seat portion to move as the seat portion is moved by the recline mechanism.

In an embodiment, the supporting frame comprises a main transom, an intermediate support that operatively supports the seat portion and the back portion, and a rocker mechanism that operatively connects the main transom and an intermediate support to provide a rocking motion therebetween, wherein the arm rest supports are mounted to the seat portion to move as the seat portion is rocked by the rocker mechanism. The arm assemblies may alternatively be provided in a reclining chair that does not have a rocker mechanism.

In an embodiment, the seat portion comprises a seat frame and a support surface supported by the seat frame for supporting a seated occupant, and the arm rest supports are mounted to the seat frame.

In an embodiment, the arm rest supports are mounted to the seat portion so that the orientations of the arm rest supports relative to the seat portion are fixed.

In an embodiment, lower portions of the arm rest supports are pivotally connected to the seat portion, the arm rest supports configured such that the orientations of the arm rest supports relative to the seat portion change for at least part of the reclining action of the back portion.

In an embodiment, in each arm assembly, either the arm rest or the arm rest support comprises one or more bearing members, and the other of the arm rest or arm rest support comprises one or more complementary elongate slots for receiving the bearing member(s), the one or more elongate slot(s) extending in the direction of movement of the arm rest on the arm rest support.

In an embodiment, the back portion comprises a resiliently flexible shell, with upper body contacting surfaces of the arm rests formed by, or connected to, part of the resiliently flexible shell. In an embodiment, the resiliently flexible shell comprises a central main back supporting portion, and elongate arm rest portions, one on either side of the central main back supporting portion, wherein rear ends of the elongate arm rest portions are connected to the central main back supporting portion and forward ends of the elongate arm rest portions form the upper body contacting surfaces of the arm rests. In an embodiment, rear portions of the elongate arm rest portions are arcuate when the back portion of the chair is in an upright position, and are substantially flat when the back portion of the chair is reclined.

In accordance with a third aspect of the present invention, there is provided a head or neck support assembly for a chair, the head or neck support assembly comprising: a base for mounting the head or neck support assembly to a chair; a first member that is rotatable relative to the base about a first axis; a second member that is rotatable relative to the base about a second axis that is substantially parallel to the first axis; a first linkage arrangement comprising a first pair of generally parallel arms that have first ends that are pivotally connected to the first member about axes that are substantially perpendicular to the first axis and that have second ends; a second linkage arrangement comprising a second pair of generally parallel arms that have first ends that are pivotally connected to the second member about axes that are substantially perpendicular to the second axis and that have second ends; and a head or neck support that is operatively supported by the second ends of the generally parallel arms of the first and second linkage arrangements, wherein the head or neck support is moveable relative to the base with two substantially perpendicular degrees of freedom.

In an embodiment, the second ends of the first pair of generally parallel arms are moveable toward and away from the second ends of the second pair of generally parallel arms, upon movement of the head or neck support relative to the base.

In an embodiment, the second ends of the first pair of generally parallel arms are pivotally connected to a first support link about axes that are substantially parallel to the pivot axes between the parallel arms and the first member, and the second ends of the second pair of generally parallel arms are pivotally connected to a second support link about axes that are substantially parallel to the pivot axes between the parallel arms and the second member, and wherein the first and second support links being rotatable relative to the head or neck support, with the rotation axes of the first and second support links relative to the head or neck support being substantially parallel to the rotation axes of the first and second members relative to the base. In an embodiment, the first and second members are operatively coupled such that as the first member is rotated in one direction relative to the base, the second member rotates a corresponding amount in an opposite direction relative to the base, and wherein the rotating of the first and second members causes corresponding movement of the first and second linkage arrangements about the first and second axes relative to the base and rotation of the first and second support links relative to the head or neck support, with corresponding movement of the first and second support links toward or away from one another. In an embodiment, the head or neck support comprises a housing containing a first toothed rack that is coupled to the first support link, a second toothed rack that is coupled to the second support link, and a pinion gear that is rotatably mounted to the housing and engaged with the first and second toothed racks, wherein movement of the first and second support links toward and away from one another moves the toothed racks, with the racks and pinion gear linking the movement of the first and second support links.

In an embodiment, the head or neck support assembly comprises a locking mechanism to selectively inhibit movement of the first and second members and the first and second linkage arrangements and thereby maintain the head or neck support in a desired position. In an embodiment, the head or neck support assembly comprises a locking member that selectively inhibits pivoting of the first pair of generally parallel arms relative to the first member and that selectively inhibits rotation of the first member relative to the base. In an embodiment, the first pair of generally parallel arms are pivotally connected to a first support link, wherein the locking member is carried by the first support link and is engageable with one of the first pair of generally parallel arms to inhibit pivoting of the first pair of generally parallel arms relative to the first support link and thereby inhibit pivoting of the first pair of generally parallel arms relative to the first member. In an embodiment, an engagement surface is provided on one of the first pair of generally parallel arms, and the locking member comprises a complementary engagement surface for engaging with the engagement surface on one of the first pair of generally parallel arms.

In an embodiment, the head or neck support comprises a housing containing a first toothed rack that is rotatably connected to the first support link, and wherein the locking member is engageable with the first toothed rack to inhibit rotation of the first support link relative to the first toothed rack, thereby inhibiting rotation of the first member relative to the base. In an embodiment, the toothed rack comprises a body having an aperture and an engagement surface, and the locking member extends through the aperture in the body of the toothed rack and through an aperture in the first support link and is moveable only axially relative to the first support link, and wherein the locking member comprises a complementary engagement surface for engaging with the engagement surface on the toothed rack to inhibit rotation therebetween.

In an embodiment, the locking member is configured such that when moving the locking member from an unlocked position to a locked position, the locking member initially inhibits pivoting of the first pair of generally parallel arms relative to the first member and then inhibits rotation of the first member relative to the base. In an embodiment, the locking member comprises a first locking member portion for inhibiting pivoting of the first pair of generally parallel arms relative to the first member, a second locking member portion for inhibiting rotation of the first member relative to the base, and a biasing device between the first locking member portion and the second locking member portion.

In an embodiment, the head or neck support assembly comprises a second locking member that selectively inhibits pivoting of the second pair of generally parallel arms relative to the second member and that selectively inhibits rotation of the second member relative to the base. In an embodiment, the head or neck support comprises an unlock plate with a pair of slots in which the locking members are slidably mounted such that the first and second support links can move toward and away from one another, and at least one actuation lever for actuating by a user, wherein actuation of the actuation lever moves the unlock plate and disengages the locking members to enable the position of the head or neck support to be adjusted. In an embodiment, the head or neck support assembly comprises a biasing device to bias the lever and thereby the unlock plate into a position in which the locking members are engaged to inhibit movement of the head or neck support.

In an embodiment, the head or neck support assembly comprises two actuation levers for actuating by a user, wherein actuation of either or both actuation levers moves the unlock plate and disengages the locking members to enable the position of the head or neck support to be adjusted. In an embodiment, it is sufficient to actuate one of the actuation levers to disengage the locking members to enable the position of the head or neck support to be adjusted. In an alternative embodiment, it is necessary to actuate both of the actuation levers to disengage the locking members to enable the position of the head or neck support to be adjusted. The actuation levers may be positioned adjacent respective sides of the head or neck support. In an embodiment, the actuation levers are arranged for actuation from a rear of the head or neck support. In an alternative embodiment, the actuation levers are arranged for actuation from a front of the head or neck support.

In an embodiment, the head or neck support assembly is mounted to a chair having a back portion with a central spine, wherein the base and the central spine are integral. Alternatively, the base may be separately formed from the central spine, and may be mounted to the back portion by being connected to the spine. Alternatively, the base may be connectable to, or integrally formed, with a part of the back portion other than the spine, for example a frame member or shell of the back portion.

In accordance with a fourth aspect of the present invention, there is provided an adjustable support arrangement for a chair comprising: a mounting assembly comprising an elongate closure; a slider arrangement comprising a first slider portion and a second slider portion in fixed relation, the slider portions being slidable together along the closure to open and close a portion of the closure; and a support member operatively connected to the slider arrangement; wherein the support member is adjustable to a plurality of positions between first and second end positions by sliding the slider portions along the closure.

In an embodiment, the first slider portion and the second slider portion are integrally formed. Alternatively, the first slider portion and the second slider portion may be separately formed, but configured to move together with movement of the support member.

In an embodiment, the closure comprises two opposite, engagable sides that engage to close or partially close the respective closure.

In an embodiment, the opposing sides of each closure each comprise a plurality of engagable teeth. The closure may comprise a zipper with first and second slider portions. Alternatively, the opposing sides of the closure may comprise a cooperating projection and recess.

In an embodiment, portions of the closure externally of the first and second slider portions are closed. A portion of the closure between the first and second slider portions may form an opening.

The support arrangement may comprise a second elongate closure that is substantially parallel to the first elongate closure, and wherein the slider arrangement comprises third and fourth slider portions that are slidable together along the further second closure. The second elongate closure may have any one or more of the features outlined in relation to the first closure. The first and second closures could be the same, or could differ.

In an embodiment, the support arrangement further comprises a carriage wherein the slider portions are fixed to the carriage and the support member is operatively connected attached to the support carriage. In an embodiment, the slider portions are connected to the carriage by way of a snap connection.

In an embodiment, the support member is removably attached to the carriage. The support member may, for example, be connected to the carriage by way of a snap connection.

In an embodiment, the closure(s) is/are flexible. In an embodiment, the mounting assembly is flexible. In an embodiment, the mounting assembly comprises a flexible load dispersion panel for attachment to the front surface of a cushioned support.

In an embodiment, the mounting assembly further comprises tension members for movably attaching the support arrangement to a frame or relatively rigid member.

In an embodiment, the support member is a head or neck support and the support member is height adjustable relative to the mounting assembly. In an alternative embodiment, the support member is a lumbar support and the support member is height adjustable relative to the mounting assembly.

In accordance with a fifth aspect of the present invention, there is provided a chair comprising: a seat portion for supporting an occupant; a back portion for supporting the back of a seated occupant; and an adjustable support arrangement as outlined in relation to the fourth aspect above; wherein the mounting assembly is attached to the back portion.

In an embodiment, the back portion is upholstered and the upholstery comprises an elongate aperture substantially parallel to the closure(s), and wherein the slider arrangement comprises a carriage with a forwardly protruding connector portion that protrudes through the aperture for connection to the support member.

In accordance with a sixth aspect of the present invention, there is provided an adjustable support arrangement for a chair comprising: a flexible mounting assembly for mounting to a cushioned support, the mounting assembly comprising a flexible support rail; a slider arrangement being slidable along the support rail; and a support member operatively connected to the slider arrangement; wherein the support member is adjustable to a plurality of positions between first and second end positions by sliding the slider arrangement along the support rail.

In an embodiment, the flexible support rail comprises an elongate closure.

In an embodiment, the mounting assembly comprises a flexible load dispersion panel for attachment to the front surface of a cushioned support. In an embodiment, the load dispersion panel comprises a woven or non-woven fabric.

In an embodiment, the mounting assembly further comprises tension members for movably attaching the support arrangement to a frame or substantially rigid member.

In an embodiment, the support member is a head or neck support and the support member is height adjustable relative to the mounting assembly. In an alternative embodiment, the support member is a lumbar support and the support member is height adjustable relative to the mounting assembly.

The support arrangement may have any one or more of the features outlined in relation to the fourth aspect above.

In accordance with a seventh aspect of the present invention, there is provided a chair comprising: a seat portion for supporting an occupant; a back portion for supporting the back of a seated occupant; and an adjustable support arrangement as outlined in relation to the sixth aspect above, wherein the back portion comprises a rear relatively rigid portion and a cushioned portion and the mounting assembly is attached to a front surface of the cushioned portion.

In an embodiment, the mounting assembly comprises a flexible load dispersion panel, and the load dispersion panel is attached to the front surface of the cushioned portion by an adhesive.

In an embodiment, the mounting assembly comprises tension members that extend through apertures in the cushioned portion and attach to the relatively rigid portion of the back portion.

This invention may also be said broadly to consist in the parts, elements and features referred to or indicated in the specification of the application, individually or collectively, and any or all combinations of any two or more said parts, elements or features.

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

As used herein the term "and/or" means "and" or "or", or both.

As used herein "(s)" following a noun means the plural and/or singular forms of the noun It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

The invention consists in the foregoing and also envisages constructions of which the following gives examples only.

BRIEF DESCRIPTION OF THE DRAWINGS

In order that the invention may be more fully understood, some embodiments will now be described by way of example with reference to the accompanying figures in which:

FIG. 70A corresponds the un-locked position of FIG. 66, FIG. 70B corresponds the locking position of FIG. 67, FIG. 70C corresponds the locking position of FIG. 68;

FIG. 82C showing the lever position when the head or neck support assembly is unlocked and free to be repositioned;

FIG. 103 is a partial front perspective view of the upholstery on the chair back portion assembled over the mounting assembly of FIG. 97, with the support connecting portion of the slider carriage exposed by a slot in the upholstery;

FIG. 104A is a partial exploded view showing attachment of the head or neck support to the upholstery covered mounting assembly of FIG. 103; and FIG. 104B is a front perspective view showing the head or neck support attached to the upholstery covered mounting assembly of FIGS. 103 and 104A, showing the head or neck support adjusted to an upper position.

DETAILED DESCRIPTION OF PREFERRED FORMS

Figure 1:
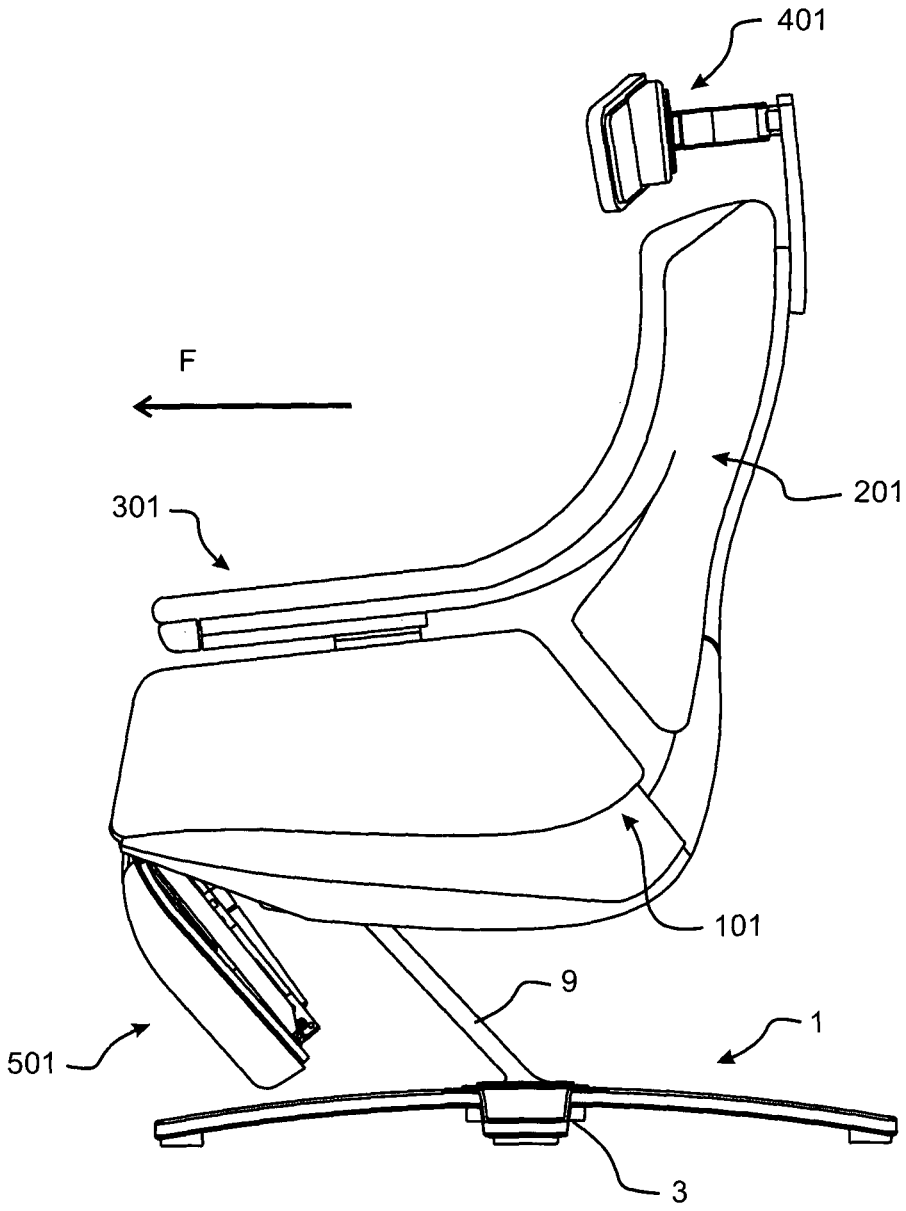
FIG. 1 is a side view of a chair in accordance with a preferred form of the present invention, in a neutral rock, no recline position with the leg or foot support assembly retracted and when that chair is unoccupied.
Figure 2:
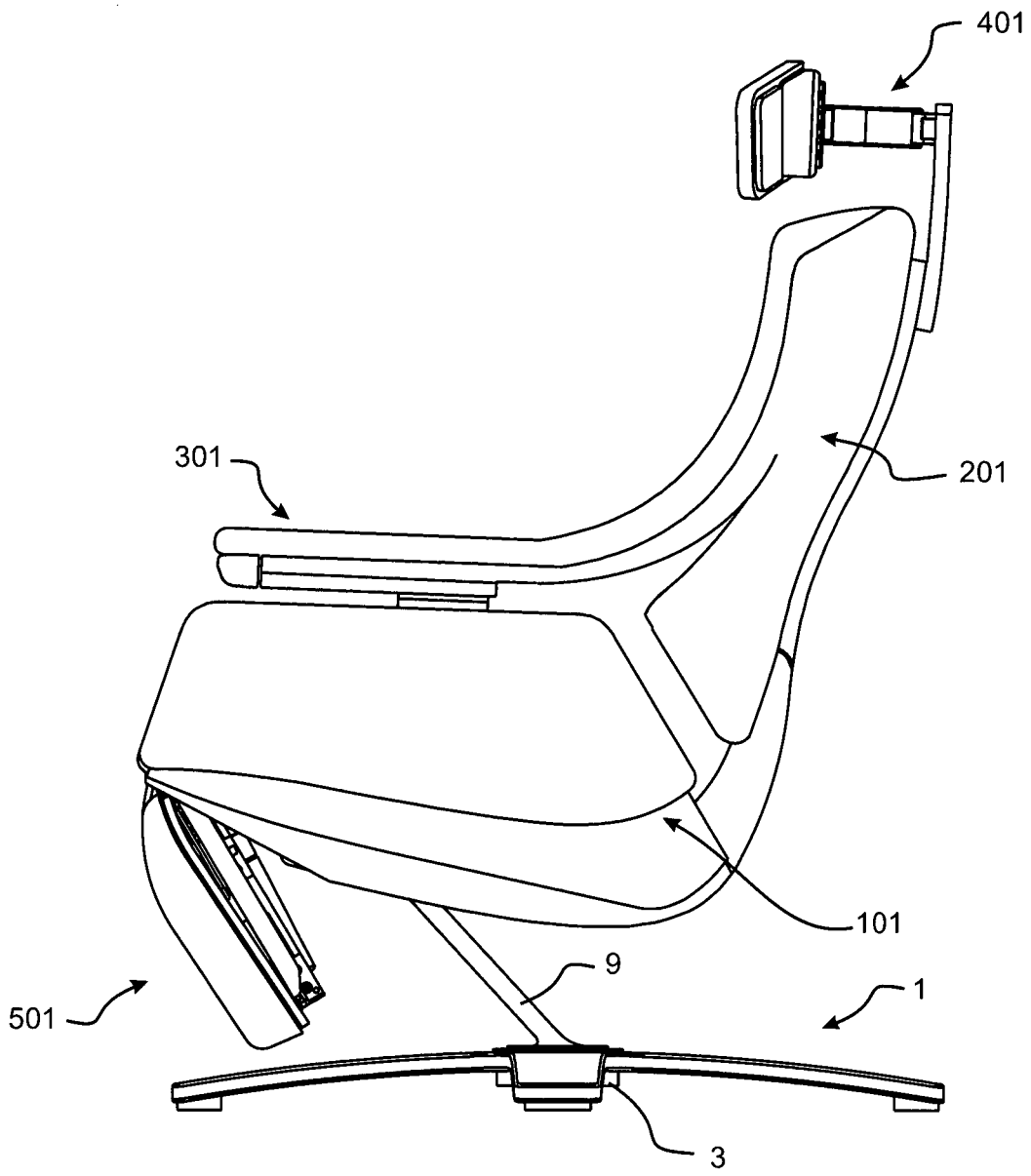
FIG. 2 is a side view similar to FIG. 1, but once the chair is occupied.
Figure 3:
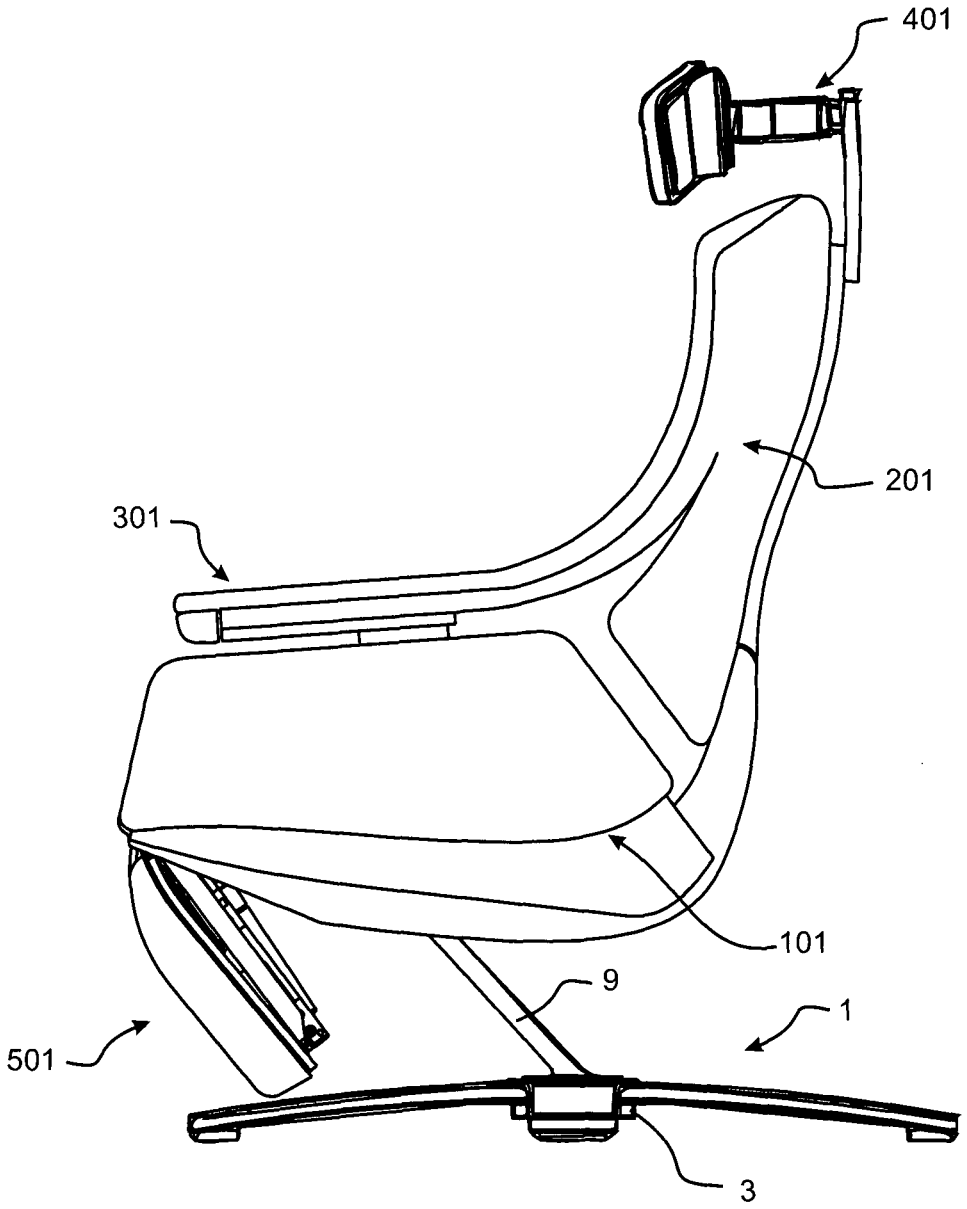
FIG. 3 is a side view similar to FIG. 2, but with the chair in a forward rocked position.
Figure 4:
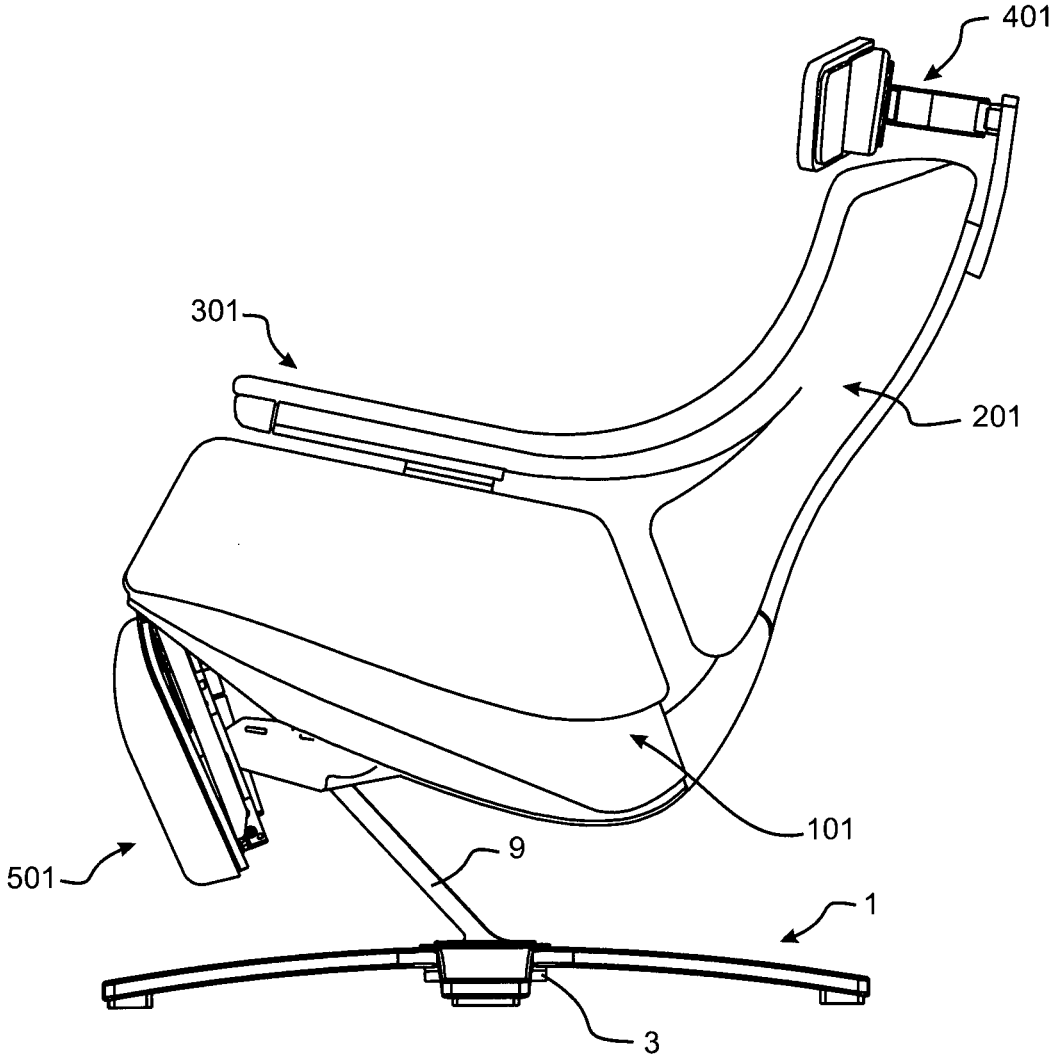
FIG. 4 is side view similar to FIG. 3, but with the chair in a rearward rocked position.
Figure 5:
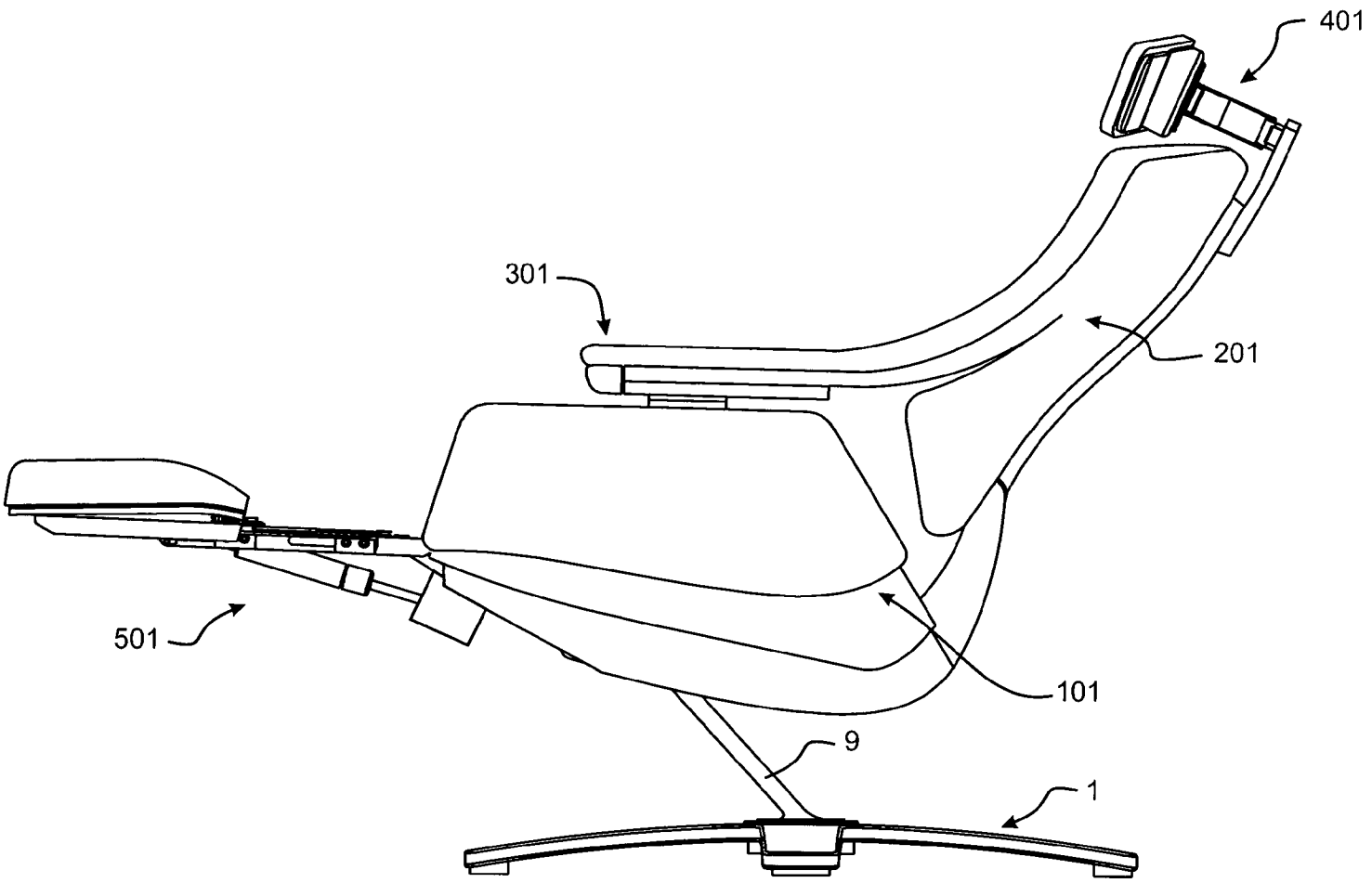
FIG. 5 is a side view of the chair of FIG. 1 in a neutral rock, half reclined and occupied position, with the leg or foot support assembly extended.
Figure 6:
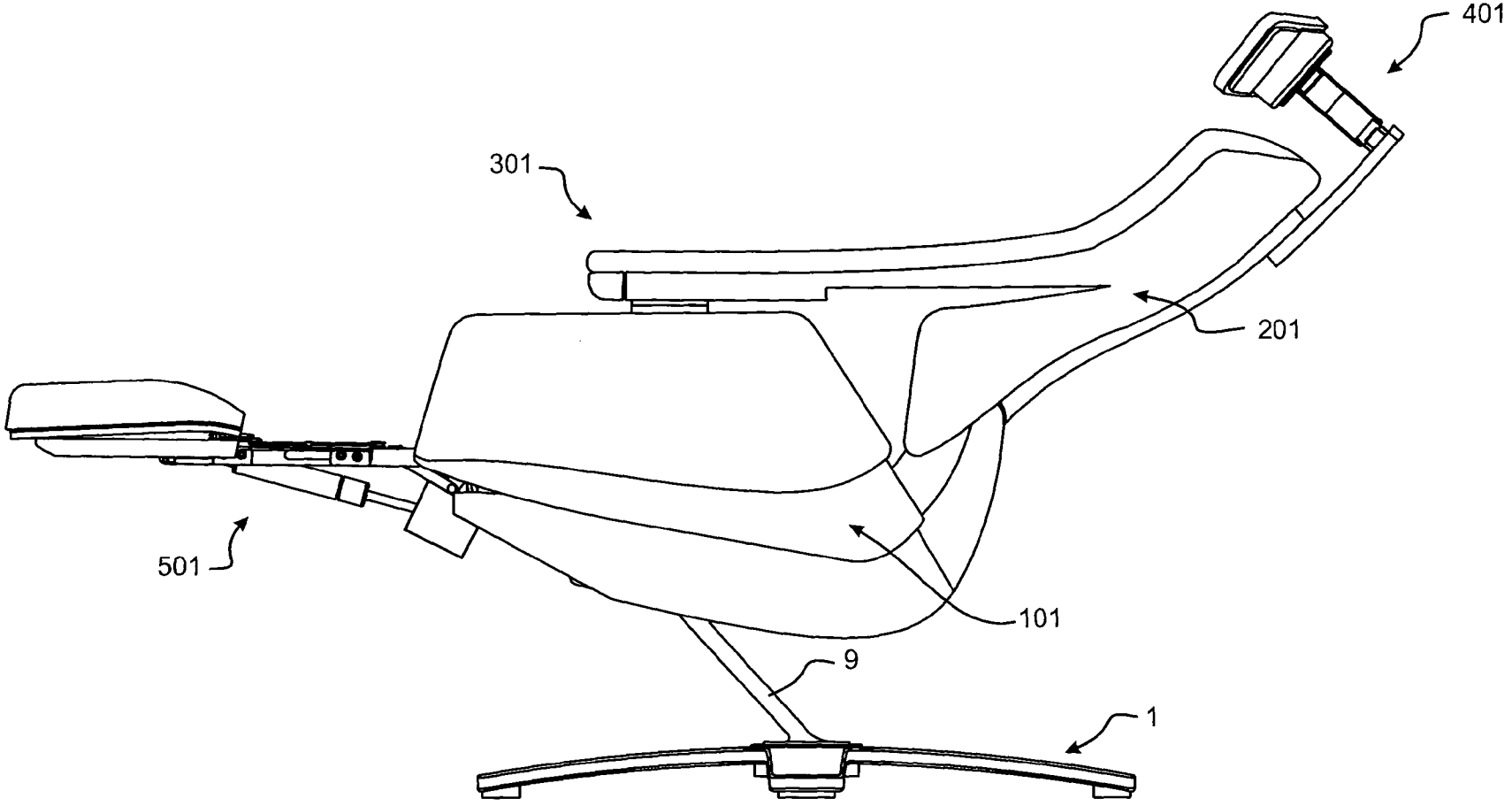
FIG. 6 is a side view similar to FIG. 5, but with the chair in a fully reclined position.
Figure 7:
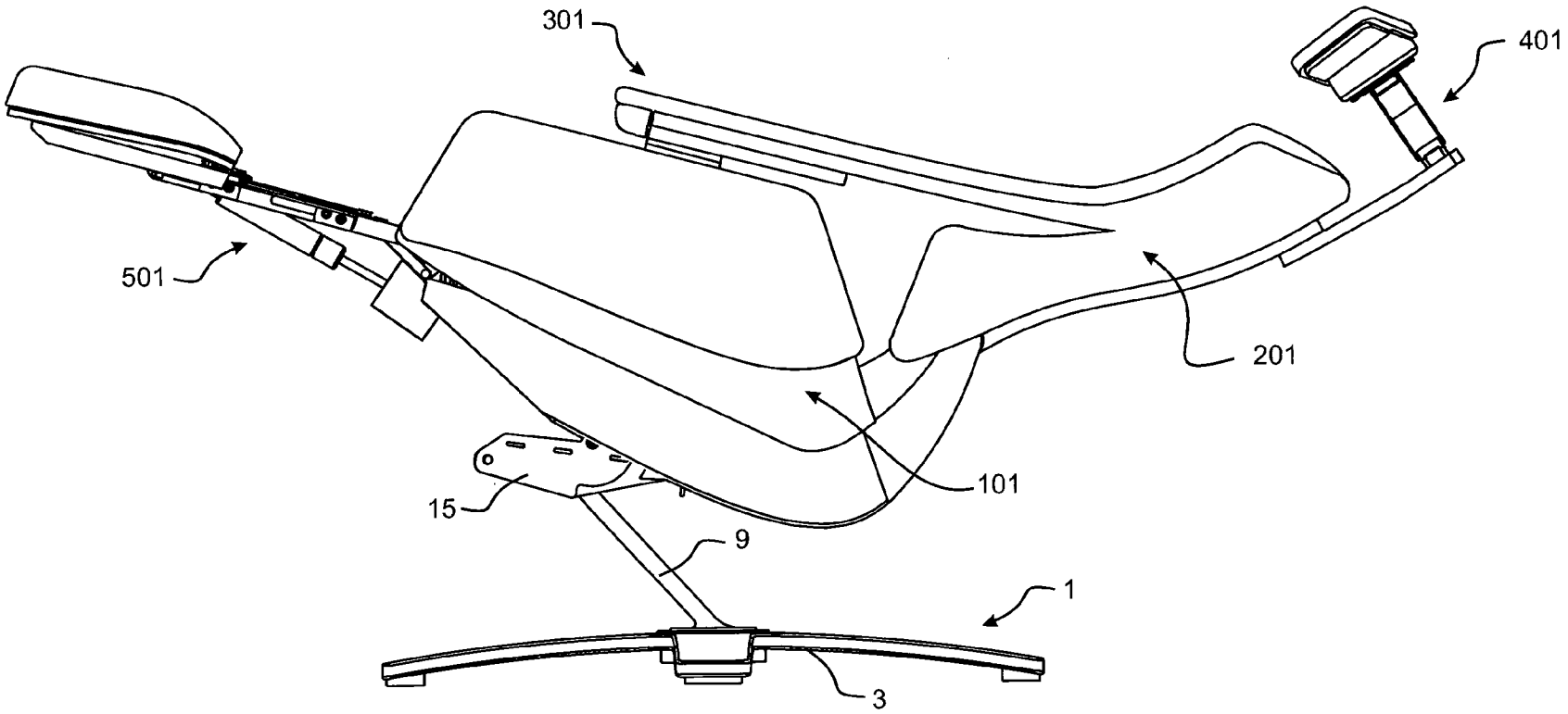
FIG. 7 is a side view similar to FIG. 6, but with the chair in a rearward rocked position.
Figure 8:
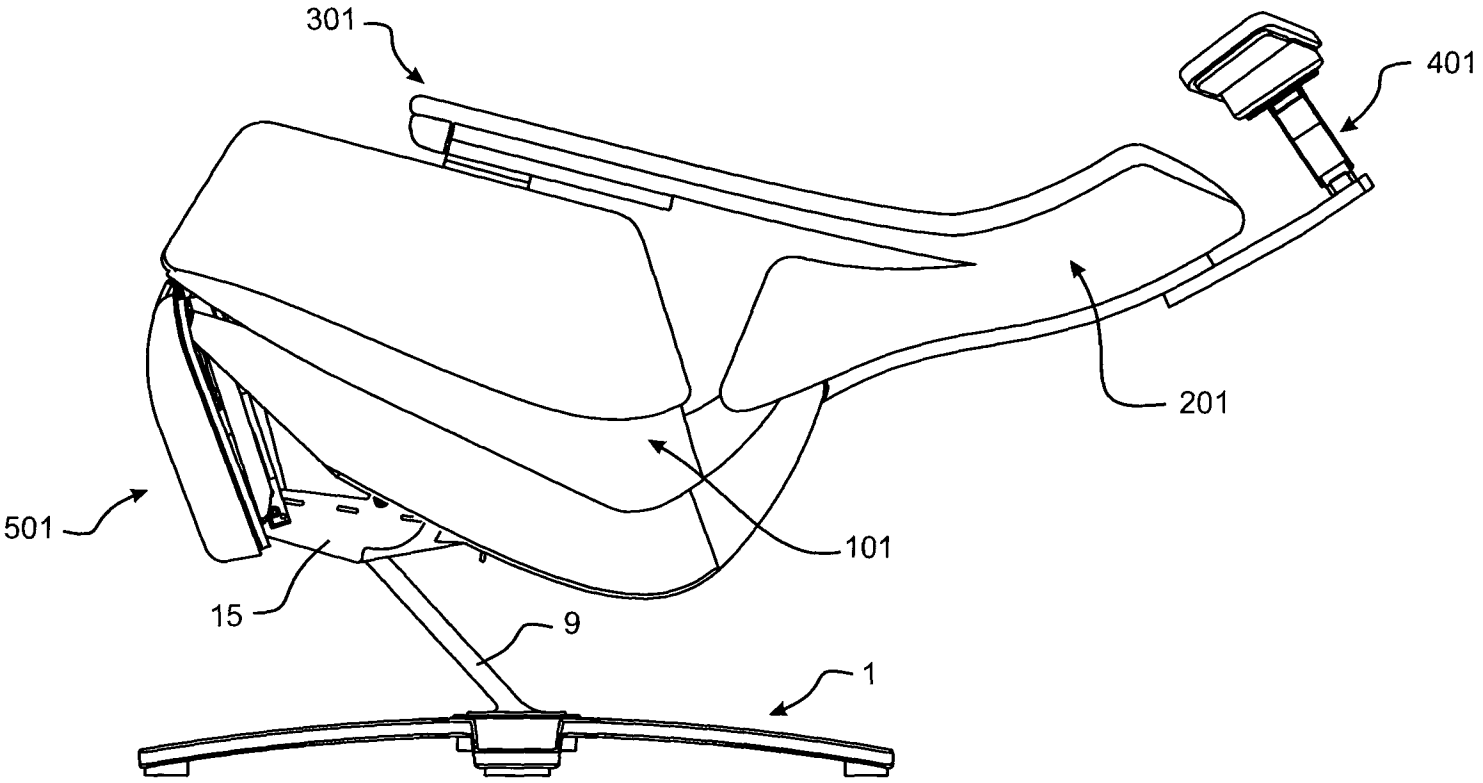
FIG. 8 is a side view similar to FIG. 7, but with the foot or leg support assembly retracted.

FIGS. 1 to 8 show a reclining domestic lounger chair according to a preferred embodiment of the present invention. The chair comprises a supporting frame 1 including a base assembly 3, a seat portion 101 for supporting a seated occupant, a back portion 201 for supporting the back of a seated occupant, arm rests 301 for supporting the arms of a seated occupant, an adjustable head or neck rest or support assembly 401 and an extendable and retractable foot or leg rest or support assembly 501.

The chair additionally has a recline mechanism configured to lift the seat portion 101 relative to an intermediate support of the supporting frame 1 upon a reclining action of the back portion 201, and a rocker mechanism that operatively connects a main transom of the supporting frame and the intermediate support of the supporting frame, to provide a rocking motion therebetween. These features will be described in further detail below.

The mechanisms and features operate together to provide a large number of possible occupant supporting configurations of the chair, some of which are shown in FIGS. 1 to 13. The rocker mechanism enables the body supporting surfaces of the chair (including the seat portion, back portion, foot or leg support, head or neck support, and arm rests) to rock forward and rearward relative to the base assembly 3, for example between a forward rocked position shown in FIG. 3, a neutral rock position shown in FIG. 2, and a full rearward rocked position shown in FIG. 4. The recline mechanism enables the back portion 201 of the chair to be reclined from an upright position shown in FIG. 2, through a partly reclined position shown in FIG. 5, to a fully reclined position shown in FIG. 6. The rocker mechanism is configured such that the chair can be rocked by a seated occupant whether the back portion is in the upright, partly reclined, or fully reclined position. The foot or leg support can be extended or retracted in any position of the back portion. Similarly, the head or neck support can be adjusted in position in any rocked or reclined position of the chair. Therefore, the configurations shown in FIGS. 1 to 13 are only some of the possible occupant supporting configurations of the chair, and other configurations are possible.

Since the figures illustrate the preferred form chairs from various different angles as convenient to explain certain parts, an arrow marked "F" has been inserted into the figures where appropriate to indicate a forward direction of the chair. Accordingly the terms forward, rearward, left side, and right side (or similar) should be construed with reference to the forward direction F of the chair, not necessarily with reference to the orientation shown in the particular figure.

The features of the preferred form chairs are described and shown herein to give a full understanding of the components and operation of the preferred form chair. It will be appreciated that not all of the features described herein need be provided in every chair.

Base

The lower part of the supporting frame 1 comprises a base 3 for supporting the chair on a support surface. Referring to FIGS. 10 to 18, the base has a plurality of radially extending legs 5 that intersect at a hub 7. The base can have any suitable number of legs, but preferably has at least three legs to provide the required level of support and balance to the chair on the support surface. In the preferred form shown, the base has four equally angularly spaced legs, but the base could have five or more legs. A base upright 9 extends at a non-perpendicular angle upwardly and forwardly from the hub 7, and at its upper end has a support 11 that extends forwardly at a flatter angle than the majority of the upright 9 of the base. A pivot connection 13 is provided on each side of the support at a forward end thereof, and a main transom 15 is connected to the support 11 at the pivot connections 13, with the main transom cantilevered rearwardly from its connection to the support 11. The seat portion, back portion, recline mechanism, and rocker mechanism are supported either directly or indirectly on the main transom.

The main transom 15 may be supported from the base by at least one resilient member 17 that is arranged to deform and allow generally downward movement of the main transom to absorb initial impact as an occupant sits on the seat portion. This provides a 'plonk' feature, and avoids the hard impact that would generally be experienced when an occupant initially sits on a conventional chair. In the form shown, the supporting frame has two elastomeric blocks 17 that are provided between the main transom 15 and the support 11, one elastomeric block positioned at or toward each side of the support 11. The elastomeric blocks are positioned between the main transom and the base at a position spaced from the pivot connections 13. The elastomeric blocks are compressed between engagement surfaces 11*a* on the support and engagement surfaces 15*a* on the main transom, as an occupant sits on the seat portion 101. The elastomeric block(s) or other resilient member(s) may have cut-outs, apertures, or weakened areas to change the amount of deformation force with respect to deformation.

Figure 14:
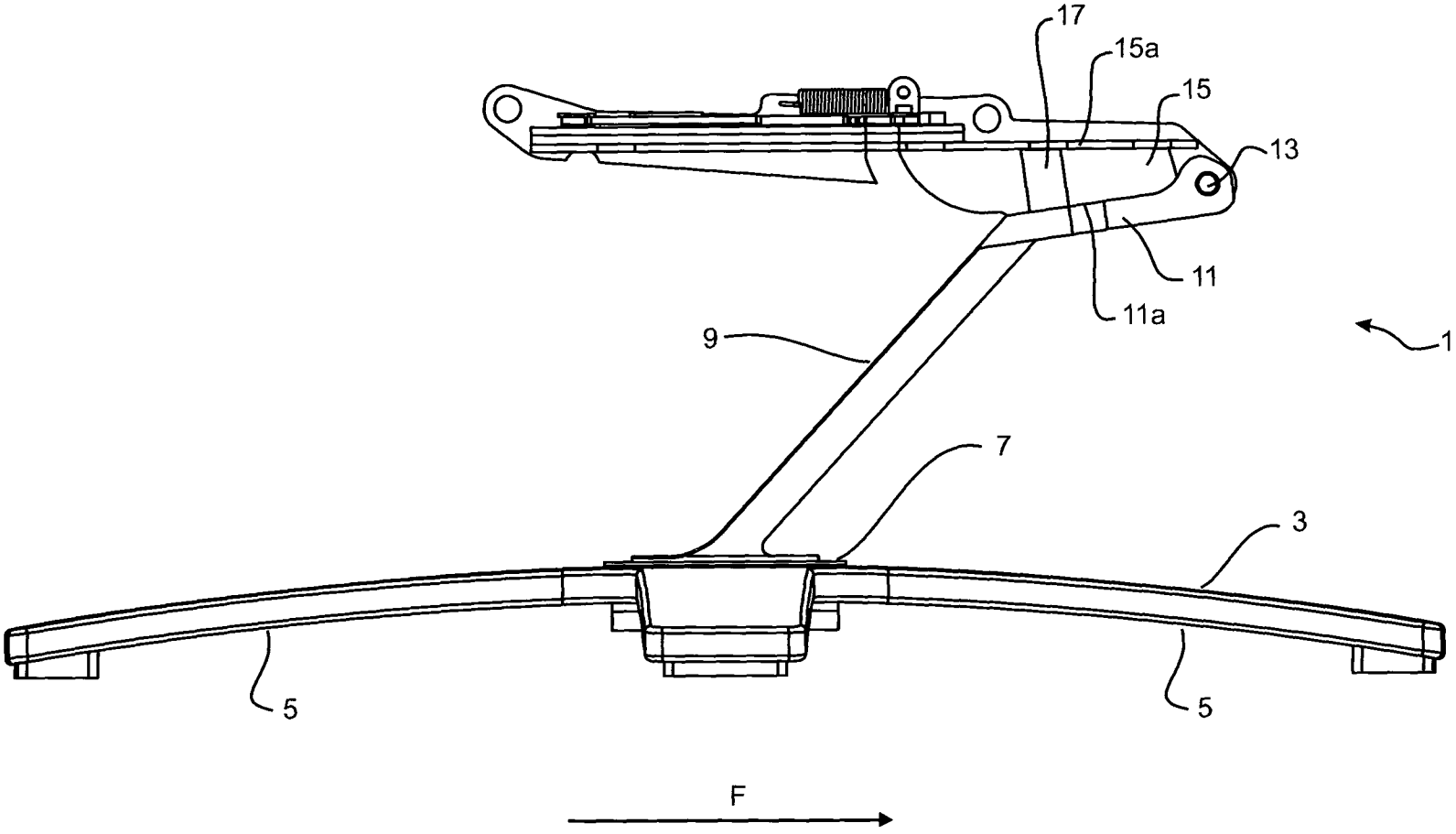
FIG. 14 is a side view of the cantilevered support frame of the chair, in a position corresponding to the chair being unoccupied.
Figure 15:
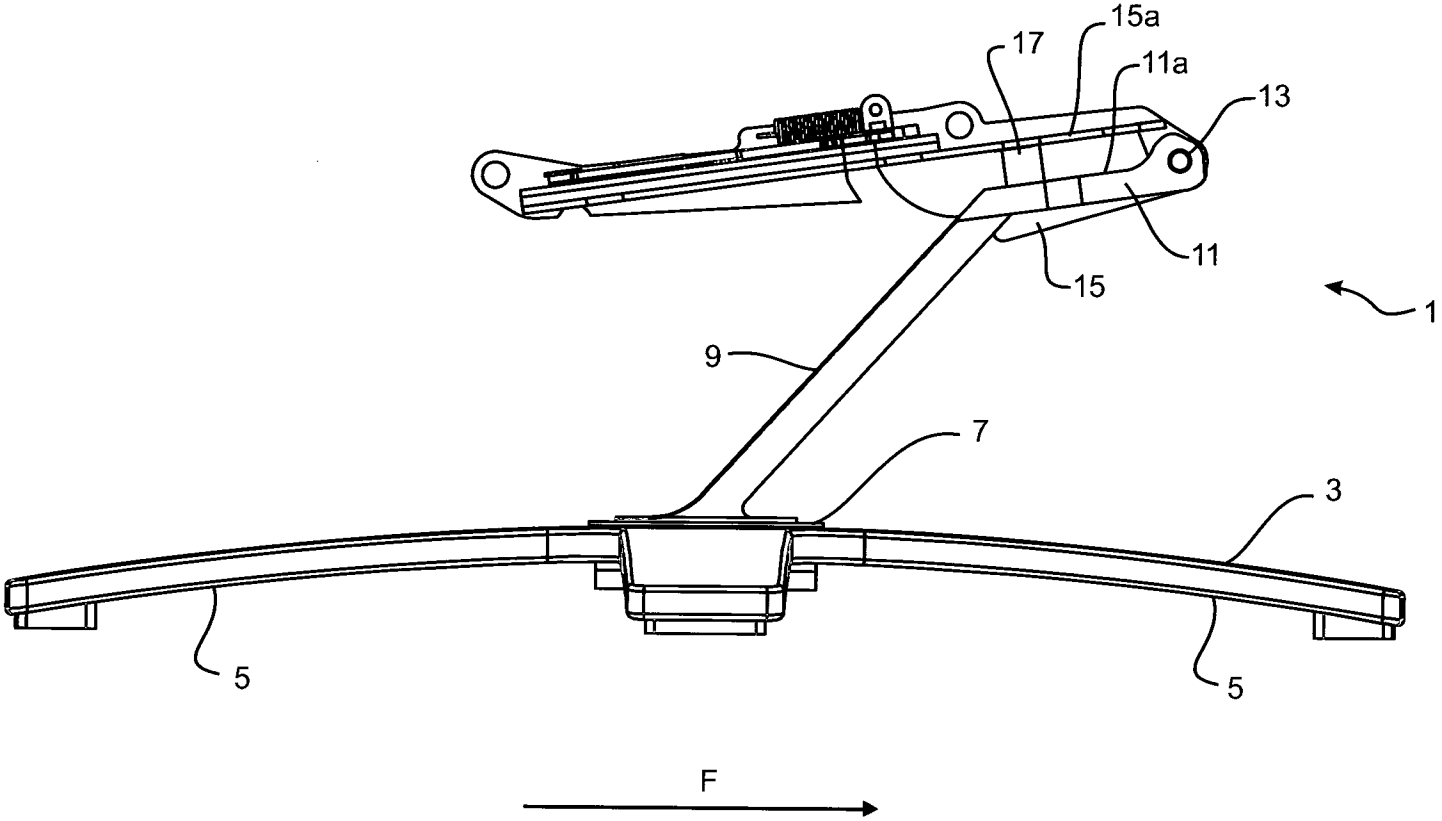
FIG. 15 is a side view similar to FIG. 14, but in a position corresponding to the chair being occupied.

FIG. 14 shows the position of the main transom 15 relative to the support 11 before an occupant sits on the seat portion, with the main transom being substantially horizontal (i.e. typically at an angle of about zero degrees). FIG. 15 shows the position of the main transom 15 relative to the support 11 after an occupant sits in the seat portion, with the main transom pivoted downwardly and rearwardly about the pivot connections 13 to be rearwardly tilted from horizontal at an angle of about 8 degrees. The elastomeric blocks provide an increasing resistance to the pivoting of the main transom as it moves, to provide a soft landing as the occupant sits down on the seat portion. As shown in FIG. 15, a spacing is preferably provided between the sides of the support 11, so that part of the main transom 15 can pass between the sides of the support 11 as the occupant sits on the seat portion.

Figure 16C:
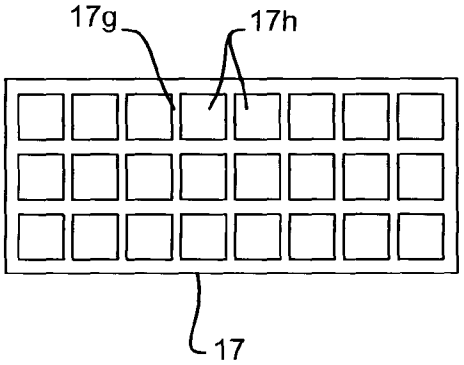
FIGS. 16A to 16C show examples of possible configurations of the resilient member of cantilevered support frame.
Figure 16B:
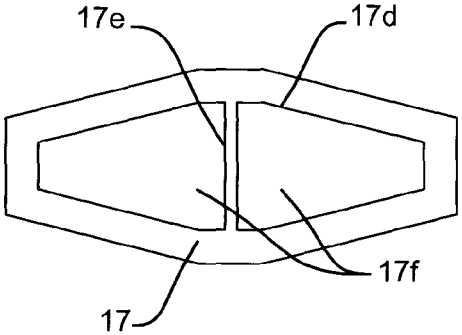
Figure 16A:
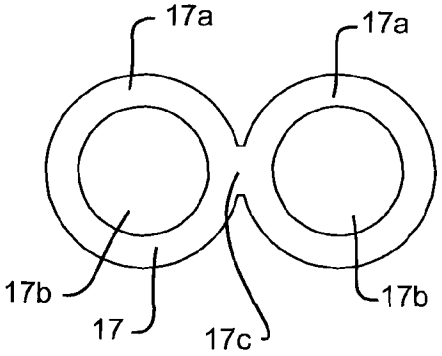

The elastomeric blocks 17 or other resilient members could be solid with sufficient compressibility to give the required plonk, or could be shaped in such a way as to give the required deflection using less material. Such shapes might include cylindrical cross sections which deform in the radial direction or honeycomb matrixes where the honeycombs collapse. FIGS. 16A to 16C show three example configurations of the elastomeric blocks 17. FIG. 16A shows a 'FIG. 8' configuration having two adjacent hollow cylinders 17*a* with respective apertures 17*b*, and an interconnecting region 17*c*. FIG. 16B shows a tapered arrangement having a polygonal exterior shape 17*d* with at least one internal web 17*e*, and a plurality of apertures 17*f*. FIG. 16C shows a cellular matrix form having a plurality of polygonal cells 17*g*, and in the form shown square cells, defining respective apertures 17*h*.

Alternatively, rather than being pivotally connected, the transom 15 may be rigidly fixed to the base upright 9. In one embodiment, the transom 15 and the upright 9 may be integral.

Base Swivel

The base 3 of the supporting frame 1 is preferably configured so that the upright 9 and thereby the main transom 15 and the components supported by the main transom 15 are rotatable about a substantially vertical axis relative to the support surface engaging portion of the base. The hub 7 may be configured as shown in FIGS. 17 and 18.

Figure 17:
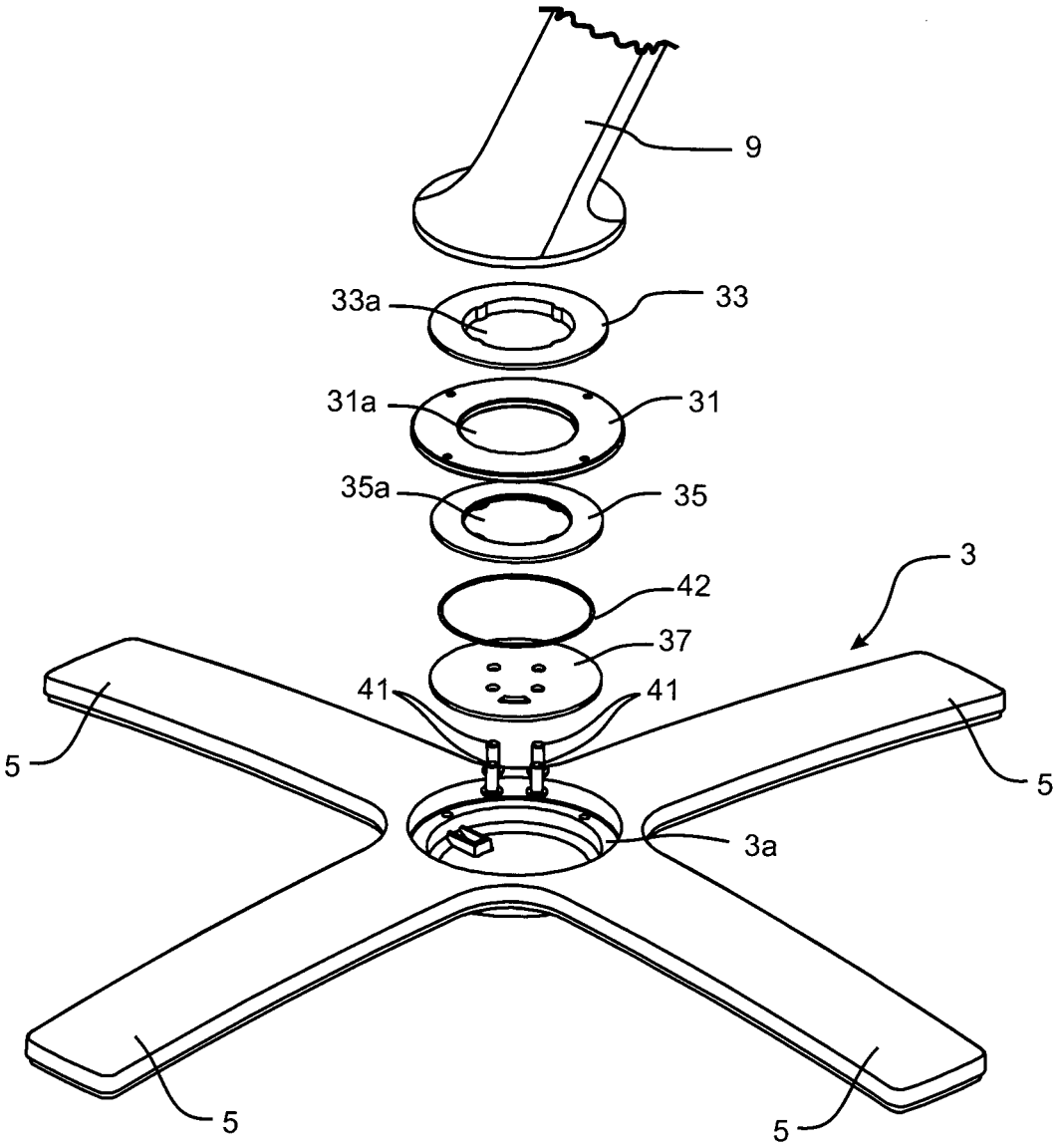
FIG. 17 is an exploded perspective view of the swivel of the cantilevered support frame of FIGS. 14 and 15, showing part of the cantilevered support.
Figure 18:
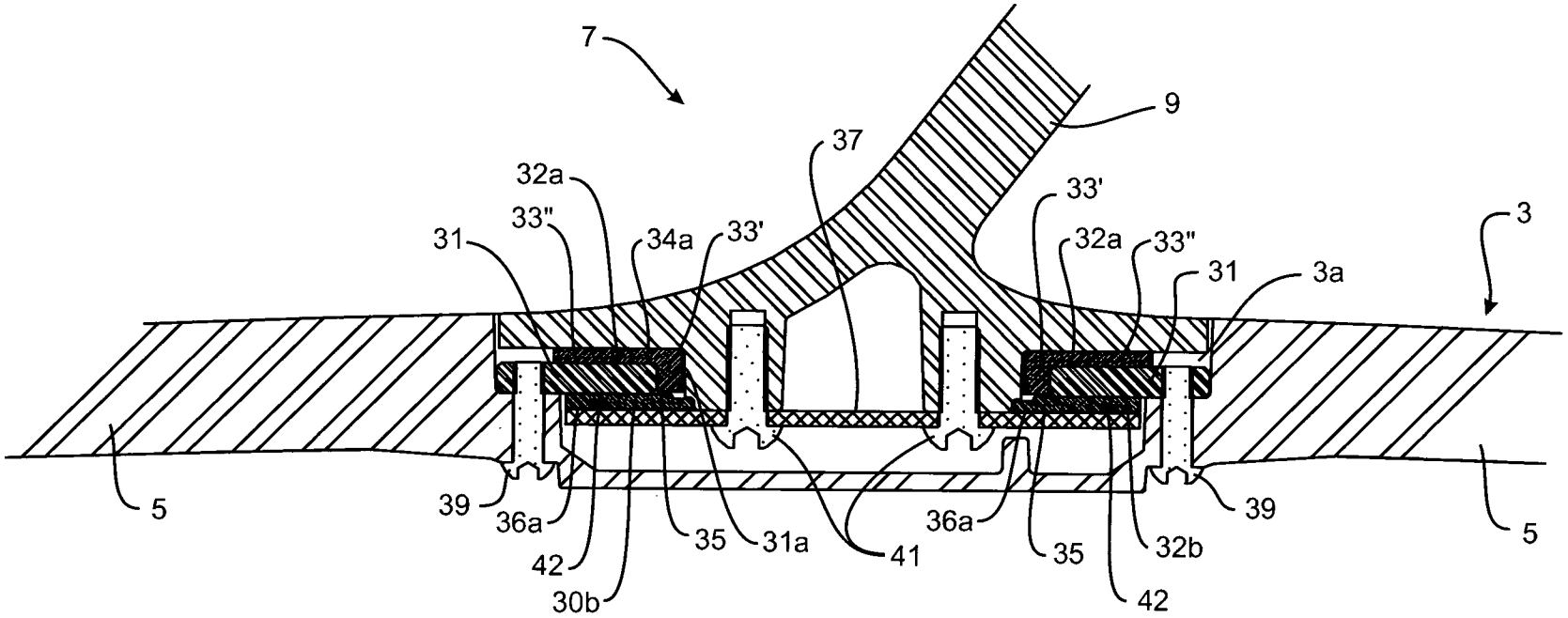
FIG. 18 is a sectional view through the swivel of the cantilevered support frame of FIGS. 14 and 15.
Figure 19:
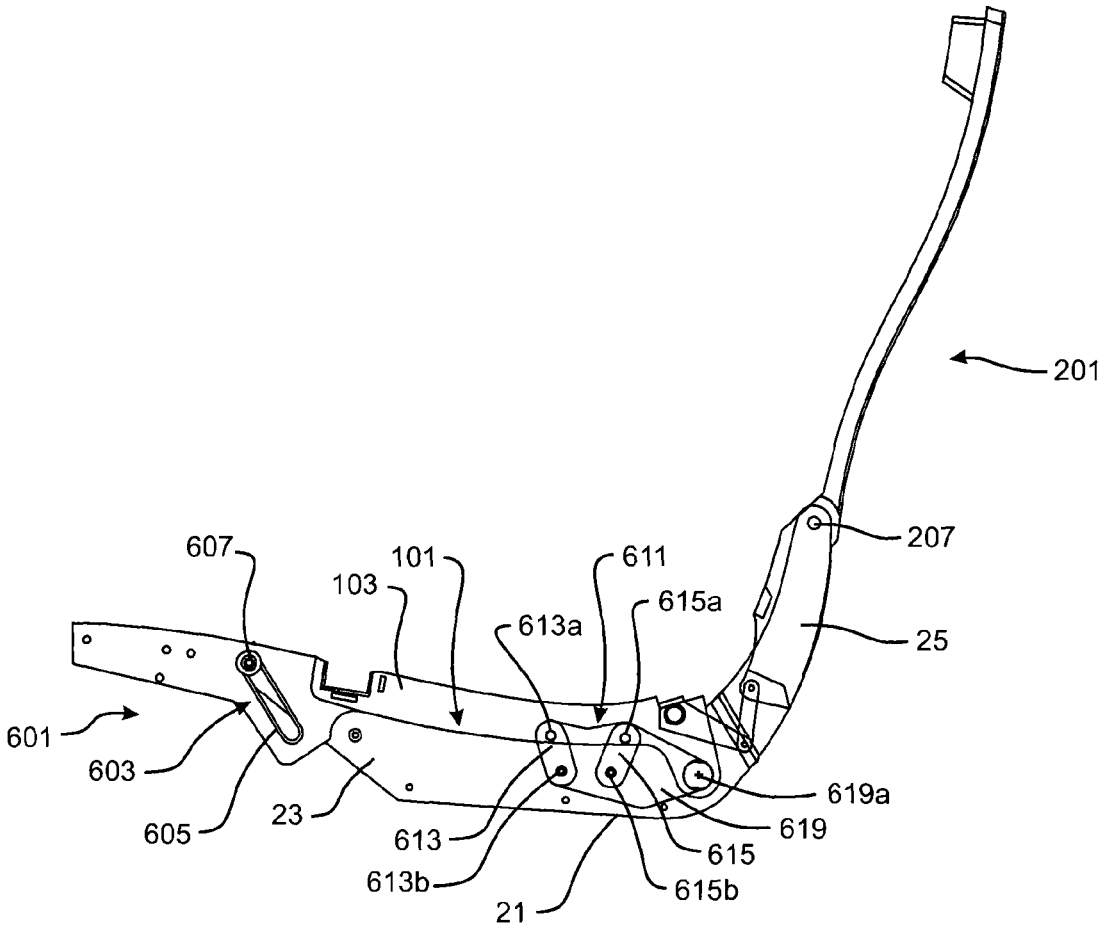
FIG. 19 is a side view of part of the recline mechanism of the chair, when the back portion is in an upright position.
Figure 20:
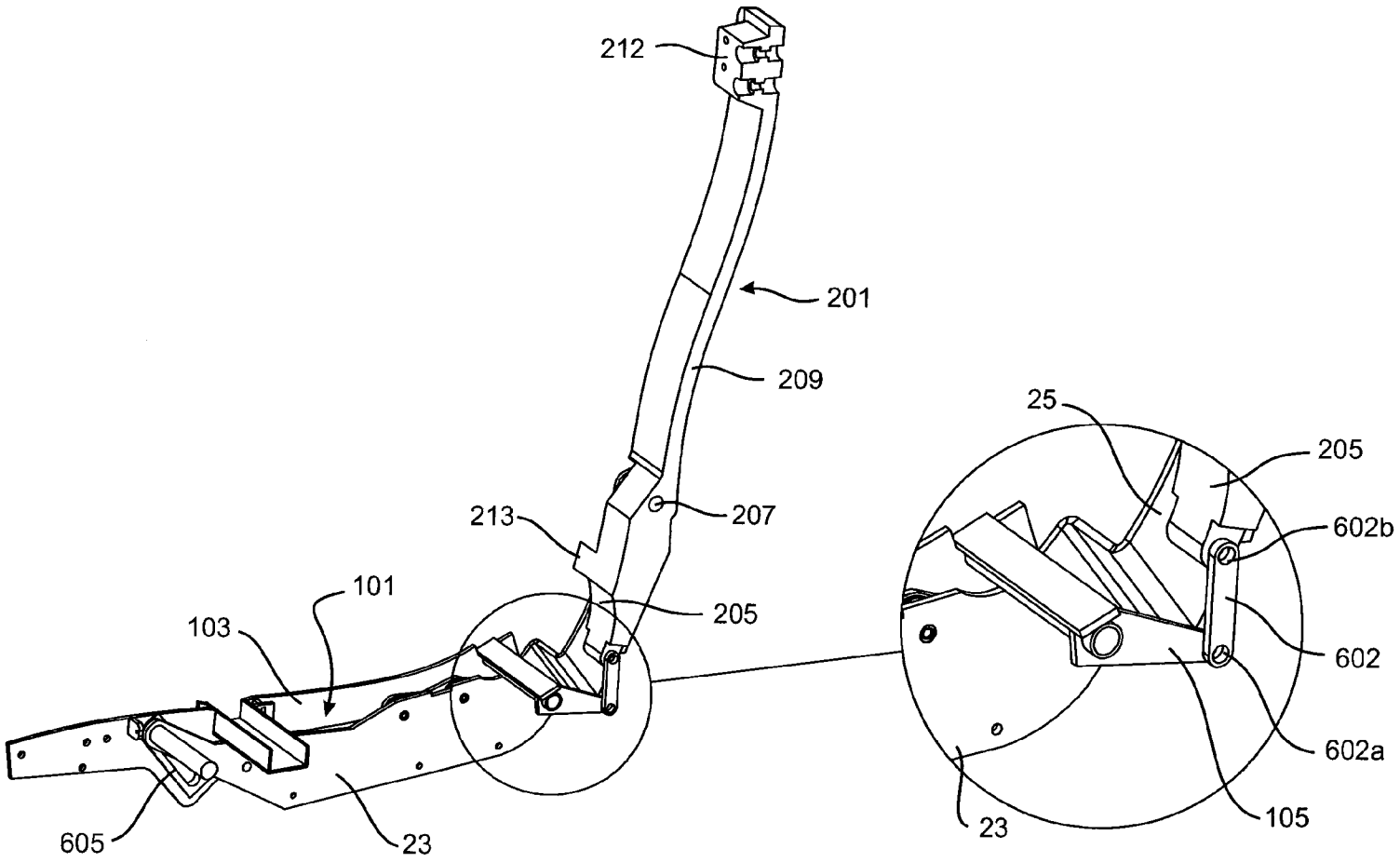
FIG. 20 is a part sectional view corresponding to FIG. 19.
Figure 21:
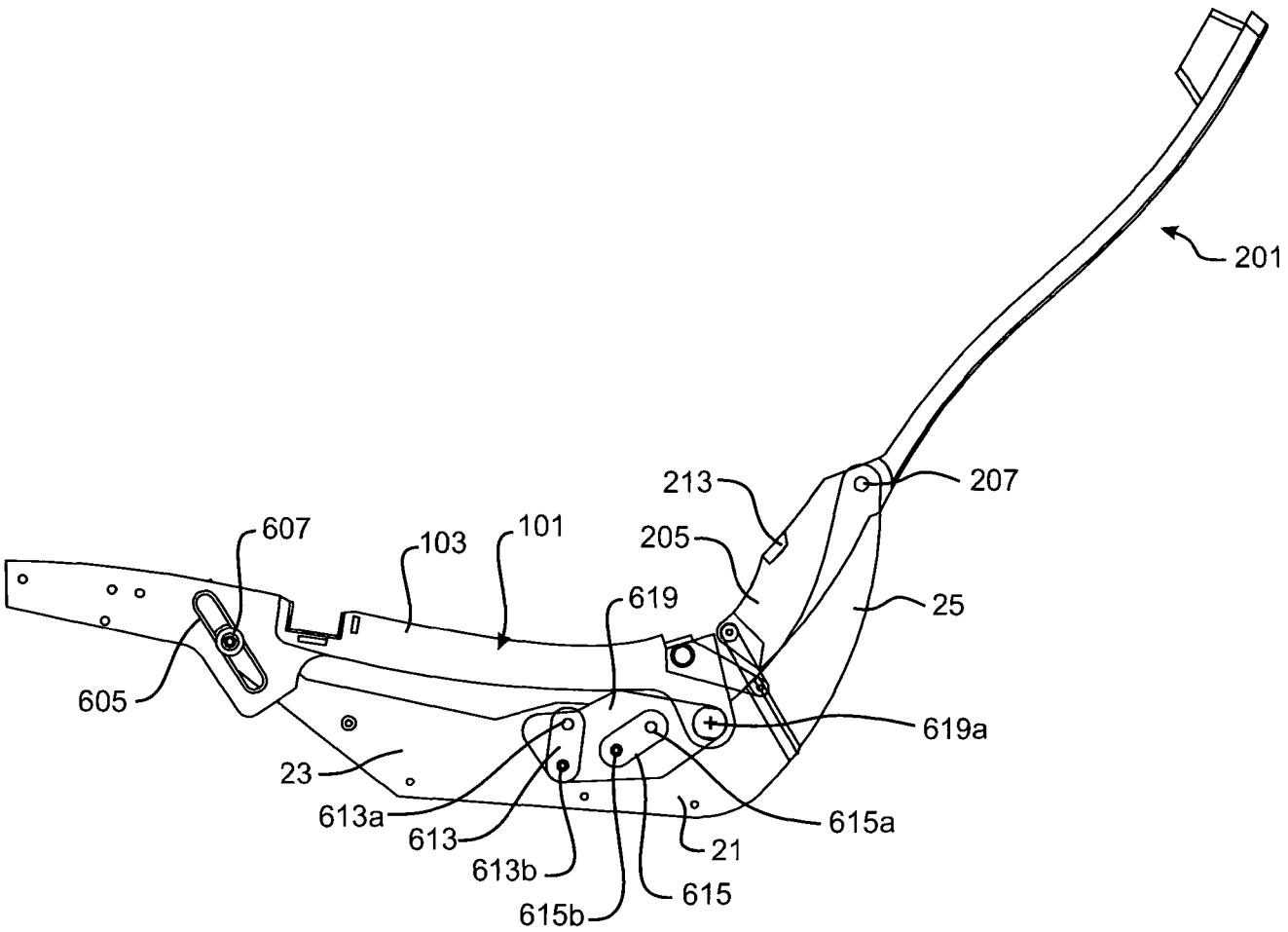
FIG. 21 is a side view similar to FIG. 19, but when the back portion is partly reclined.
Figure 22:
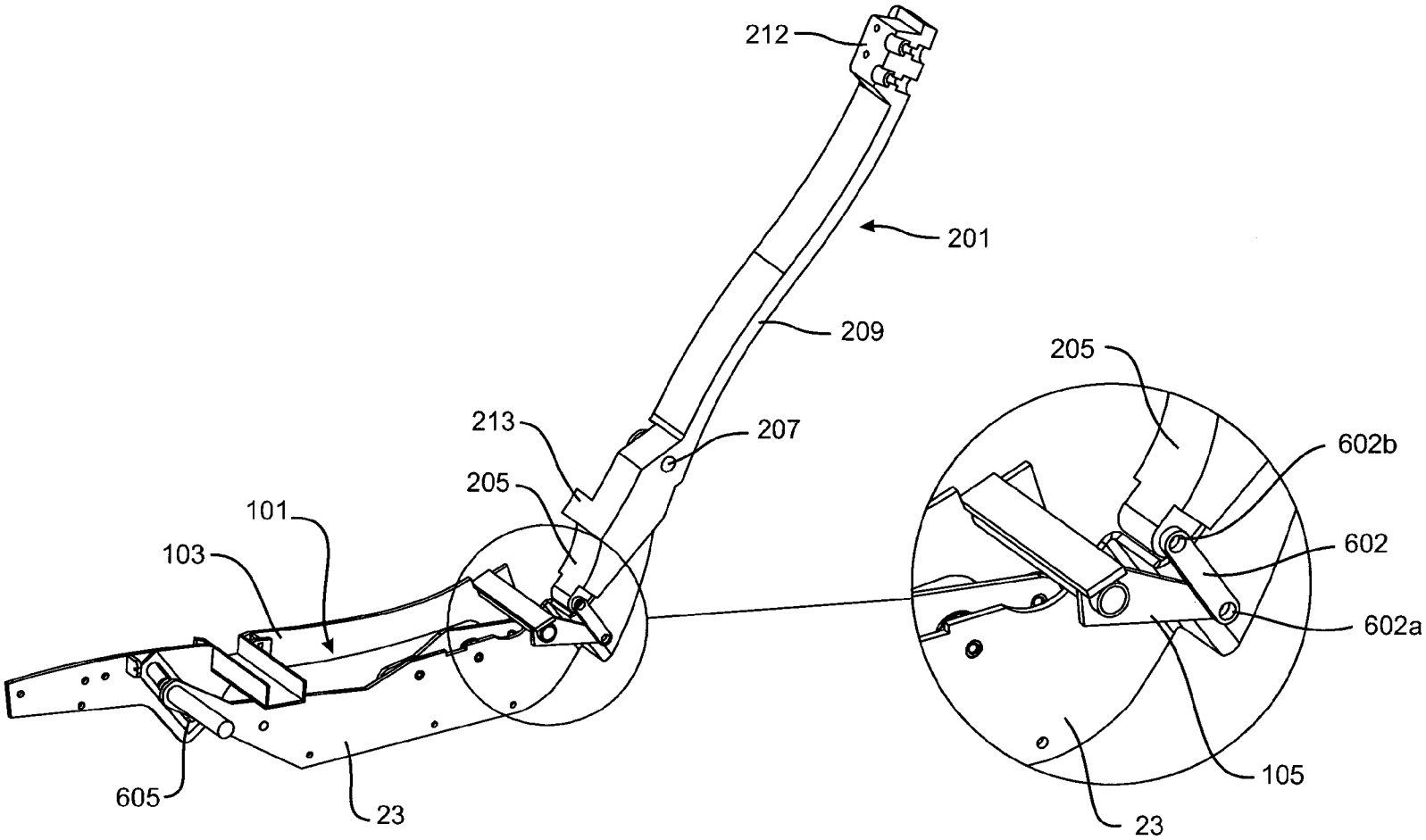
FIG. 22 is a part sectional view corresponding to FIG. 21.
Figure 23:
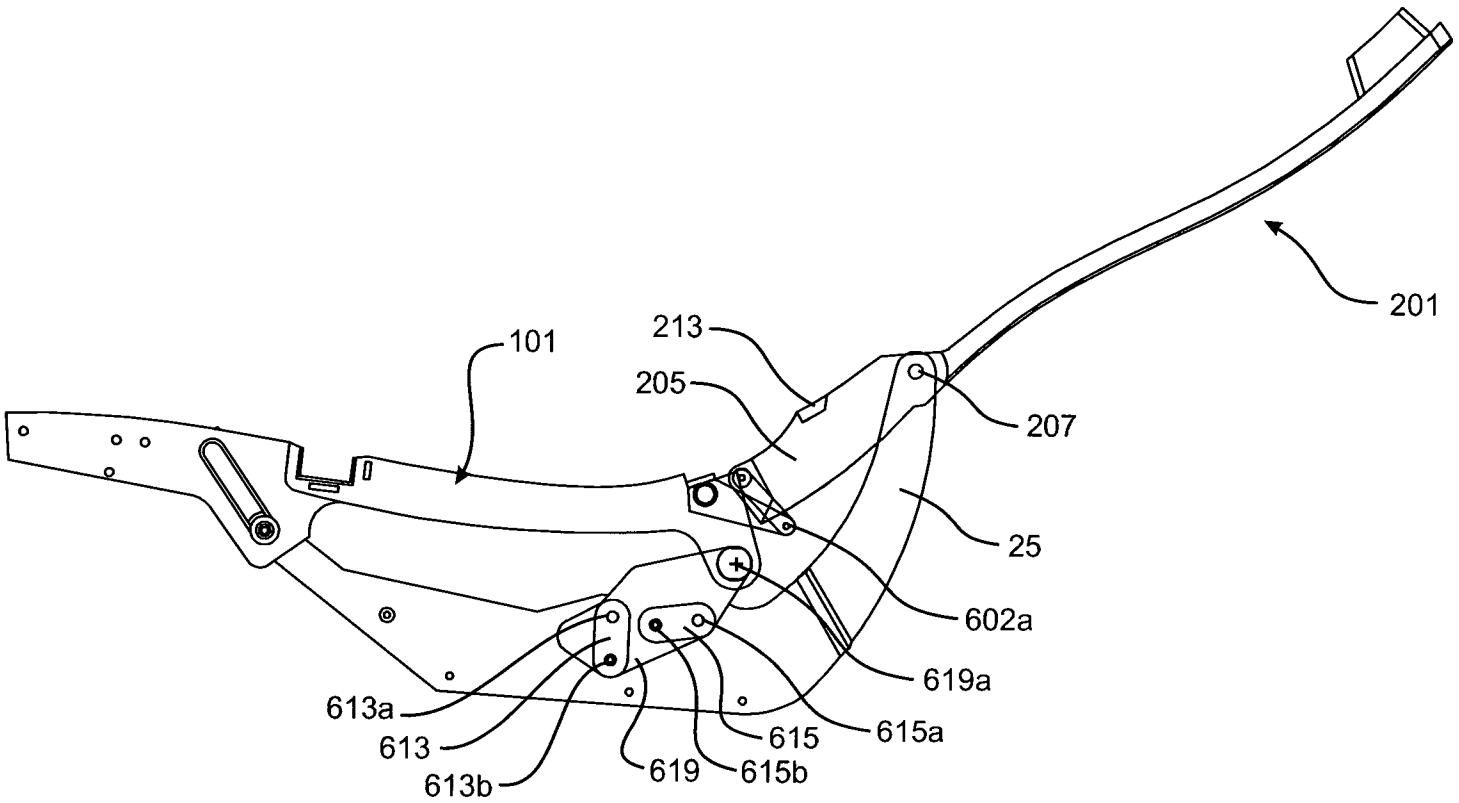
FIG. 23 is a side view similar to FIG. 19, but when the back portion is fully reclined.
Figure 24:
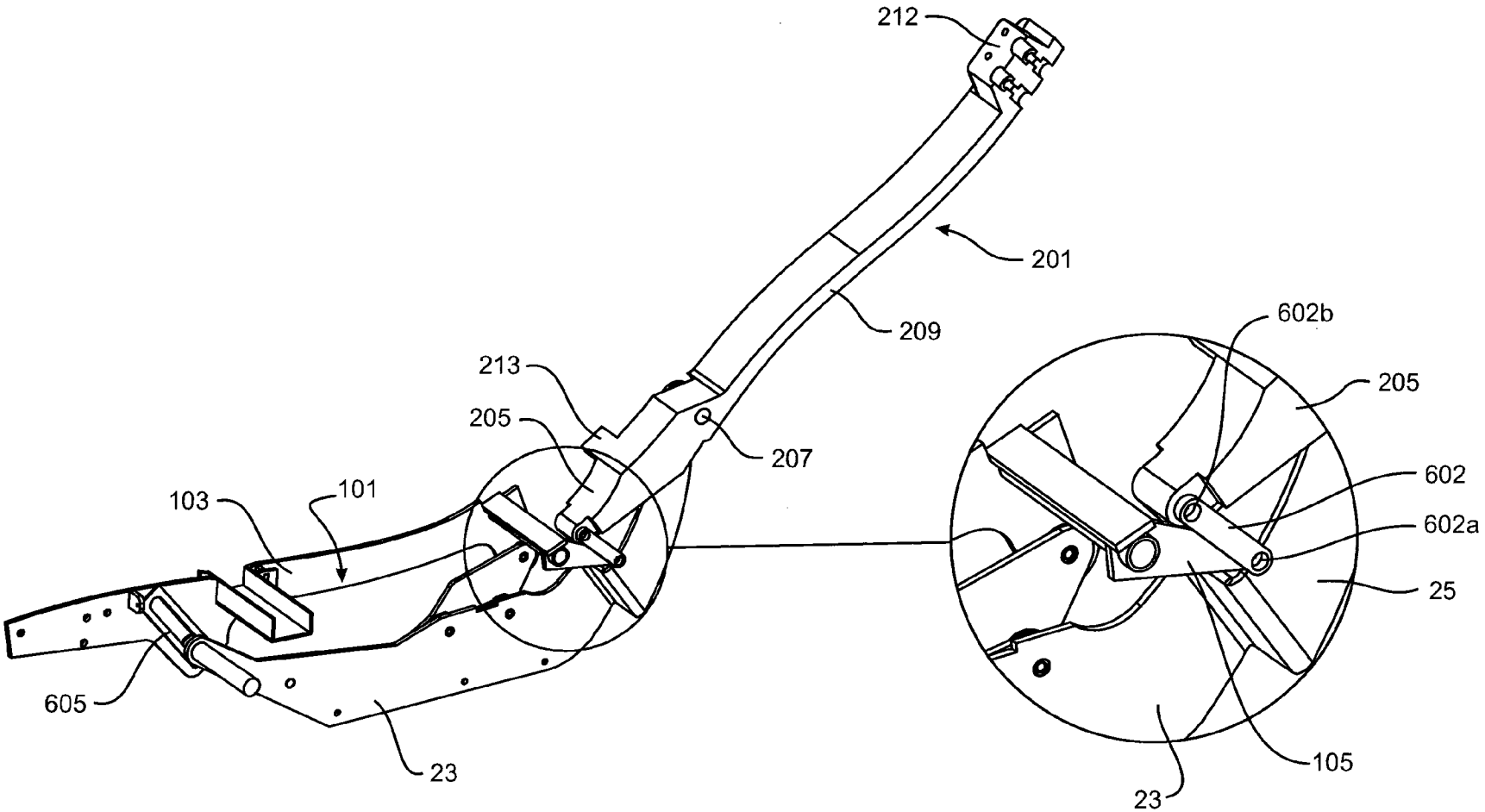
FIG. 24 is a part sectional view corresponding to FIG. 23.

FIGS. 17 and 18 show a preferred swivel arrangement that pivots the cantilevered upright 9 to the base 3. The base 3 has a central recess 3*a* for receiving the hub 7 of the upright 9. In an alternative configuration, the recess could be formed by a through aperture. An annular bearing plate 31 having an aperture 31*a* with a smaller diameter than the base recess 3*a* is fixed to the base 3 and arranged to be concentric with the base aperture, such that the bearing plate protrudes into the base providing upper and lower bearing surfaces 32*a* and 32*b*.

Base recess 3*a* and bearing plate aperture 31*a* together form a stepped recess in the base. An underside of the hub 7 of the upright 9 has a complementary stepped profile with surfaces that are spaced from the surfaces of the base 3 and bearing plate 31*a* when the hub is mounted to the base. An upper, top hat washer 33 having a central cylindrical portion 33' and an annular flange 33" at one end thereof is positioned in the stepped recess, between the hub 7 of the upright and an upper planar annular bearing surface 32*a*, to provide a planar annular bearing surface 34*a* that bears against surface 32*a* as the upright rotates relative to the base. A sandwich member 37 is provided on the opposite side of the bearing plate 31 to the hub 7 of the upright, and fixed to the hub 7 at a central portion, for example using bolts 41. A lower washer 35 is positioned between an upper side 37*a* of the sandwich member and a lower planar annular bearing surface 32*b*, to provide a planar annular bearing surface 36*a* to bear against surface 32*b* as the upright rotates relative to the base. The lower washer 35 has an aperture 35*a* corresponding in size to an aperture 33*a* in the upper washer. An o-ring 42 may be positioned between the lower washer 35 and the sandwich member 37. The o-ring 42 is compliant to minimise non-rotational movement of the upright 9 and to reduce the need for fine tolerances on the base swivel components.

The upright 9, washers 33, 35, and sandwich member 37 are rotatable in tandem relative to the base 3 and bearing plate 31 to swivel the chair. As the upright 9, washers 33, 35, and sandwich member 37 are rotated, the bearing surfaces 34*a* and 36*a* slide against the respective bearing surface on the bearing plate 31.

The upper and lower washers 33, 35 preferably comprise a low friction material such as acetal. The bearing plate 31 comprises a hard bearing material, and may be a metallic material, for example hardened chrome steel or anodised aluminium. The hub 7, legs 5, and sandwich member 37 are all suitably a metallic material. The use of low friction materials in the bearing surfaces provides a smooth low friction swivel with a large surface area for the bearing surfaces suitable for accommodating offset loadings and moment loads such as those produced by the cantilevered upright 9.

FIGS. 17 and 18 show only one preferred embodiment of the base swivel, however other embodiments are possible. For example, in an alternative embodiment, the underside of the hub 7 of the upright 9 could be a flat surface and the stepped recess could be provided on the sandwich member 37 such that a central portion of the sandwich member 37 extends through the aperture 31*a* in the bearing plate. Similarly, the upper washer 33 could be a plain washer, and the lower washer 35 a 'top hat' washer. In a further embodiment, the respective sides of the hub 7 of the upright 9 and the sandwich member 37 that are adjacent the respective washers 33, 35 could comprise a flat surface and be spaced apart. In such an arrangement, a spacer may optionally be provided between the two members.

In the embodiment shown, the bearing plate 31, upper washer 33 and lower washer 35 are all separate members. Alternatively one or more of these members may be integral with another component, for example the bearing plate 31 may be integral with the base 3, the upper washer 33 may be integral with the hub of the upright 7, and/or the lower washer 35 may be integral with the sandwich member 37. As a further example, rather than having one or both of the washers 33, 35, the bearing surfaces 34*a*, 36*a* may be provided by a coating of a suitable bearing material on the respective upright and/or the sandwich member, and/or the bearing surfaces 32*a*, 32*b* may be provided by a coating of suitable bearing material on the upper and lower surfaces of the bearing plate 31.

In place of the swivel described in relation to FIGS. 17 and 18, an alternative off-the-shelf component could be used which may be of similar construction or use an alternative bearing mechanism such as ball or roller bearings.

In an alternative configuration, the main transom could be provided on a more conventional pedestal base. However, such a base would not provide the benefit of the 'plonk' feature described above.

Recline Mechanism

Referring to FIGS. 19 to 24, the chair comprises a recline mechanism 601 that is configured to lift the seat portion 101 upon a reclining action of the back portion 201. The recline mechanism comprises at least one operative connection between the seat portion 101 and the supporting frame 1.

Figure 9:
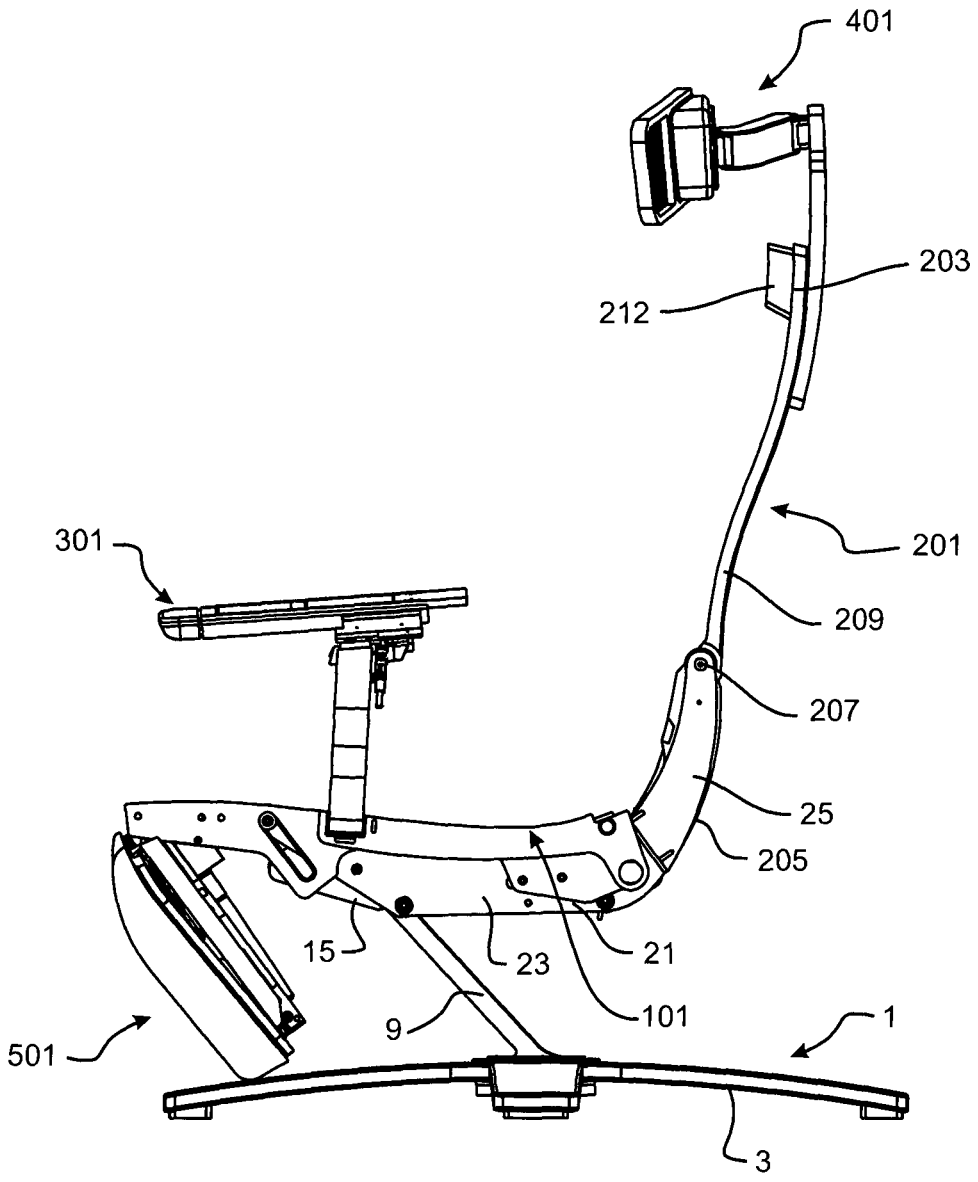
FIG. 9 is a side view of the skeleton of the chair, in a position similar to FIG. 1, but with the chair in a forward rocked position.
Figure 35:
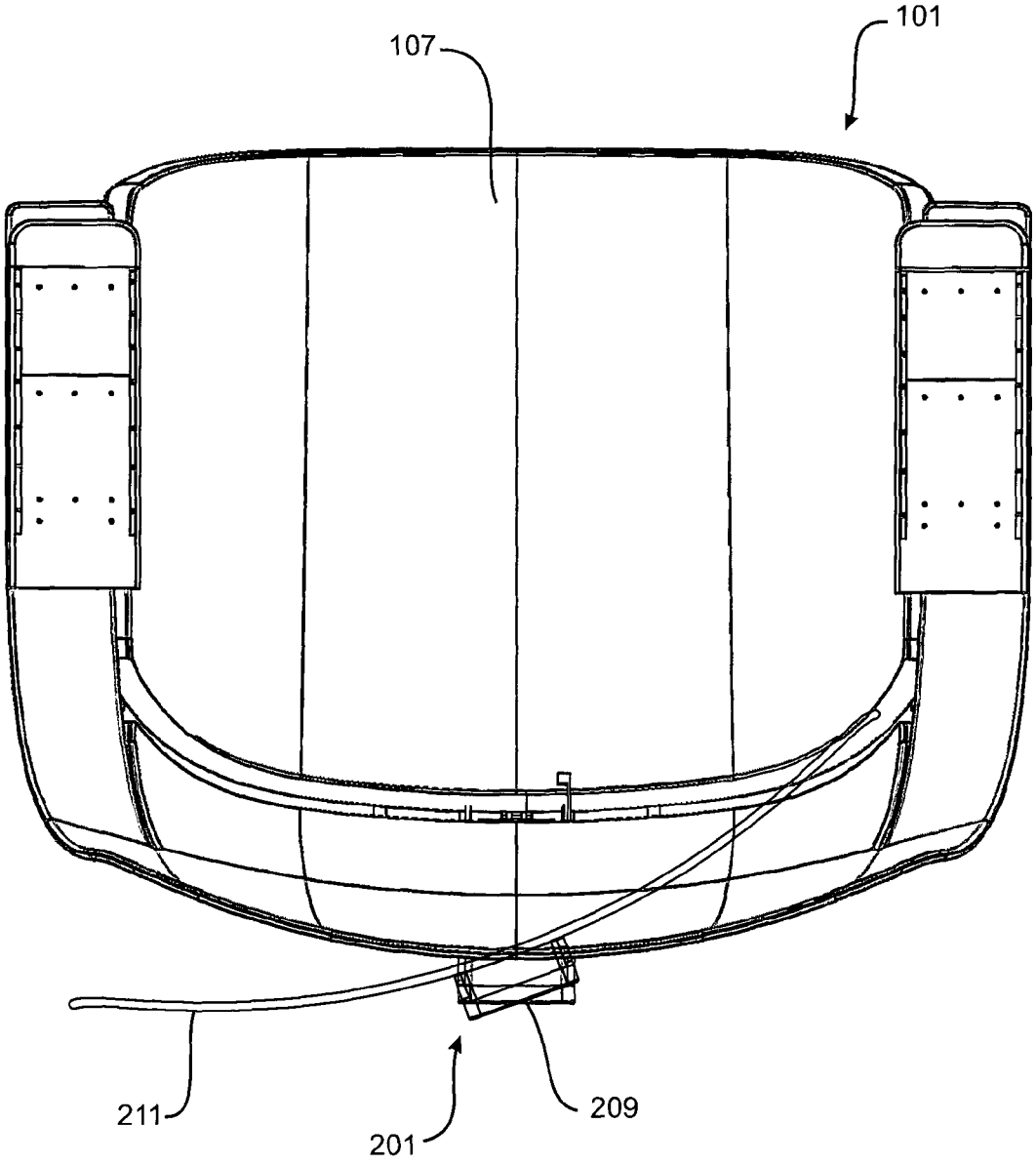
FIG. 35 is an overhead view of the back portion of the chair, schematically showing the twisting action of the back portion.
Figure 36:
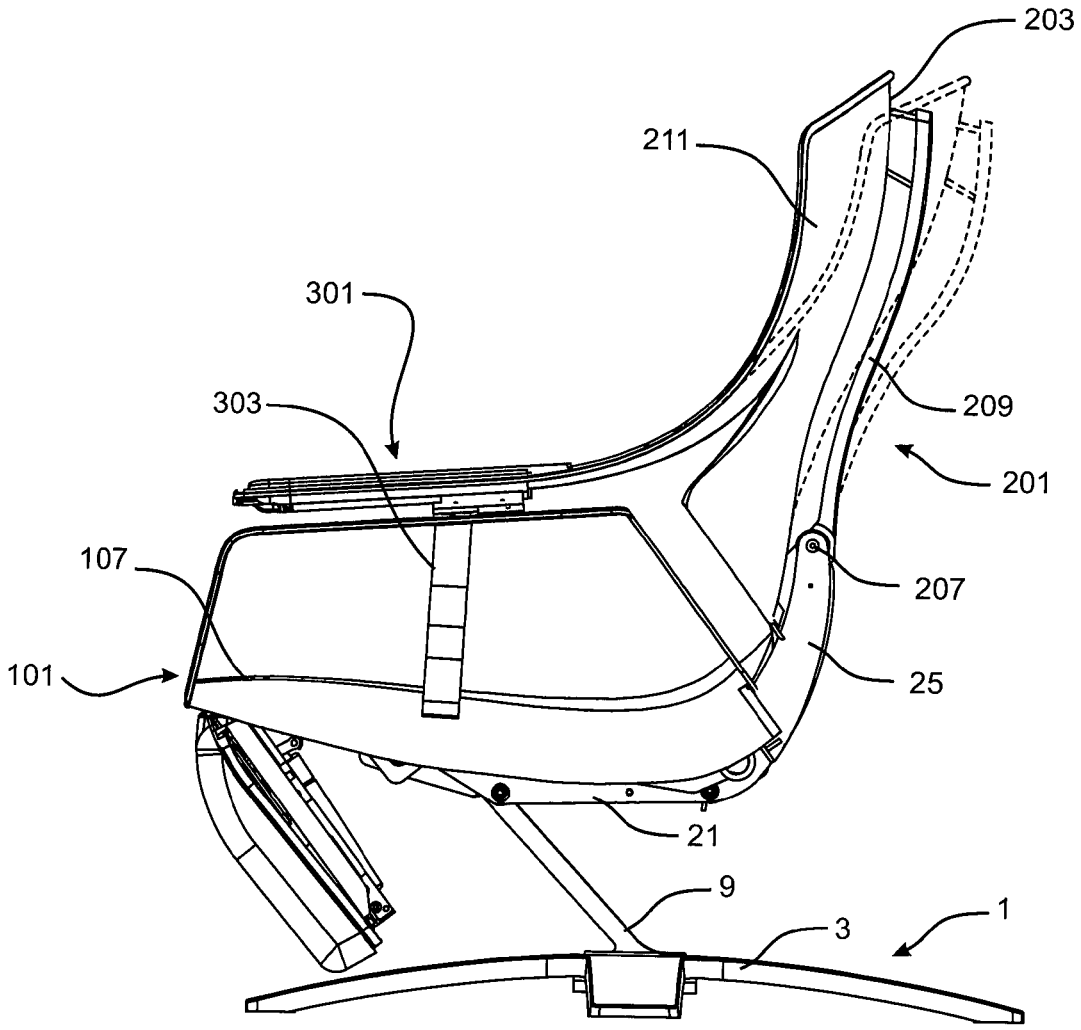
FIG. 36 is a side view of the chair, schematically showing the rearward flexing of the upper end of the back portion, with the rearward flexed position shown in broken lines.

Reverting to FIG. 9 for example, it can be seen that the back portion 201 for supporting the back of a seated occupant that has an upper end 203, a lower end 205, and is pivotally mounted at pivot 207 relative to the supporting frame 1. Pivot 207 is positioned above the lower end 205 of the back portion 201. As shown in FIGS. 35 and 36, the back portion of the chair comprises a central spine 209, and a compliant support surface 211 supported by the spine for supporting the back of a seated occupant. An upper portion of the spine will preferably have connection feature 212 for connecting the compliant support surface to the spine. A lower portion of the spine 209 is pivotally connected to the supporting frame at pivot 207, with a bottom portion of the spine 205 pivotally connected to a drag link 602. The compliant support surface 211 may be any suitable type. For example, the compliant support surface may comprise a resiliently flexible shell supported by the spine 209 and a cushion supported by the shell. Alternatively, the cushion may not be provided, and instead the compliance in the support surface may be provided by slots, apertures, or regions of enhanced flexibility in the shell.

As shown in FIG. 36, the spine 209 is resiliently flexible such that an upper end of the spine can be flexed rearwardly relative to a portion of the spine adjacent the pivot connection 207 of the spine to the supporting frame. Additionally, as shown in FIG. 35 the spine 209 may be resiliently flexible so it can twist with a torsional action around a longitudinal axis of the spine, upon application of a suitable force by a seated occupant to the compliant support surface 211. These features, and the compliant support surface, enable an occupant to sit in unusual positions and be supported by the chair, thereby increasing the comfort level offered by the chair. Additionally, the configuration encourages healthy blood flow through micro-movements and allows freedom of movement with continuous support of the user.

Similarly, the seat portion comprises a seat frame 103 and a support surface 107 mounted to the seat frame for supporting a seated occupant. The support surface 107 of the seat portion may be compliant or rigid and of any of the types outlined in relation to the back portion.

Referring to FIGS. 19 to 24, a drag link 602 is pivotally connected at pivot 602*a* to the seat portion 101. A fixed extension 105 extends rearwardly from a seat frame 103 of the seat portion 101, and the drag link 602 is pivotally connected at pivot 602*a* to that fixed extension 105. The drag link is also pivotally connected at pivot 602*b* to the back portion 201 at a position below the pivotal mounting 207 of the back portion relative to the supporting frame. The recline mechanism 601 is configured such that as the back portion 201 of the chair is reclined, the lower end 205 of the back portion moves forward and the drag link 602 pulls the seat portion 101 upward relative to the supporting frame 1. The drag link acts in tension during that pulling action. The drag link 602 preferably moves from a generally vertical orientation when the back portion of the chair is in the upright configuration, to a forwardly inclined orientation when the back portion of the chair is reclined (when the chair is in a neutral rock configuration).

In the form shown, the chair comprises a rocker mechanism 701 as will be described below. The rocker mechanism 701, shown in FIGS. 25 to 28C, operatively connects the main transom 15 and an intermediate support 21 to provide a rocking motion therebetween. Therefore, rather than being connected to the main transom 15, the recline mechanism 701 supports the seat portion from the intermediate support 21 of the supporting frame. The back portion 201 is also supported by the intermediate support 21. This means that the seat portion 101 and back portion 201 will rock with the intermediate support 21. In an alternative configuration of the chair without a rocker mechanism, the recline mechanism could instead support the seat portion from the main transom 15 of the supporting frame, and the back portion could be supported by the main transom.

Figure 10:
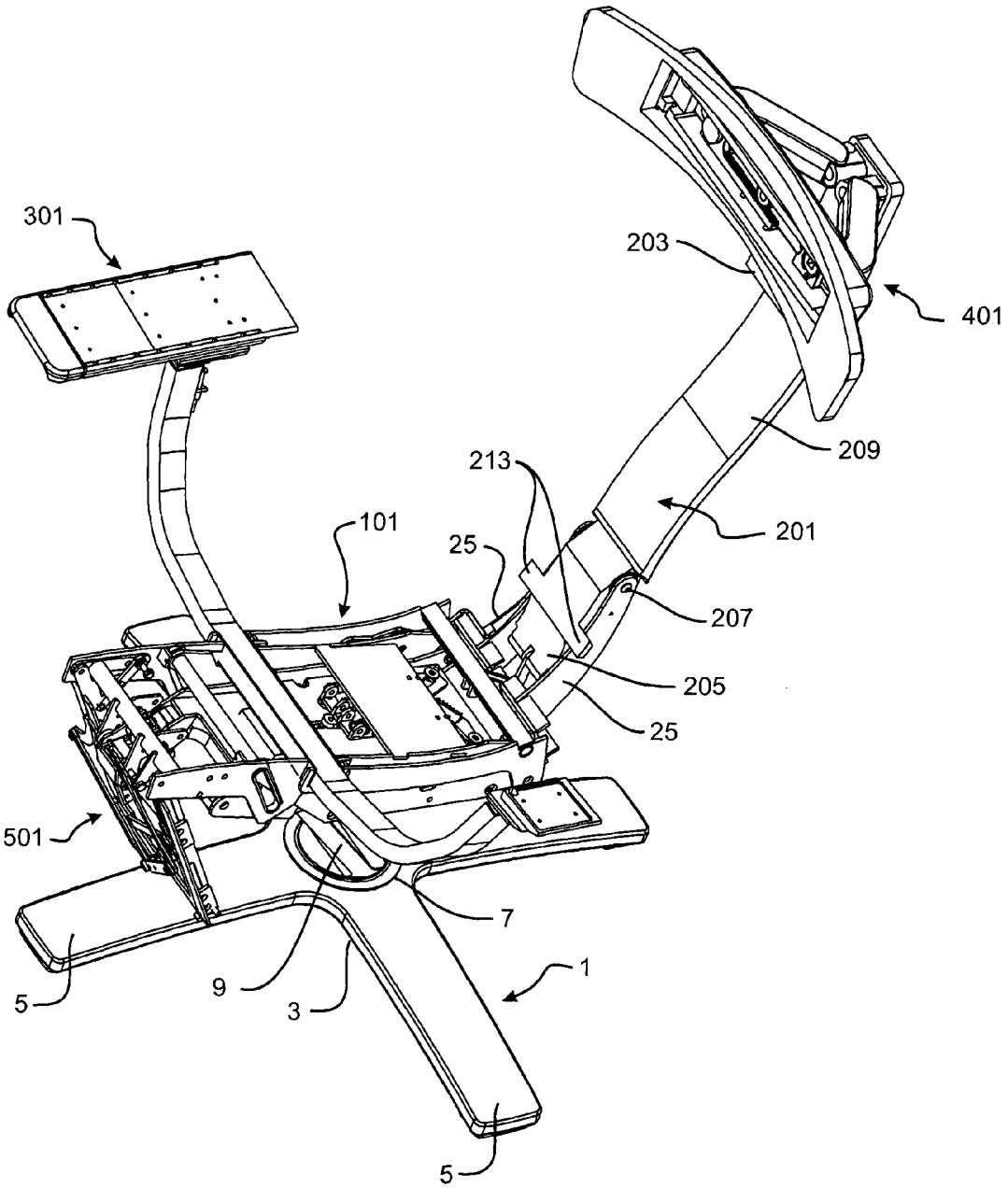
FIG. 10 is a perspective view corresponding to FIG. 9.
Figure 11:
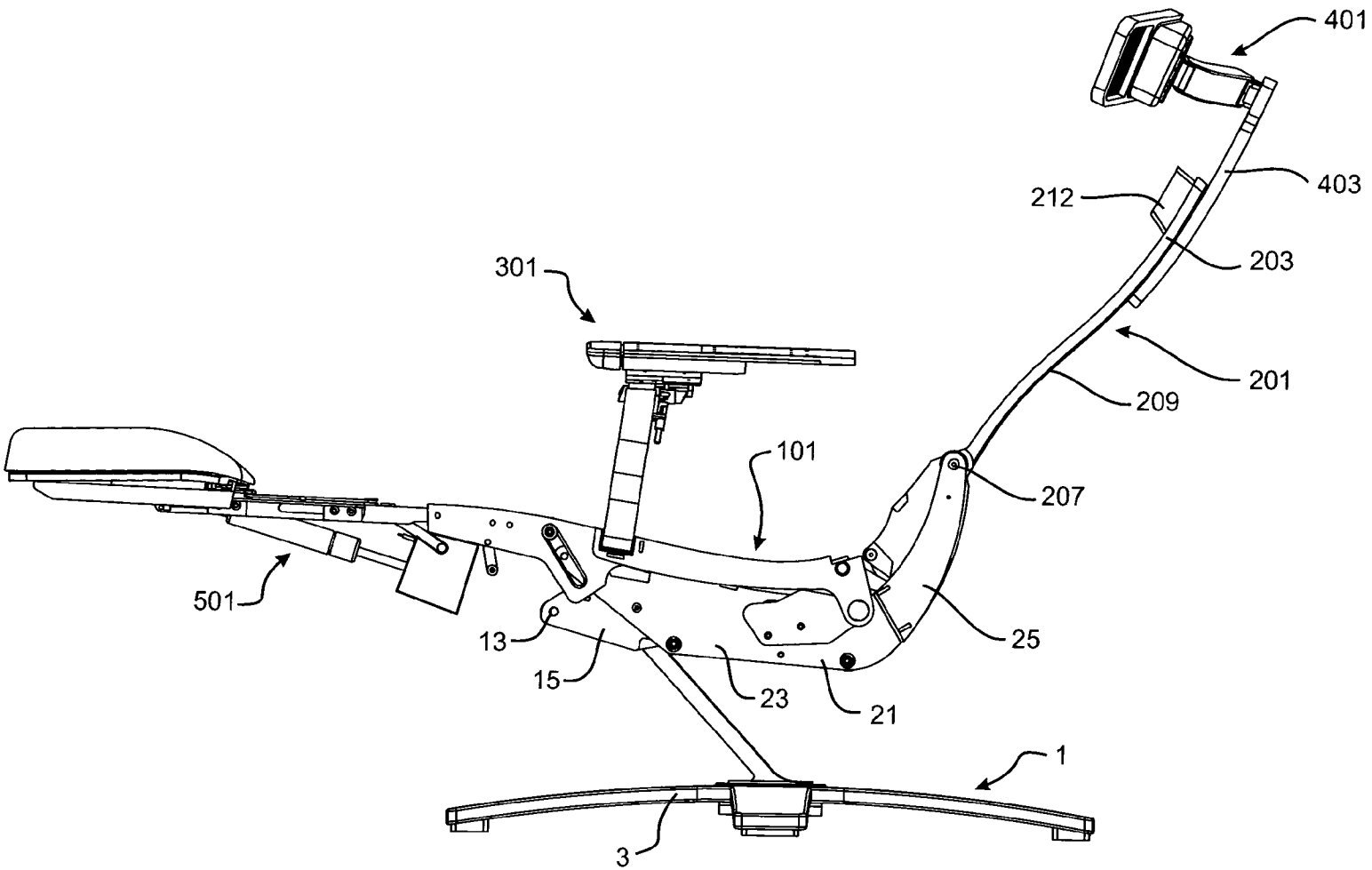
FIG. 11 is a side view of the skeleton of the chair, in a position corresponding to FIG. 5.
Figure 12:
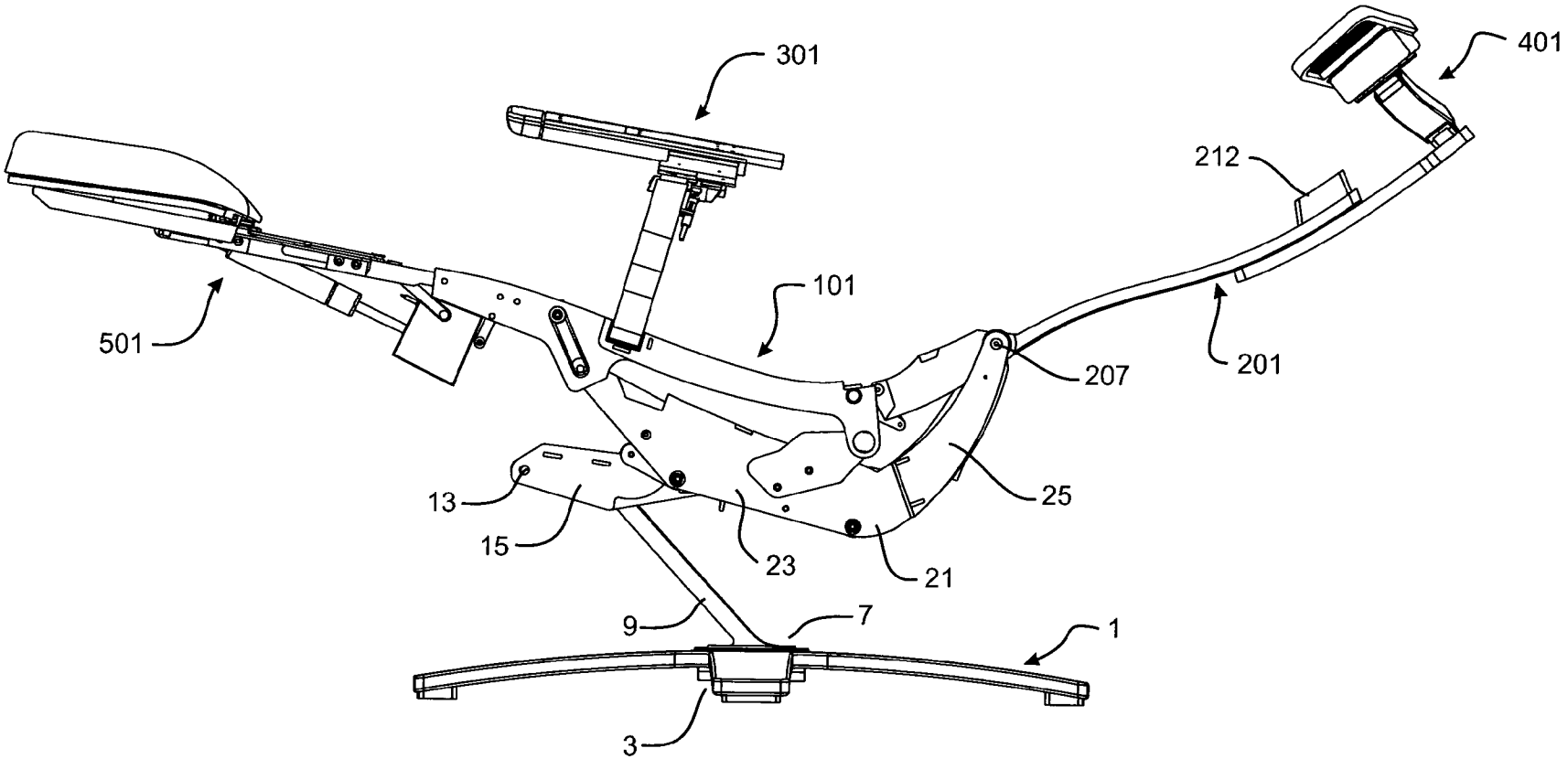
FIG. 12 is a side view of the skeleton of the chair, in a position corresponding to FIG. 7.
Figure 13:
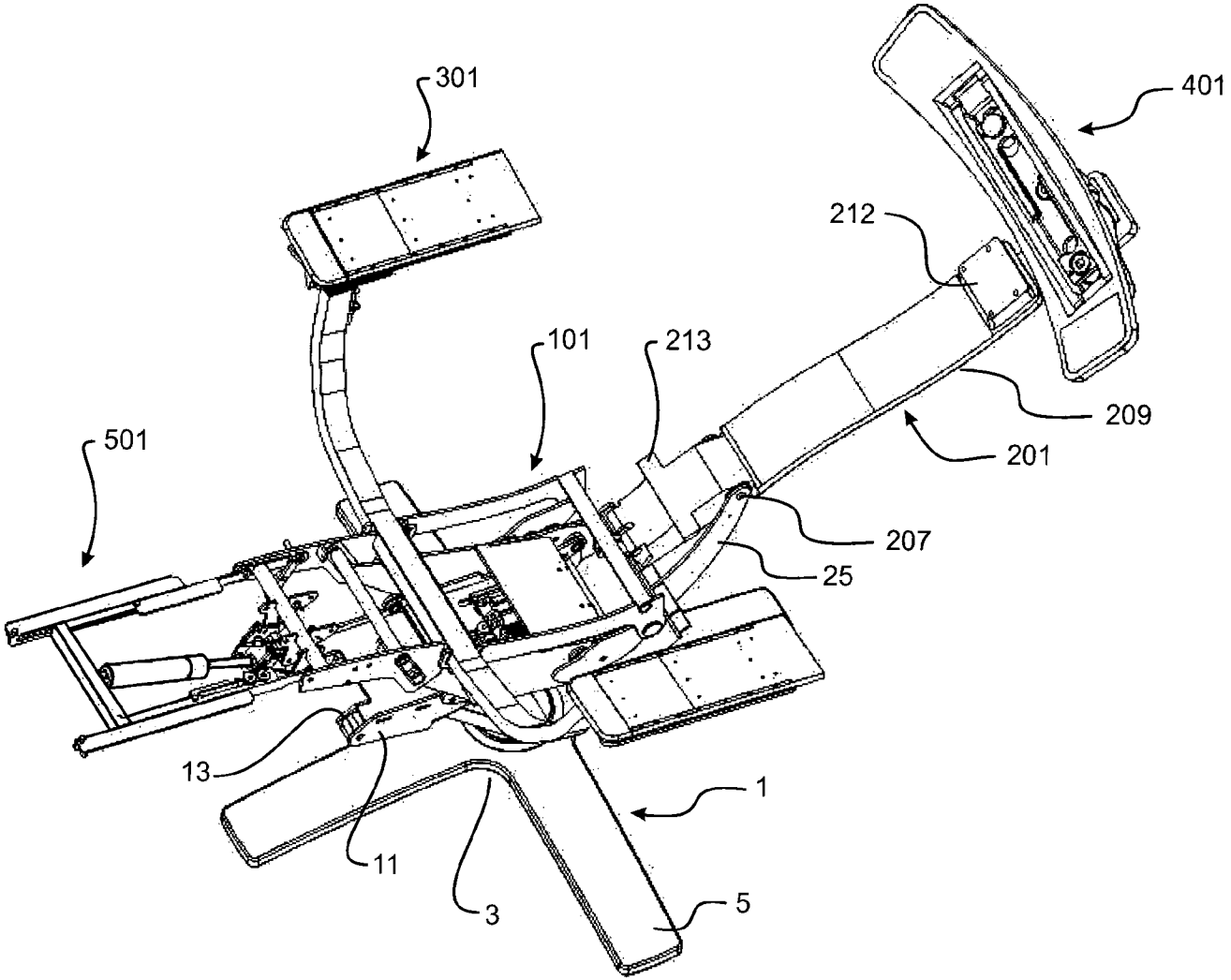
FIG. 13 is a perspective view corresponding to FIG. 12.

As shown in FIGS. 12 and 19-24, the intermediate support 21 has a generally horizontally extending portion 23 and a pair of rearward uprights 25, with the lower portion 205 of the spine positioned between and pivotally connected to the uprights 25 at pivot 207. As shown in FIGS. 10 and 13, a portion of the spine below the pivot connection 207 may have one or more stops 213 connected thereto, which engage against uprights 25 to define the maximum rearward movement of the lower portion of the spine relative to the uprights 25. Alternatively the stops 213 may comprise inwardly protruding tabs or ledges on the uprights 25 that are configured to engage a rear surface of the lower portion 205 of the spine to limit its rearward movement.

Reverting to FIGS. 19-24, the recline mechanism comprises at least one operative connection between the seat portion 101 and the intermediate support 21. In the preferred form shown, the recline mechanism 601 comprises a front operative connection 603 between a relatively forward portion of the seat portion and the supporting frame. The front operative connection 603 guides movement of the relatively forward portion of the seat portion as the back portion is reclined or returned to upright. The front operative connection 603 comprises a slide arrangement comprising a track 605 on the seat portion 101 and a follower 607 on the intermediate support 21 of the supporting frame, with the follower 607 arranged to travel in the track 605 as the seat portion is moved upward upon recline of the back portion. Alternatively, the track 605 could be provided on the intermediate support 21 and the follower provided on the seat portion 101. The track 605 is angled upwardly and forwardly, to cause the forward part of the seat portion 101 to move upwardly and forward as the seat portion 101 is lifted by the drag link 602 of the recline mechanism. Preferably, the recline mechanism comprises two of these front operative connections, one at or adjacent each side of the seat portion 101.

In the preferred form shown, the recline mechanism also comprises a rear operative connection 611 between a relatively rearward portion of the seat portion 101 and the intermediate support 21 of the supporting frame. The rear operative connection 611 guides movement of the relatively rearward portion of the seat portion as the back portion is reclined or returned to upright. The rear operative connection 611 comprises a forward link 613 that is pivotally connected at pivot 613*a* to the intermediate support 21, a rearward link 615 that is pivotally connected at pivot 615*a* to the intermediate support 21, and a carrier link 619 that is pivotally connected at pivots 613*b*, 615*b* to the forward link and to the rearward link respectively. The carrier link 619 is pivotally connected at pivot 619*a* to the seat portion 101. The pivot connection 619*a* of the carrier link 619 to the seat portion 101 is positioned rearwardly of the pivot connections 613*b*, 615*b* of the forward link 613 and rearward link 615 to the carrier link 619. The pivot connection 602*a* (FIGS. 20, 22, 24) of the drag link 602 to the seat portion 101 is positioned generally above and generally behind the pivot connection 619*a* of carrier link 619 and the seat portion 101, when the back portion 201 of the chair is not reclined, and is positioned generally above the pivot connection 619*a* of the carrier link 619 and the seat portion 101, when the back portion of the chair is reclined.

When the back portion 201 is in an upright configuration (FIG. 19), the forward link 613 hangs downwardly and rearwardly from its pivot connection 613*a* to the intermediate support 21, and the rearward link 615 hangs downwardly and forwardly from its pivot connection 615*a* to the intermediate support. When the back portion is fully reclined (FIG. 23), the forward link 613 hangs generally downwardly from its pivot connection 613*a* to the intermediate support 21, and the rearward link 615 extends generally forwardly from its pivot connection 615*a* to the intermediate support 21. The pivot connection 602*a* of the drag link 602 to the seat portion 101 is positioned upwardly and rearwardly of the pivot connection 619*a* of the carrier link 619 and the seat portion 101, when the back portion 201 of the chair is fully reclined. Preferably, the recline mechanism comprises two of these rear operative connections, one at or adjacent each side of the seat portion 101.

The operative connections 603, 611 between the seat portion 101 and the intermediate support 21 are arranged such that the relatively forward and relatively rearward portions of the seat portion move upward and forward with a substantially linear movement as the back portion is reclined, with the amount of movement of the relatively rearward portion being greater than the amount of movement of the relatively forward portion, to provide a forward tilt of the seat portion 101 as the back portion is reclined. That forward tilt reduces force against the underside of the occupant's thighs as the back portion is reclined, and also reduces 'shirt pull'. Preferably, the seat portion 101 has a rearward tilt angle when the back portion 201 is upright, and the seat portion 101 has a smaller rearward tilt angle when the back portion 201 is fully reclined. Preferably, the upward movement of the relatively rearward portion of the seat portion is greater than that of the relatively forward portion of the seat portion.

In an alternative configuration, the rear operative connections could instead comprise track and follower arrangements of the type described for the front operative connections. In another configuration, the front operative connections could instead comprise pivot and link arrangements of the type described for the rear operative connections.

Because the recline mechanism 601 lifts the seat portion 101 upon recline of the back portion 201, the recline mechanism is a weight compensating mechanism. That is, the occupant's body weight influences the force that must be applied to the back portion to cause it to recline. A lighter weight occupant who would generally be less strong does not need to apply as much force to the back portion, as a heavier occupant who would generally have greater strength. A lighter occupant is also typically shorter and therefore applies force to the back portion at shorter distance above the back pivot 207, achieving less leverage than a taller occupant. The present recline mechanism, has the advantage that for the same force applied to the back portion, less leverage is required (i.e. the force can be applied closer to the back pivot) to lift a lighter occupant than a heavier occupant. These benefits mean that tension adjustment and/or a user activated recline lever are not required.

The use of the drag link 602 and a pivot of the back portion to the supporting frame above the bottom of the back portion enables the lower portion of the back portion and the seat portion to travel on independent paths, reducing the amount of 'shirt pull' that would occur if the back portion was pivoted directly to the seat portion. The position of the pivot 207 of the back portion to the supporting frame also provides optimal lumbar rotation as the back portion is reclined, and reduces the spacing that is required between the back of the chair and a wall to enable the chair to be reclined, despite the back portion of the preferred embodiment chair being reclinable to an angle of about 37 degrees. Additionally, the drag link 602 provides variable gearing through the travel of the back portion 201 and the seat portion 101, due to the changing link angle relative to the back angle. That varies the weight compensation rate inversely to the recline angle of back portion. As the back portion 201 reclines rearward, more of the occupant's weight is on the back portion 201, increasing the weight compensation requirement of the seat portion 101 to keep the rate of change of angle of the back portion recline controlled. The drag link angle change increases the amount of seat lift per degree of back angle, and therefore the effort required to recline, as the back angle increases Having a recline mechanism that moves the seat portion 101 forward and upward upon recline of the back portion 201 means that the occupant's centre of gravity will be moved a minimal amount upon recline of the back portion. This minimises any undesired rocking of the chair that may otherwise occur due to recline of the back portion.

Rocker Mechanism

As discussed above, the supporting frame 1 comprises a main transom 15, an intermediate support 21, and a rocker mechanism 701 that operatively connects the main transom and the intermediate support to provide a rocking motion therebetween. Referring to FIGS. 25 to 28C, the rocker mechanism 701 comprises a front rocker arm 703 pivotally connected to the main transom 15 at pivot 703*a* and to the intermediate support 21 at pivot 703*b*, and a rear rocker arm 705 pivotally connected to the main transom at pivot 705*a* and to the intermediate support 21 at pivot 705*b*.

Figure 25:
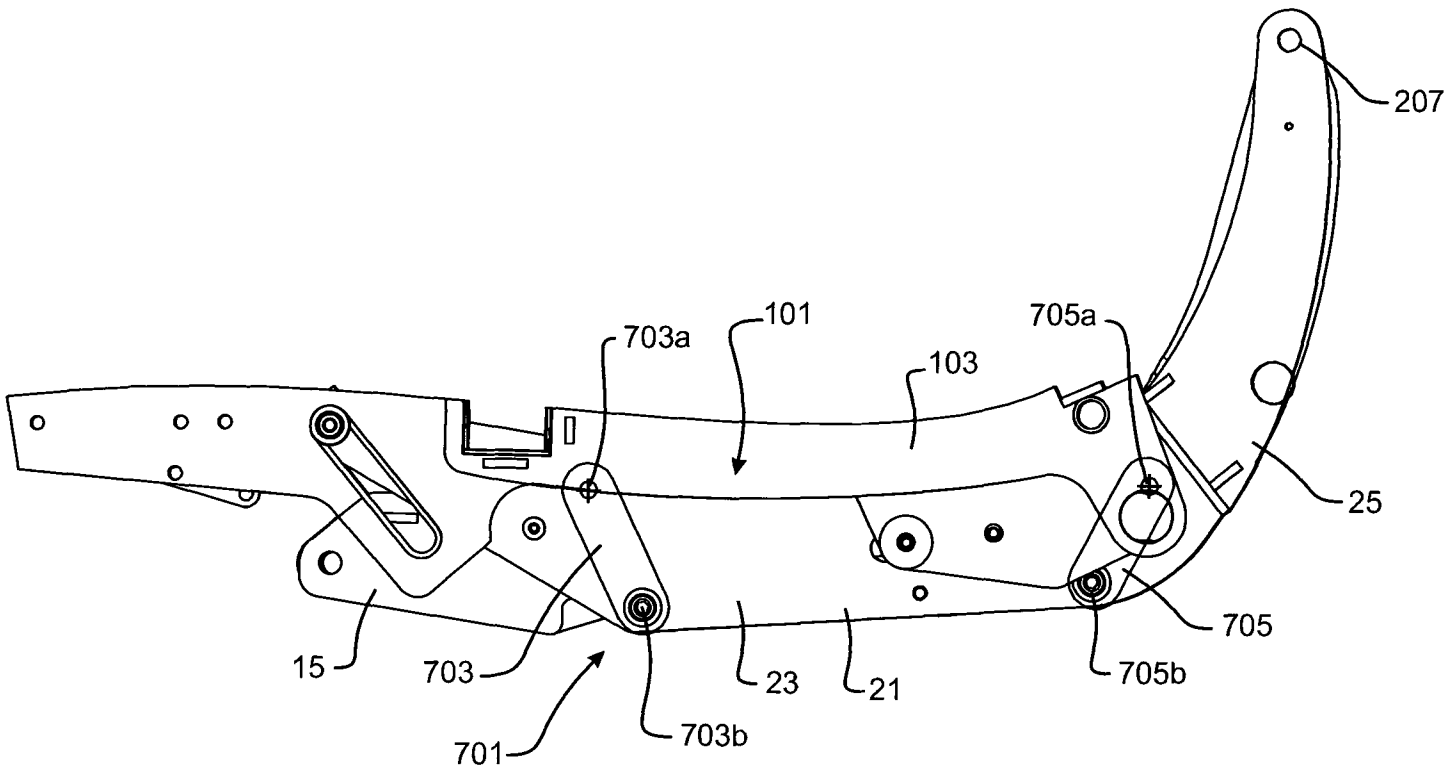
FIG. 25 is a side view of part of the rocker mechanism of the chair, when the intermediate support is in a neutral rock position.
Figure 26:
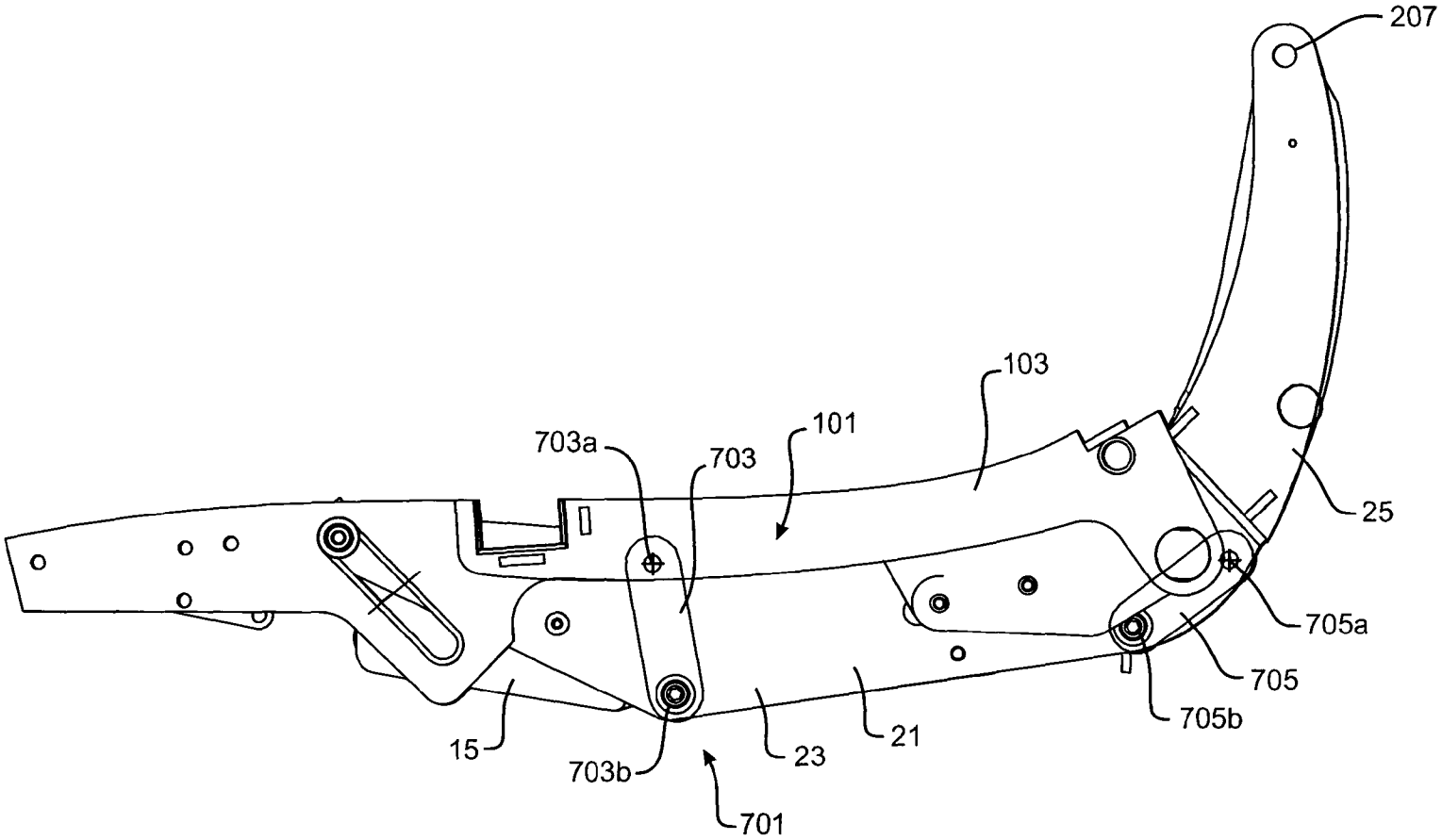
FIG. 26 is a side view similar to FIG. 25, but when the intermediate support is in a forward rocked position.
Figure 27:
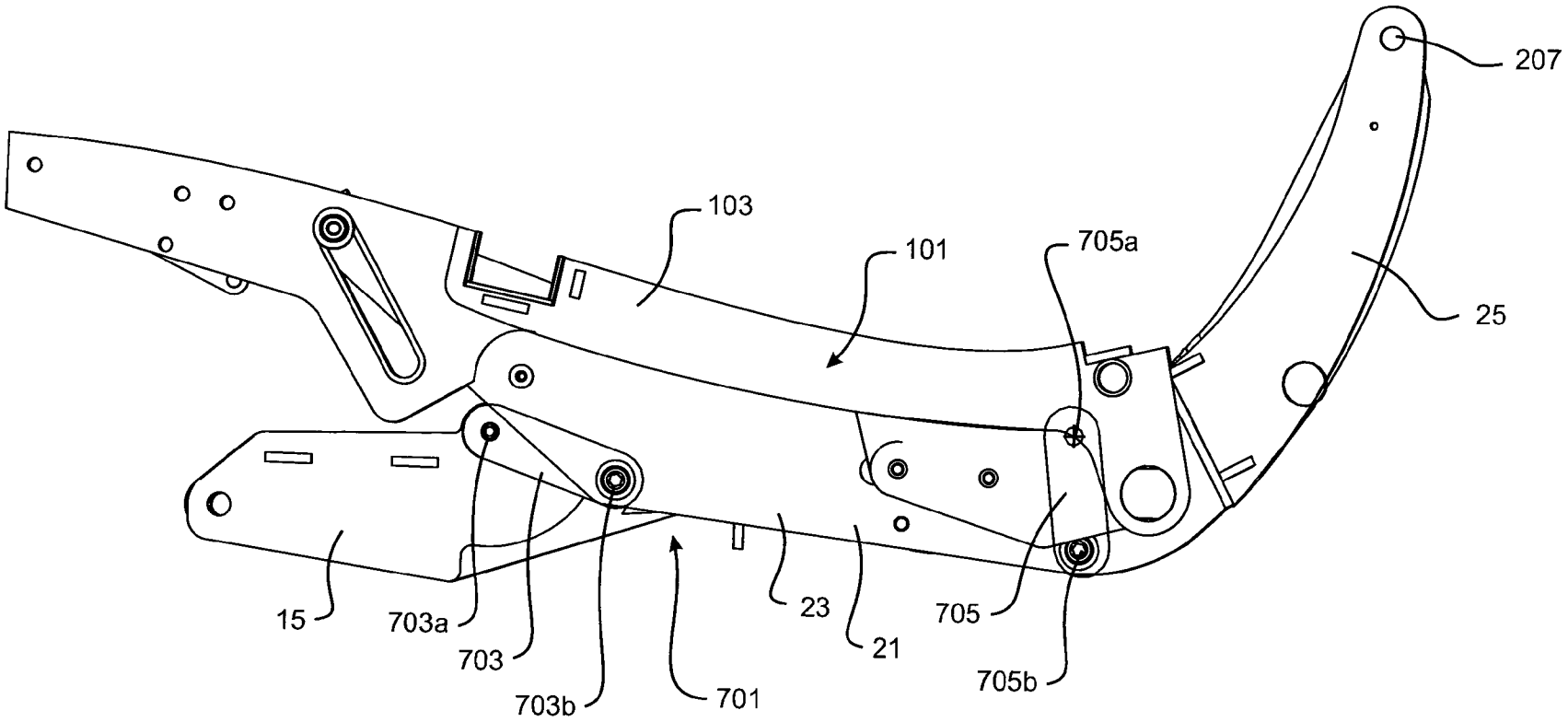
FIG. 27 is a side view similar to FIG. 25, but when the intermediate support is in a rearward rocked position.

The front rocker arm 703 and the rear rocker 705 arm hang generally downwardly from their pivot 703*a*, 705*a* connections to the main transom 15, at least when the rocker mechanism is in a neutral position as shown in FIG. 25. As shown in FIG. 27, when the intermediate support 21 is in the rearward rocked position, the front rocker arm 703 extends generally rearwardly from its pivot connection 703*a* to the main transom, and the rear rocker arm 705 extends generally downwardly from its pivot connection 705*a* to the main transom. When the intermediate support is in the forward rocked position as shown in FIG. 26, the front rocker arm 703 extends generally downwardly from its pivot connection 703*a* to the main transom, and the rear rocker arm 705 extends downwardly and forwardly from its pivot connection 705*a* to the main transom.

The arms 703, 705 are configured such that their action simulates rocking motion of a traditional rocking chair utilising a curved piece of wood in contact with the support surface. A traditional rocking chair motion is a combination of rotation and translation. The intermediate support 21, and thereby the seat portion 101 and the back portion 201, can be rocked between a rearwardly angled rearward rocked position as shown in FIG. 27 and a forwardly angled forward rocked position as shown FIG. 26.

Preferably, the front rocker arm 703 is longer than the rear rocker arm 705. Preferably, the pivot connection 703*a* of the front rocker arm 703 to the main transom 15 is positioned vertically higher than the pivot connection 705*a* of the rear rocker arm 705 to the main transom, as shown in FIG. 25. 'Plonk' of the chair as a user sits down will affect the pivot positions. This configuration provides a compact package size for the rocker mechanism, while providing the same motion that would be provided if equal length arms were used with their pivots to the main transom positioned the same height from the floor.

Preferably, the rocker mechanism comprises two of said front rocker arms and two of said rear rocker arms, positioned at or adjacent respective sides of the seat portion.

Figure 28A:
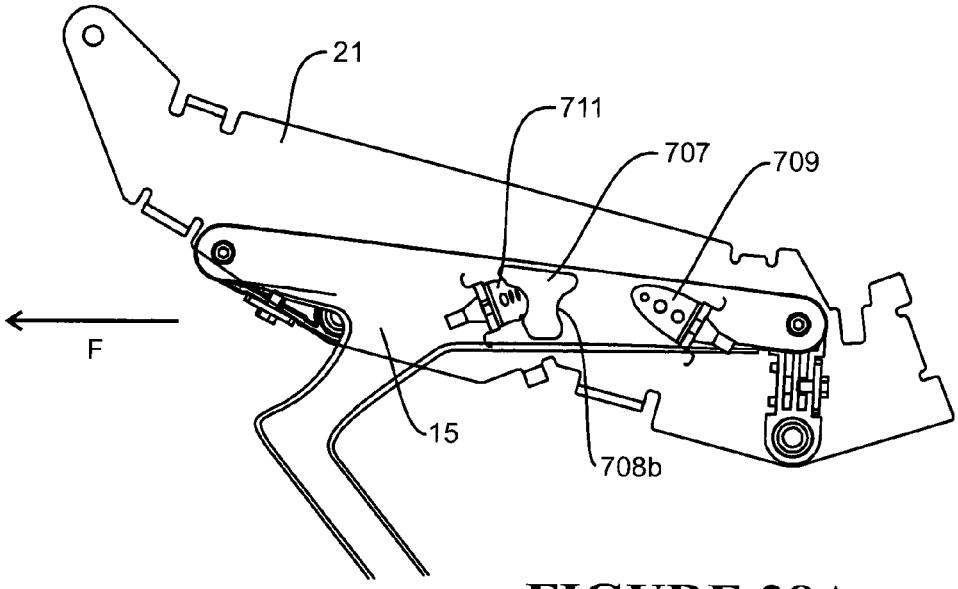
FIGS. 28A to 28C are partial sectional views through the cantilevered support frame showing the rocker mechanism connecting the intermediate support frame, and a rock stop arrangement for limiting forward and rearward rock of the intermediate support frame, with FIG. 28A showing the intermediate frame rocked rearward and the front intermediate frame stop compressed, FIG. 28B showing the intermediate frame in a neutral rock position, and FIG. 28C showing the intermediate frame rocked forward and the rear intermediate frame stop compressed.
Figure 28B:
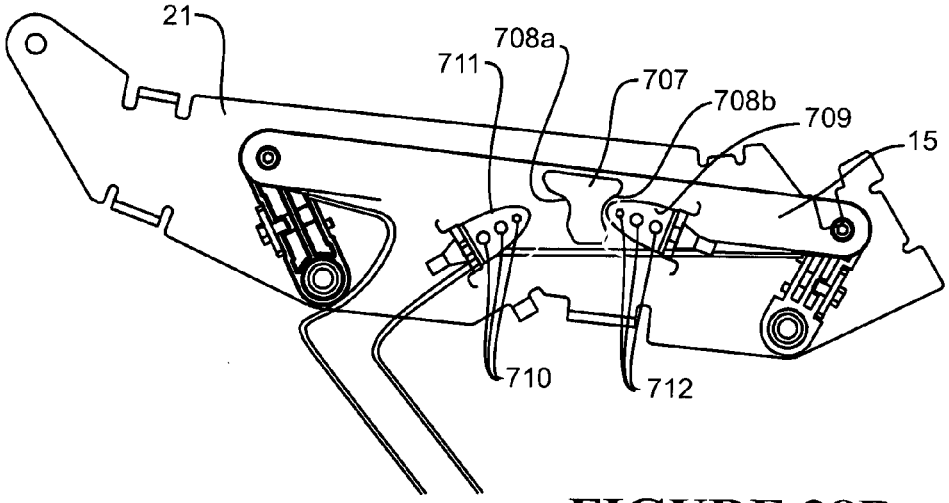
Figure 28C:
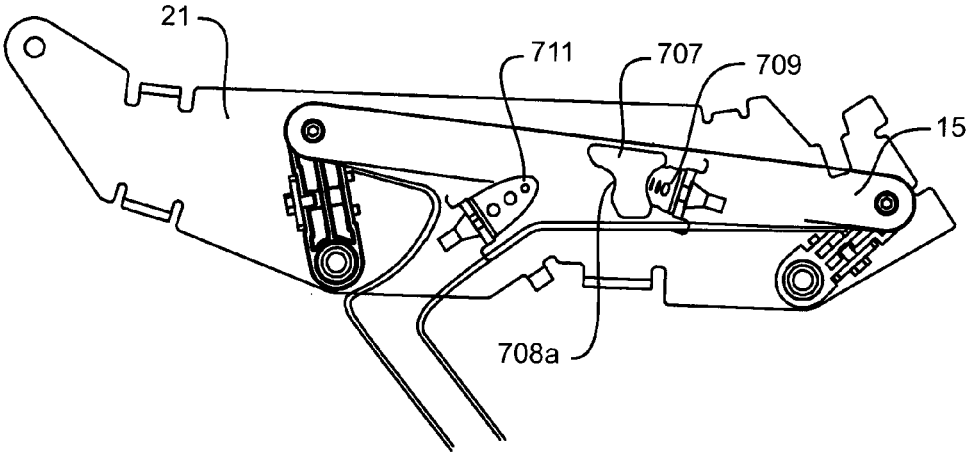

Preferably, the rocker mechanism comprises one or more stops (not shown) to limit forward and/or rearward rock of the intermediate support relative to the transom 15. FIGS. 28A to 28C illustrate an embodiment having compressible forward 709 and rearward 711 stops fixed to the intermediate support. The forward stop 709 is fixed to a rearward portion of the intermediate support 21 and limits forward rocking of the intermediate support relative to the transom 15. The rearward stop 711 is fixed to a portion of the intermediate support 21 forward of the forward stop 709 and limits rearward rocking of the intermediate support relative to the transom 15. The transom 15 comprises a fixed stop 707 having first and second abutment surfaces 708*a*, 708*b*. The forward and rearward stops 709, 711 provided on the intermediate support comprise compressible elastomeric members. The elastomeric members are tapered from their base and comprise apertures 710, 712 to increase their compressibility. The fixed stop 707 of the transom is substantially non-compressible.

As the intermediate frame 21 rocks rearward relative to the transom 15, as shown in FIG. 28A, the rearward compressible stop 711 comes into contact with the first abutment surface 708*a* on the fixed stop 707. As the intermediate frame 21 continues to rock rearward, the forward compressible stop 711 is forced into the first abutment surface 708*a*, compressing the rearward stop 711 and slowing the velocity of the rearward rock. As the rearward stop 711 is compressed further, the velocity of the rock slows further until the stop is fully compressed, limiting the rearward rock of the intermediate member 21. As the intermediate member 21 is rocked forward towards the neutral rock position, the rearward stop 711 expands until it is out of contact with the fixed stop 707 and in its non-compressed configuration as shown in FIG. 28B.

Similarly, as the intermediate frame 21 rocks forward relative to the transom 15, the forward compressible stop 709 comes into contact with the second abutment surface 708*b* on the fixed stop 707. As the intermediate frame 21 continues to rock forward, the forward compressible stop 709 is forced into the second abutment surface 708*b*, compressing the forward stop 709 and slowing the velocity of the forward rock. As the forward stop 709 is compressed further, the velocity of the rock slows further until the stop is fully compressed, limiting the forward rock of the intermediate member 21. As the intermediate member 21 is rocked rearward towards the neutral rock position, the forward stop 709 expands until it is out of contact with the fixed stop 707 and in its non-compressed configuration.

In an alternative embodiment, the compressible stops could be provided on the transom, and the abutment surfaces may be provided on the intermediate member. In a further embodiment, rather than compressible stops, the intermediate support 21 and/or the transom 15 may comprise front and/or rear hard limit stops to limit the front and rear rock of the seat portion.

The rocker mechanism will function irrespective of whether the back portion is upright or reclined. However, in an embodiment having a foot or leg support assembly as described below, the chair is preferably provided with a rocking inhibitor arrangement to counter the effect of weight change when the foot or leg support is extended.

Arm Assemblies

Figure 29:
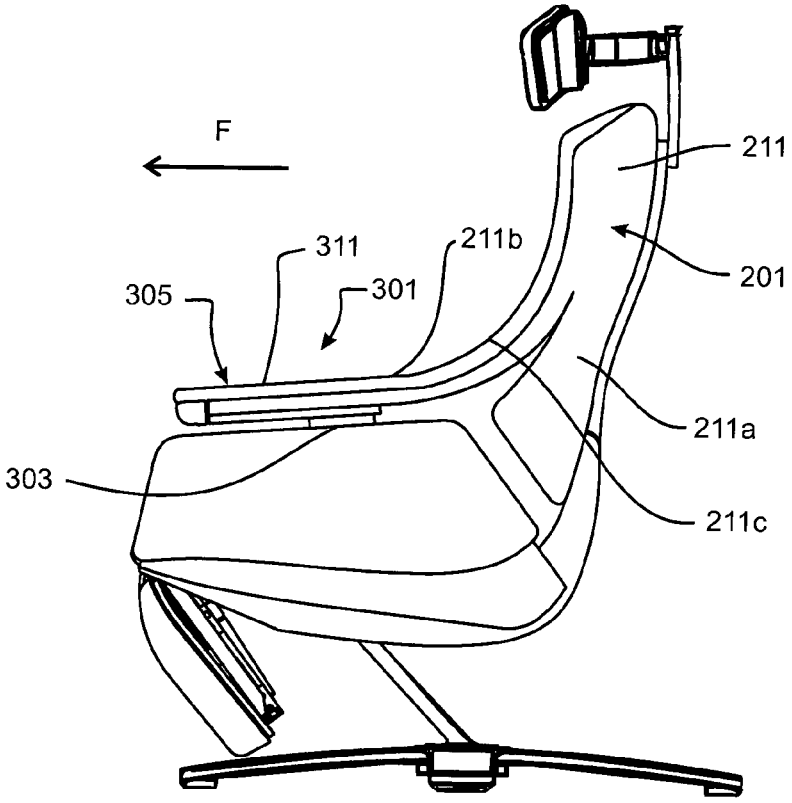
FIG. 29 is a side view of the chair when the back portion is in a neutral rock, upright position, showing the forward sliding position of the arm rests.
Figure 30:
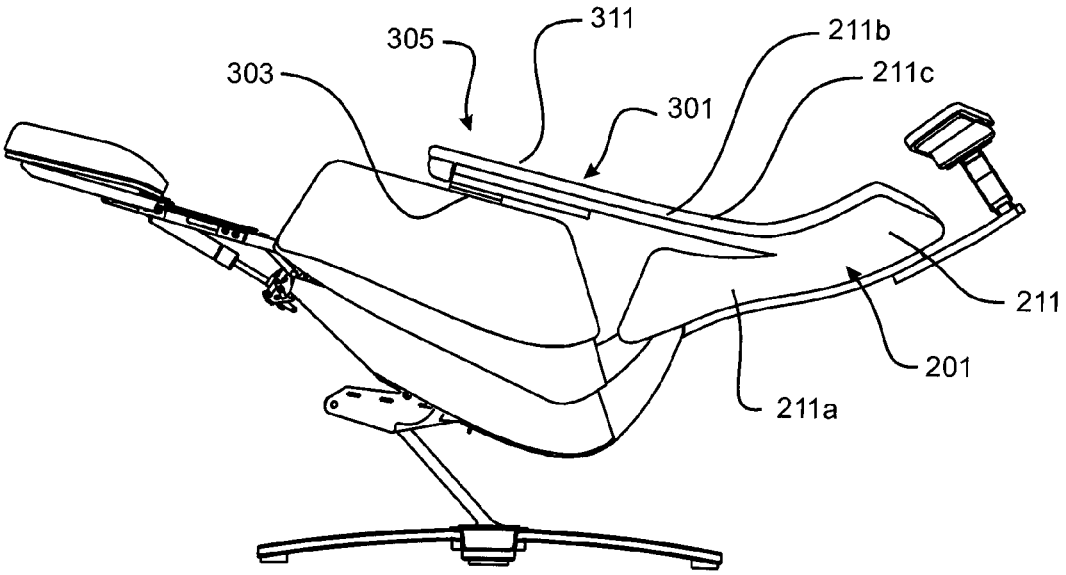
FIG. 30 is a side view corresponding to FIG. 29, with the chair rocked rearward and the back portion is reclined, with a corresponding rearward slide of the arm rests.

The chair has a pair of arm assemblies 301 positioned one on either side of the seat portion 101. As shown in FIGS. 29 to 34, each arm assembly comprises an upright arm rest support 303 and an arm rest 305 that is slidably mounted to the arm rest support at an upper end thereof. The arm rests 305 are operatively connected to the back portion 201 such that as the back portion 201 is reclined, the arm rests 305 slide rearwardly on the arm rest supports 303. When the back portion is returned to the upright position, the arm rests 305 slide forward on the arm rest supports to return to their forward positions. FIG. 29 shows the arm rests in their forward positions when the back portion 201 is upright, and FIG. 30 shows the arm rests in their rearward positions when the back portion 201 is fully reclined.

Because the chair comprises a recline mechanism 601 configured to lift the seat portion 101 upon a reclining action of the back portion 201, to maintain a desired position between the seat portion and the arm rest supports 303, the arm rest supports 303 are mounted to the seat portion 101 to move with the seat portion as the seat portion is moved by the recline mechanism. Similarly, because the chair comprises a rocker mechanism that operatively connects the main transom 15 and the intermediate support 21 to provide a rocking motion therebetween, by mounting the arm rest supports 303 to the seat portion 101, the arm rest supports 303 will move with the seat portion 101 as the seat portion is rocked by the rocker mechanism.

In the form shown, the arm rest supports 303 are mounted to the seat frame of the seat portion 101, so that the orientations of the arm rest supports 303 relative to the seat portion 101 are fixed. In an alternative configuration, lower portions 303*a* of the arm rest supports 303 are pivotally connected to the seat portion (e.g. to the seat frame 103), with the arm rest supports 303 configured such that the orientations of the arm rest supports relative to the seat portion 101 change for at least part of the reclining action of the back portion. This could occur, for example, by the arm rests 305 initially sliding on the arm rest supports and, at a certain point of the rearward movement of the arm rests 305, the arm rests could catch and cause the arm rest supports to pivot rearwardly.

Figure 31:
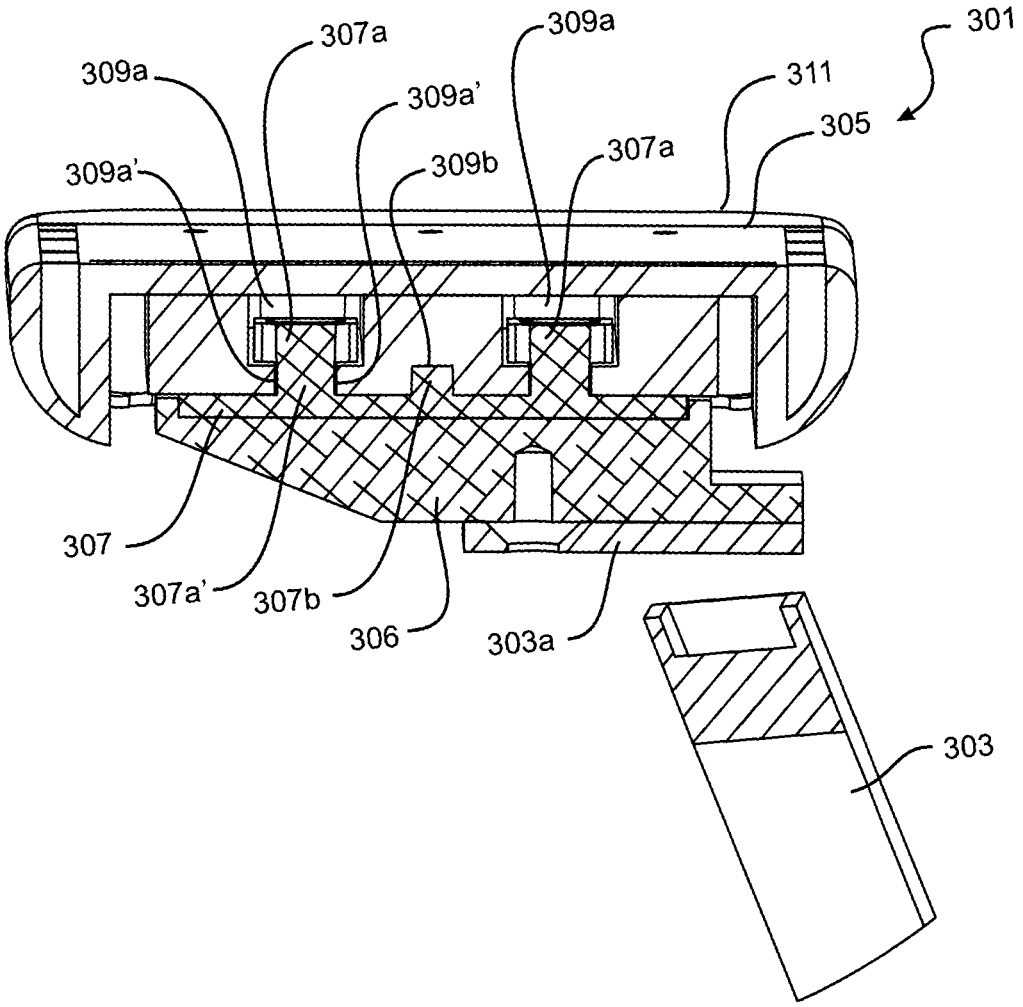
FIG. 31 is a sectional view through one of the arm rest assemblies.
Figure 32:
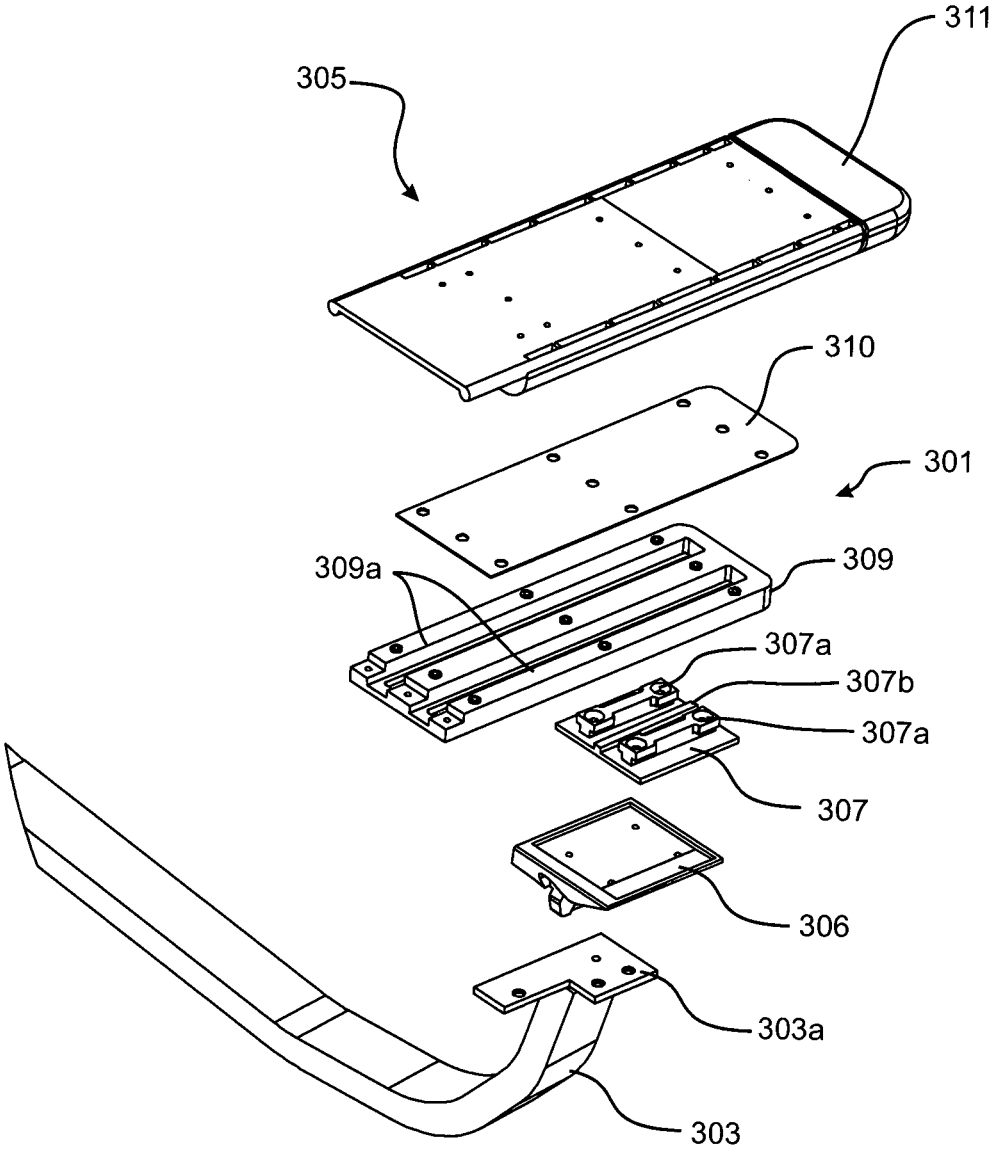
FIG. 32 is an exploded perspective view of one of the arm rest assemblies.
Figure 33:
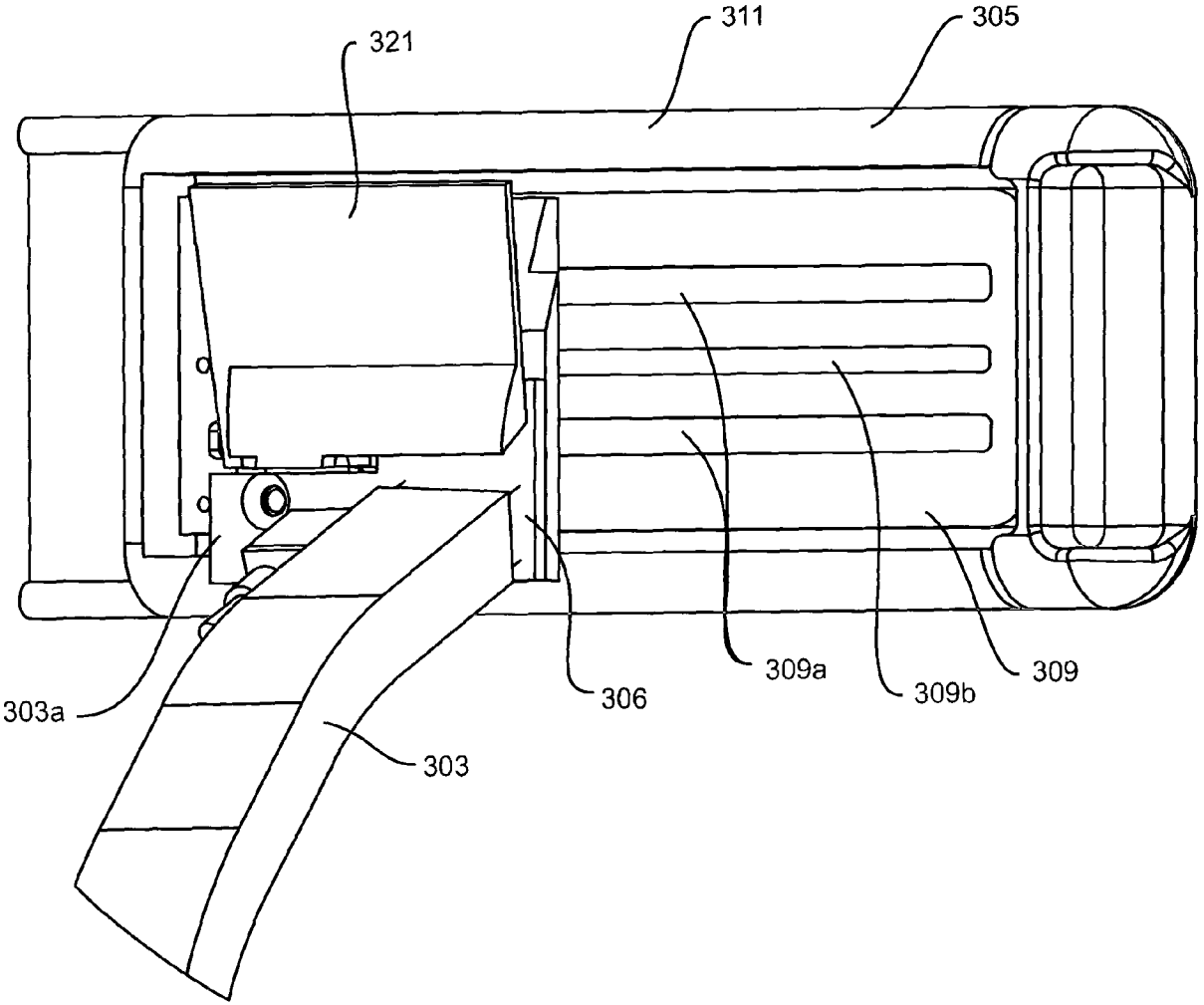
FIG. 33 is an underside view of one of the arm rest assemblies.

Referring to FIGS. 31 to 33, in each arm assembly, either the arm rest 305 or the arm rest support 303 comprises a pair of spaced apart guiding members 307*a*, and the other of the arm rest 305 or arm rest support 303 comprises a pair of complementary elongate slots 309*a* that receive the guiding members. The guiding members 307*a* are spaced apart in a direction transverse to the forward and rearward movement direction of the arm rest on the arm rest support. In the form shown in FIG. 32, each arm assembly includes a support 303 with a post plate 303*a*, an optional slide support 306 mounted to the post plate 303*a*, and a guide structure 307 mounted to the slide support. The guide structure 307 includes the spaced apart guiding members 307*a*. The arm rest 305 has slide structure 309 that includes the spaced apart slots 309*a*, an optional slide top plate 310, and an upper body contacting surface 311. Alternatively the guide structure 307 may directly connect to the post plate 303*a* and/or the upper body contacting surface 311 may directly connect to the slide structure 309. At least part of the guiding members 307*a* are generally T-shaped in vertical cross-section, with the upright portion 307*a*' of the T-shape extending between two inwardly-directed base flanges 309*a*' of the slide structure 309.

Either the arm rest 305 or the arm rest support 303 of each assembly may further comprise a central guide member 307*b*, and the other of the arm rest 305 or arm rest support 303 may comprise a complementary central elongate slot 309*b* that receives the central guide member. When the arm rest 305 is slid forward or rearward relative to the support 303, the surfaces of the central guide member 307*b* bear against the surfaces of the central slot 309*b*. The tolerances between the central guide member 307*b*, and the central slot 309*b* are finer than the tolerances between the T-shaped guide members 307*a* and their respective slots 309*a* so that the central guide member 307*b*, and the central slot 309*b* prevent side-to-side movement and twisting of the arm rest support. The T-shaped guide members 307*a* and their respective slots 309*a* primarily act to prevent the arm rest 305 being lifted off the arm rest support.

As discussed above, the back portion may comprise a resiliently flexible shell 211. Upper body contacting surfaces 311 of the arm rests may be integrally formed by part of the resiliently flexible shell. The resiliently flexible shell 211 preferably comprises a central main back supporting portion 211*a*, and elongate arm rest portions 211*b*, one on either side of the central main back supporting portion. Rear ends of the elongate arm rest portions are connected to the central main back supporting portion and forward ends of the elongate arm rest portions form the upper body contacting surfaces 311 of the arm rests. The elongate arm rest portions 211*b* may be integrally formed with the resiliently flexible back shell 211 or may be separate members that are connected to the back shell 211, for example by clipping an upper portion 211*c* of the arm rest to the back shell 211.

The arm rest portions could also be tension members, with biasing members such as springs to return the slides to their forward positions.

Preferably, rear portions 211*c* of the elongate arm rest portions 211*b* are arcuate when the back portion 201 of the chair is in an upright position (as shown in FIG. 29), and are substantially flat when the back portion 201 of the chair is reclined (FIG. 30).

By providing the sliding arm rests with part of the arm rests 305 formed by, or connected to, the back portion of the chair 201, the gap that would otherwise open between the back portion 201 and the arm rest 305 is eliminated. Additionally, because the arm rests 305 slide forward and rearward on the arm rest supports 305 with movement of the back portion, the occupant's arm will not slide excessively on the surfaces of the arm rests, reducing wear on the occupant's clothing and on any upholstery on the arm assemblies. Additionally, the flattening of the rear portions of the arm rests 305 upon recline of the back portion follows the natural straightening of the occupant's arms as the occupant reclines the back portion of the chair.

Cushioning surfaces could be provided on or in the arm rests. For example, cushioning could be provided on or under the surfaces 311. The cushioning may be integral with the cushioning of the back portion 201 of the chair.

Figure 34:
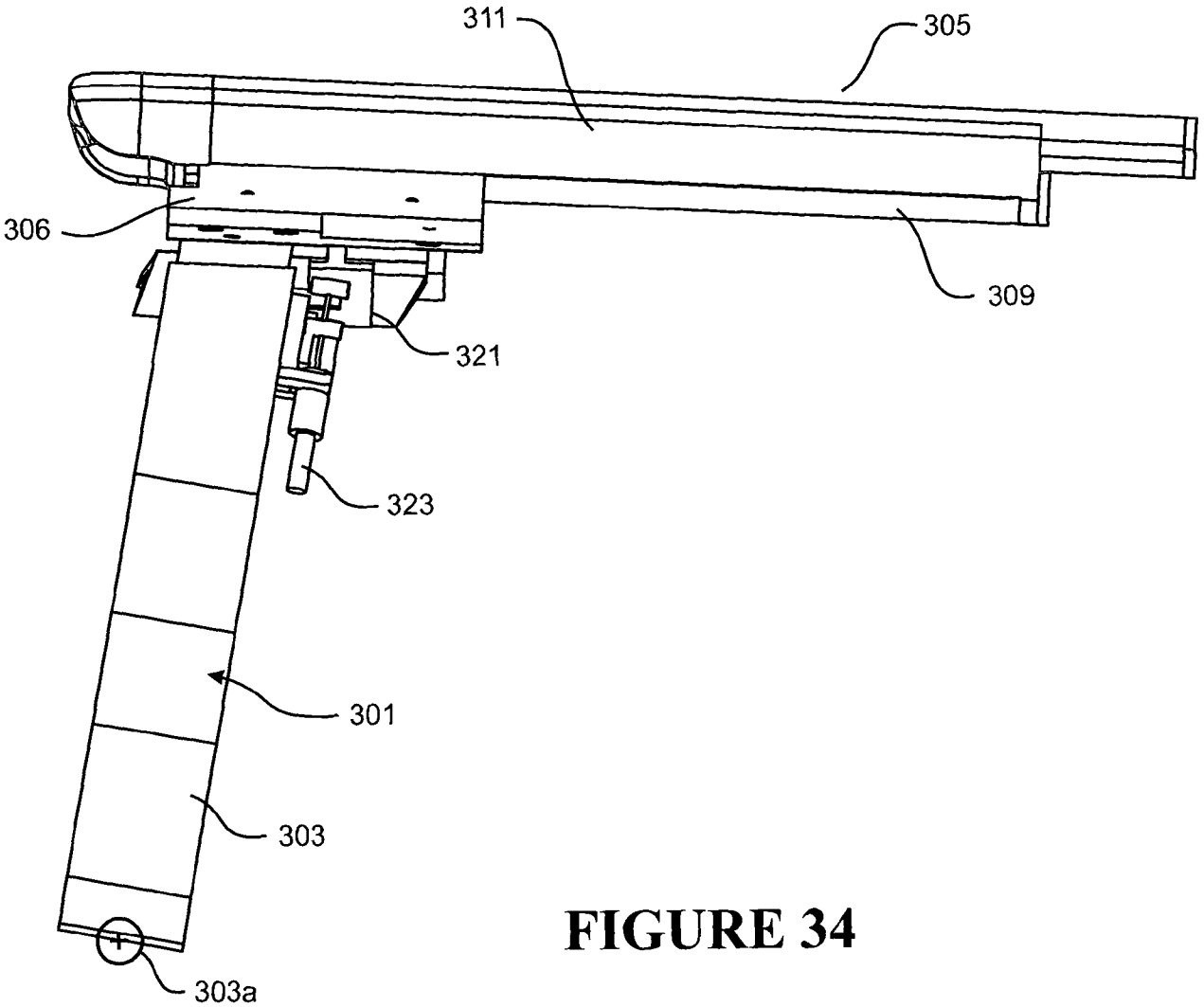
FIG. 34 is a side view of one of the arm rest assemblies.

FIGS. 33 and 34 also show a first user actuator 321 mounted to the underside of one of the arm rests 305 for use by a chair occupant to actuate the foot or leg support assembly described below. A corresponding second user actuator may be mounted to the underside of the other one of the arm rests 305 for use by a chair occupant to actuate the rock lock assembly described below. The user actuators each comprise a paddle for gripping by an occupant's fingers, which is operatively connected to a respective cable, the cables being operatively connected to the foot or leg support assembly or to the rock lock assembly respectively. For the foot or leg support assembly, when the paddle is released, the foot or leg support assembly is not actuated. The user actuator 321 could be any other suitable type, such as a lever or button for example. In an alternative configuration, the actuator could activate an electrically driven foot or leg support via a motor.

The arm assemblies could be incorporated into other types of chairs with reclining back portions which may or may not have recline mechanisms to move the seat portions upon movement of the back portion, and which may or may not have rocker mechanisms.

Foot or Leg Support Assembly

The chair comprises a foot or leg support assembly 501 as described below. The assembly can be used to support an occupant's feet, legs, or both, depending on the configuration of the assembly and the size of the occupant. References to a foot or leg support assembly should be understood to cover any of: a support assembly that is suitable for supporting an occupant's feet, a support assembly that is suitable for supporting an occupant's legs, or a support assembly that is suitable for supporting an occupant's feet and legs.

Figure 37:
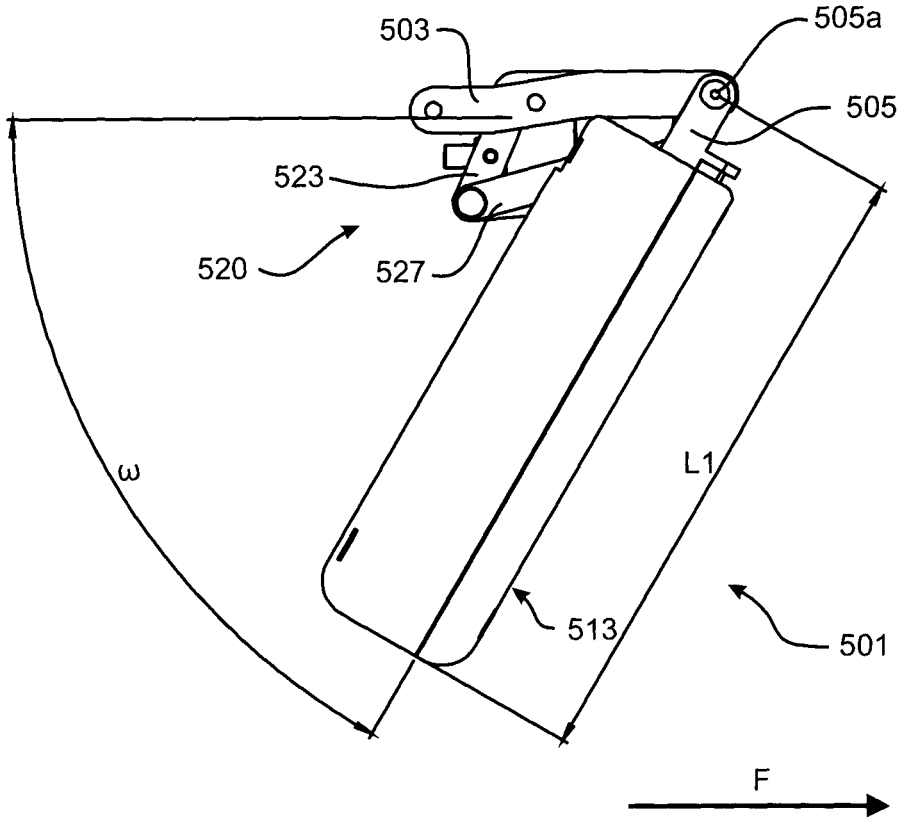
FIG. 37 is a left side view of the foot or leg support assembly of the chair when the foot or leg support member is retracted.
Figure 38:
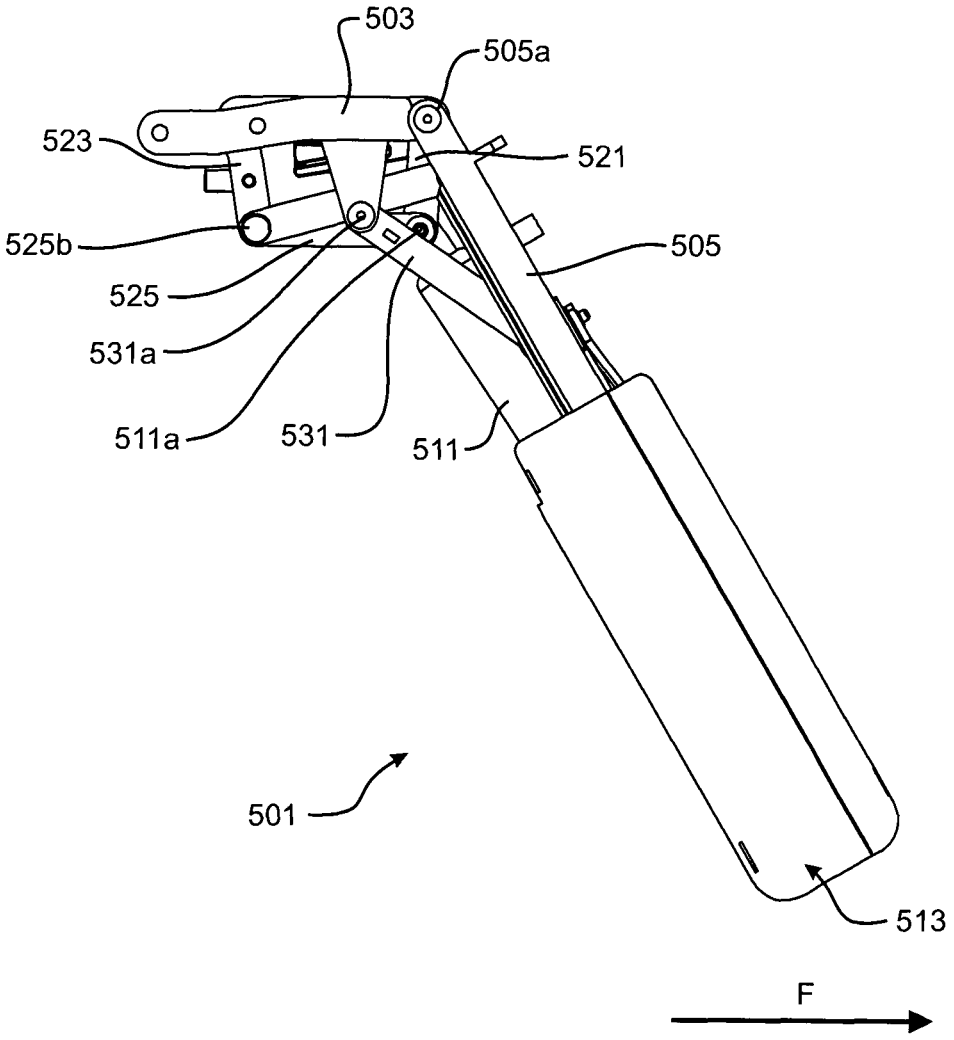
FIG. 38 is a left side view of the foot or leg support assembly of FIG. 37 when the foot or leg support member is partially extended.
Figure 39:
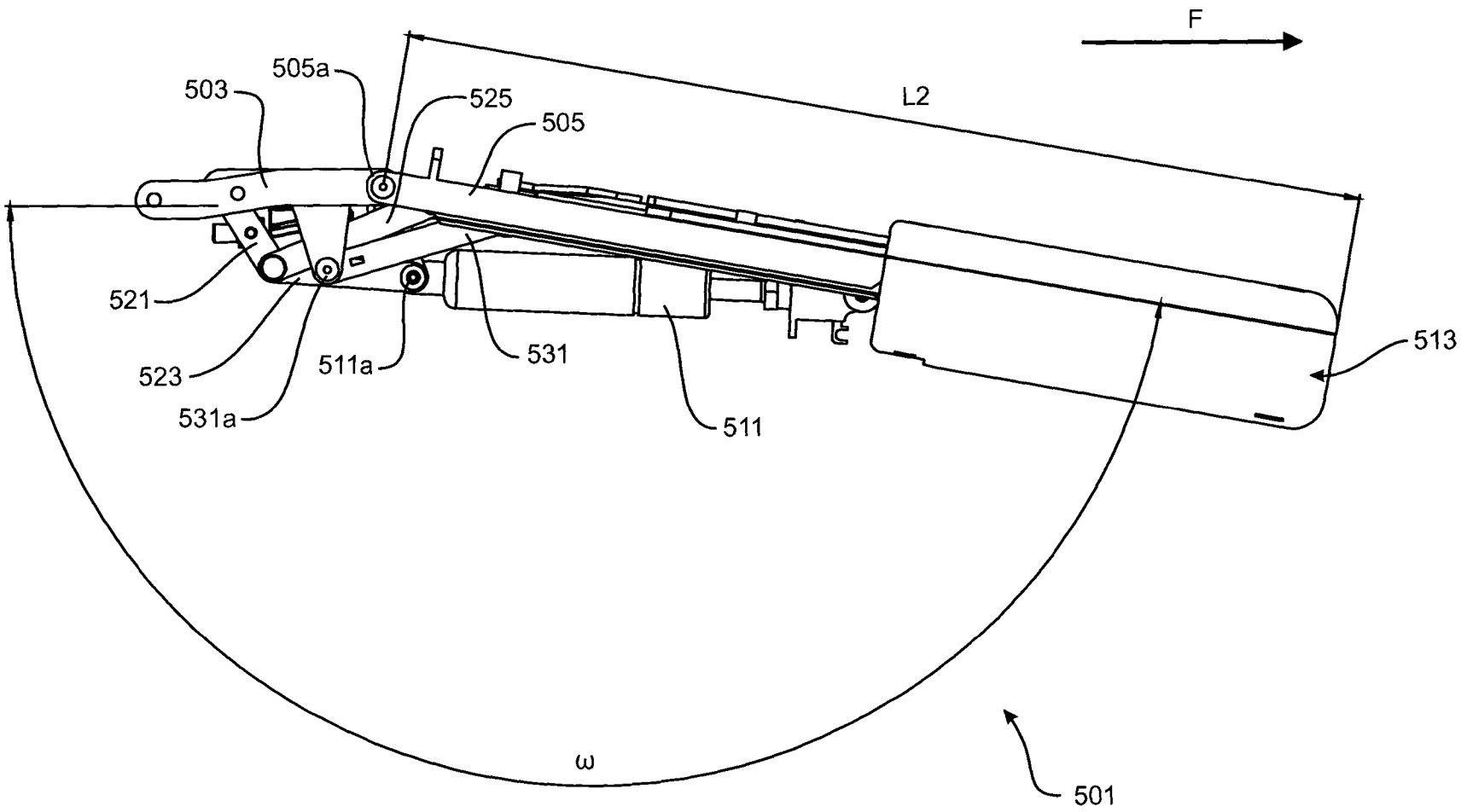
FIG. 39 is a left side view of the foot or leg support assembly of FIG. 37 when the foot or leg support member is extended.

The foot or leg support assembly 501 is movable between a deployed and extended position shown in FIG. 39 for supporting an occupant's feet or legs, and a retracted position shown in FIG. 37. FIG. 38 shows an intermediate position of the foot or leg support assembly 501 between the deployed and retracted positions. The foot or leg support assembly is mounted to the seat portion 101 of the chair via a mounting bracket 503 so that the foot or leg support assembly moves with the seat portion 101 when the seat is rocked and/or moved during recline of the back portion in embodiments having rocker or recline mechanisms as described above.

The foot or leg support assembly comprises a frame 505, an extension mechanism 509, an actuator 511 and a movable support portion 513 for receiving and supporting an occupant's feet or legs. The frame 505 is pivoted at a first end 505*a* to the mounting bracket 503 or directly to the seat portion 101 and configured to be pivoted about its first end by the actuator 511 which is preferably a gas spring. In the retracted position, the frame 505 is preferably angled rearwardly so that the angle co between the mounting bracket 503 and the frame 505 is about 60 degrees. That corresponds to a rearward angle of the frame 505 of about 30 degrees when the chair is upright and in its neutral rock position. As the frame 505 is pivoted outward toward the deployed position, the extension mechanism 509 is configured to move the moveable support portion 513 in a direction away from the first frame end, increasing the angle ω, to the extended position shown in FIG. 39. Preferably in the extended position, the angle ω between the mounting bracket 503 and the frame 505 is about 170 degrees. That corresponds to an angle of about 10 degrees below horizontal when the chair is upright and in its neutral rock position. The footrest extended to a position slightly below horizontal provides a more comfortable seating position than it would if it extended the entire way to horizontal.

As best seen in FIGS. 37 to 40 and 44 to 46, the gas spring 511 is operably connected at a first end 511*a* to the mounting bracket 503 via a linkage 520 and pivotally connected at a second end 511*b* to the frame 505. The foot or leg support may have a single linkage 520 having the components described below. Alternatively, there could be two spaced apart linkages 520, each having the components described below. The linkage 520 comprises three links 521, 523, 525 forming a four-bar linkage with the mounting bracket 503. A first link 521 is pivotally connected to the mounting bracket 503 at a pivot 521*a* that is co-linear with the frame 505 pivot 505*a*, a second link 523 is pivotally connected to the mounting bracket 503 at a pivot 523*a* spaced rearwardly from the first link pivot 521*a*. A third link 525 is pivotally attached to the first link 521 at a first pivot 525*a* and to the second link 523 at a second pivot 525*b*. The gas spring 511 is pivotally attached to the linkage at the pivot 525*a* between the first and third links 521, 525. A restrictor link 527 (FIG. 40) is pivotally attached at one end to the pivot 525*b* between the second and third links 523, 525 and pivotally attached at its opposite end to the frame 505. The frame 505 is pivotable outwardly about its first end 505*a* between the retracted position and the deployed position upon extension of the gas spring 511, and pivotable inwardly about its first end 505*a* between the deployed position and the retracted position upon compression of the gas spring 511. The restrictor link 527 pulls the linkage forward as the frame 505 pivots outwards, moving the pivoted end of the gas spring 511*a* forward.

The gas spring 511 may be selectively actuated at any frame 505 position via the user actuator 321. When the frame 505 is in the retracted position, actuation of the user actuator enables the foot or leg support assembly 501 to move from the retracted position to the deployed position.

The gas spring 511 is selectively released by an occupant using a user actuator 321 which is coupled to a gas spring release by a cable. FIGS. 37 and 39 show the frame 505 in the retracted and extended positions with the user actuator 321 released so there is no movement of the frame 505 relative to the seating portion. The frame can be stopped and positioned at any intermediate position between the transition position and the deployed position by an occupant releasing the user actuator 321.

To retract the foot or leg support assembly 501 from any position, a chair occupant must actuate the user actuator 321 and apply an inward force to the foot or leg support member, for example with their legs or feet. The linkage 520 controls the position of the first end 511*a* of the gas spring 511 so that the position of the first end 511*a* is a function of the position of the frame 505. Moving the position of the first end 511*a* of the gas spring 511 changes the ratio between the required gas spring extension or retraction to angularly displace the frame 505 a given amount.

Figure 43:
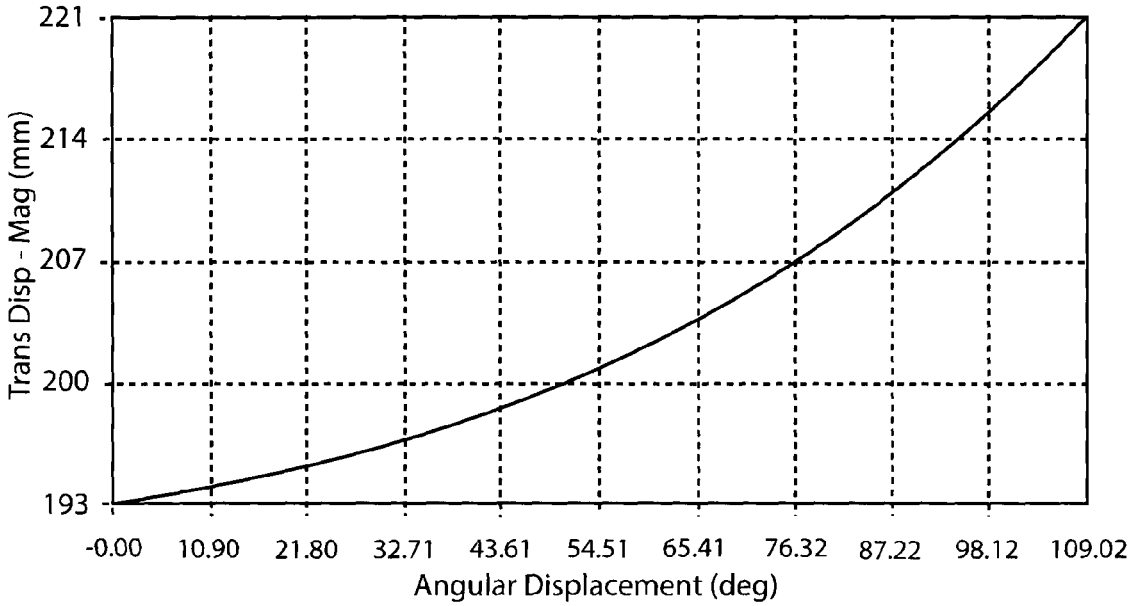
FIG. 43 is a chart showing the relationship between the gas spring extension required for various angular displacements of the foot or leg support frame for the foot or leg support assembly of FIGS. 37 to 42.

FIG. 43 shows the displacement of the gas spring 511 against the angular displacement of the frame 505. When the frame is substantially vertical (at 30 degrees forward of the fully retracted position), the magnitude of the gas spring 511 extension required to pivot the frame 505 outwards 5 degrees is less than the spring extension required to pivot the frame 505 outwards 5 degrees when the frame is 60 degrees forward of the retracted position, for example. This means that, when the foot or leg support 501 is being deployed, the user experiences a rising force rate as the foot or leg support rotates outwards, to assist the user in lifting their legs. The converse is also true. When the frame is substantially vertical, the amount the gas spring 511 must be compressed to pivot the frame 505 inwards 5 degrees is less than the amount the gas spring 511 must be compressed to pivot the frame 505 inwards 5 degrees when the frame is 60 degrees forward of the retracted position, for example. This means that as the foot or leg support assembly is moved back to the retracted position, the user needs to apply less force the closer the footrest is to the retracted position.

The moveable foot or leg support member 513 of the foot or leg support assembly 501 is arranged to slide relative to the frame 505 such that the foot or leg support assembly 501 is extendable from an initial length L1 to an extended length L2. The extension mechanism 509 is configured to slide the moveable support member in a direction away from the first frame end 505*a*, to an extended position as the frame is moved from the retracted position to the deployed position by the gas spring 511. This sliding of the support member causes the support member to follow an arc similar to the arc through which an occupant's lower legs or feet move as the occupant moves them outward. This results in less 'trouser pull' which is the result of relative movement between a support portion and an occupant's legs or feet as a foot or leg support is deployed.

Figure 40:
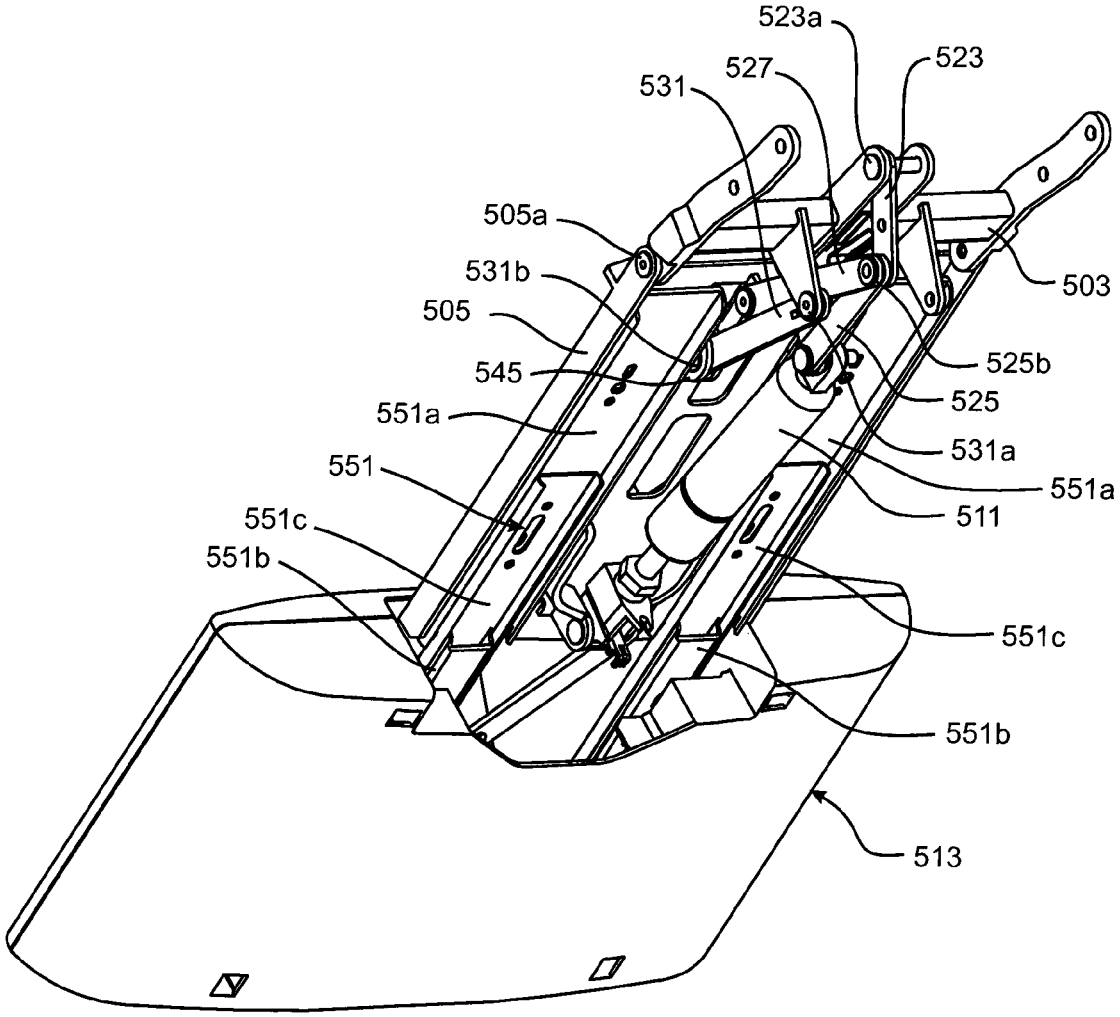
FIG. 40 is an underside perspective view of the underside of the foot or leg support assembly of FIG. 37 in an extended position.
Figure 41:
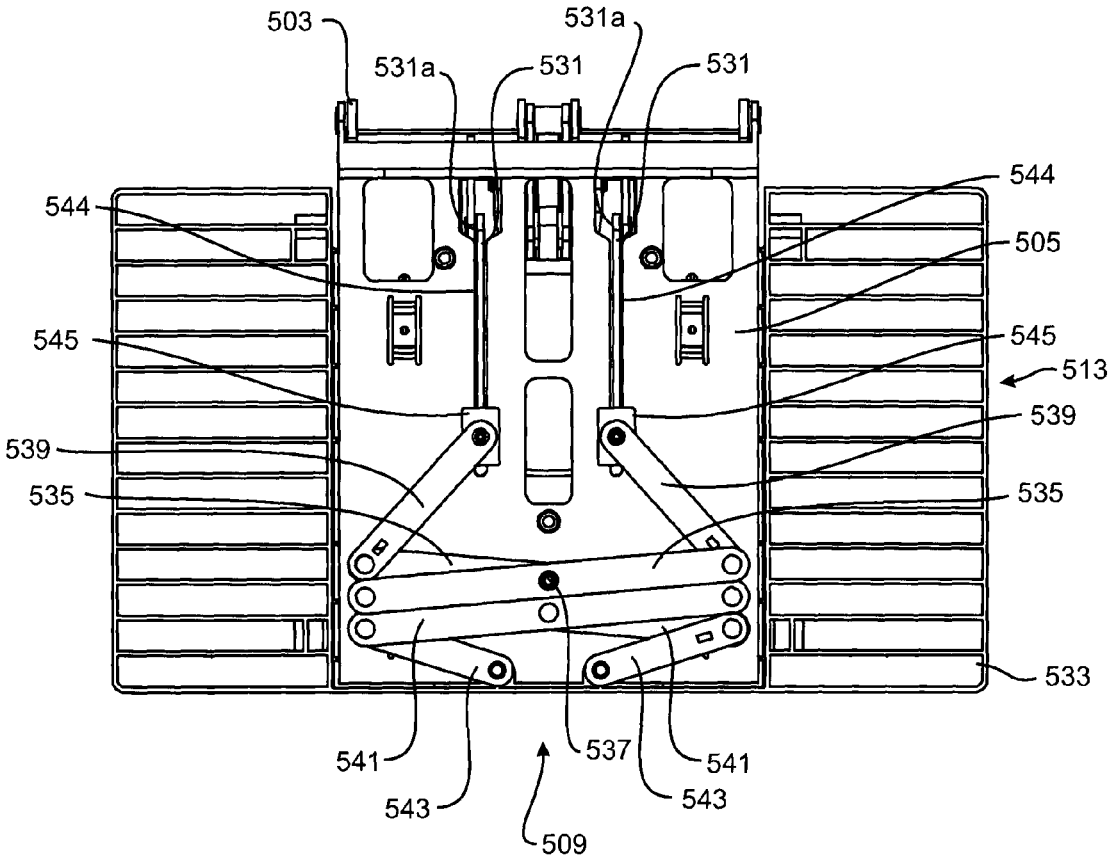
FIG. 41 is an elevation view normal to the support frame of part of the foot or leg support assembly of FIG. 37 in an un-extended position.
Figure 42:
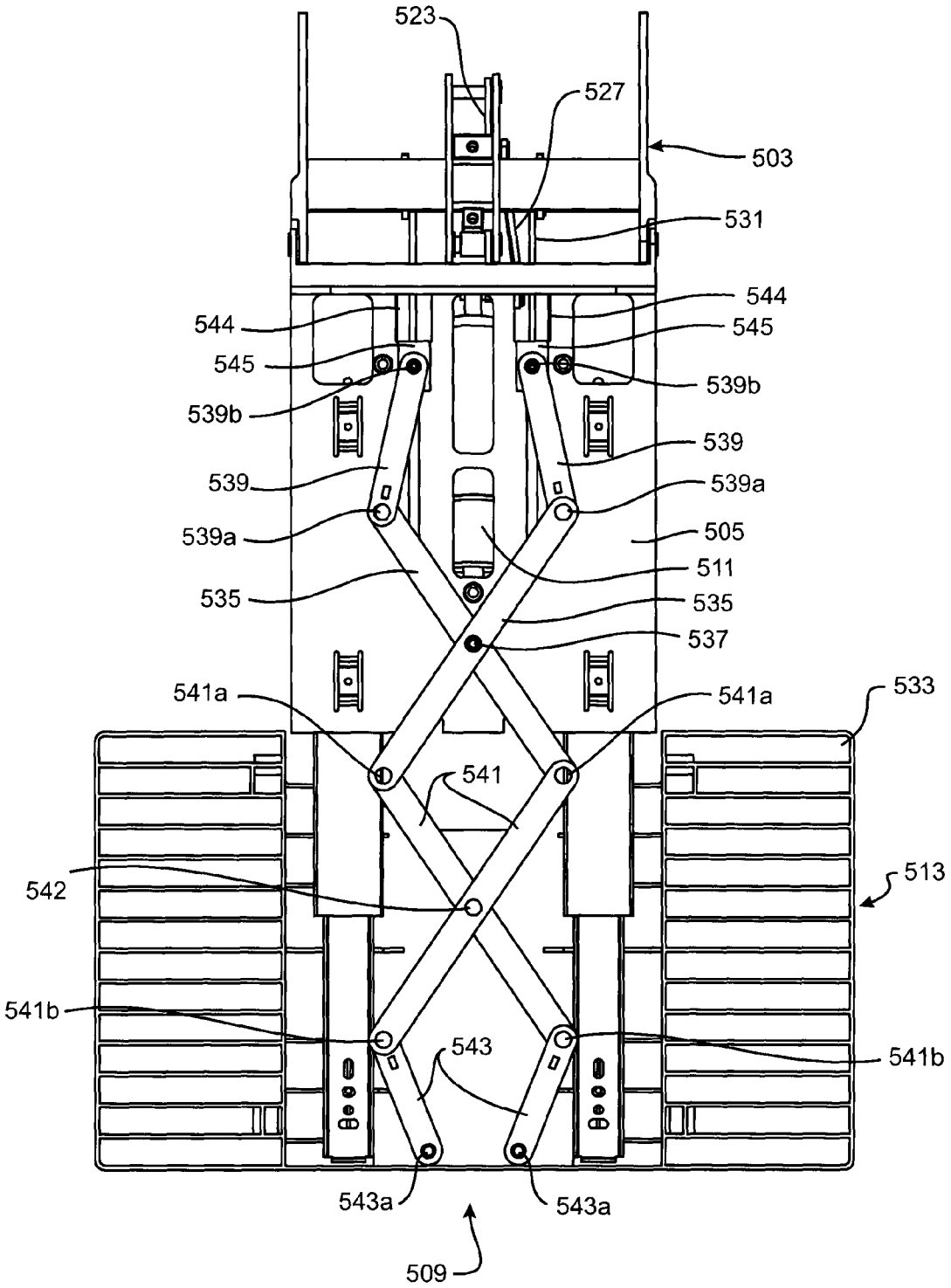
FIG. 42 is a view normal to the support frame of part of the foot or leg support assembly of FIG. 37 in a fully extended position.

Referring to FIGS. 40 to 42, the extension mechanism 509 comprises two drag links 531, a support portion frame 533 that forms part of the movable support member 513, and a linkage arrangement operatively connected between the drag links 531 and the support portion frame 533. The drag links 531 are pivotable about respective first pivots 531*a* spaced below and rearward of the frame pivot 505*a*, and each have an end 531*b* that is slidable relative to the frame 505. The linkage arrangement further comprises two driving links 535 pivoted to the frame 505 at a fixed pivot 537 spaced from the first frame end 505*a* (and preferably at or towards the opposite end of the frame 505 as shown), two drag connecting links 539 each having a first end 539*a* pivotally connected to a respective driving link 535 and a second end 539*b* that is pivotable relative to the slidable end 531*b* of a respective drag link 531 and arranged to slide relative to the frame 505 with the slidable end of the respective drag link 531, and a scissor linkage. The scissor linkage comprises two support connector links 543 each pivotally connected to the movable support portion frame 533, and two main links 541. The main links 541 each comprise a first end 541*a* pivoted to a respective driving link 535 and a second end 541*b* pivoted to a respective support connector link 543. The two main links 541 are pivotally connected to each other at a pivot 542 intermediate their first and second ends 541*a*, 541*b*. The pivot 542 is movable relative to both the frame 505 and the support portion 513.

In a preferred embodiment, the slidable end 531*b* of each drag link 531 is pivotally connected to a sliding block 545. Slots 544 are positioned on opposite sides of the centre of the frame 505, and the sliding blocks 545 are each configured to slide longitudinally in a respective slot 544. The second end 539*b* of each frame connector link 539 is pivotally connected to a respective sliding block 545 about a pivot that is transverse to the pivots between the drag links 531 and sliding blocks 545, such that each pivot slides relative to the frame 505 with the slidable end of the respective drag link 531 and sliding block 545.

FIG. 41 shows the foot or leg support assembly 501 and extension mechanism 509 in an unextended position. This position corresponds to a substantially vertical frame position when the chair is in an upright and neutral rock position. When the frame 505 is pivoted by the gas spring 511 from the position shown in FIG. 37 toward the deployed position shown in FIG. 39, the slidable ends 531*b* of the drag links 531 move toward the first end of the frame 505*a* and the support portion frame 533 moves toward the extended position, as shown in FIG. 42.

In the embodiment shown in FIGS. 40 to 42 the moveable support member 513 is slidably mounted to the frame 505. In the form shown, the support member 513 is mounted to the frame 505 via a slide assembly 551. The slide assembly comprises a first part 551*a* fixed to the frame 505, a second part 551*b* fixed to the support member 513, and a floating part 551*c* slidably attached to both the first and second parts 551*a*, 551*b*. In an alternative embodiment, the foot or leg support assembly may comprise two slidable extension members, slidably attached to the frame, with the movable support portion 513 slidably mounted to the extension members. The extension members could be slidable via slots in the frame sides, and guide features on the extension members, or via slots or channels on the extension members and corresponding guide features on the frame 505, for example. In such an embodiment, the slidable extension members would be pulled outwardly along to the frame 505 as the moveable support member 513 is moved to the extended position. The support member 513 or support member frame 533 may have features on its underside to catch the extension members to slide them outward as the support member 513 is extended, allowing the support member 513 to be supported beyond the end of the frame 505 in the extended position. Springs acting between the frame 505 and the extension members may be used to retract the slides as the support member 513 retracts.

The single user actuator 321 controls all of the outward pivoting of the frame 505, inward pivoting of the frame 505, and extension and retraction of the support member 513 relative to the frame 505.

Other than the drag links 531, the components of the extension mechanism 509 all move in a plane substantially corresponding to that of the frame 505. That configuration enables a low profile support assembly to be provided. The sliding of the support member 513 as the frame 505 is pivoted outwardly and inwardly means that the support member 513 can stay in an approximately fixed position relative to an occupant's feet or legs, improving comfort and reducing wear on clothing.

The above describes only one preferred form extension mechanism 509. Alternative linkage arrangements may be used to push or pull the movable support member 513 relative to the frame 505 as the frame 505 is pivoted inwards or outwards. In an alternative embodiment, the actuator 511 could be provided in a foot or leg support assembly that doesn't have an extension mechanism. In another alternative embodiment, rather than a gas spring, an alternative actuator, for example a powered actuator, could be used to deploy and retract the foot or leg support assembly 501.

The foot or leg support assembly could be incorporated into other types of chairs that may or may not have recline mechanisms or rocking mechanisms. In embodiments that do not have rocking mechanisms, the frame 505 may instead be pivotally mounted to a main transom rather than to the seat portion.

Because the foot or leg support member 513 of the preferred embodiment can retract to a rearwardly angled position beneath the seat portion of a chair, an occupant can more easily egress the chair than would be the case if the foot or leg support only retracted to a vertical position. An occupant can place their feet flat on the ground partly beneath the seat portion to stand up. In an alternative embodiment, the foot or leg support may comprise a switch and gas spring arrangement that avoids the need of the occupant applying rearward force to fully retract the support member past the vertical position.

Figure 44:
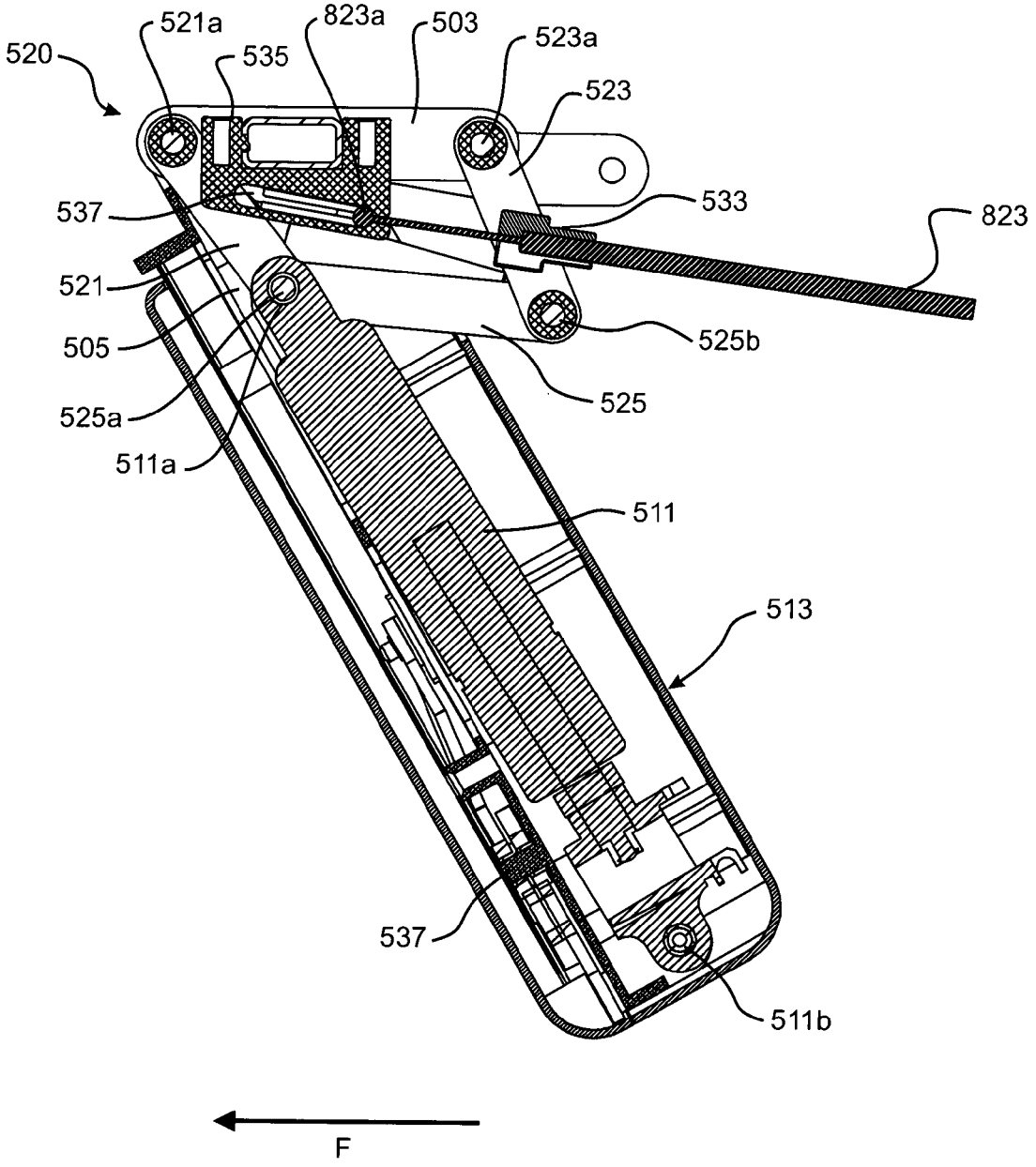
FIG. 44 is a section view taken through a centreline of the foot or leg support assembly when the foot or leg support member rest is retracted
Figure 45:
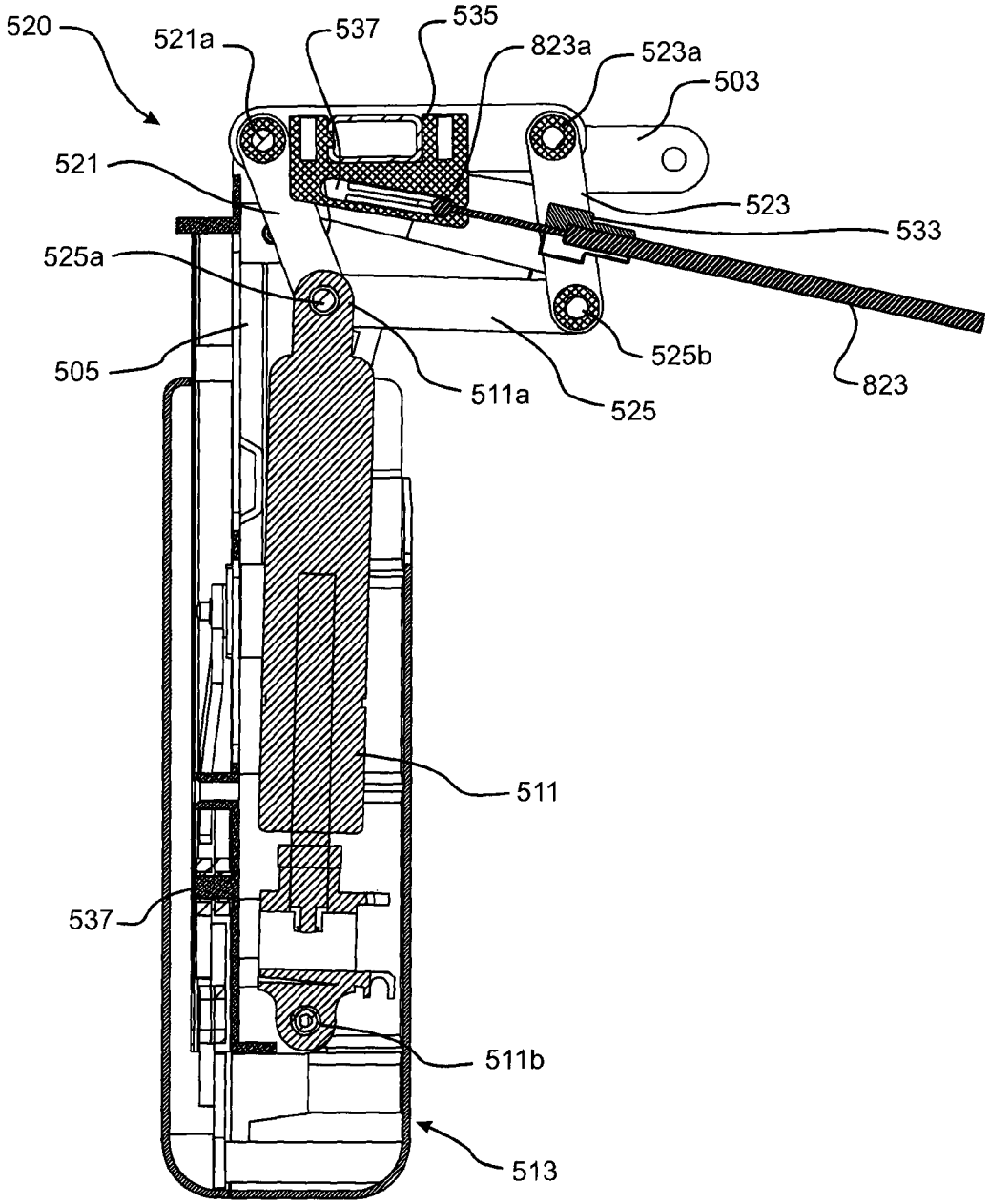
FIG. 45 is similar view to FIG. 44, but with the foot or leg support member in a substantially vertical position when the chair is upright.
Figure 46:
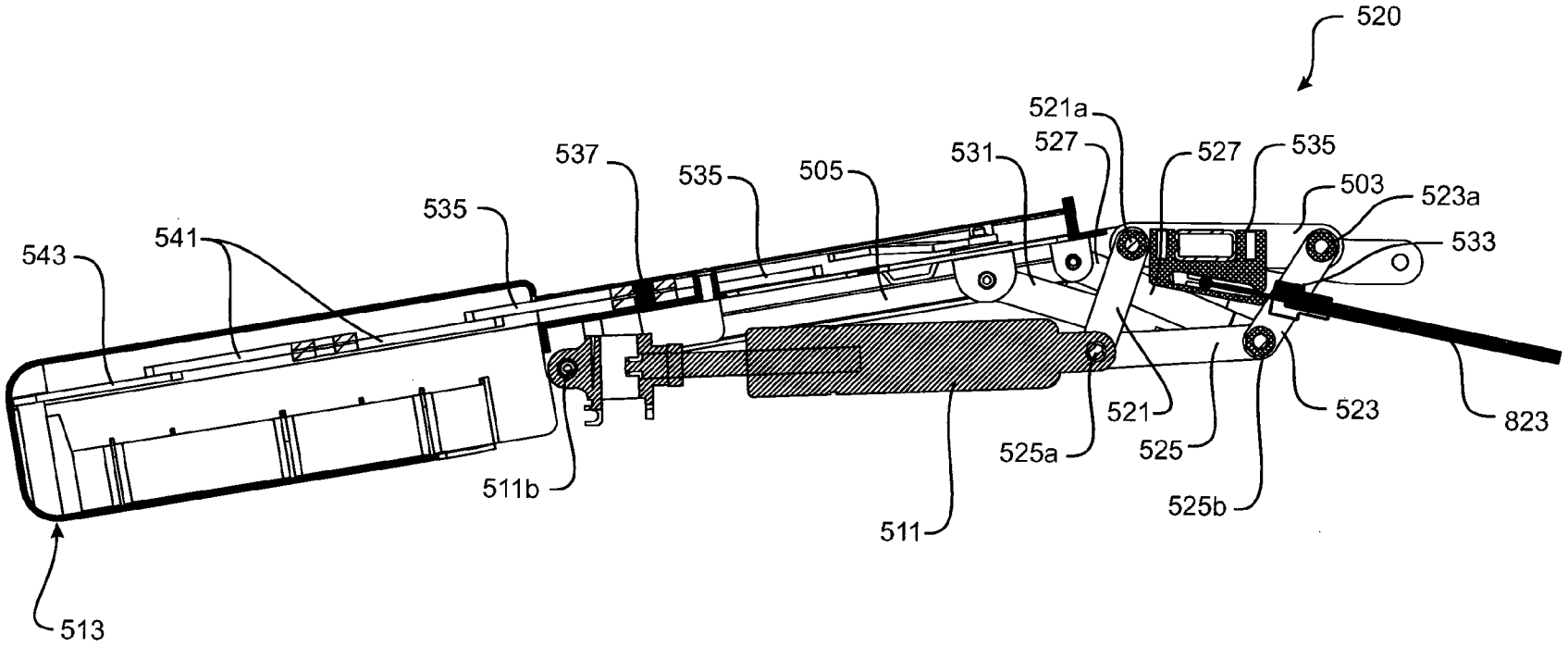
FIG. 46 is similar view to FIGS. 44 and 45, but with the foot or leg support member fully extended.
Figure 47:
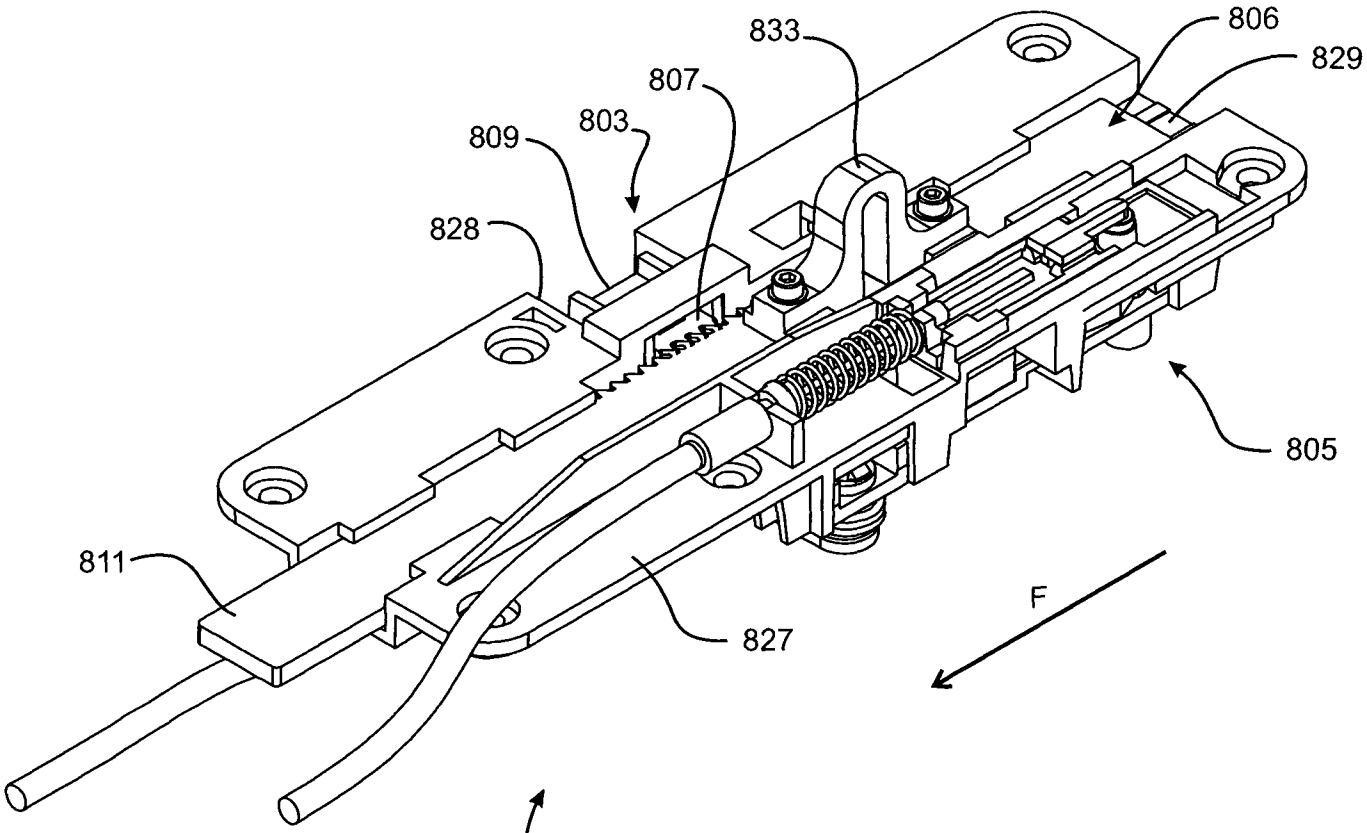
FIG. 47 is an overhead front perspective view of a rocking inhibitor arrangement comprising an anti-rock ratchet assembly to inhibit forward rocking of the intermediate support when the foot or leg support is extended and a lock assembly to selectively lock the rock of the seat independent of the position of the foot or leg support, in a configuration where the foot or leg support is extended and forward rocking is prevented.
Figure 48:
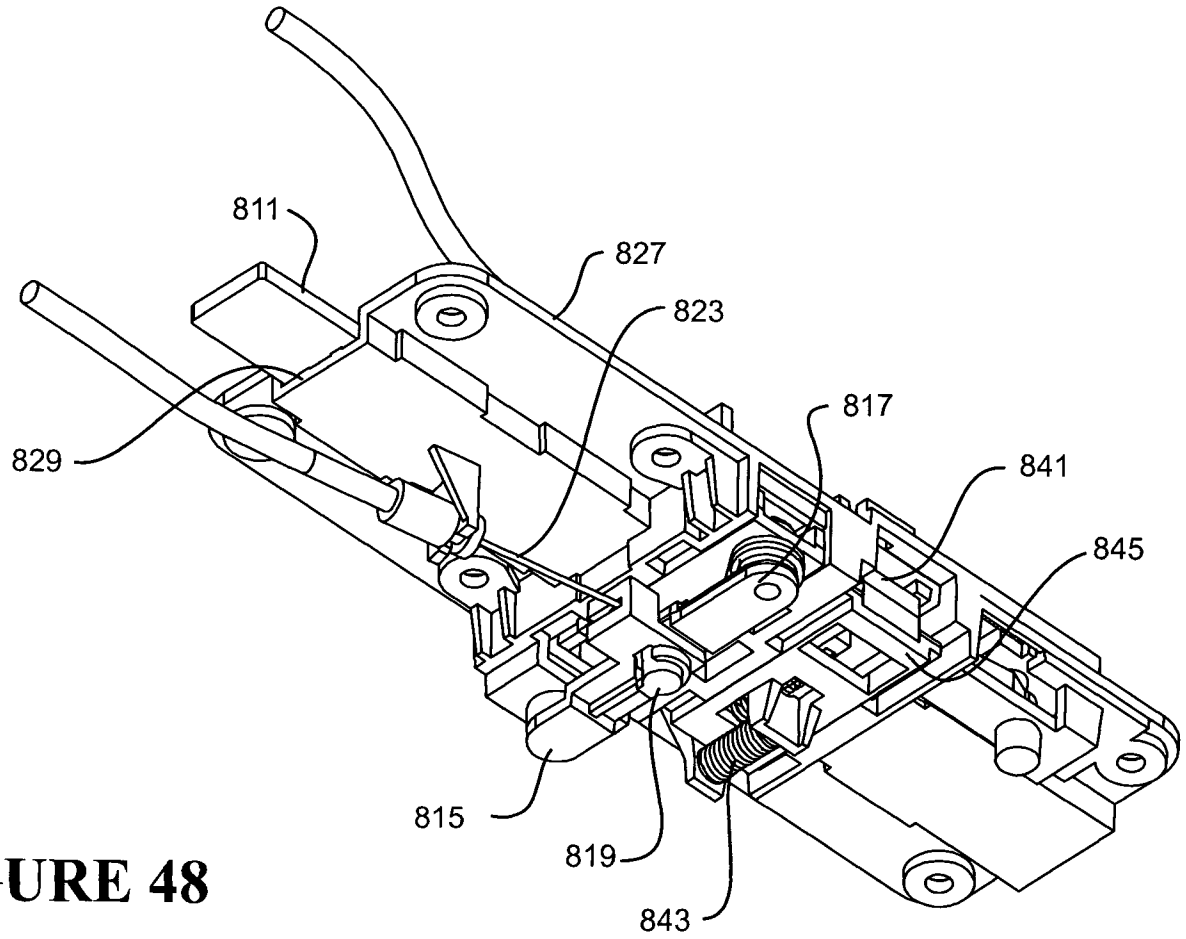
FIG. 48 is a perspective view corresponding to FIG. 47 of the underside of the rocking inhibitor arrangement of FIG. 47.
Figure 49:
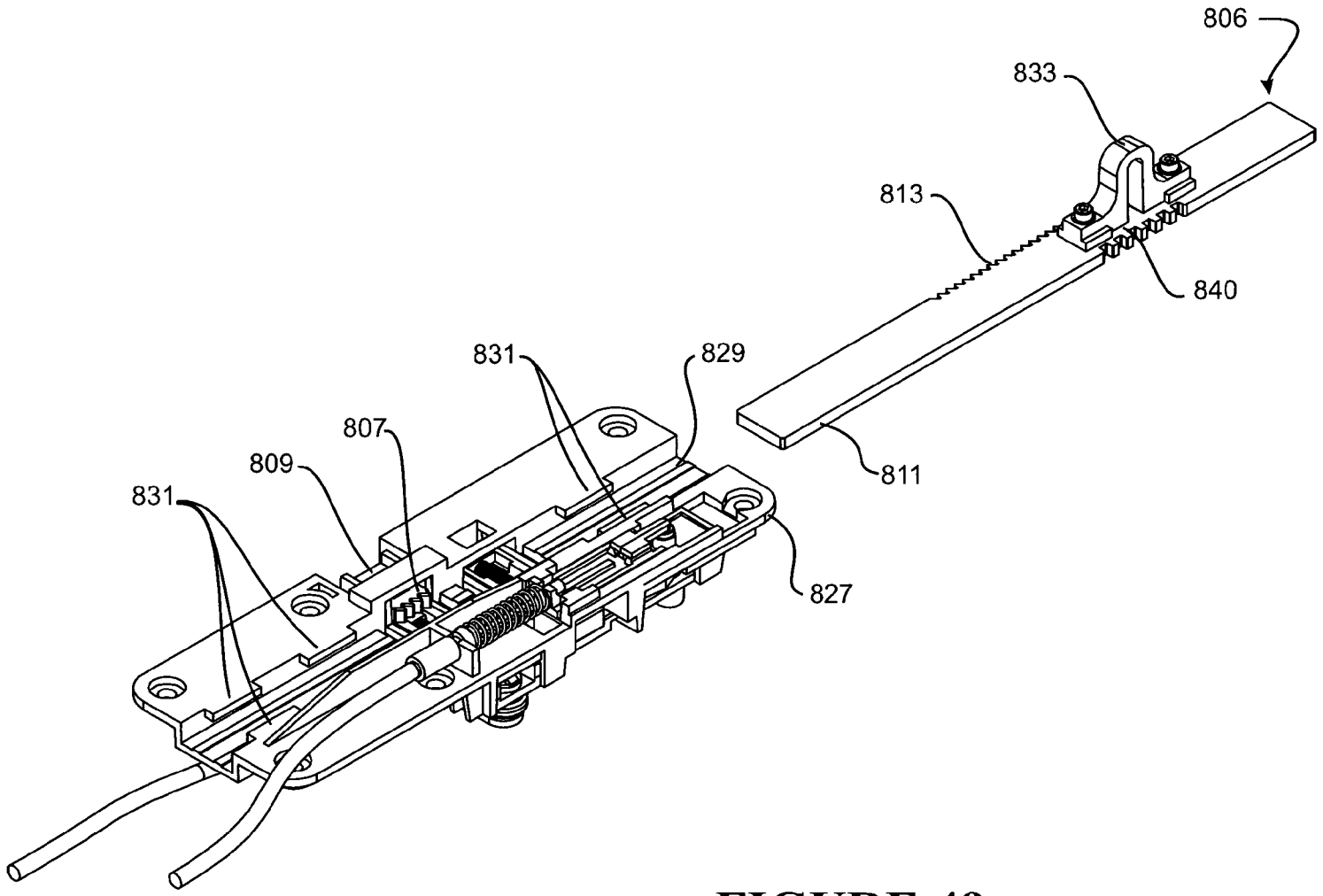
FIG. 49 is a partially exploded perspective view of the rock inhibitor arrangement of FIG. 47, showing the central slide member removed.

FIGS. 44 to 46 show an arrangement 533, 535 coupling the movement of the foot of leg support assembly 501 to a rocking inhibitor arrangement to prevent forward rocking of the chair when the foot or leg support is deployed. This arrangement is discussed further below in relation to the rocking inhibitor.

Rocking Inhibitor

Referring to FIGS. 47 to 57, the chair comprises a rocking inhibitor arrangement 801 to inhibit forward rocking of the intermediate support 21 relative to the main transom 15 when the foot or leg support assembly 501 is extended and to selectively lock forward and rear rocking of the intermediate support 21 independent of the position of the foot or leg support assembly 501. The rocking inhibitor arrangement 801 comprises a mounting member 827 for mounting to the transom 15, an optional anti-rock ratchet assembly 803, a rock lock assembly 805, and a slide assembly 806 connected to the intermediate support 21 and comprising a slide member 811 slidably mounted to the main transom.

Figure 50:
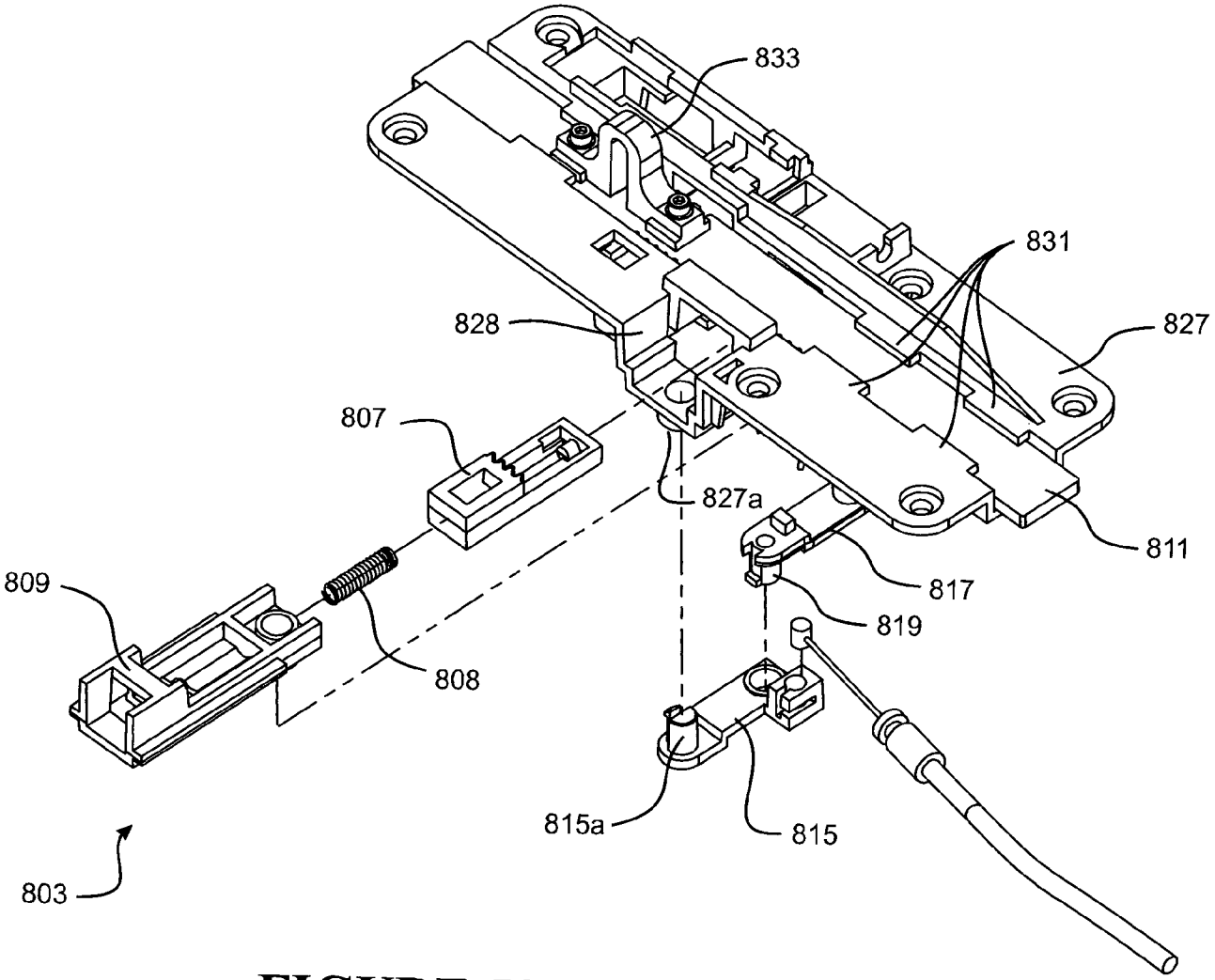
FIG. 50 is an overhead exploded perspective view of the anti-rock ratchet assembly of the rock inhibitor arrangement of FIG. 47.
Figure 51:
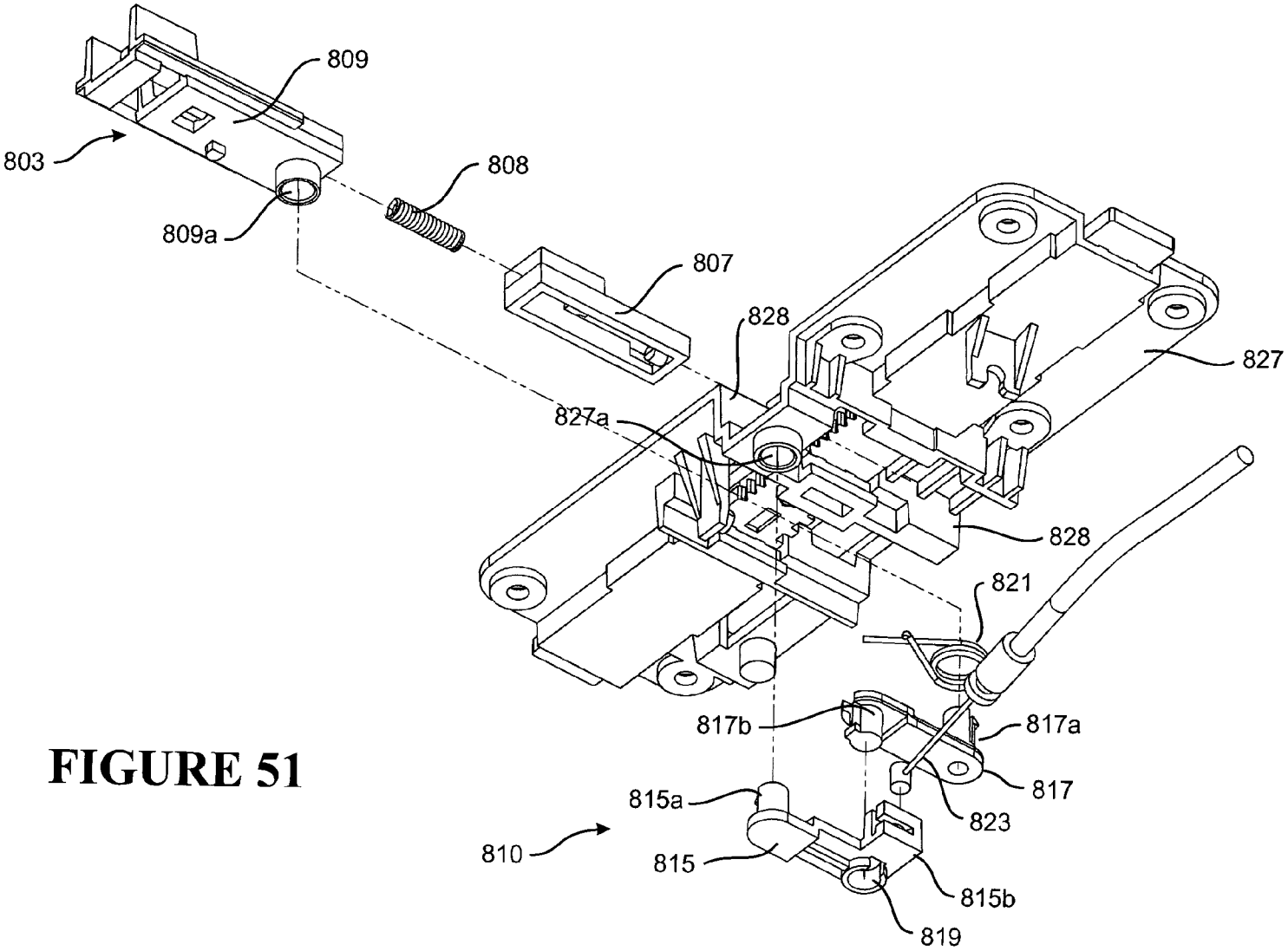
FIG. 51 is an underside exploded perspective view of the anti-rock ratchet assembly of FIG. 50.

Referring to FIGS. 50 and 51, the anti-rock ratchet assembly 803 comprises a carriage 809 transversely slidable relative to the mounting member 827, a ratchet pawl 807 carried by the carriage 809 and slidable relative to the carriage 809 and transversely slidable relative to the mounting member 827 and slide member 811. A series of ratchet teeth 813 are formed on the slidable member 811 of the slide assembly 806, for engaging with teeth on the ratchet pawl 807. The ratchet pawl 807 is slidable transversely relative to the slidable member 811 between an outward disengaged position and an engaged position. The anti-rock ratchet assembly 803 is configured to automatically engage to inhibit forward rocking of the intermediate support 21 when the foot or leg support assembly 501 is extended, and to automatically disengage to allow forward rocking of the intermediate support when the foot or leg support assembly is retracted.

The central slide member 811 of the slide assembly 806 is slidably mounted to the mounting member 827 via a guide channel 829 in the mounting member. Guide features 831 in the form of inwardly protruding tabs retain the slide member 811 in the channel 829. A connecting member 833 is attached to the central slide member 811 and connected to the intermediate support 21 which rocks relative to the transom and mounting member 827 as the chair is rocked. The connecting member 833 may be integral with the central slide member 811, or alternatively, the central slide member 811 may be directly connected to the intermediate support 21, such as via a pivot connection.

The anti-rock ratchet assembly 803 comprises an actuation assembly 810, shown in exploded form in FIG. 51, operatively connected to the foot or leg support 501. The actuation assembly 803 comprises a first actuation link 815 having a first end 815*a* pivotally connected to the mounting member 827 at pivot 827*a* towards one side of the mounting member 827, and a second actuation link 817 having a first end 817*a* pivotally connected to the carriage 809 at a pivot 809*a* towards the opposite side of the mounting member 827. A second end 815*b* of the first link 815 is pivotally attached to the second end 817*b* of the second actuation link 817 at a central pivot 819. A biasing member 821 in the form of a torsion spring is positioned between the mounting member 827 and the pivot 809*a* between the carriage 809 and second actuation link 817 to bias the first end 817*a* of the actuation link outwards and the carriage 809 and pawl 807 inwards towards the slide member 811 and therefore the pawl 807 into engagement with the ratchet teeth 813.

Figure 52B:
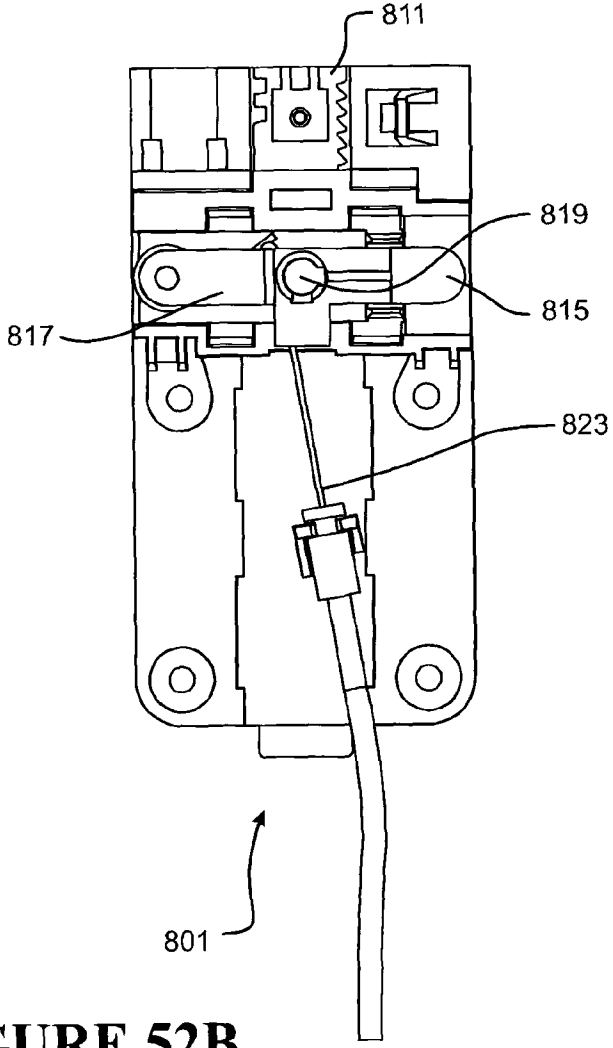
FIG. 52B is a view corresponding to FIG. 52A, but in a configuration where the foot or leg support is extended and forward rocking is prevented.
Figure 52A:
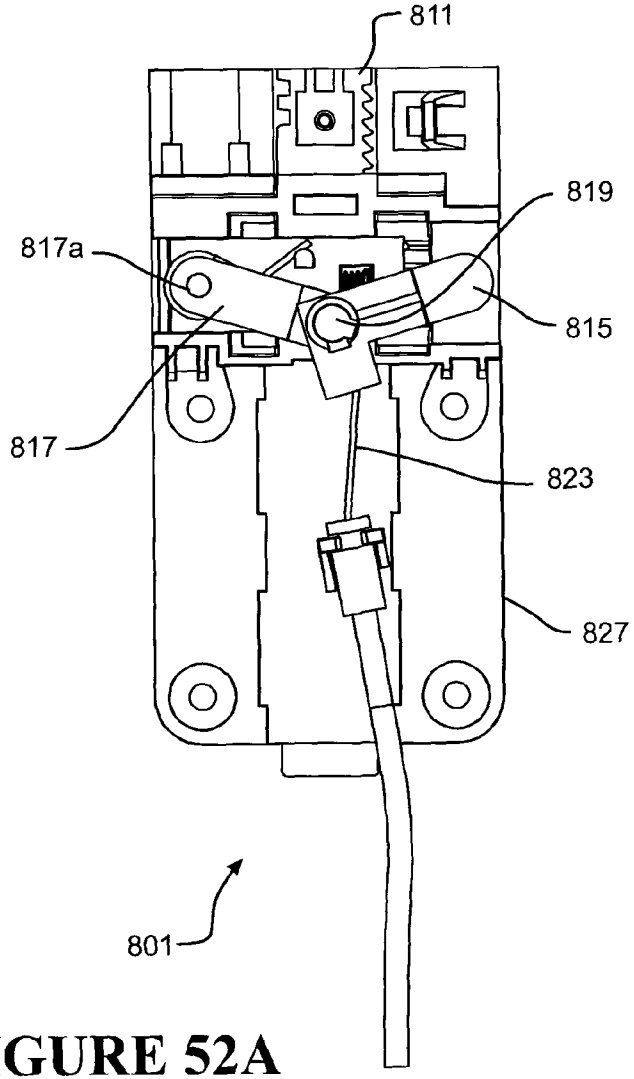
FIG. 52A is a bottom view of the anti-rock ratchet assembly of the rocking inhibitor arrangement of FIG. 47, in a configuration where the foot or leg support is retracted and forward rocking is enabled.

A cable 823 is operatively connected to the actuation links 815, 817 at the central pivot 819. As shown in FIG. 52A, pulling the cable pulls the central pivot 819 forward, moving the first end 817*a* of second actuation link 817 inwards and the carriage 809 and ratchet pawl 807 outwards and out of engagement with the ratchet teeth 813. As shown in FIG. 52B, releasing the cable tension reverses this action, allowing the first end 817*a* of second actuation link 817 to move outwards under the bias of biasing member 821 and the carriage 809 and ratchet pawl 807 to move inwards, and back into engagement with the ratchet teeth 813. The cable 823 is operatively attached to the foot or leg support 501.

FIG. 52A shows the actuation assembly 810 in a first, disengaged mode of the anti-rock ratchet assembly 803 in which the foot or leg support assembly 501 is retracted and the chair is free to rock. In the first mode, the anti-rock ratchet pawl 807 is in its disengaged position. The retracted foot or leg support 501 tensions the cable, pulling the actuator into the disengaged position shown. The slide assembly 806 is free to move with the seat portion of the chair as it rocks.

FIG. 52B shows the actuation assembly 810 in a second, engaged mode of the anti-rock ratchet assembly 803 in which the foot or leg support assembly has been at least partially deployed. As the foot or leg support is moved outward from its retracted position, a member that is operatively connected to the foot or leg support acts on the cable 823. That reduces the tension in the cables 823, so that the first biasing spring 821 causes the carriage 809 to move inwards, allowing the actuation arrangement 810 to move into the second, engaged mode shown. Preferably, the actuator arrangement 810 is moved into the second mode when the foot or leg support 501 reaches an approximately vertical position or is moved slightly forward of vertical, and teeth on the ratchet pawl 807, are biased into engagement with teeth 813 on the slide member 811.

Figure 53C:
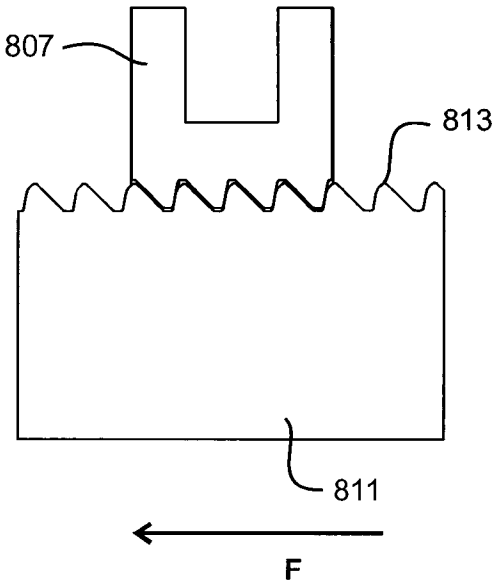
FIG. 53C is a view corresponding to 53B but with the seat portion rocked slightly forward of the position of FIG. 53B, with the ratchet and pawl teeth fully engaged to prevent forward rocking.
Figure 53B:
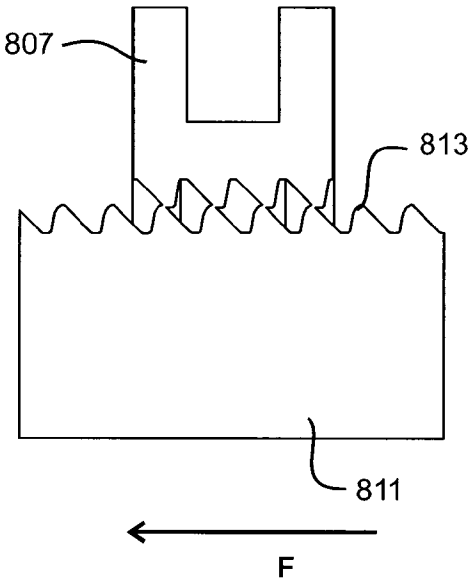
FIG. 53B is a view corresponding to 53A but with the seat portion rocked slightly forward of the position of FIG. 53A, with the ratchet and pawl teeth partly engaged.
Figure 53A:
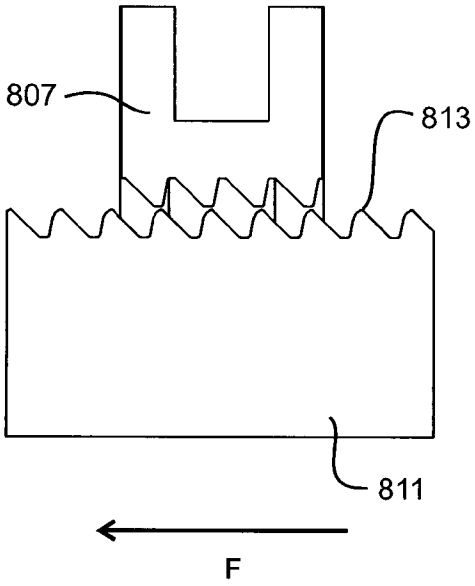
FIG. 53A is an enlarged plan view of the engagement teeth of the anti-rock ratchet assembly of FIG. 47 when the foot or leg support has been extended but the teeth on the pawl and ratchet are not aligned and engagement of the teeth is delayed by a biasing device.

As can be seen from FIGS. 50 and 51, a second biasing member 808 in the form of a compression spring is positioned between the pawl 807 and the carriage 809 and biases the ratchet pawl 807 inwards relative to the carriage 809, towards the slidable member 811 and teeth 813. When the carriage 809 is in the engaged position of the second mode, the ratchet pawl 807 is biased into engagement with the ratchet teeth 813. When the anti-rock ratchet assembly is configured to the second mode, if the teeth of the ratchet pawl 807 and the teeth 813 of the slide member 811 and misaligned as shown in FIG. 53A, the ratchet pawl is not forced into engagement but is biased towards the teeth by biasing member 808. The ratchet pawl 807 will then move to engage the teeth 813 of the slide member 811 upon slight forward or rearward sliding of the slide member 811 aligning the teeth as shown in FIGS. 53B and C. In the second mode, the ratchet pawl 807 can slide outwards relative to the carriage to allow the slide assembly 806 to slide only rearward relative to the transom. Forward rocking of the chair while the foot or leg support 501 is forward of the seat is disabled, preventing the chair from tipping forward due to the weight of the foot or leg support, but still allowing the seat to be rocked rearwardly.

When the foot or leg support is being retracted, the actuator arrangement and anti-rock ratchet assembly 803 is returned to the first mode when the foot or leg support 501 is moved to slightly forward of vertical or a vertical position as it is being retracted.

Referring to FIGS. 44 to 46, the anti-rock ratchet actuating cable 823 is operatively connected to the foot or leg support assembly 501 by a cable connector arrangement. The cable connector arrangement comprises a moulded housing 535 fixed to the mounting bracket 503 or an underside of the seat portion and a cable connector 533 fixed to the second link 523 of the linkage 520 supporting the gas spring 511. The housing 535 contains a channel, slot or cavity 537 with an aperture at its rearmost end. An end 823*a* of the cable 823 extends through the aperture and is free to slide in the channel, slot or cavity 537 as the foot or leg support frame 505 pivots. A cable connector 533 attaches the sheath of the anti-rock ratchet cable 823 to the second link 523 of the linkage 520. When the foot or leg support 501 is in an extended position as shown in FIG. 46, the second link 523 and therefore the cable connector 533 is close to the moulded housing 535 allowing the cable end 823*a* to slide forward in the housing 535, such that no tension is being applied to the cable 823 and therefore, the anti-rock ratchet assembly is biased into its locked position.

When the foot or leg support 501 is retracted, the second link 523 and therefore the cable connector 533, is moved away from the moulded housing 535. That pulls the cable end 823*a* rearward in the housing 535. When the foot or leg support 501 reaches a vertical orientation, as shown in FIG. 45, the end of the cable 823*a* is positioned at the rearmost position in the channel, slot or cavity 537.

As the foot or leg support 501 is retracted further, towards the position shown in FIG. 44, the second link 523 and therefore the cable connector 533 continues to be moved away from the moulded housing 535. An enlarged portion or pin on the end of the cable end 823*a* prevents the cable from being pulled through the aperture and out of the housing 535, instead tensioning the cable 823, pulling the central pivot 819 in the anti-rock ratchet assembly forward to unlock the forward rock. The foot or leg support assembly maintains the anti-rock ratchet assembly 501 in this unlocked configuration as long as it is retracted behind the generally vertical orientation (when the chair is upright).

Figure 54:
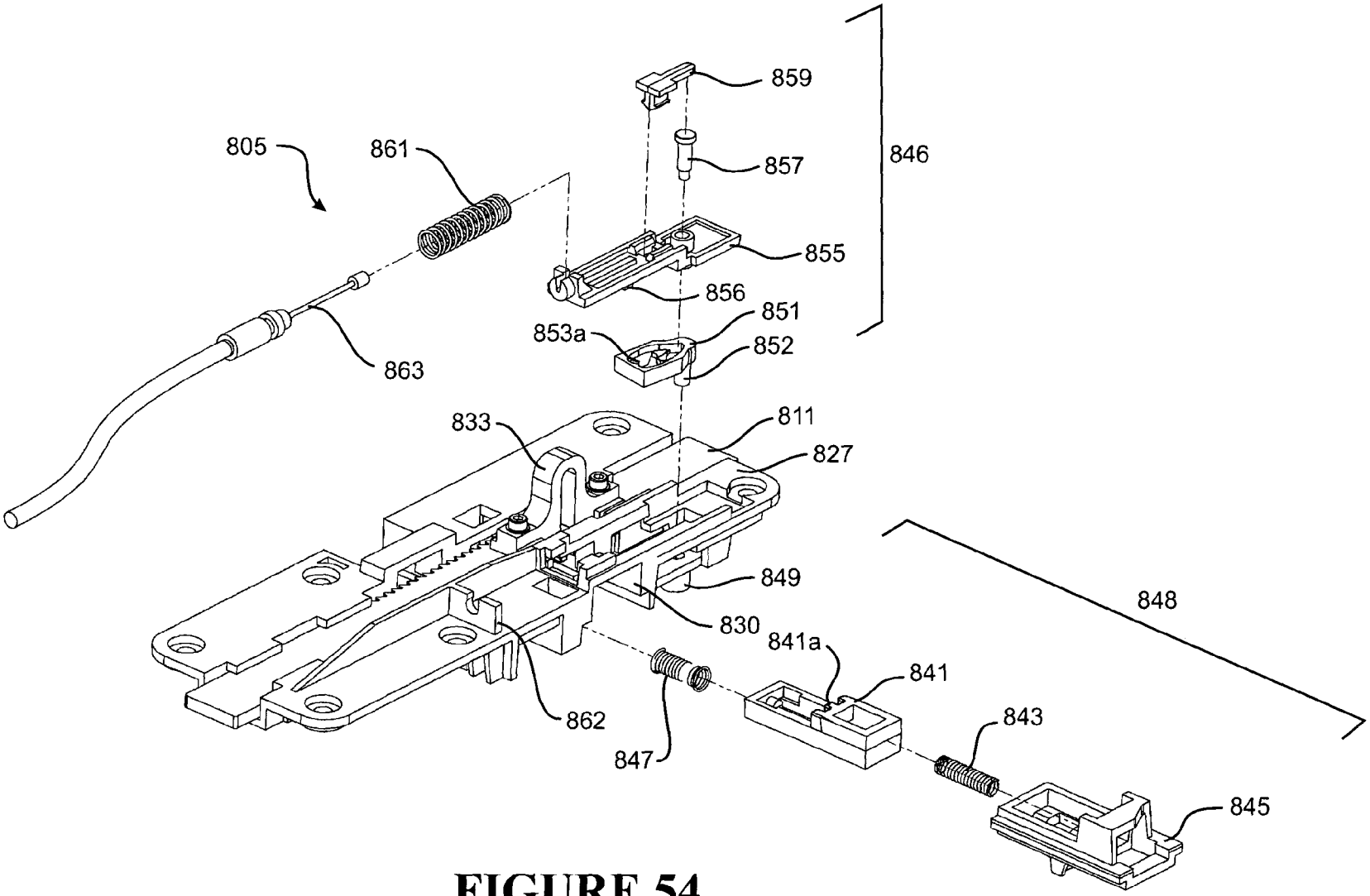
FIG. 54 is an overhead exploded perspective view of the lock assembly of the rock inhibitor arrangement of FIG. 47.

The rock lock assembly 805 is shown in exploded form in FIG. 54. The rock lock 805 comprises a detent assembly 846 which is operatively connected to and actuates a locking assembly 848. The locking assembly comprises a lock carriage 845 transversely slidable in a channel 830 in the mounting member 827, a lock member 841 carried by the lock carriage 845 and which is slidable relative to the lock carriage 845, and the slide member 811. One side of the slide member 811 comprises square lock teeth 840. The lock member 841 comprises complementary square lock teeth 841*a* that are engageable with the slide member square lock teeth 840 to prevent forward and rearward sliding of the slide member 811 and rocking of the chair. Alternatively, the teeth 840, 841*a* could be different shapes.

In the locking assembly, 848, a lock biasing member 843 is positioned between the lock carriage 845 and the lock member 841, biasing the lock member 841 towards the slide member 811. The lock carriage 845 is biased outwards, away from the slide member 811 by a carriage biasing member 847 positioned between a projection on the lock carriage 845 and a projection on the mounting member 827.

The detent assembly 846 comprises a detent pawl 851 pivotally mounted on the mounting member 827, a slidable pin carrier 855 slidably mounted on the mounting member 827, and a detent pin 857 protruding downwardly from the pin carrier. A biasing member comprising a spring 861 is positioned between the pin carrier 855 and a protrusion 862 on the mounting member 827 to bias the pin carrier rearwardly. A cable 863 is operatively connected to a front end of the pin carrier 855 and to a paddle (not shown) or lever for actuation by a user to lock and unlock the rocking of the chair.

Figure 55B:
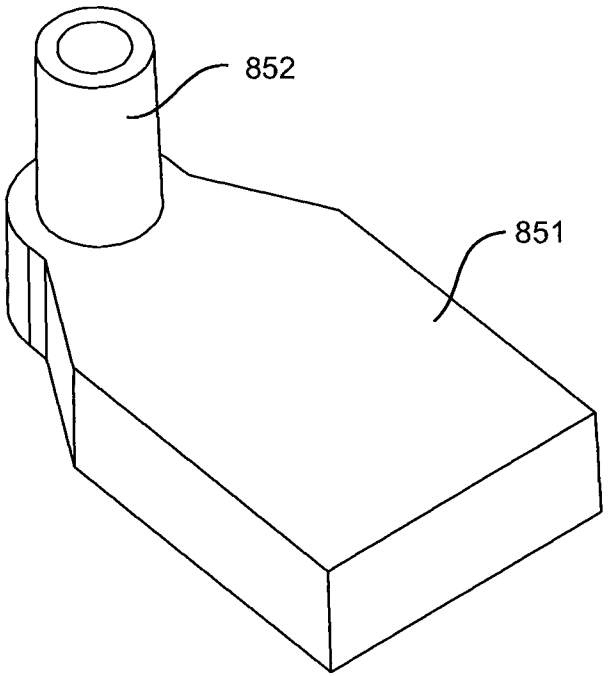
FIGS. 55A and B are top and bottom perspective views respectively of the rock lock detent pawl.
Figure 55A:
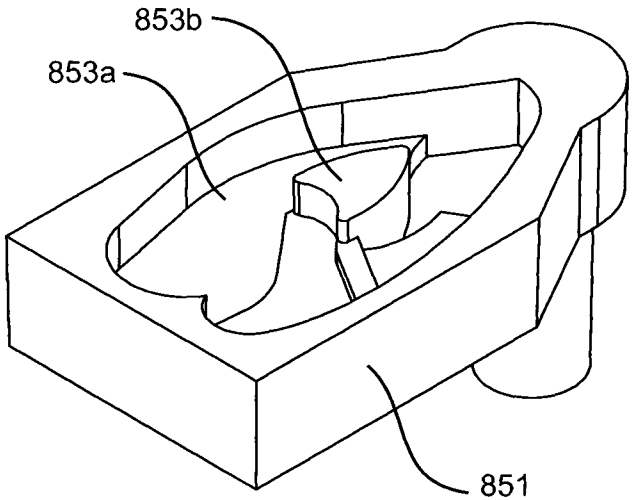

The detent pawl 851 is shown in FIGS. 55A and B. The detent pawl 851 is pivotally attached to the mounting member 827 through an aperture 849 in the mounting member about an off-centre pivot 852. A heart-shaped groove 853*a* on the top surface of the pawl 851 receives the detent pin 857. The groove 853*a* has a central projection 853*b* and a stepped surface to guide the pin 857 in the groove 853*a*. A resilient member 859 (FIG. 54) movably connects the detent pin 857 to the pin carrier 855 to enable some up and down movement of the pin 857, biasing the pin downwardly towards the surface of the groove so that the pin contacts the stepped surface of the groove 853*a* at every position in the groove 853*a*. The off-centre pivot 852 of the pawl 851 enables the pawl to pivot towards the left or right in response to movement of the pin carrier 855 and pin 857 in the groove 853*a*.

Figure 56A:
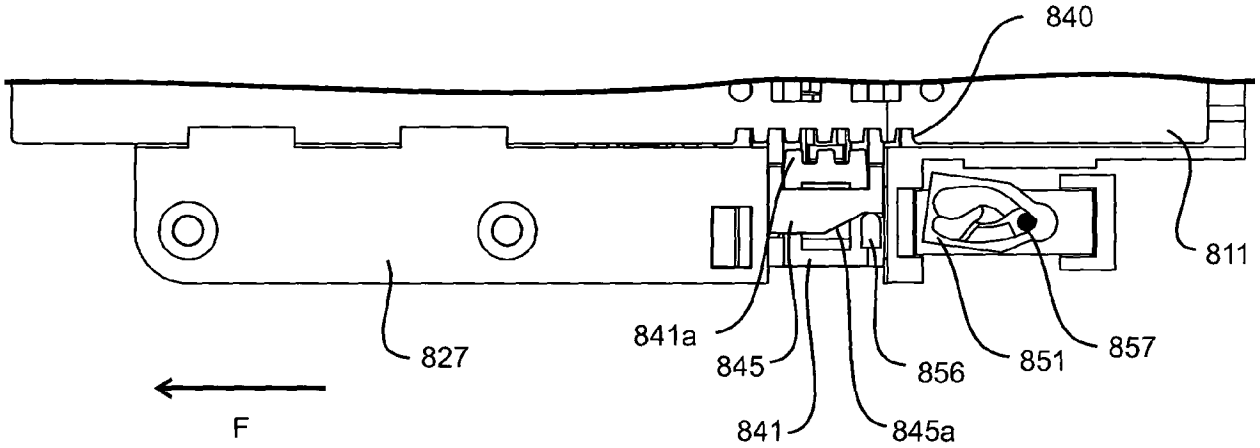
FIGS. 56A to 56G are partial overhead views showing the operation of the rock lock assembly, with FIG. 56A showing the rock lock in a released configuration with the seat portion free to rock, FIG. 56B showing the rock lock during actuation with locking delayed due to misaligned engagement teeth on the central slide member, FIG. 56C corresponding to FIG. 56B but when the user has released the actuator and the detent pin is in a locked position, FIG. 56D showing the seat portion rocked slightly forward from its position in FIGS. 56B and C and the lock biased into engagement with the teeth on the central slide member, FIG. 56E showing the detent pin moved into the unlocked position during actuation by user to unlock the rock lock, FIG. 56F showing the detent pin returned to the unlocked position but retraction of the lock pawl delayed due to frictional force, and FIG. 56G showing the lock pawl retracted and the rock lock in the released configuration with the seat portion free to rock.

An underside of the pin carrier 855 comprises a cam 856. The lock carriage 845 of the locking assembly comprises a camming surface 845*a* with two parallel end portions and a rearwardly inwardly angled intermediate portion (FIG. 56A). The cam 856 contacts the camming surface 845*a* to operate the lock.

Operation of the lock assembly will now be described with reference to FIGS. 56A to 56G. In a first stage shown in FIG. 56A, the rock lock is released and the seat portion is free to rock. In this configuration, the user has released the actuation paddle and the pin carrier 855 and pin is biased rearwardly by spring 861 to a first stop position in the detent pawl 851. The cam 856 on the underside of the pin carrier 855 is therefore also in its rearmost position. The lock carriage 845 and camming surface 845*a* are biased outwardly by spring 847, into contact with the cam 856. The extent of the outward movement of the lock carriage 845 is limited by the position of the cam 856. In this stage, the cam is in its rearmost position to allow maximum outward movement of the lock carriage 845 and lock member 841, so that the teeth 840, 841*a* on the slide member and lock member 811, 841 are disengaged.

Figure 56B:
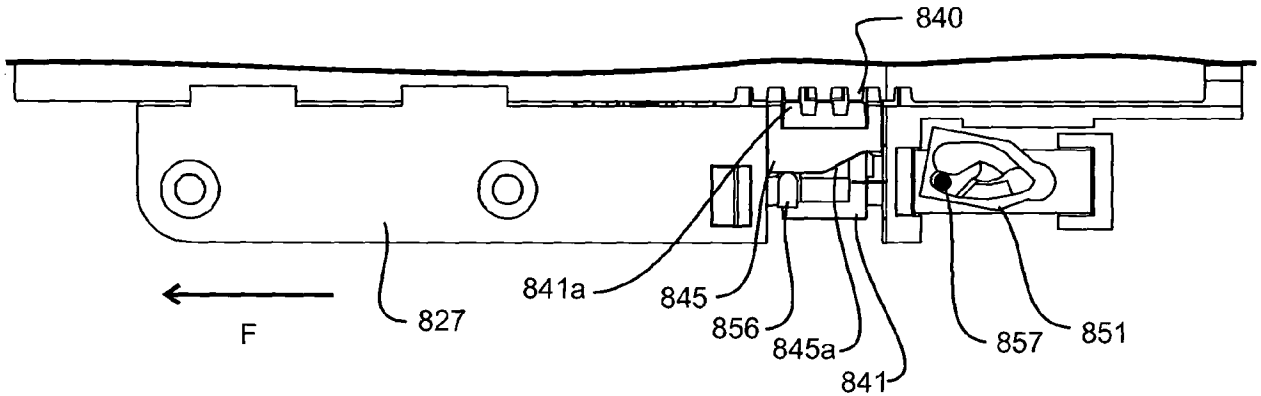

In a second stage shown in FIG. 56B the user is actuating the actuation paddle or lever to lock the chair rock. This tensions the cable 863 and pulls the pin carrier 855, pin 857, and cam 856 forward to their forward-most position. The movement of the cam 856 along the lock carriage camming surface 845*a* pushes the lock carriage 845 and lock member 841 inwards. In the configuration shown, the user has actuated the lock assembly when the teeth 840 on the central slide 811 and the teeth 841*a* on the lock member 841 are misaligned. This means that when the lock carriage 845 is moved inwards, the lock member 841 moves outwards relative to the lock carriage 845, compressing biasing member 843, to delay locking until the slide member 811 is moved to align the teeth.

Figure 56C:
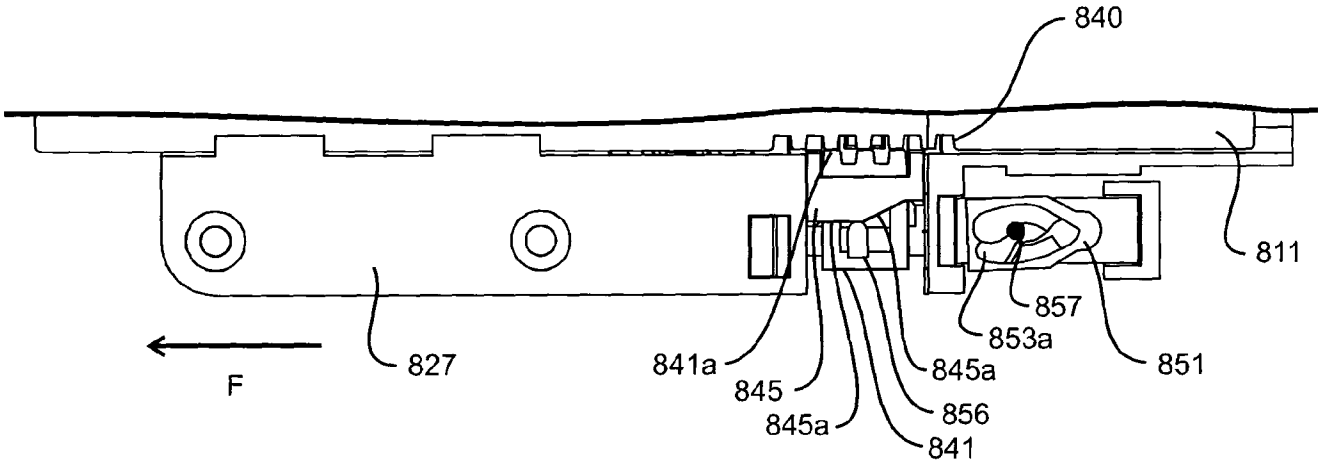

FIG. 56C shows a third stage where the user has released the actuation paddle or lever, releasing tension in the cable 863. The spring 861 causes the pin carriage 855 to again move rearwardly, and the pin 857 to move rearwardly in the detented groove 853*a*. The stepped, angled surfaces within the groove 853*a* prevent the pin from returning to the first stop position of stage one, and instead direct the pin 857 to a second stop position between the pin positions of stages one and two, as shown. The cam 856 moves rearwardly with the pin carriage 855 but remains forward of the angled portion of the camming surface 845*a* and holds the lock carriage 845 in the position of stage two.

Figure 56D:
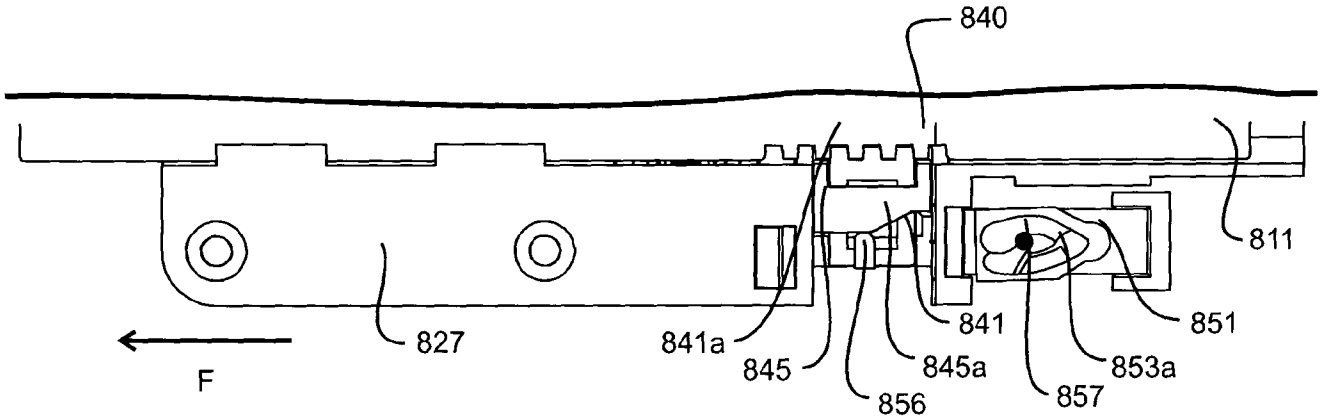

The fourth stage shown in FIG. 56D corresponds to the third stage where the actuation paddle is released, but the seat has been rocked slightly forward from its position in FIGS. 56B and C. The forward rocking slides the slide member teeth 840 to a position where they are aligned with the teeth 841*a* on the lock member 841. The lock member 841 biased inwardly on the lock carrier 845 by spring 843, is then forced into engagement with the slide member teeth 840 to lock forward and rearward rock of the chair relative to the transom.

Figure 56E:
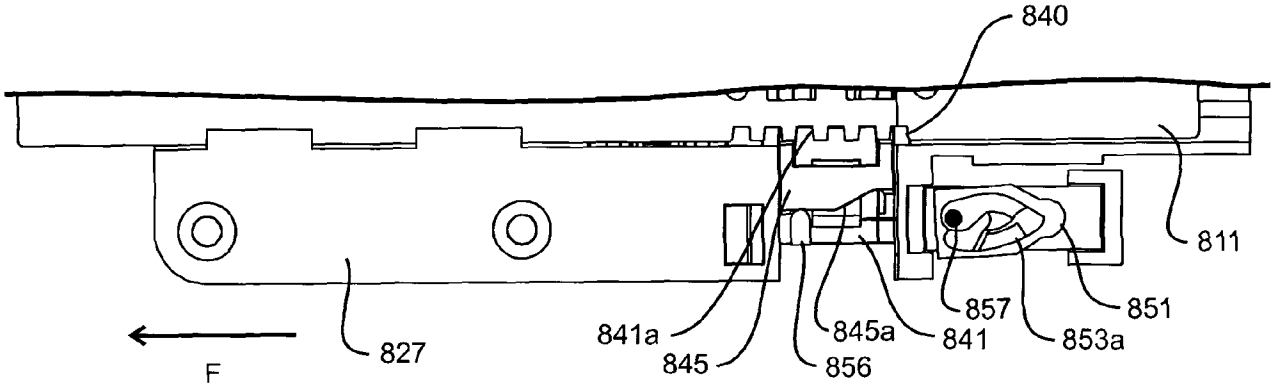

FIG. 56E shows a fifth stage where the user is actuating the actuation paddle or lever to release the lock. The cable 863 is tensioned pulling the pin carriage 855, pin 857, and cam 856 forward to their forward most position. The pin 857 travels forward in the detent pawl groove 853*a*, but to a different side of the pawl than in stage two. The movement of the cam 856 forward along the lock carriage camming surface 845*a* retains the lock carriage 845 and lock member 841 in their engaged positions.

Figure 56F:
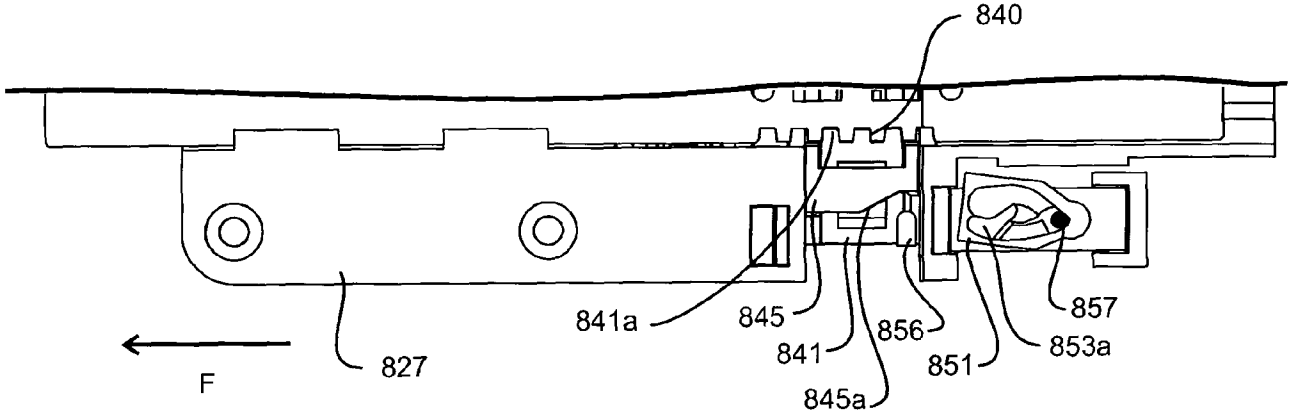

In a sixth stage, shown in FIG. 56F, the user has once again released the actuation paddle or lever, releasing tension in the cable 863. The spring 861 causes the pin carriage 855 to again move rearwardly, causing the pin 857 to move rearwardly in the detented groove 853*a*. The stepped, angled surfaces within the groove 853*a* direct the pin 857 back to the first stop position of the first stage. The cam 856 moves rearward with the pin carrier 855. Friction between the lock member teeth 841*a* and the slide member teeth 840 may prevent the lock member 841 and carriage 845 sliding outwards, out of engagement, meaning the camming surface 845*a* is no longer in contact with cam 856, as shown, delaying unlocking of the rock.

Figure 56G:
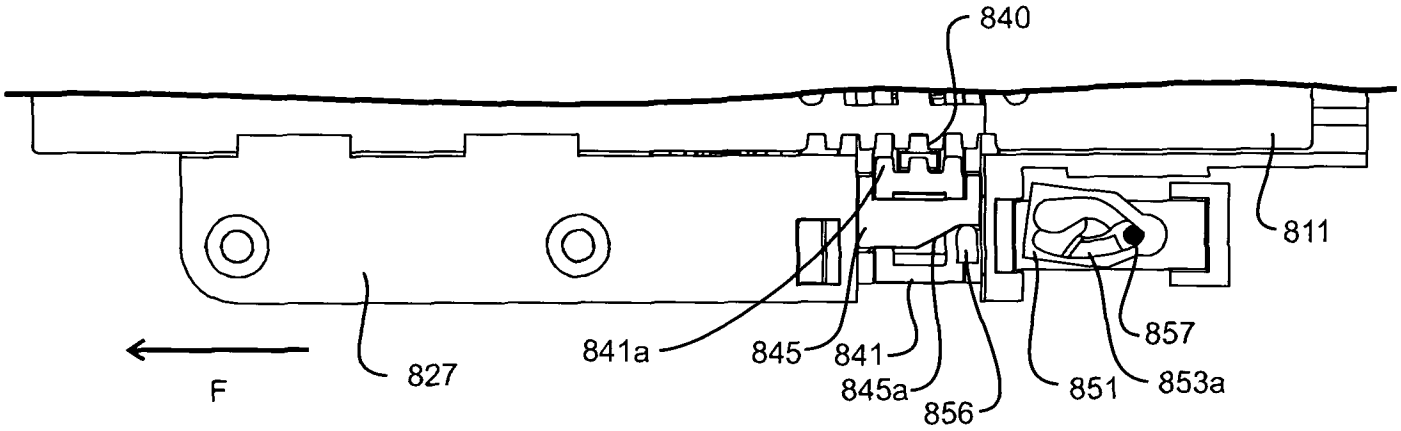

FIG. 56G shows a final stage, corresponding to the sixth stage of FIG. 56F but where the pressure on the seat portion has been shifted, releasing the frictional forces between the lock member teeth 841*a* and the slide member teeth 840. This allows the lock 841 and lock carriage 845 to move out of engagement with the slide member 811, into the configuration of the first stage so that the chair is free to rock relative to the transom.

The lock assembly 805 enables a user to selectively lock forward and rearward rocking of the intermediate support 21, independent of the position of the foot or leg support assembly 501. A first 'click' of the actuation paddle or lever moves the assembly to a locking configuration (stages three and four) and a second 'click' moves the lock assembly to a release configuration (stages one, six and seven).

In the embodiment shown, the slide member 811 forms part of both the anti-rock ratchet assembly 803 and the lock assembly 805. Angled teeth 813 are provided on one side of the slide member to interact with the ratchet pawl 807, and square teeth 840 are provided on the opposite side of the slide member 811 to interact with the lock member 841. Alternatively, separate slidable members could be provided for each of the anti-rock ratchet assembly 803 and the lock assembly 805. Alternative embodiments of the chair may comprise only one of the anti-rock ratchet assembly 803 or the lock assembly 805. Embodiments of the chair having no foot or leg support would not include the anti-rock ratchet assembly.

Figure 57:
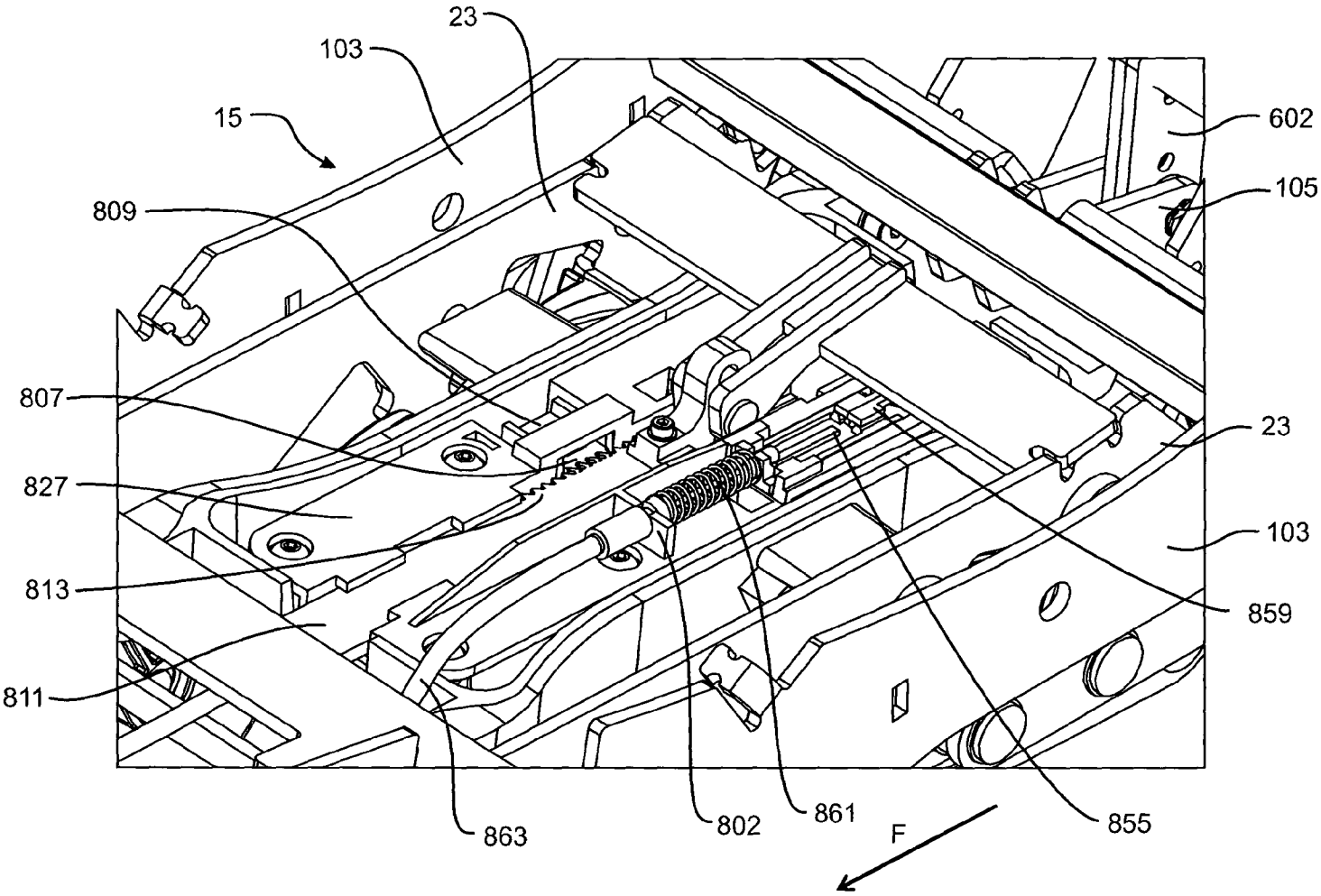
FIG. 57 shows the rocking inhibitor arrangement of FIG. 47 positioned in the transom of the chair.
Figure 58:
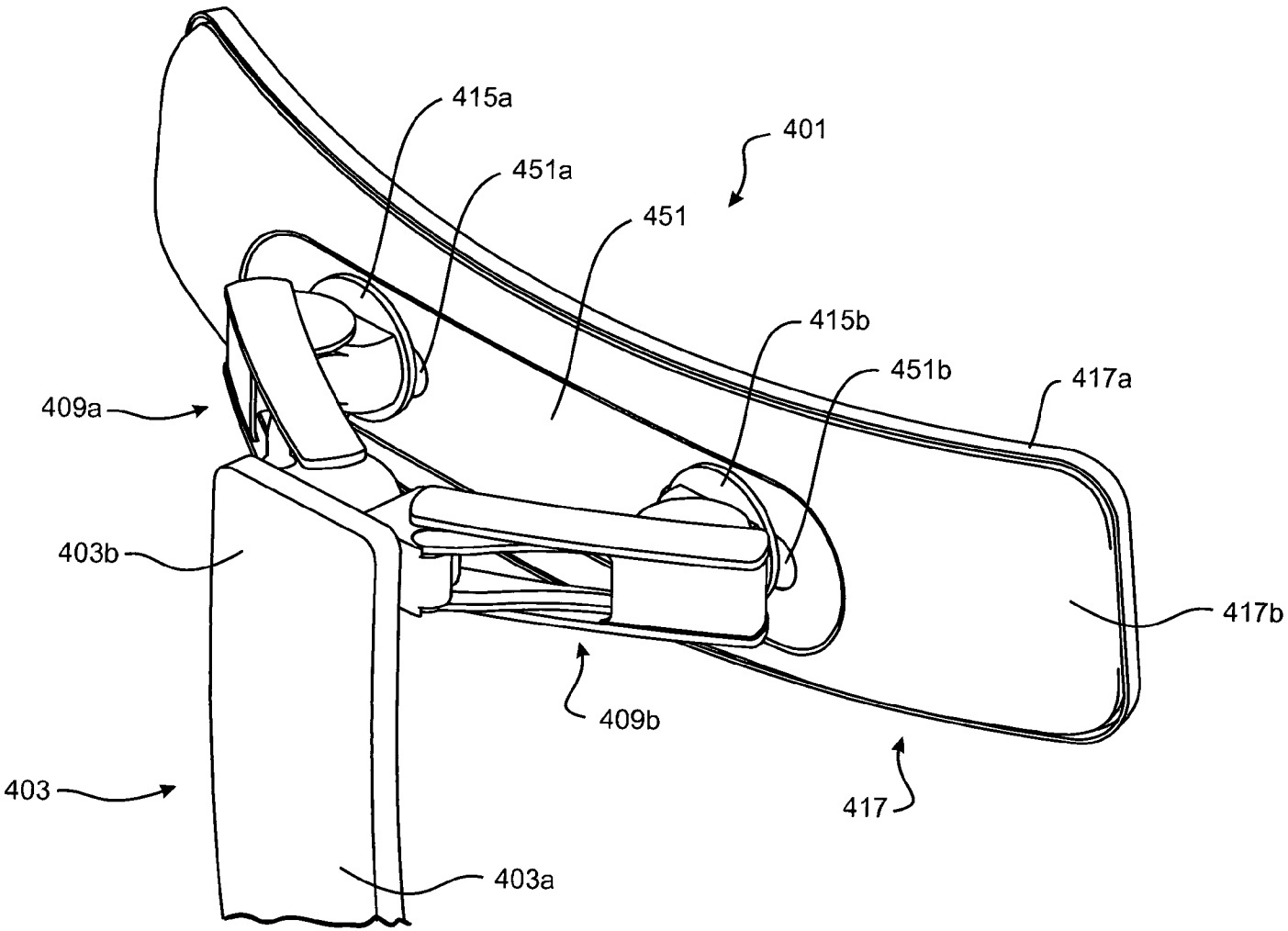
FIG. 58 is a rear perspective view of a first preferred form head or neck support assembly of the chair.
Figure 59A:
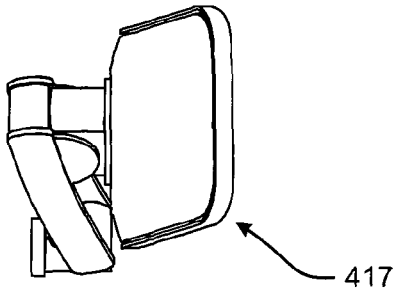
FIGS. 59A to F show some of the possible adjustment positions of the head or neck support assembly.
Figure 59D:
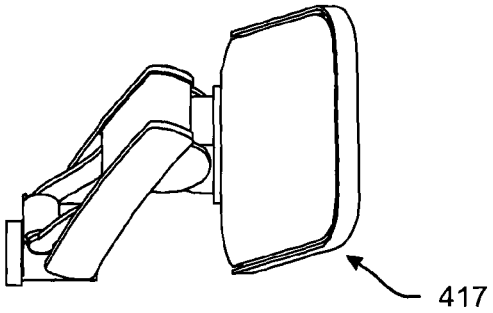
Figure 59B:
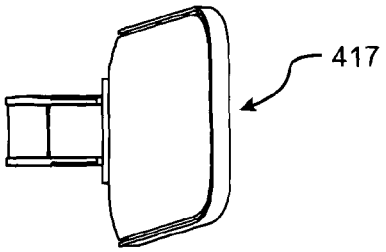
Figure 59E:
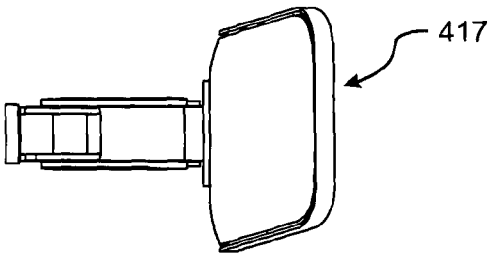
Figure 59C:
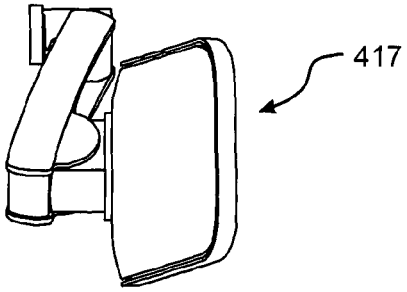
Figure 59F:
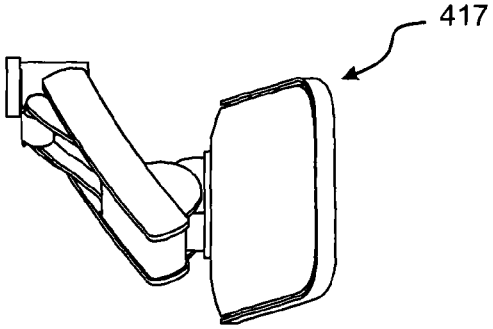
Figure 60:
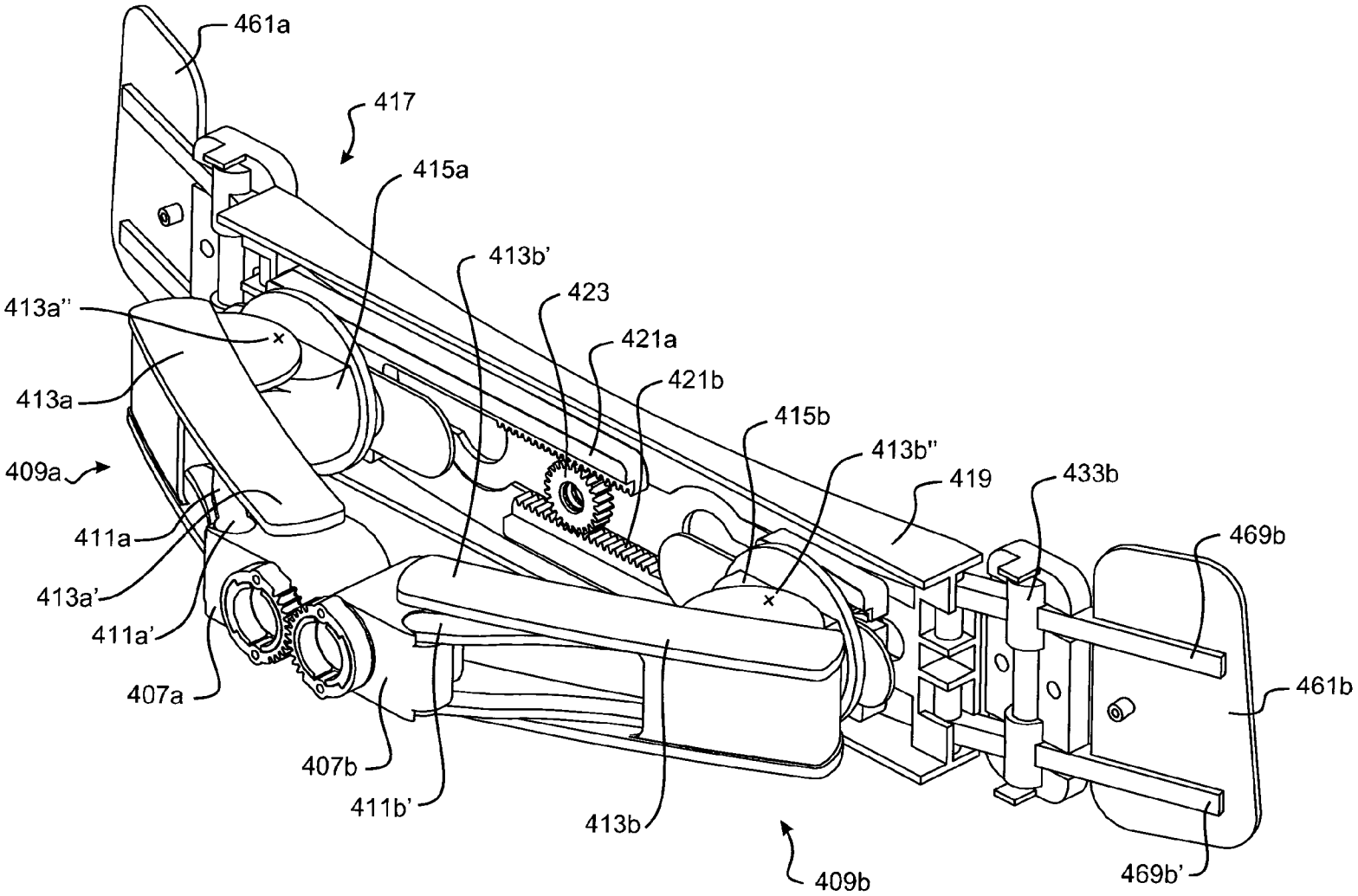
FIG. 60 is a rear perspective view similar to FIG. 58, but with some of the components removed for clarity.
Figure 61A:
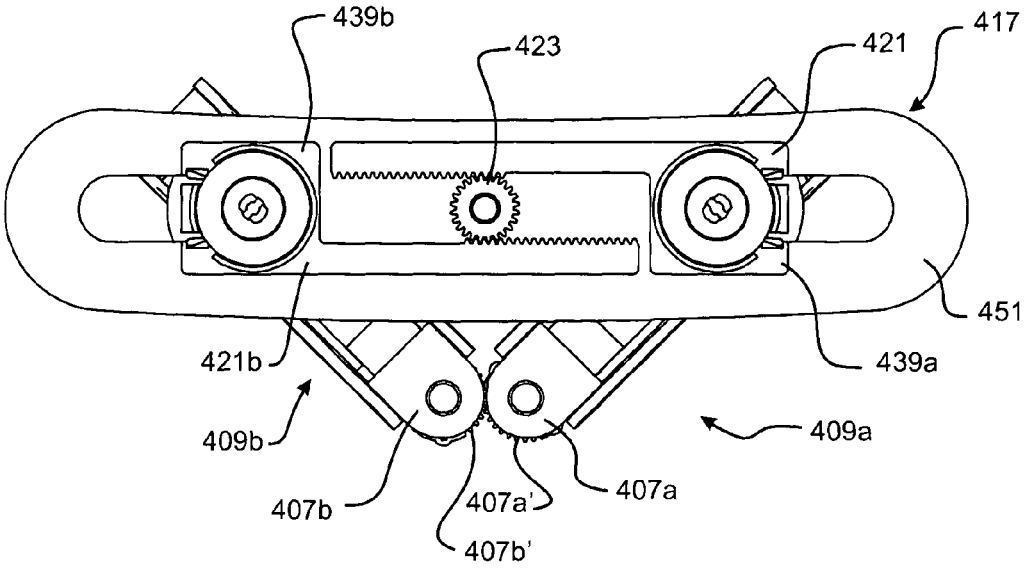
FIG. 61A is a front view of some of the components of the head or neck support assembly, when in a raised position.
Figure 61B:
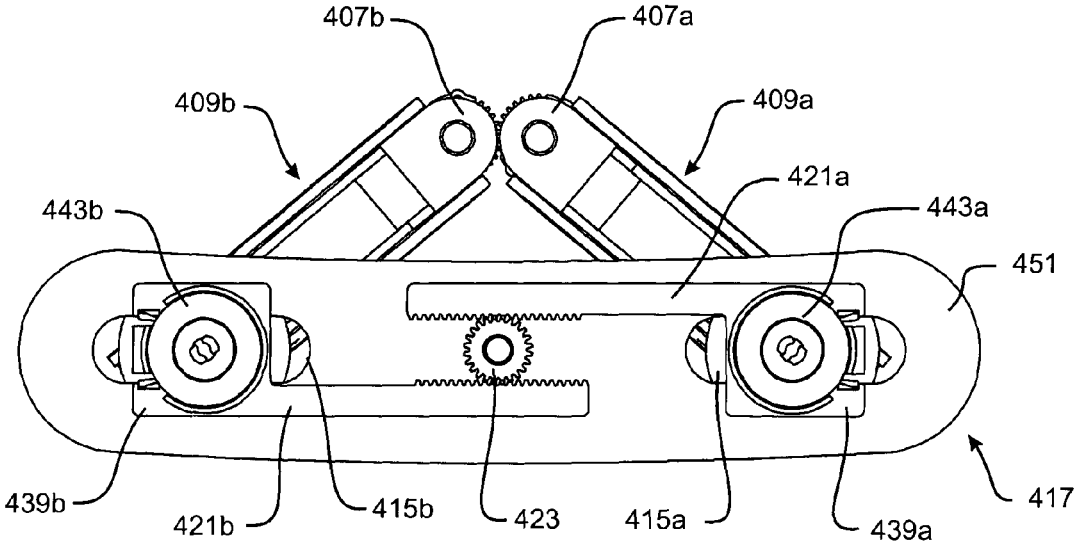
FIG. 61B is a front view, when in a lowered position.
Figure 62A:
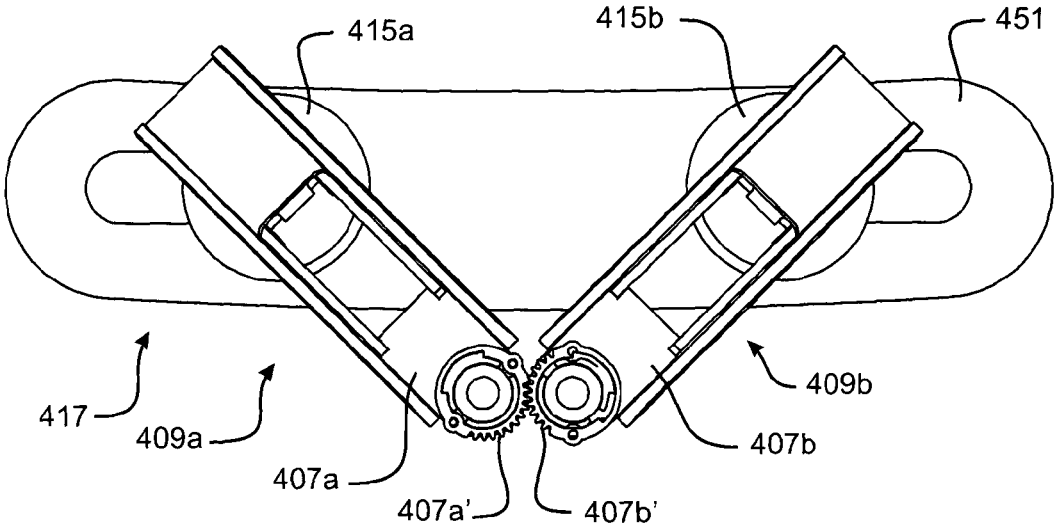
FIG. 62A is a view corresponding to FIG. 61A but from behind.
Figure 62B:
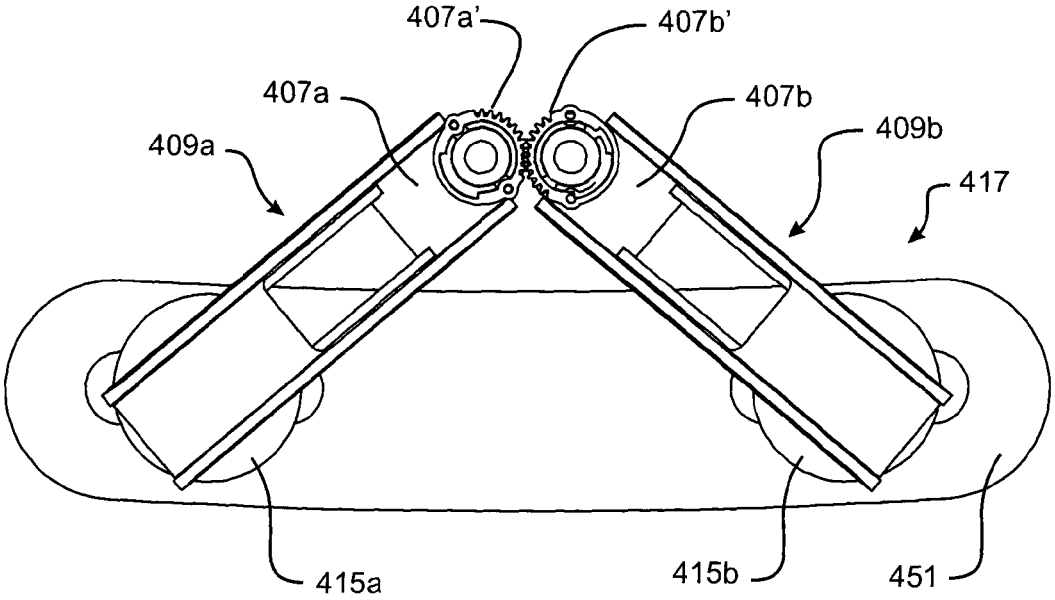
FIG. 62B is a view corresponding to FIG. 61B but from behind.
Figure 63A:
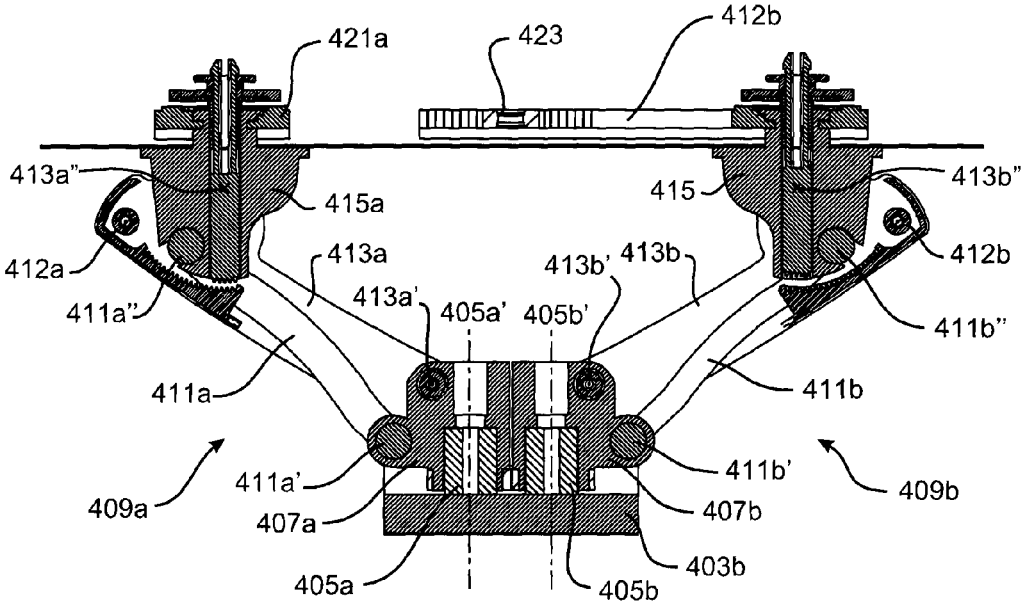
FIG. 63A is an overhead section view of some of the components of the head or neck assembly, when in a forward position.
Figure 63B:
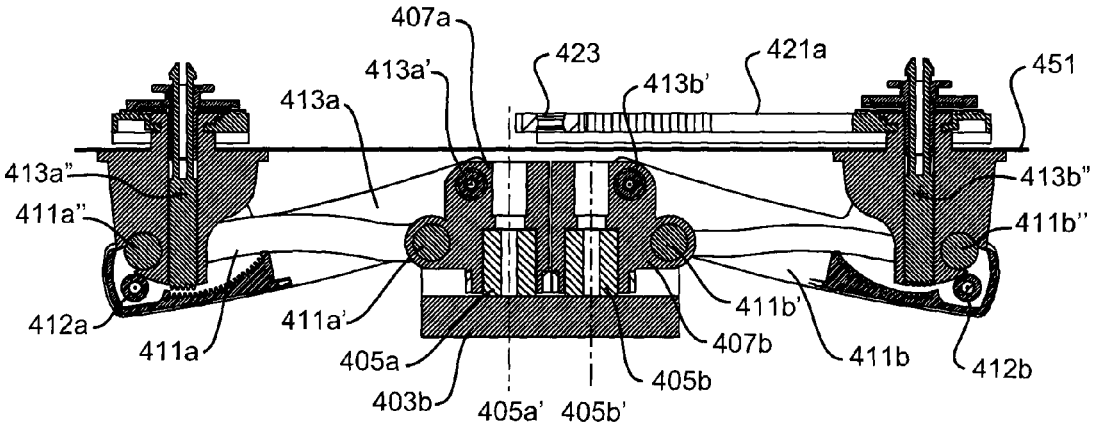
FIG. 63B is an overhead section view, when in a rearward position.
Figure 64:
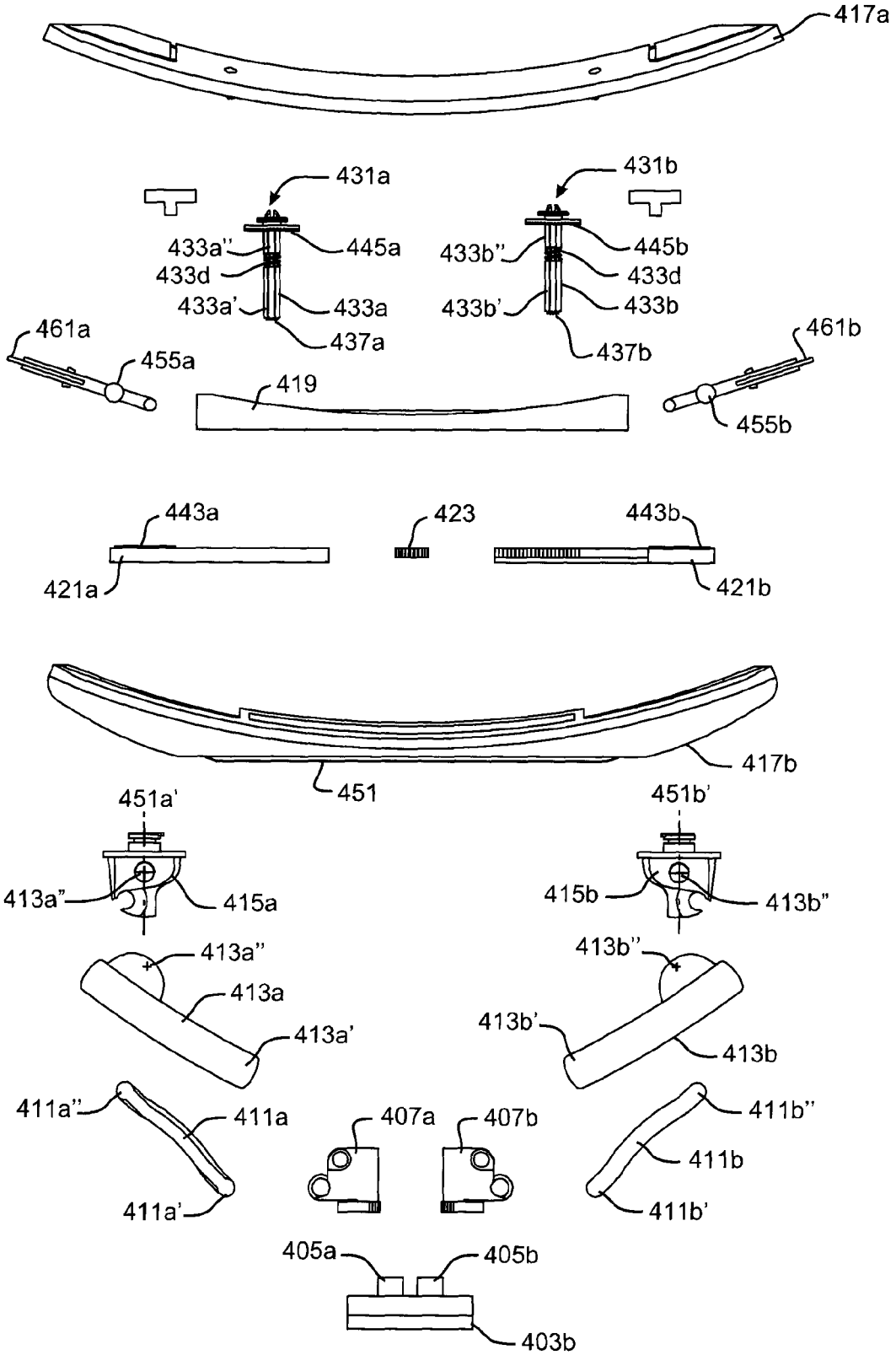
FIG. 64 is an overhead exploded view of some of the components of the head or neck support.
Figure 65:
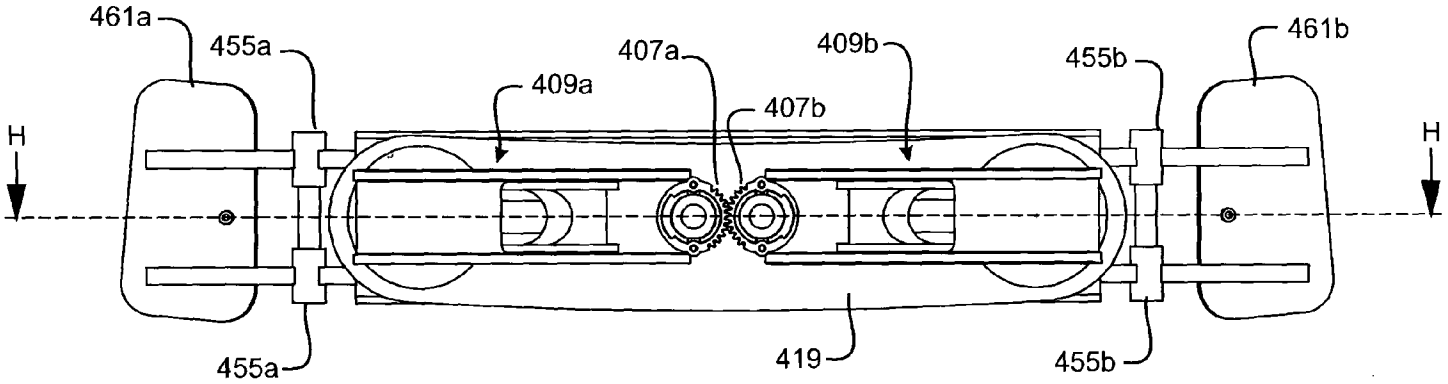
FIG. 65 is a rear view of the head or neck support assembly, with the head or neck support housing removed showing section line H-H.

Preferably, the components in the rocking inhibitor arrangement 801 are designed to be thin so that the arrangement is compact for packaging under the seat. FIG. 57 shows the mounting member 827 carrying the rocking inhibitor arrangement 801 positioned in the transom 15. Alternatively, the rocking inhibitor arrangement 801 may be arranged in a vertical plane.

First Preferred Form Support Assembly

The chair may comprise a head or neck support assembly 401 as described below. The assembly can be used to support an occupant's head, neck, or both, depending on the configuration of the assembly and the size of the occupant. References to a head or neck support assembly should be understood to cover any of: a support assembly that is suitable for supporting an occupant's head, a support assembly that is suitable for supporting an occupant's neck, or a support assembly that is suitable for supporting an occupant's head and neck.

Referring to FIGS. 58 to 77, the head or neck rest assembly 401 comprises a base 403 (only shown in some views, for clarity) for mounting the assembly 401 to the chair. In the form shown, the base 403 is a mounting plate, with a lower part 403*a* of the plate being connected to the spine 209 at the upper end 203 thereof. The base 403 could alternatively be any suitable shape to provide a desired aesthetic. The connection of the lower part 403*a* of the plate to the spine 209 can be any suitable type, such as a fastener(s) or clip(s) for example. The connection of the plate to the spine may be permanent or may be reversible, so a user can reconfigure the chair with or without the support assembly. Alternatively, the base 403 may be integral with the spine 209. The remainder of the support assembly is mounted to the upper part of the plate.

The upper part 403*b* of the plate has two forwardly-directed spigots 405*a*, 405*b*. A first member 407*a* is rotatably connected to the base by being rotatably mounted on the first spigot 407*a*. A second member 407*b* is rotatably connected to the base by being rotatably mounted on the second spigot 407*b*. The first axis 405*a*' of the first member 407*a* on the first spigot 405*a* is substantially parallel to the second axis 405*b*' of the second member 407*b* on the second spigot 405*b*.

The first and second members 407*a*, 407*b* are preferably operatively coupled by gear surfaces 407*a*', 407*b*' (FIGS.

61A to 62B) such that as the first member 407*a* is rotated in one direction relative to the base 403, the second member 407*b* rotates a corresponding amount in an opposite direction relative to the base. It will be appreciated from the geometry and arrangement of components that the first and second members 407*a*, 407*b* can only be rotated by substantially less than 360 degrees.

The first member 407*a* carries a first linkage arrangement 409*a* comprising a first pair of generally parallel arms 411*a*, 413*a* that have first ends that are pivotally connected to the first member about axes 411*a*', 413*a*' that are substantially perpendicular to the first axis 405*a*'. The second member 407*b* carries a second linkage arrangement 409*b* comprising a second pair of generally parallel arms 411*b*, 413*b* that have first ends that are pivotally connected to the second member about axes 411*b*', 413*b*' that are substantially perpendicular to the second axis 405*b*'. As first and second members 407*a*, 407*b* are rotated relative to the base about axes 405*a*', 405*b*', the first and second linkage arrangements pivot with the first and second members. This movement is controlled by the gearing at 407*a*', 407*b*', to control movement of the head or neck support as the first and second members 407*a*, 407*b* are rotated relative to the base. In the form shown, the arms 411*a*, 413*a* on the first base member 407*a* and the arms 411*b*, 413*b* on the second base member 407*b* extend outwardly away from each other. Alternatively the two sets of arms 411*a*, 413*a* and 411*b*, 413*b* could extend in the same direction, so that the arm 411*a* is substantially parallel to arm 411*b*, and so that the arm 413*a* is substantially parallel to the arm 413*b*.

Arms 413*a*, 413*b* act as protective covers over the parallel arms 411*a*, 411*b*. Alternatively separate protective covers could cover the first and second pairs of parallel arms. The arms 411*a*, 411*b* will typically be identical to each other, but could differ. It will be appreciated from reviewing the figures that the arms 411*a*, 413*a*, and 411*b*, 4113*b* need not be truly parallel, and can instead be any suitable shape that provides a four bar linkage of the type shown with substantially parallel pivot axes on members 407*a*, 407*b* and on support mounting links 415*a*, 415*b* described below. Indeed, in the form shown, arms 411*a* and 413*a*, and arms 411*b*, 413*b* are different shapes, with arms 413*a*, 413*b* at least partly encapsulating arms 411*a*, 411*b* within recesses in the arms. In the form shown, the arms 413*a*, 413*b* are each two-part members comprising two halves, with connectors 412*a*, 412*b* joining the two halves together to partly encapsulate the respective parallel arm 411*a*, 411*b*. By using generally parallel arms, the head or neck support 417 will stay substantially parallel to the base 403, rather than possibly becoming skewed during adjustment.

A head or neck support 417 is operatively supported by the second ends of the generally parallel arms 411*a*, 413*a*, 411*b*, 413*b* of the first and second linkage arrangements. In the form shown, the second ends of the first pair of generally parallel arms 411*a*, 413*a* are pivotally connected to a first support link 415*a* about axes 411*a*", 413*a*" that are substantially parallel to the pivot axes 411*a*', 413*a*' between the parallel arms 411*a*, 413*a* and the first member 407*a*. The second ends of the second pair of generally parallel arms 411*b*, 413*b* are pivotally connected to a second support link 415*b* about axes 411*b*", 413*b*" that are substantially parallel to the pivot axes 411*b*', 413*b*' between the parallel arms 411*b*, 413*b* and the second member 407*b*. The first and second support links 415*a*, 415*b* are pivotable relative to the head or neck support 417, with the pivot axes 415*a*', 415*b*' of the first and second support links 415*a*, 415*b* relative to the support 417 being substantially parallel to the pivot axes 405*a*', 405*b*' of the first and second members 407*a*, 407*b* relative to the base.

The second ends of the first pair of generally parallel arms 411*a*, 413*a* are moveable toward and away from the second ends of the second pair of generally parallel arms 411*b*, 413*b* (in a widthwise direction of the chair), upon movement of the head or neck support 417 relative to the base 403. The movement toward and away from each other of the second ends of the first and second pairs of generally parallel arms, causes a corresponding movement toward and away from each other of the first and second support links 415*a*, 415*b*.

The head or neck support 417 comprises a housing having a front part 417*a* and a back part 417*b*. The housing 417 houses a unlock plate 419 containing a first toothed rack 421*a* that is coupled to the first support link 415*a*, a second toothed rack 421*b* that is coupled to the second support link 415*b*, and a pinion gear 423 that is rotatably mounted to unlock plate 419 and engaged with the first and second toothed racks 421*a*, 421*b*, wherein movement of the first and second support links 415*a*, 415*b* toward and away from one another moves the toothed racks 421*a*, 421*b*, with the racks and pinion gear linking the movement of the first and second support links 415*a*, 415*b* and thereby movement of the second ends of the first and second generally parallel arms. This arrangement also prevents the head or neck support 417 from moving to an off-centred position to one side relative to the base 403.

The head or neck rest assembly also comprises a locking mechanism 431*a*, 431*b* to selectively inhibit movement of the first and second support links 415*a*, 415*b*, the first and second linkage arrangements 409*a*, 409*b*, and indirectly, the first and second members 407*a*, 407*b*, to thereby maintain the head or neck support 417 in a desired adjusted position. As shown in FIGS. 64 to 71 and 75 to 77, the locking mechanism 431*a*, 431*b* comprises at least one locking member 433*a* that selectively inhibits pivoting of the first pair of generally parallel arms 411*a*, 413*a* relative to the first support link 415*a* and thereby inhibits pivoting of the first pair of generally parallel arms relative to first member 407*a*, and that selectively inhibits rotation of the first support link 415*a* and thereby inhibits rotation of first member 407*a* relative to the base 403. Preferably, the locking mechanism also comprises a second locking member 433*b* that selectively inhibits pivoting of the second pair of generally parallel arms 411*b*, 413*b* relative to the second support link 415*b* and thereby inhibits pivoting of the second pair of generally parallel arms relative to the second member 407*b*, and that selectively inhibits rotation of the second support link 415*b* and thereby inhibits rotation of the second member 407*b* relative to the base 403. However, in an alternative embodiment, a single locking member could be provided to lock movement on one side of the head or neck support assembly. As a result of the linking of movement of members 415*a* and 415*b*, and the interactions of the racks 421*a*, 421*b* and pinion gear 423, locking movement on one side of the assembly would lock movement of the assembly overall.

Member 417*b* comprises a rear plate 451 made of stainless steel for example and comprising two spaced apart transversely extending elongate slots 451*a*, 451*b* within which first and second support links 415*a*, 415*b* are slidably mounted.

With reference to the right hand side of the head or neck support assembly, the first locking member 433*b* is carried by the first support link 415*b* and is engageable with one of the first pair of generally parallel arms 411*b*, 413*b* to inhibit pivoting of the first pair of generally parallel arms relative to the first support link 415*b* and thereby inhibit pivoting of the first pair of generally parallel 411*b*, 413*b* arms relative to the first member 407*b*. An engagement surface 435*b* (FIGS. 65 to 70C) is provided on one of the first pair of generally parallel arms, and in form shown is provided on arm 413*b*. The locking member 433*b* comprises a complementary engagement surface 437*b* for engaging with the engagement surface 435*b*. The engagement surface 435*b* is an arcuate gear surface with a plurality of teeth, and the engagement surface 437*b* has complementary teeth to engage with the teeth of the arcuate gear surface. The teeth on the gear surface 435*b* are concentric with the pivot 413*b*" of the arm 413*b* to the first support link 415*b*. The pivot axis 413*b*" passes through the shank of the locking member 433*b* which extends through the first support link 415*b*.

The first locking member 433*b* is engageable with the first toothed rack 421*b* to inhibit pivoting of the first support link 415*b* relative to the first toothed rack 421*b* about axis 415*b*', thereby inhibiting pivoting of the first member 407*a* relative to the base 403. The first toothed rack 421*b* comprises a body 439*b* having an aperture 441*b* and an engagement surface 443*b*, and the locking member 433*b* extends through the aperture 441*b* in the body of the toothed rack and through an aperture 416*b* in the first support link 415*b*. The cross-section of the aperture 416*b* in the first support link 415*b* is non-circular, as is the cross-section of the shank of the locking member, so that the locking member 433*b* is moveable only axially relative to the first support link 415*b* along axis 415*b*' but is rotatable relative to the toothed rack 421*b* in aperture 441*b* as the link 415*b* rotates relative to the rack. The locking member has a complementary engagement surface 445*b* for engaging with the engagement surface 443*b* on the toothed rack to inhibit pivoting therebetween. Preferably, the engagement surface on the toothed rack comprises an arcuate or semi-arcuate gear surface surrounding the aperture 441*b*, and the locking member has a head with a complementary gear feature on its underside.

Figure 73:
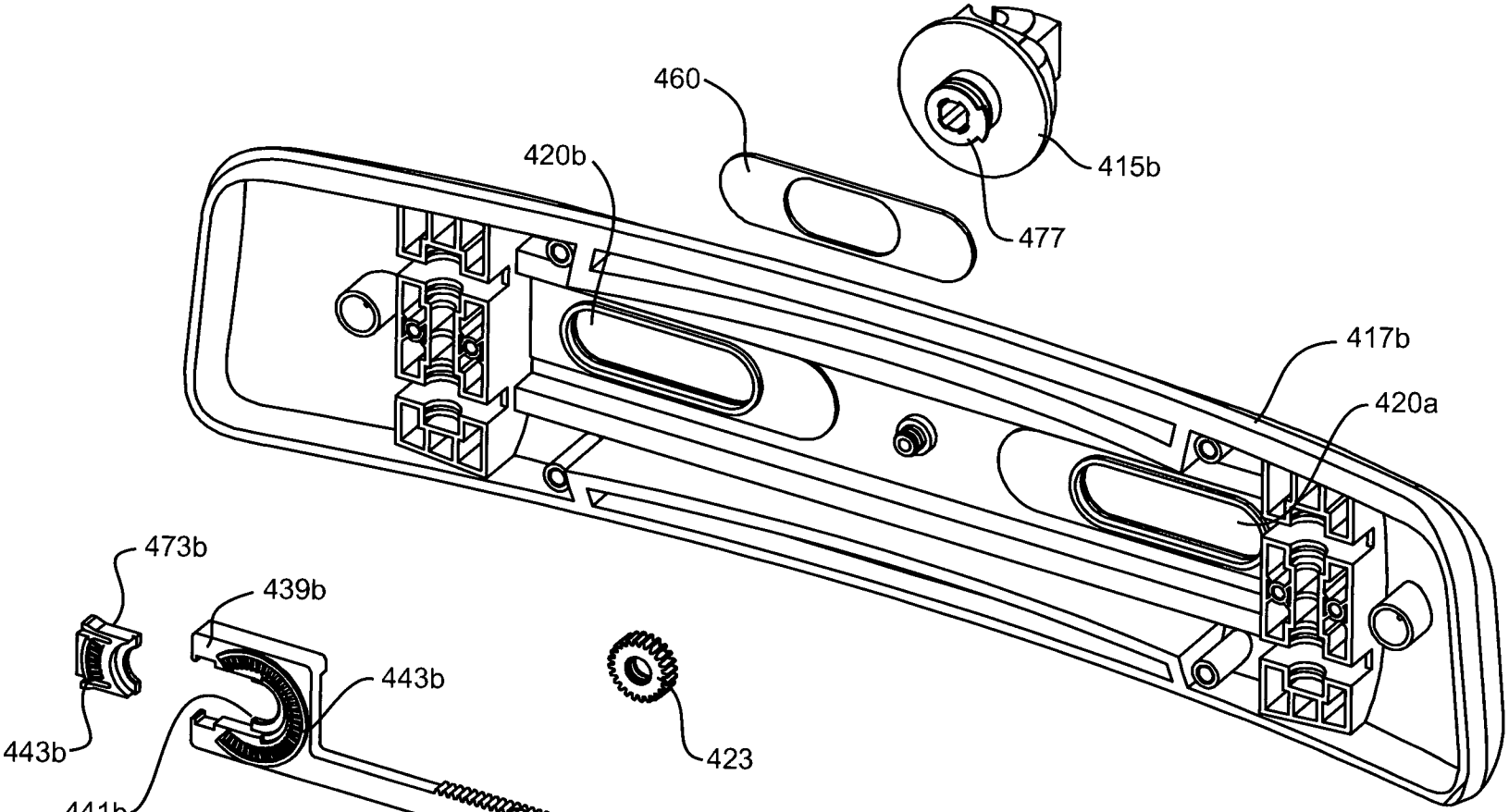
FIG. 73 is an exploded view of the assembly shown in FIG. 72.
Figure 74:
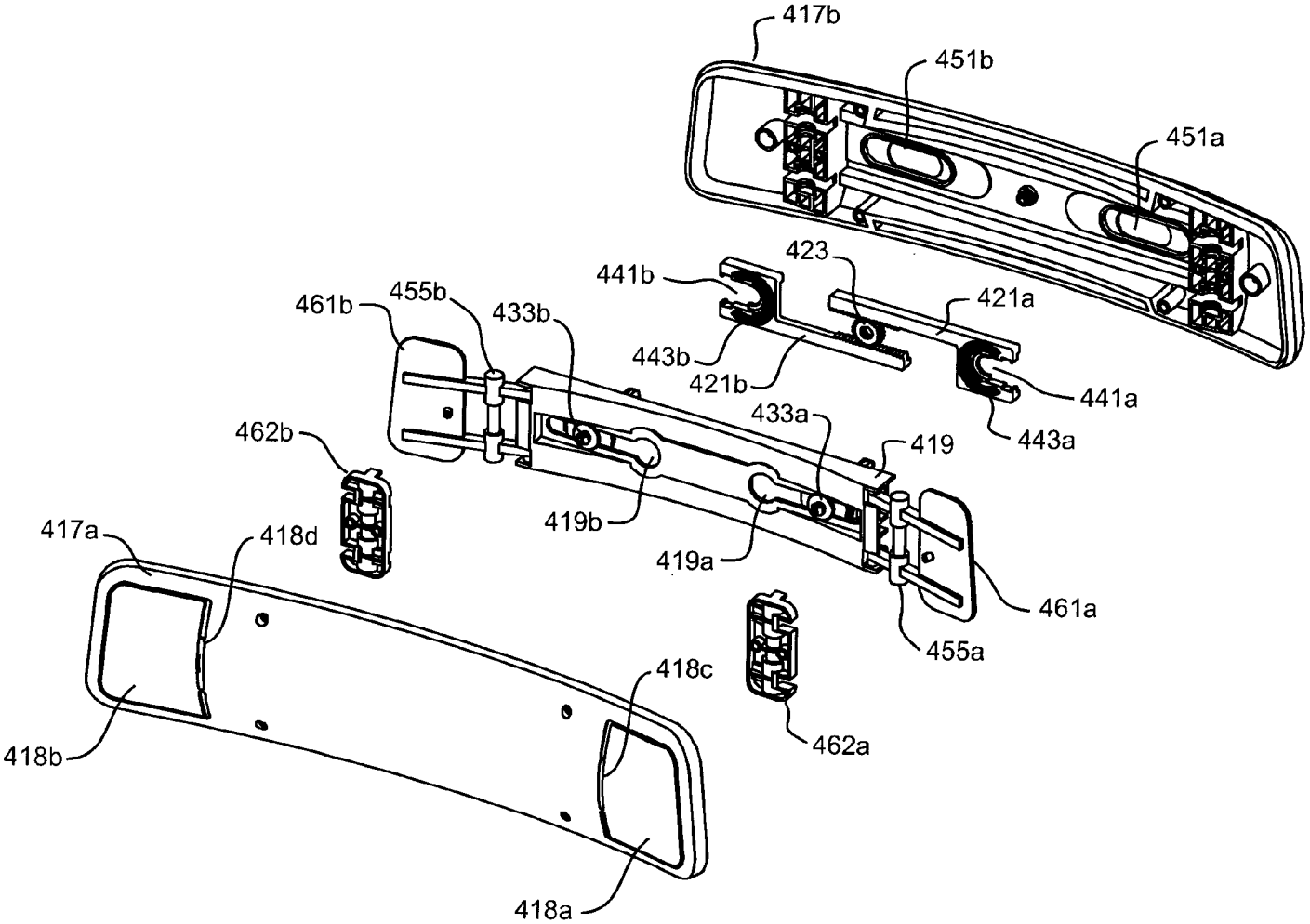
FIG. 74 is front exploded view of part of the head or neck support assembly.
Figure 75:
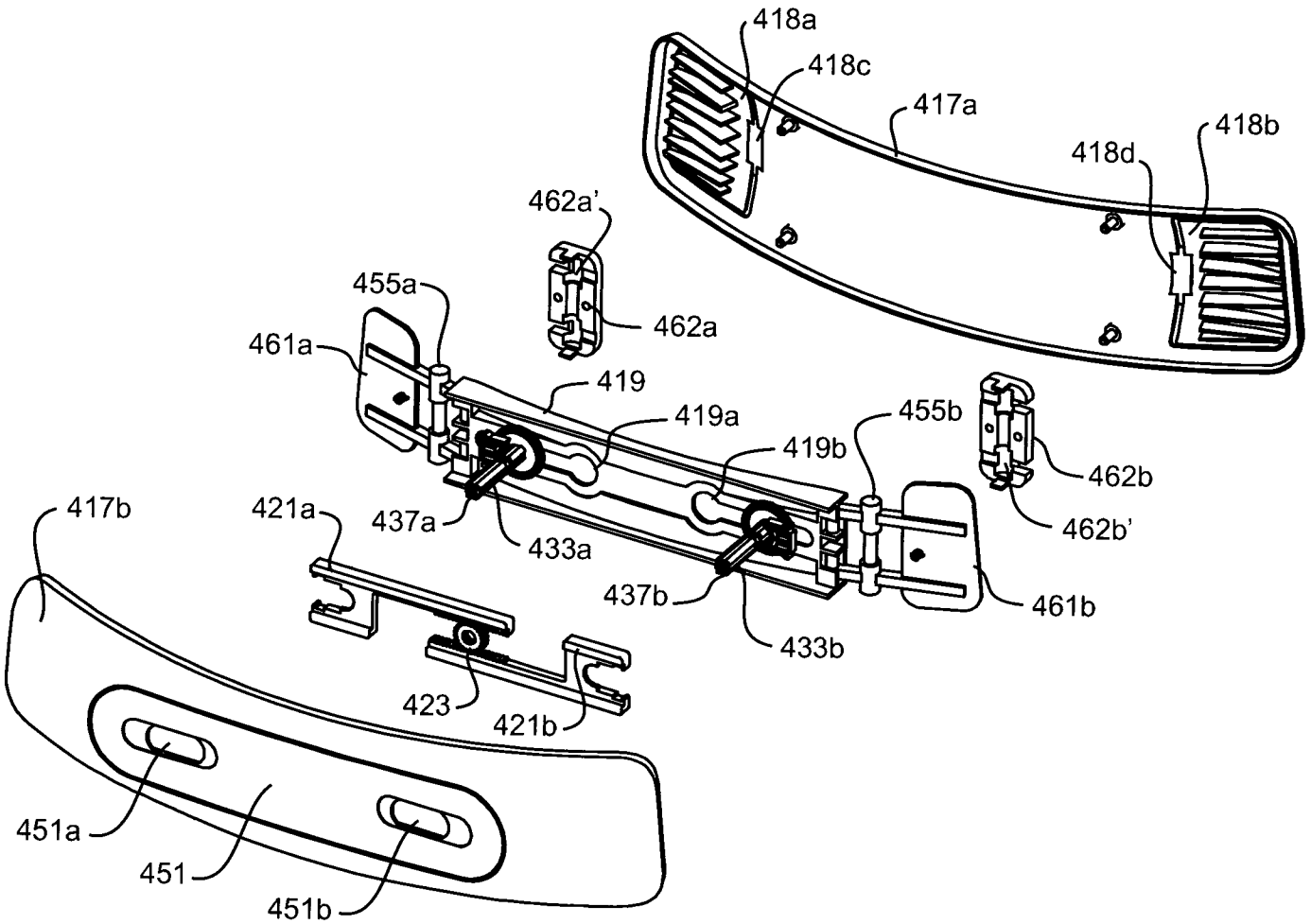
FIG. 75 is view corresponding to FIG. 74 but from the rear.
Figure 76:
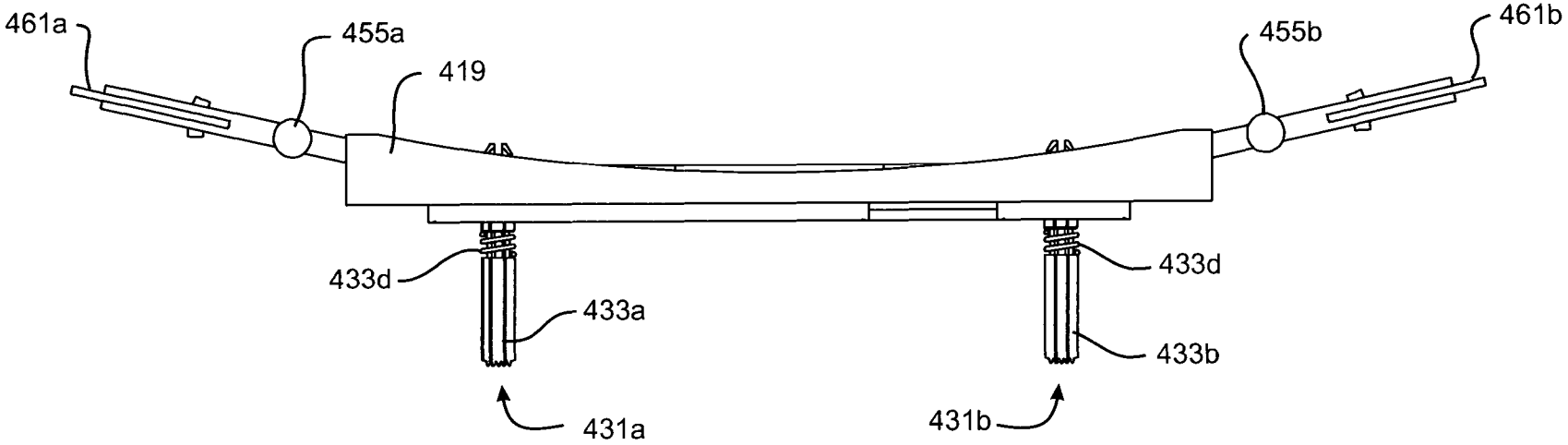
FIG. 76 is a top view of the lever assembly for the neck or head support assembly.

FIG. 73 shows how the rack 421*b*, the second support link 415*b* and the pinion 423 are assembled in the rear portion of the housing 417*b*. The support link 415*b* has a rearwardly projecting spigot 477 with a groove. The rack 421*b* comprises a removable portion 473*b* that can be removed to insert the spigot 477 into the aperture 441*b* in the rack 421*b* so that the rack holds the support link 415*b* at its grooved part preventing the support link 415*b* from moving normal to the rack 421*b*. The removable portion is then held in place by way of a snap fit. Alternatively the removable portion could be held in place by a key, for example as in the embodiment shown in FIGS. 78 to 82. FIG. 73 also shows an additional plate 460 that is a finger trap guard that covers the slot 420*b*. Two such plates will be provided.

Figure 66:
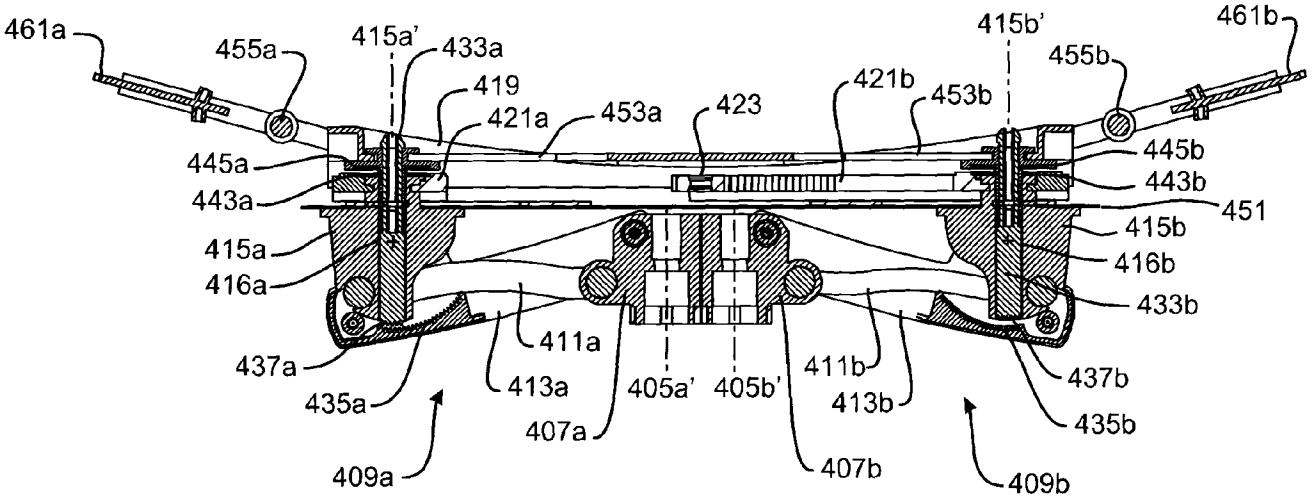
FIG. 66 is a horizontal cross-section view taken through line H-H of FIG. 65, with the locking members in an unlocked position.
Figure 67:
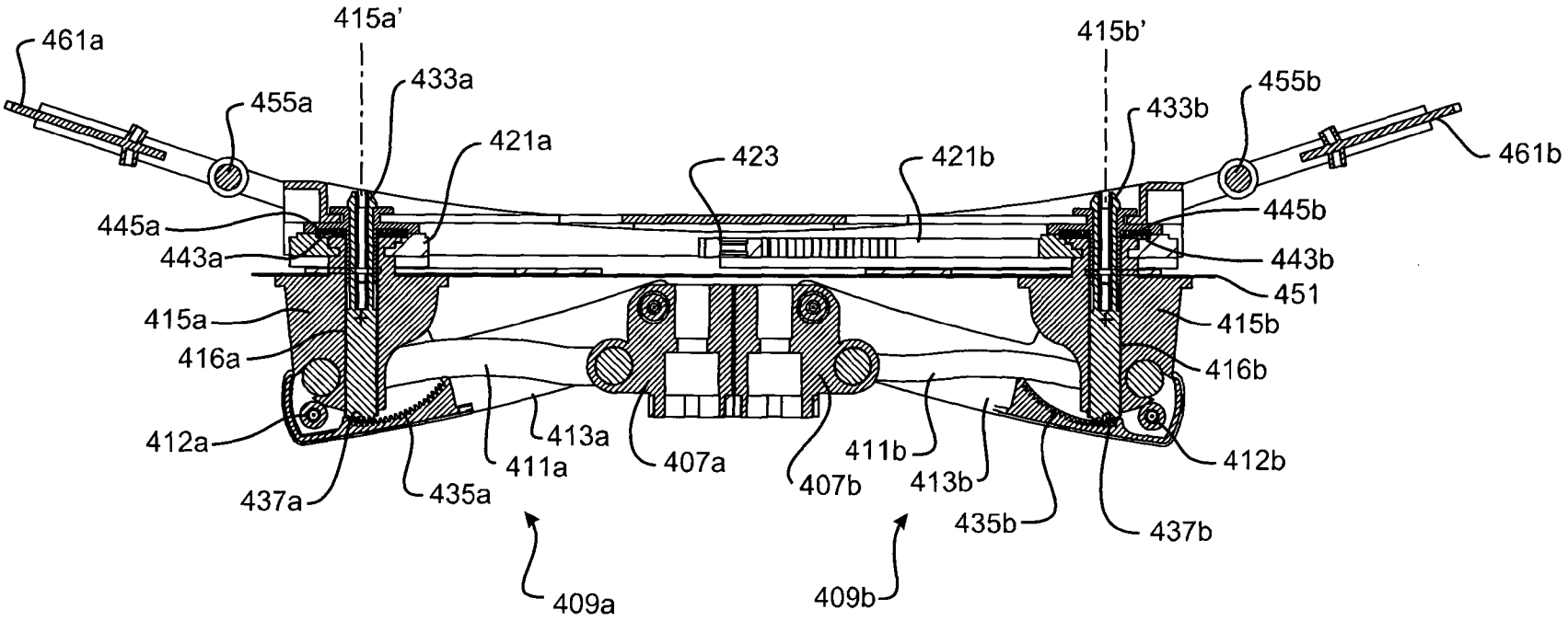
FIG. 67 is a view similar to FIG. 66, but with the locking members in an initial locking position in which they inhibit forward or rearward movement of the support member.
Figure 68:
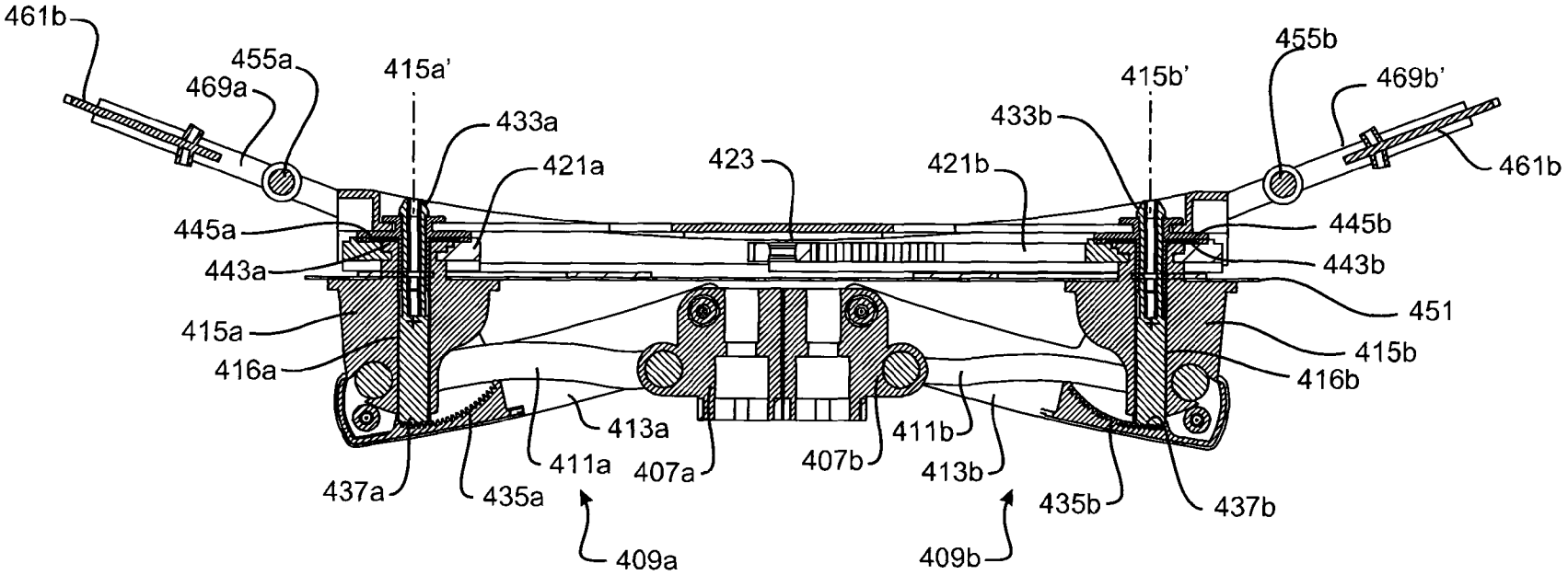
FIG. 68 is a view similar to FIG. 67, but with the locking members in a fully locking position in which they inhibit both forward or rearward, and up or down, movement of the support member.
Figure 69A:
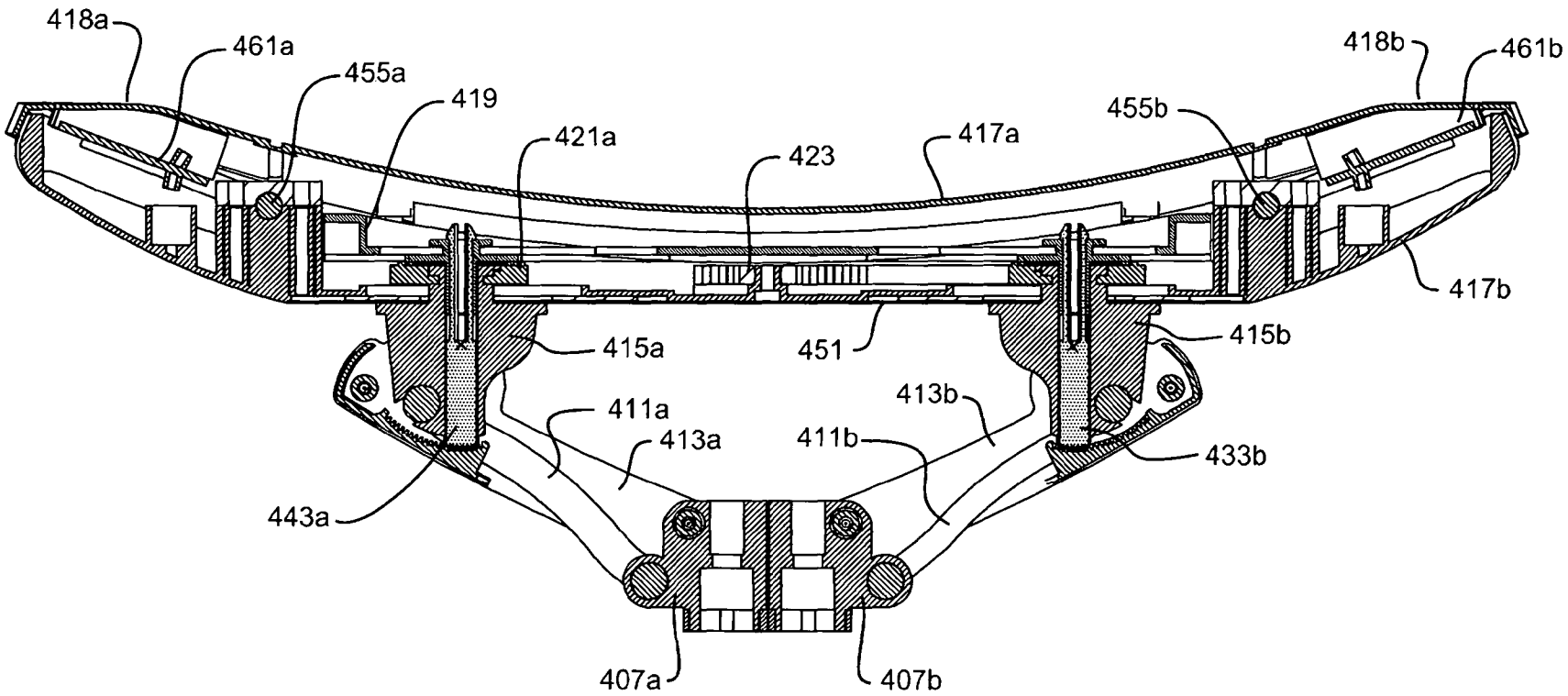
FIG. 69A is a section view similar to the sectional view of FIG. 68, but with the head or neck support assembly in a forward position and showing the head or neck support housing.
Figure 69B:
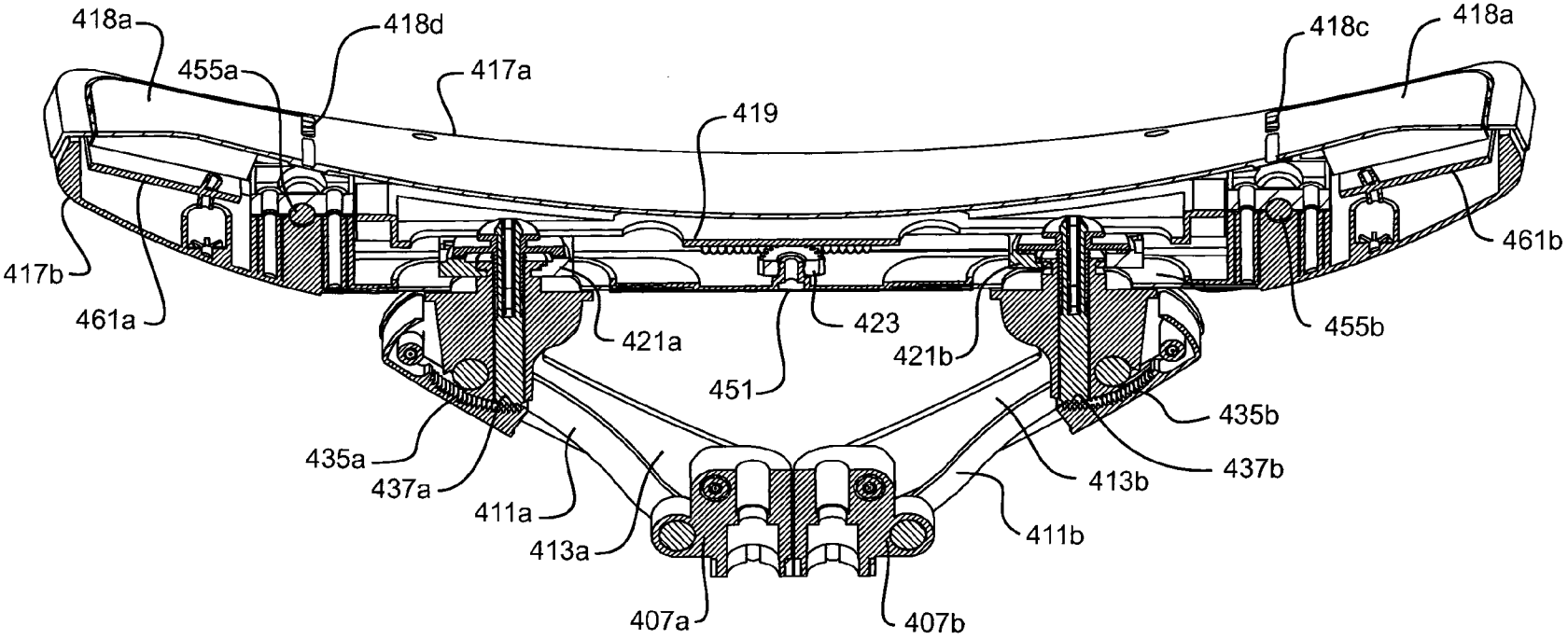
FIG. 69B is a sectional perspective view similar to the sectional view of FIG. 69A.
Figure 70C:
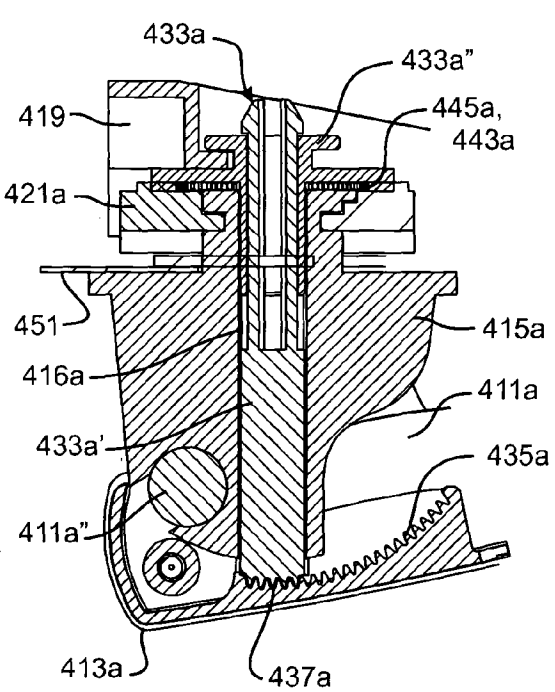
FIGS. 70A to 70C are enlarged detail section views of one of the locking mechanisms shown in FIGS. 66 to 68.
Figure 70B:
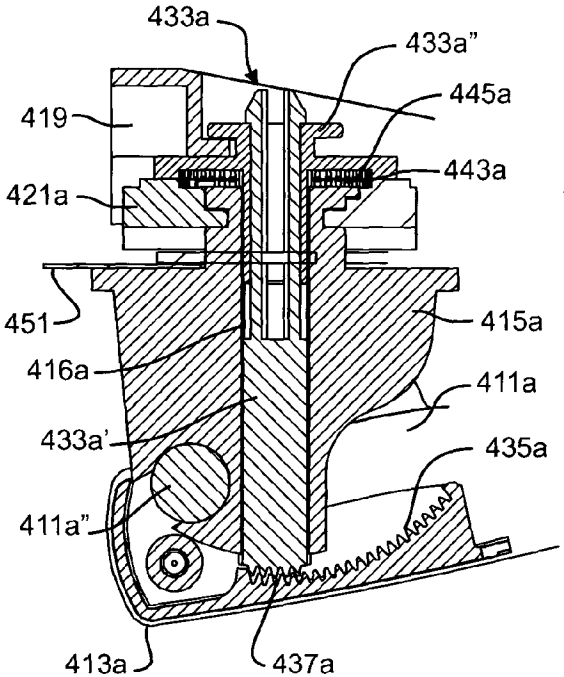
Figure 70A:
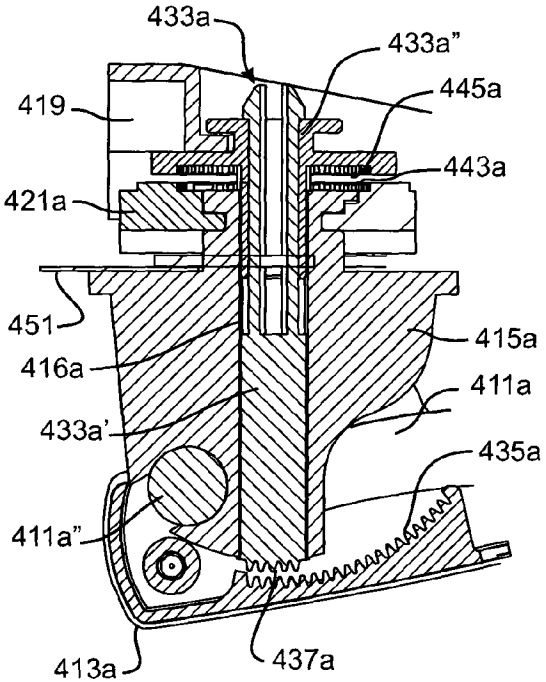
Figure 71:
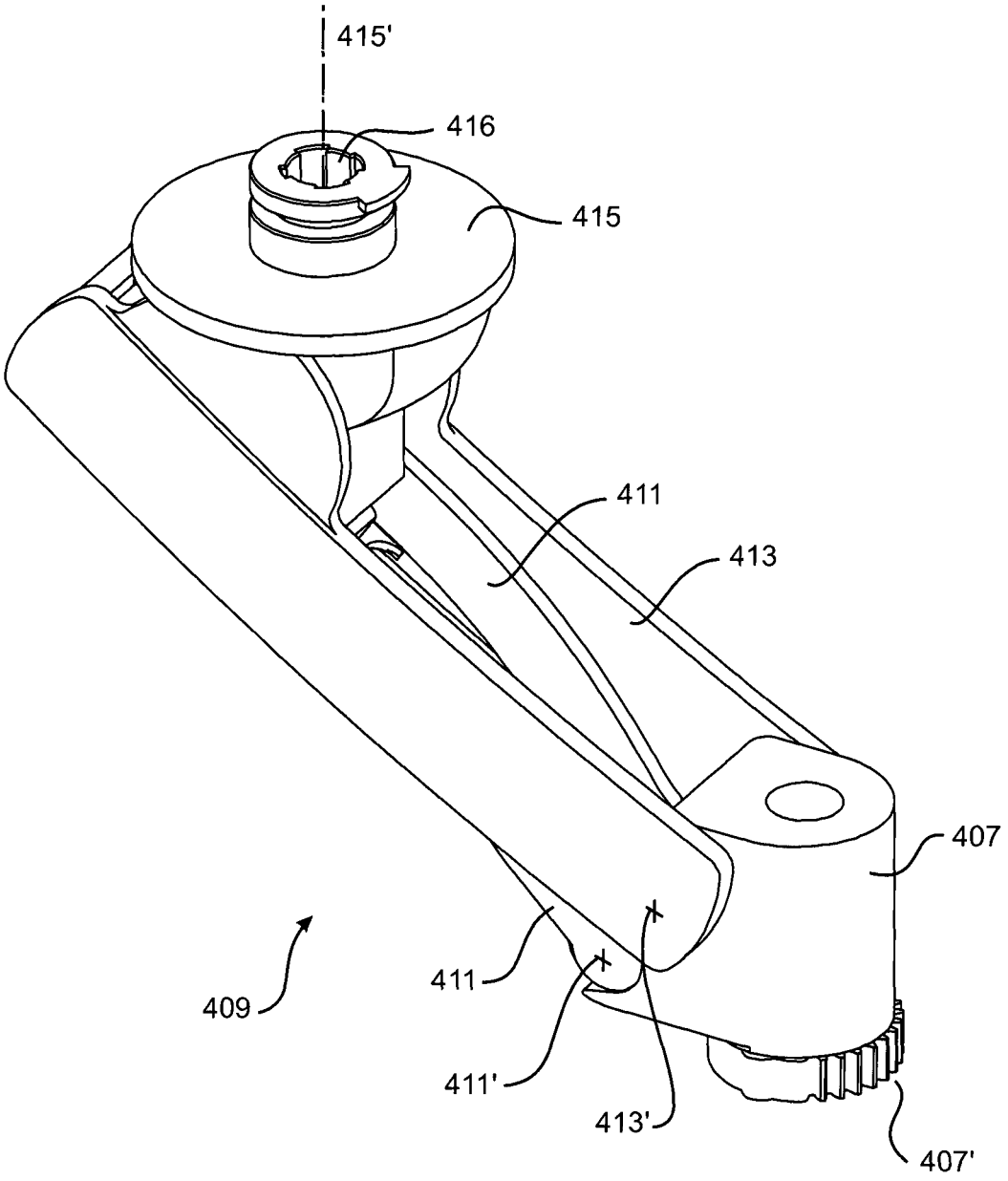
FIG. 71 is a perspective view of one of the linkage arrangements of the head or neck support assembly.
Figure 72:
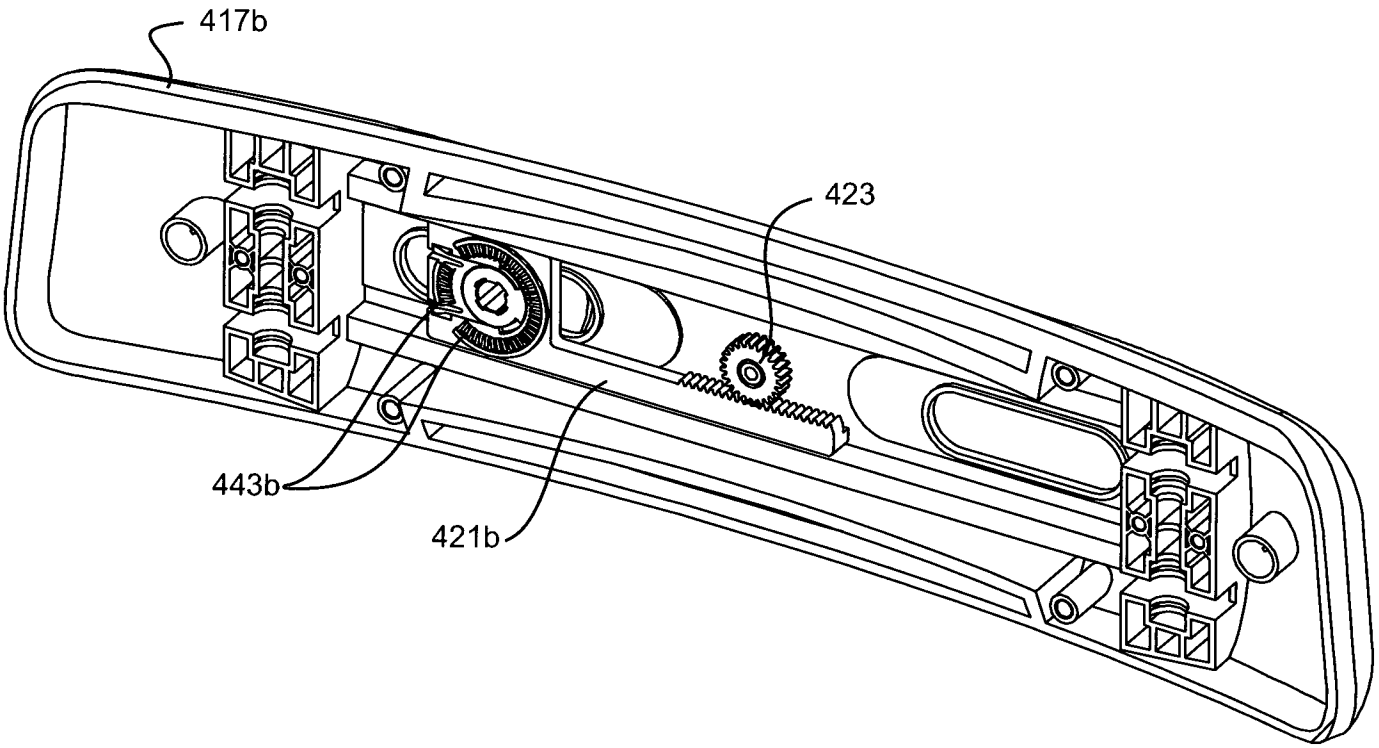
FIG. 72 is a front perspective view of the head or neck support assembly with some parts removed for clarity.

The locking members 433*a*, 433*b* are configured such that when moving the locking member 433*b* from an unlocked position as shown in FIG. 66, to a locked position as shown in FIG. 68, the locking member initially inhibits pivoting of the first pair of generally parallel arms 411*a*, 411*b* relative to the first member 407*b* and then inhibits pivoting of the first member 407*b* relative to the base 403. The locking member 433*b* comprises a first locking member portion 433*b*' for inhibiting pivoting of the first pair of generally parallel arms relative to the first member and which carries the engagement surface 437*b*, a second locking member portion 433*b*" for inhibiting pivoting of the first member relative to the base and which carries the engagement surface 445*b*, and a biasing device 433*d* between the first locking member portion and the second locking member portion to bias the first locking member portion 433*b*' away from the second locking member portion 433*b*". The biasing device can be any suitable type, such as an elastomeric block or a compression spring for example. As shown in FIG. 67, axial movement of the locking member 433*b* initially causes the engagement surface 437*b* to engage with engagement surface 435*b*. Engagement surfaces 443*b*, 445*b* are still disengaged. As shown in FIG. 68, further axial movement of the locking member 433*b* causes engagement surfaces 443*b*, 445*b* to engage. This arrangement prevents fouling of one of the sets of teeth, which could otherwise occur and prevent the locking mechanism from working.

In embodiments having two locking members 433*a*, 433*b*, the features and functioning of the left locking member 433*a* and interaction of the left locking member 433*a* with other components is the same as described above for the right locking member 433*b*. Like reference numerals indicate like parts, with suffix 'a' rather than 'b'.

The locking members 433*a*, 433*b* are slidably mounted in slots 419*a*, 419*b* in unlock plate 419 such that the first and second support links 415*a*, 415*b* can move toward and away from one another. The heads of the locking members 433*a*, 433*b* are configured with recesses that interact with the unlock plate, so that the heads of the locking members can only move relative to unlock plate 419 toward and away from each other or rotate relative to the rack 421, and not in any other direction.

Figure 77:
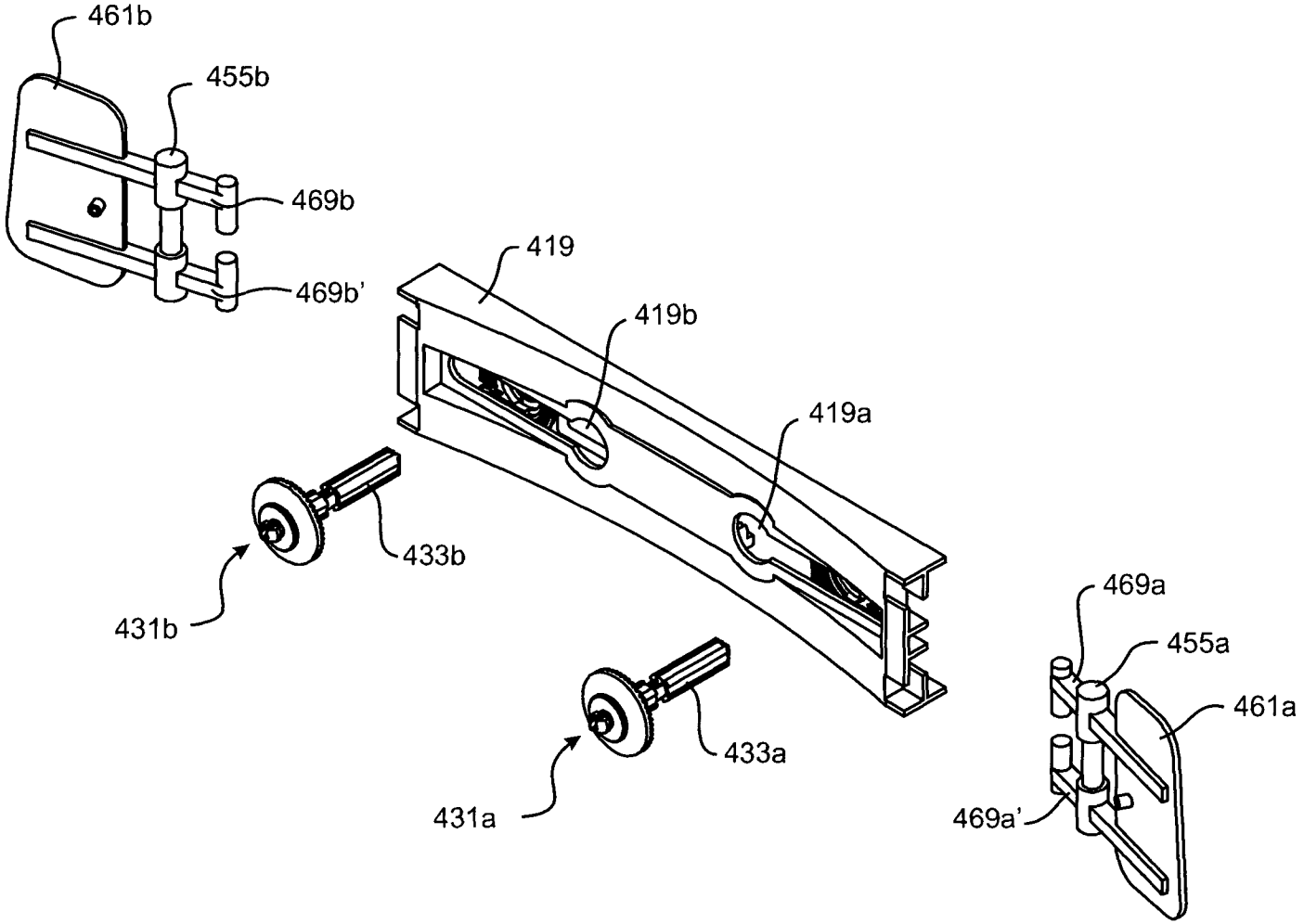
FIG. 77 is a front exploded view corresponding to FIG. 76.
Figure 78:
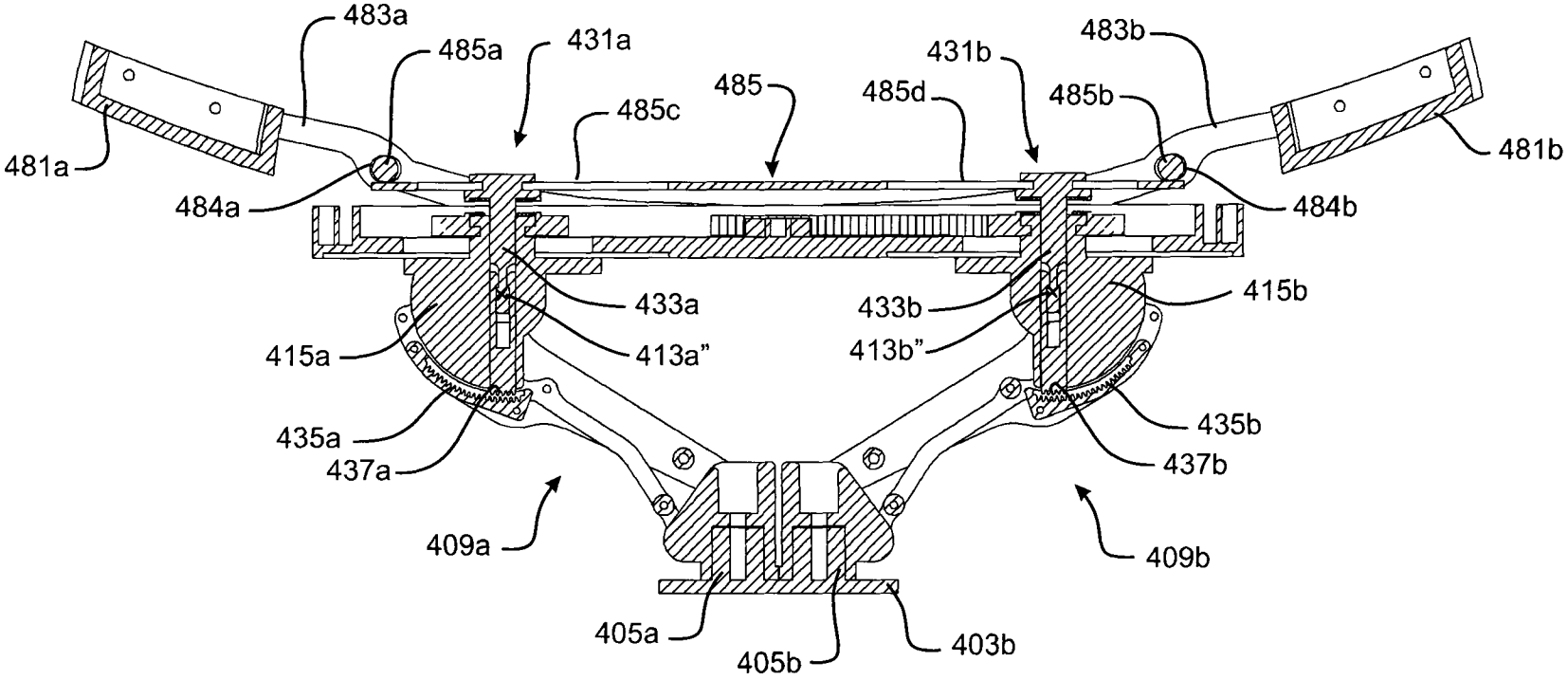
FIG. 78 is a horizontal cross-section view through a second preferred form head or neck support assembly, with the locking members in an unlocked position.
Figure 79:
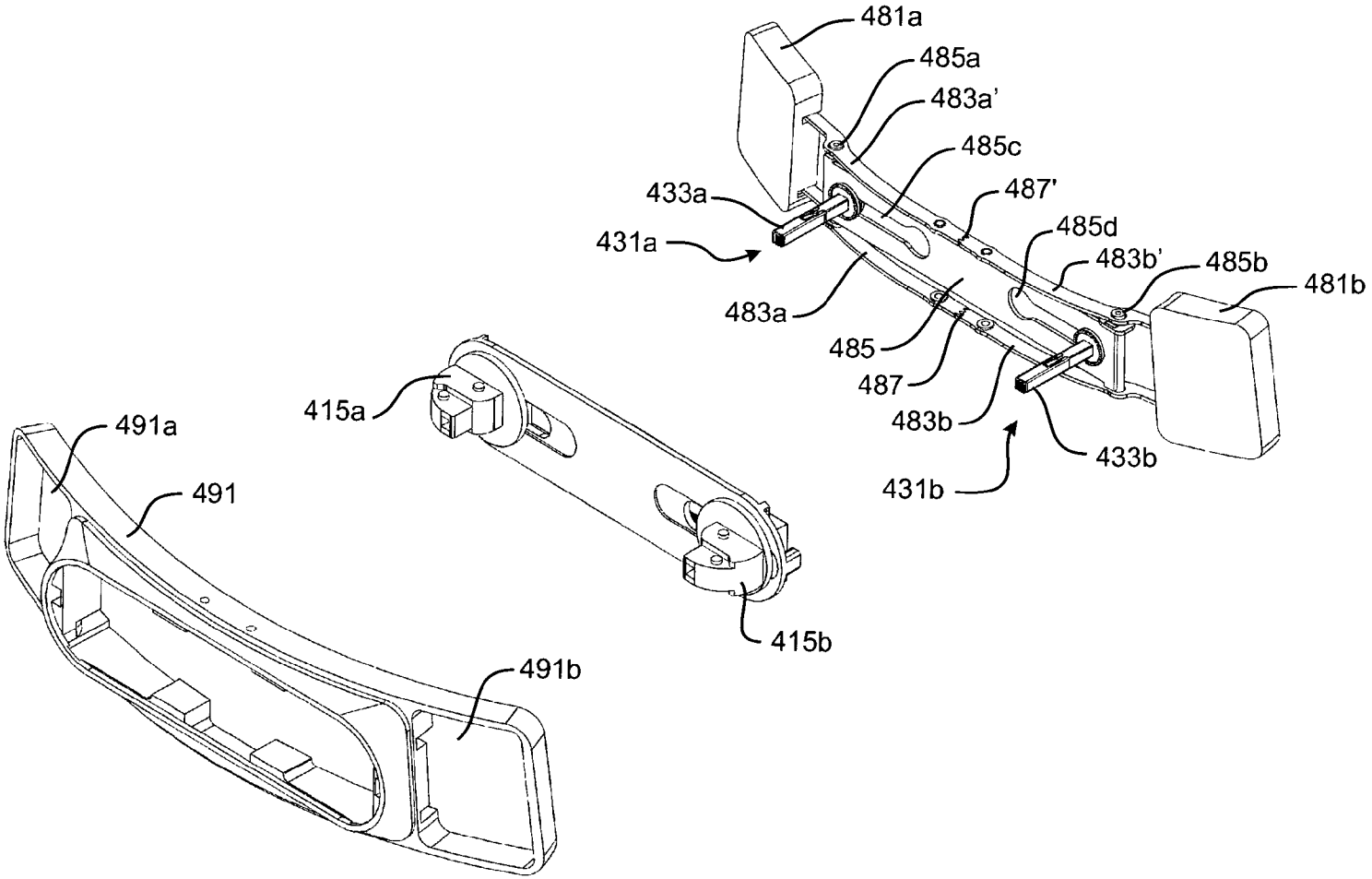
FIG. 79 is rear exploded view of part of the head or neck support assembly of FIG. 78.
Figure 80:
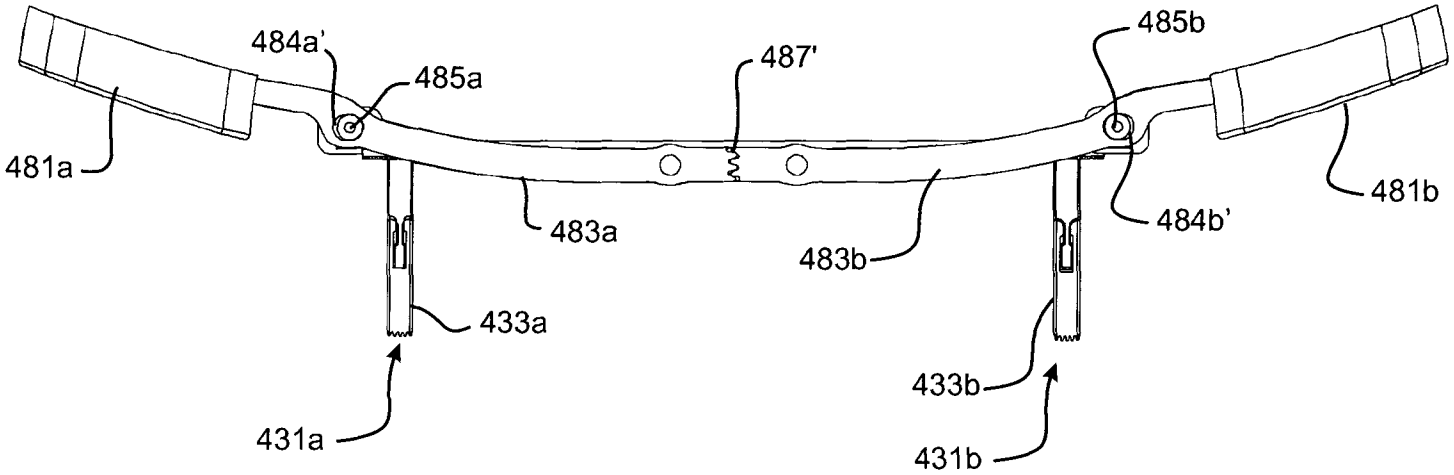
FIG. 80 is a top view of the lever assembly for the neck or head support assembly of FIGS. 78 and 79.
Figure 81:
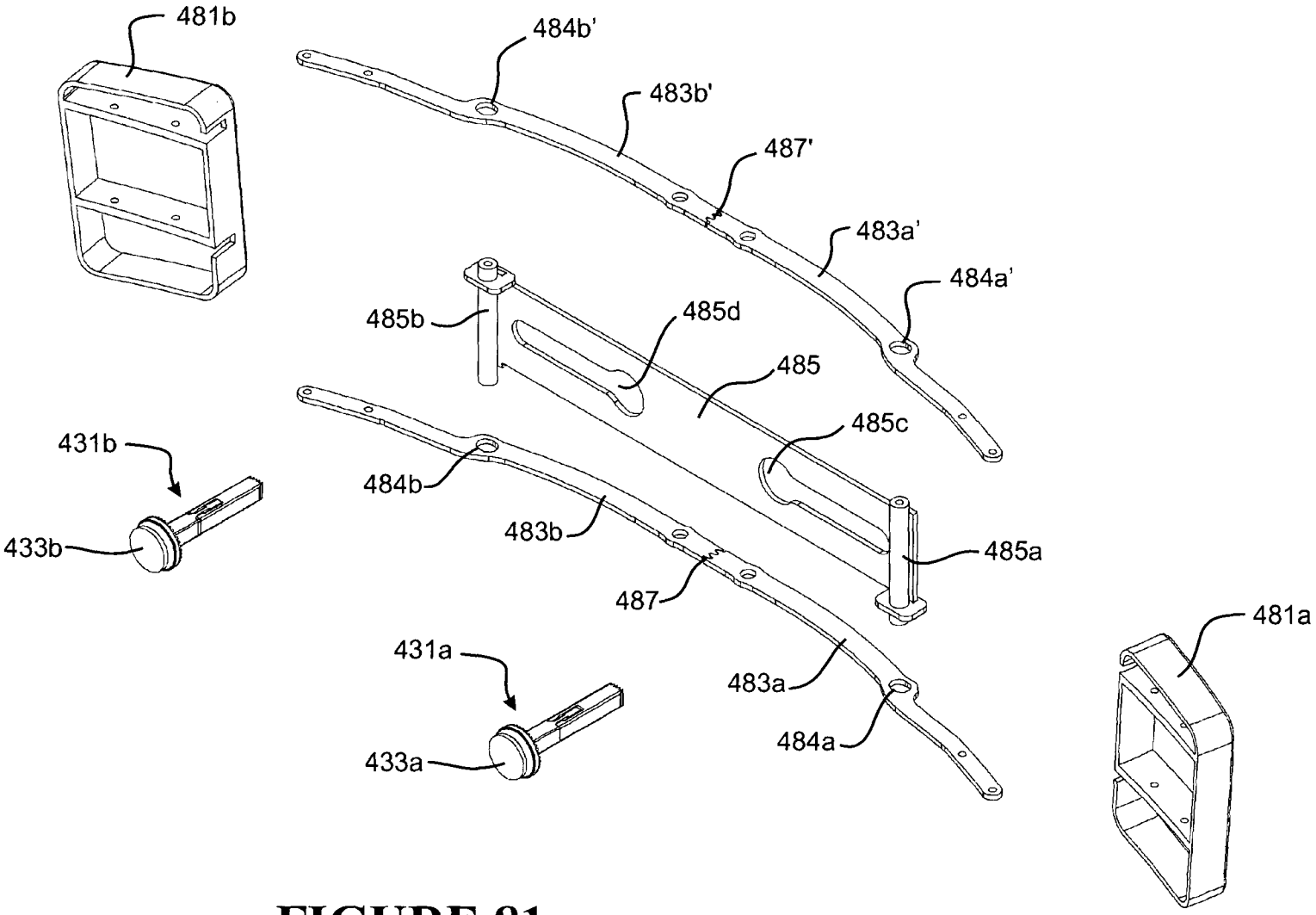
FIG. 81 is a front exploded view corresponding to FIG. 80.
Figure 82A:
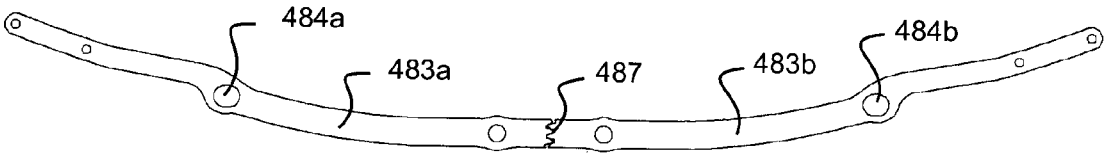
FIGS. 82A to 82C are top views of the levers of the lever assembly of FIGS. 78 to 81, with FIG. 82A showing the lever position when the head or neck support assembly is locked, FIG. 82B showing the lever position when the head or neck support assembly is partially locked.
Figure 82B:
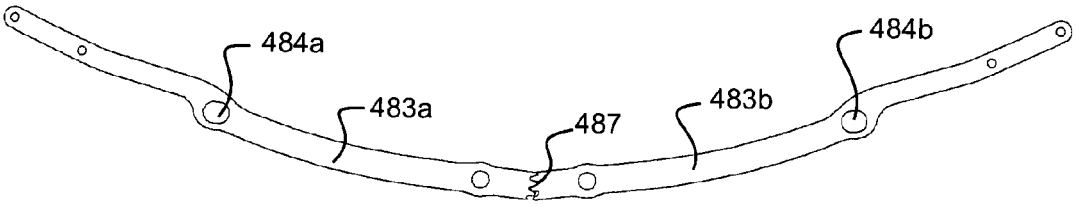
Figure 82C:
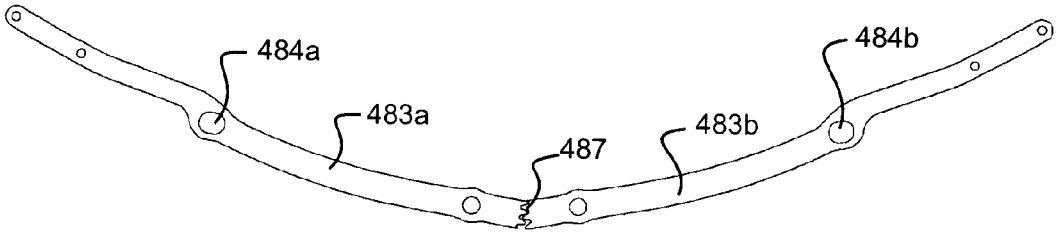

As shown in FIG. 77, the unlock plate 419 is operatively connected to at least one actuation lever 469*a*, 469*b*, 469*a*', 469*b*' each connected at one end to a paddle 461*a*, 461*b* for actuating by a user. Unlock plate 419 has grooves at or toward opposite ends thereof for pivotally receiving the ends of the levers 469*a*, 469*b*, 469*a*', 469*b*'. In one embodiment, a single actuation lever 469*a* could be provided on each side; however, it is preferred that two levers are provided. The levers comprise pivot pins 455*a*, 455*b* that are received in respective grooves 462*a*', 462*b*' in pivot supports 462*a*, 462*b* (FIG. 75), to connect the levers to the member 451. The pivot supports 462*a*, 462*b* attach to the inner surface of the front housing portion 417*a* and the grooves 462*a*', 462*b*' provide a fulcrum for the levers to pivot about. The levers 469*a* and 469*a*' could be one and the same part as the paddle 461*a*, or separate and coupled to the paddle; with the same configuration on the other side.

The outer parts of the levers are attached to paddles 461*a*, 461*b* for use by a chair occupant to release the locking mechanism to enable the head or neck support to be moved to a desired position. The levers 469*a*, 469*b*, 469*a*', 469*b*' are normally biased forward, which corresponds to the unlock plate 419 and the locking members 433*a*, 433*b* being biased rearwardly so the head or neck support is locked in position. The biasing could be provided by any suitable biasing device such as one or more springs acting on the levers or the unlock plate for example. Preferably, the biasing device biases the levers 461*a*, 461*b* and thereby the unlock plate 419 into a position in which the locking members are engaged to inhibit movement of the head or neck support.

The front portion of the housing 417*a* comprises two movable portions 418*a*, 418*b* positioned on either side of the front portion of the housing 417*a*, in front of the paddles 461*a*, 461*b*. The movable portions of the housing are hinged at respective resilient hinges 418*c*, 418*d*. Actuation of the actuation levers 469*a*, 469*b*, 469*a*', 469*b*' by pushing both movable housing portions 418*a*, 418*b* and thereby both paddles 461*a*, 461*b* rearwardly relative to the rear housing member 417*b* moves unlock plate 419 and disengages the locking members 433*a*, 433*b* to enable the position of the head or neck support 417 to be adjusted. Rearward pressure must be applied to both movable portions 418*a*, 418*b* to adjust the head or neck support 417. This prevents inadvertent disengaging of the locking members 433*a*, 433*b* if a user leans their head against one of the movable portions.

FIGS. 78 to 82 show an alternative embodiment mechanism of the head or neck support 401. Unless described below, the features and functioning should be considered to be the same as described above. This embodiment comprises an alternative actuation arrangement with paddles 481*a*, 481*b* that are actuated by pushing the paddles forward from the rear. The embodiment comprises an unlock plate 485 with a pair of slots 485*c*, 485*d* and attached pins 485*a*, 485*b*. Actuation levers 483*a*, 483*b*, 483*a*', 483*b*' connected to paddles 481*a*, 481*b* comprise respective slots 484*a*, 484*b*, 484*a*', 484*b*' that receive the pins 485*a*, 485*b*.

Inner ends of the actuation levers 483*a*, 483*b*, 483*a*', 483*b*' are geared to each other at 487 and 487' respectively, so that movement of one lever will also cause movement of the other lever to which it is geared.

The paddles project from a rear surface of the head or neck support housing 491 adjacent respective sides thereof through openings 491*a*, 491*b*. The levers 483*a*, 483*b*, 483*a*', 483*b*' are normally biased rearwardly, which corresponds to the unlock plate 485 and the locking members 433*a*, 433*b* being biased rearwardly so the head or neck support is locked in position. Actuation of the actuation levers 483*a*, 483*b*, 483*a*', 483*b*' by pushing or pulling the paddles 481*a*, 481*b* forward relative to the head or neck support moves the unlock plate 485 and disengages the locking members 433*a*, 433*b* to enable the position of the head or neck support 417 to be adjusted. Because the actuation levers 483*a*, 483*b*, 483*a*', 483*b*' are geared together, forward movement of either or both paddles moves the unlock plate 485 and disengages the locking members 433*a*, 433*b* to enable the position of the head or neck support 417 to be adjusted.

The head or neck support 417 is moveable relative to the base 403 with two substantially perpendicular degrees of freedom. That is, the support 417 can be moved up and down, and forward and rearward relative to the base 403, in any combination of movements simultaneously, when the actuation lever(s) are actuated by a user. The support 417 can be simultaneously vertically and horizontally adjusted, such as by moving the head or neck support in a diagonal movement relative to the base. The head or neck support can then be maintained in the desired adjusted position by simply releasing the actuation lever(s) so the locking member(s) engage. FIGS. 59A to 59F show a selection some of the possible adjusted positions of the head or neck support.

The orientation of the head rest mechanism could be varied. While in the form shown the pivoting of the generally parallel arms relative to the first members and support links causes forward and rearward movement of the head or neck support relative to the base 403, and the pivoting of members 407*a*, 407*b* relative to the base causes height adjustment of the head or neck support relative to the base, the mechanism could be mounted in a different orientation depending on the specific application and space considerations.

Second Preferred Form Support Assembly

Figure 83:
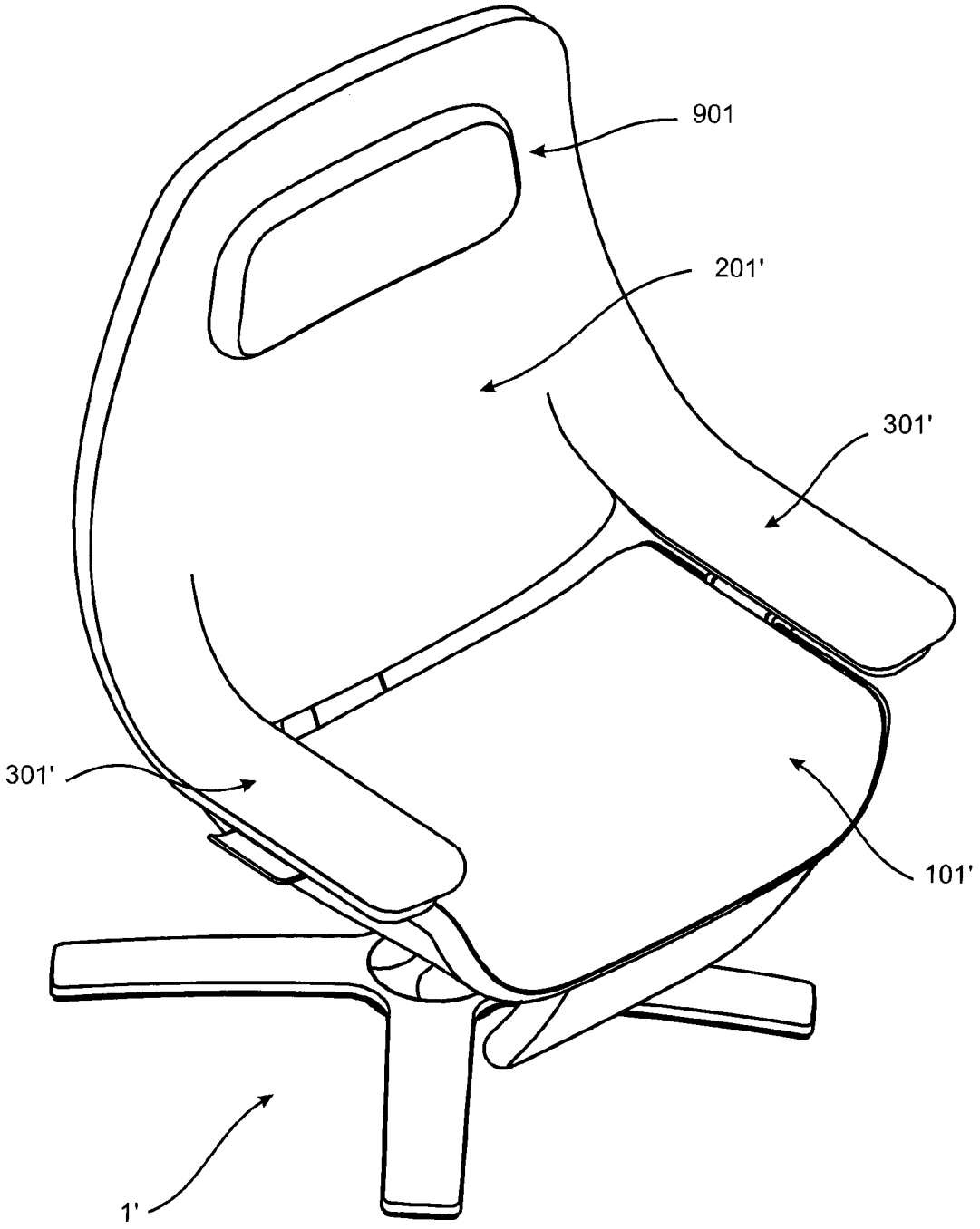
FIG. 83 is a perspective view of a second preferred form chair incorporating a height adjustable head or neck support assembly.
Figure 84:
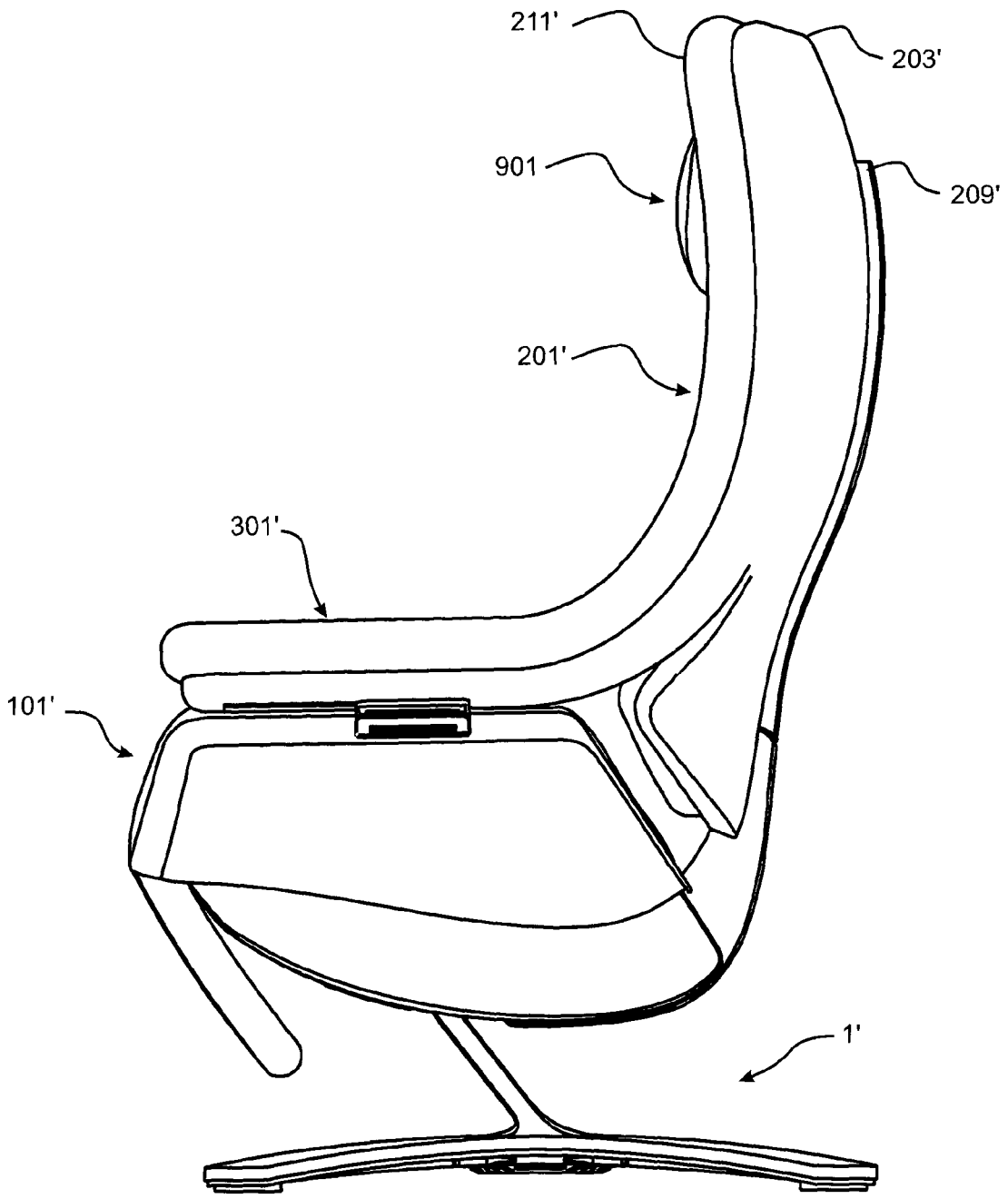
FIG. 84 is a side view of the chair of FIG. 83.
Figure 85:
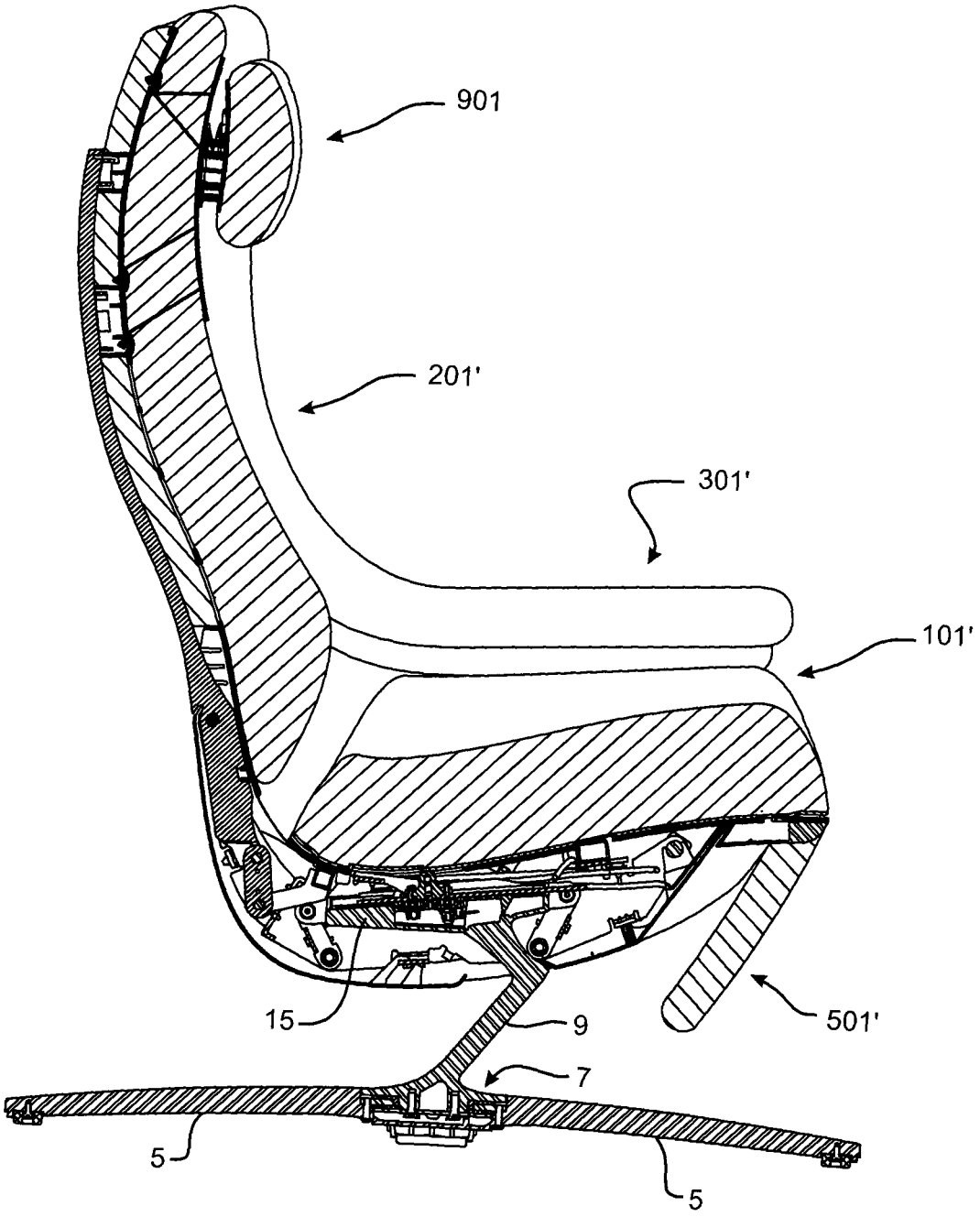
FIG. 85 is a left side section view through the chair of FIGS. 83 and 84.

FIGS. 83 and 84 show a second preferred form chair. Unless described below, the features and functioning of the chair are the same as described above, and like reference numerals indicate like parts with the addition of a prime (').

This chair differs in that it is a high backed chair, with the upper end 203' of the back portion 201' extending upwardly beyond the upper end of the spine 209'. A preferred embodiment adjustable head support arrangement 901 is supported by the back portion 201'.

FIGS. 86 to 104B show preferred embodiments of the adjustable support arrangement 901. The adjustable support arrangements 901 comprise a mounting assembly 903 with first and second parallel closures defining slits 912, a slider arrangement 904 slidable relative to the mounting assembly 903, and a support member 905 operatively connected to the slider arrangement 904. The mounting assembly 903 is configured for attachment to the back portion 201' of the chair. The support member 905 is preferably a head support, but alternatively could be a neck support, and is slidable substantially vertically relative to the mounting assembly 903 and chair back portion 201' when the back portion is generally upright, between an upper position shown in FIG. 86 and a lower position shown in FIG. 87, to adjust the height of the head or neck support member 905.

First and second parallel elongate closures each comprise two opposed, engagable sides 912*a*, 912*b* that engage to close or partially close the respective slit 912 in the closure. The slider arrangement 904 comprises two pairs of sliders 923 and a carriage 925. The sliders 923 act to open or close the respective slit 912 as they slide along the slits 912. The closures provide compliant flexible support rails upon which the support member 905 is supported.

Figure 90:
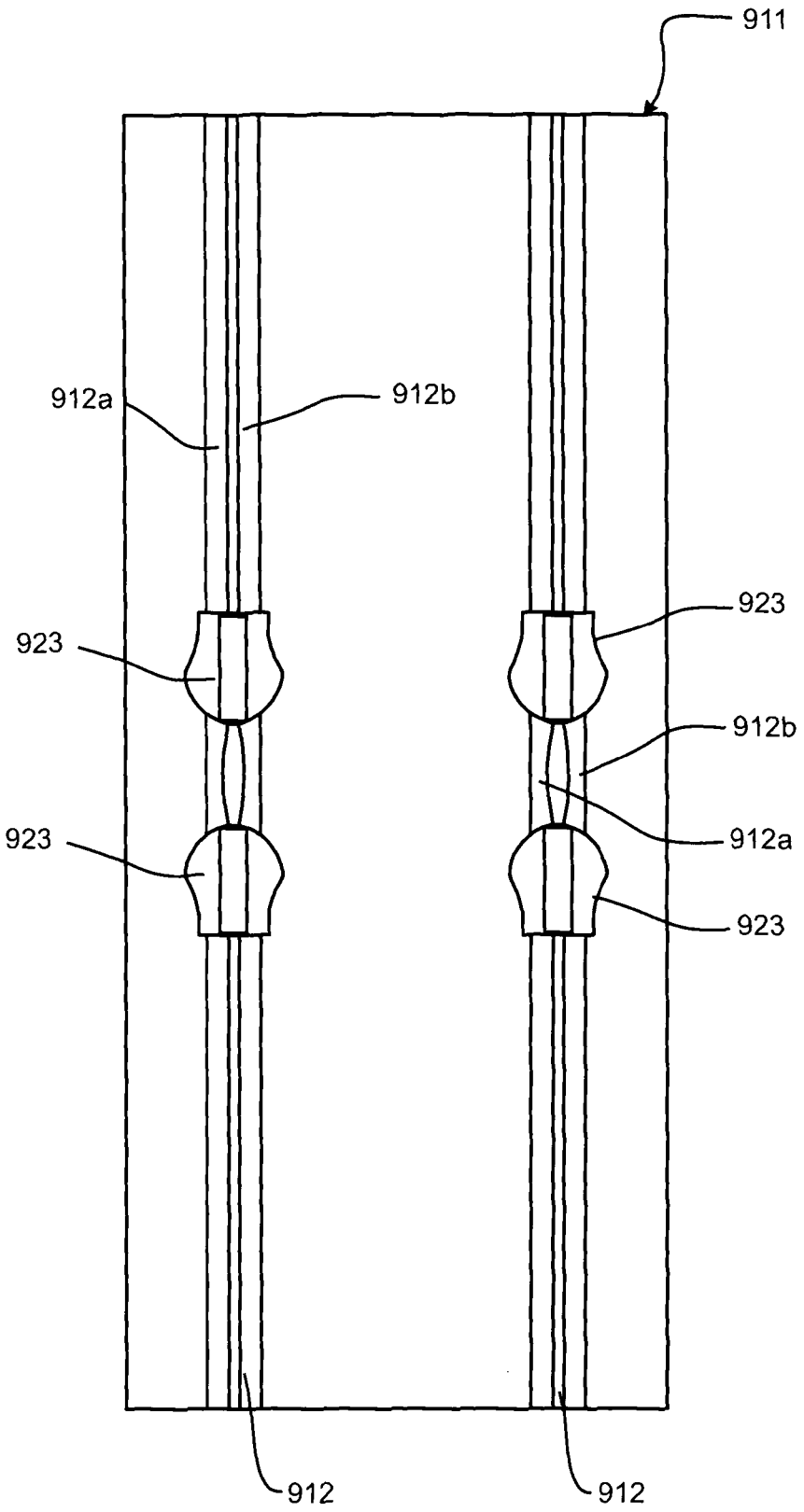
FIG. 90 is a front view of the double zipper member and attached sliders of the mounting assembly of FIGS. 86 to 89.

One pair of the sliders 923 is arranged on each of the first and second slits 912, as shown in FIG. 90, with the two sliders in each pair oppositely oriented. The carriage 925 attaches to each of the sliders 923 to fix the sliders relative to each other. As the carriage 925 is moved up and down relative to the mounting arrangement 903, all four sliders slide along the respective slits to the same extent. The head or neck support member 905 in turn is connectable to the carriage 925. As the sliders 923 in each pair are oppositely opposed, as the carriage is moved the leading slider in the direction of movement opens the slit 912 of the closure, and the trailing slider in the direction of movement closes the slit 912 of the closure.

In the embodiment of FIG. 90, the closures and sliders 923 each comprise a flexible zipper with the opposed sides 912*a*, 912*b* of the zipper having engagable teeth. The upper zipper slider 923 in each pair of sliders is arranged so that the zipper 912 is closed above the slider and open immediately below the slider. The lower slider 923 in each pair is oppositely arranged so that the slit 912 is open immediately above the slider 923 and closed below the slider 923. By that configuration, the only portion of each zipper slit 912 that is open is the portion between the sliders 923. That portion will be hidden in use by the support panel 905, when viewed from the front of the chair.

Preferably, the teeth of the zippers have 10 mm width when engaged, and the closures are preferably about 230 mm long to provide about 170 mm range of adjustable travel of the support member 905. The zippers are positioned a suitable distance apart, such as about 60 mm between slits 912 for example. Alternative sizes and configurations could be used.

Figure 91:
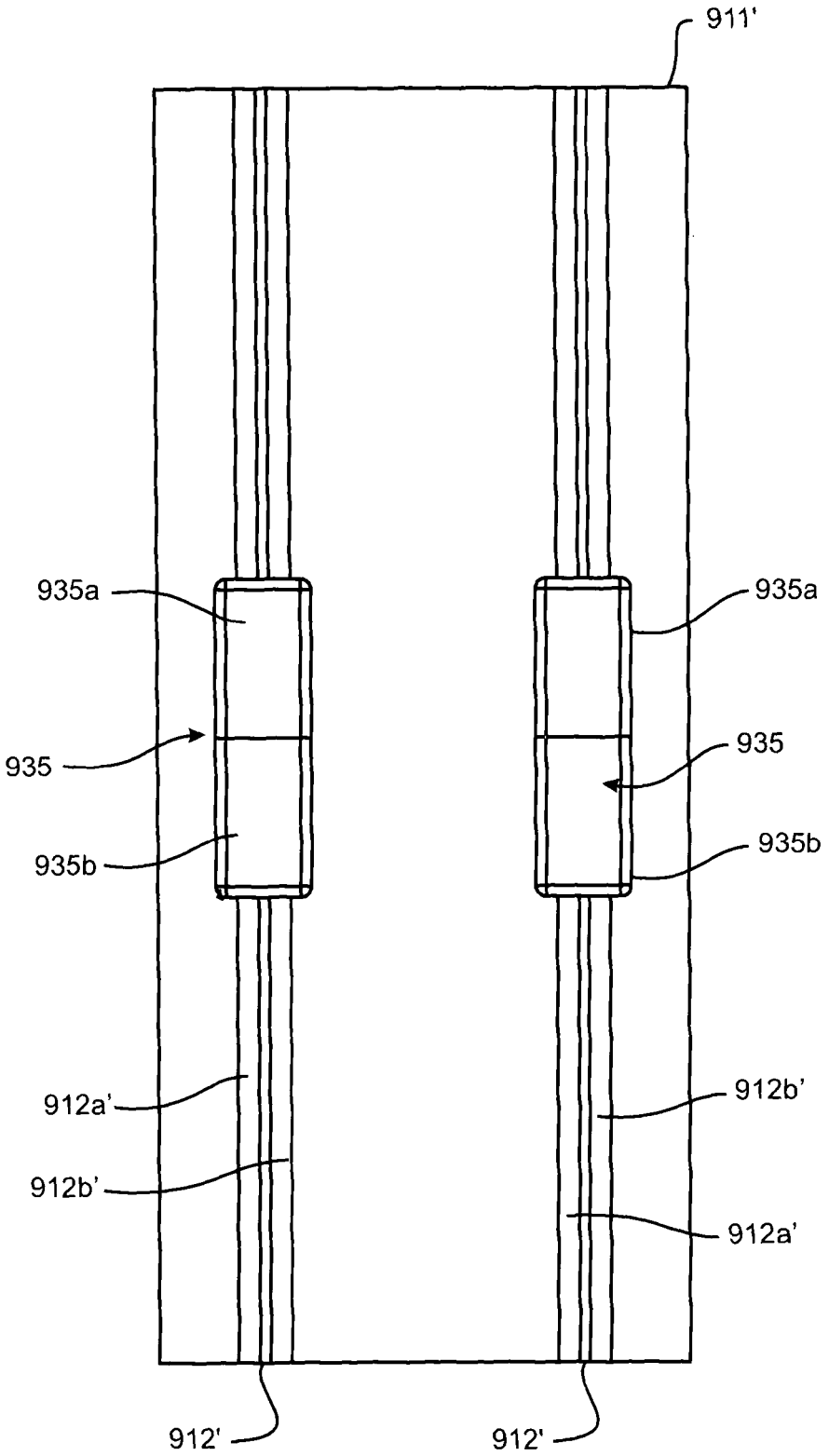
FIG. 91 is a front view of a double zipper member and attached sliders for a mounting assembly according to an alternative embodiment.
Figure 92A:
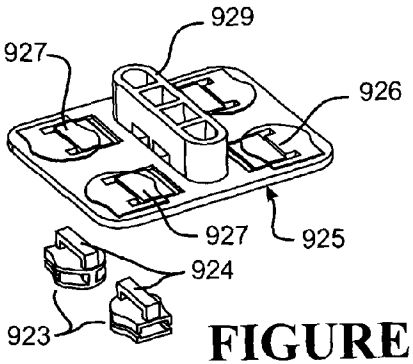
FIG. 92A is a perspective view of the slider carriage of the support assembly of FIGS. 86 to 88, with two sliders unattached.
Figure 93A:
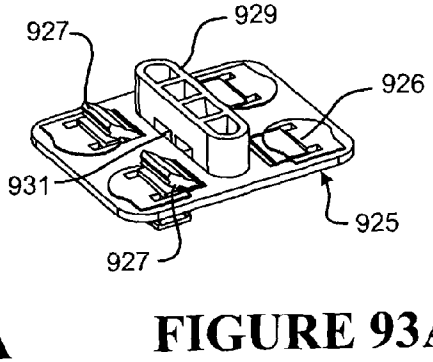
FIG. 93A is a perspective view of the slider carriage of FIGS. 92A to 92C, with the two sliders being pressed into place during assembly.
Figure 92B:
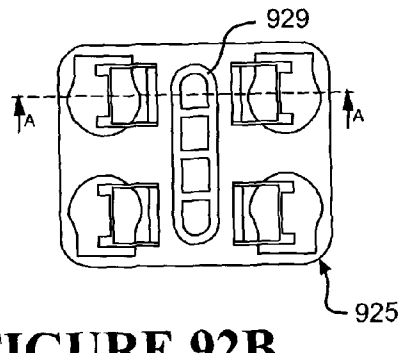
FIG. 92B is a plan view of the slider carriage arrangement in FIG. 92A.
Figure 93B:
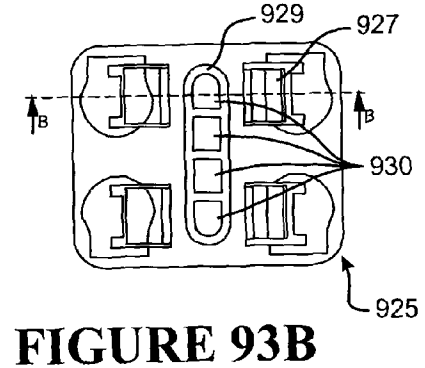
FIG. 93B is a plan view of the slider carriage arrangement in FIG. 93A.
Figure 92C:
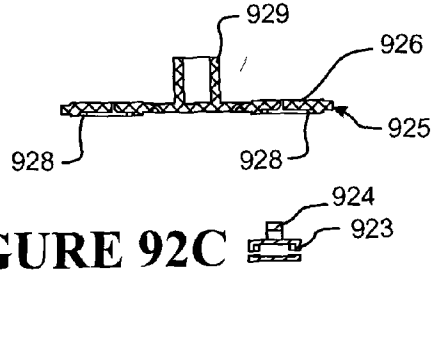
FIG. 92C is a section view taken along A-A of FIG. 92B.
Figure 93C:
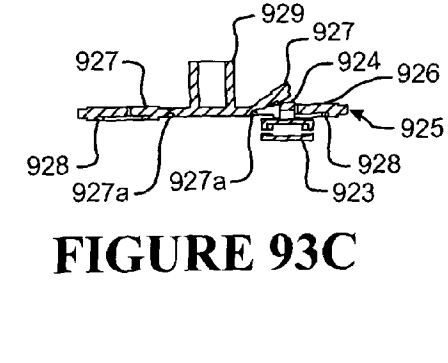
FIG. 93C is a section view taken along B-B of FIG. 93B.

In an alternative embodiment shown in FIG. 91 the two elongate parallel closures each comprise slits 912' and sliders 935 in a flexible zip-lock type arrangement. The two opposed, engagable sides 912*a*', 912*b*' of the closures comprise complementary elongate projections and recesses running along the length of the slits. A two-part slider 935 comprising and upper portion 935*a* and a lower portion 935*b* is arranged on each slit. Each upper portion 935*a* causes engagement of the complementary projections to close the respective slit 912' above the slider as the slider is lowered, and parts the two sides 912*a*', 912*b*' immediately below the portion 935*a* as the slider is raised. Conversely, each lower portion 935*b* causes engagement of the complementary projections to close the slit below the slider as the slider is raised, and parts the two sides 912*a*', 912*b*' immediately above the portion 935*b* as the slider is lowered. With this arrangement, the slits 912' are closed above and below the slider arrangement for any position of the slider arrangement intermediate the two ends. The upper and lower portions 935*a*, 935*b* of each slider 935 may be separate parts or may be integral.

In further alternative embodiments, the sliders 923, 935 may be oppositely oriented so that the slits 912, 912' are open above and below the slider arrangement 904 and closed between sliders 923 or slider portions 935*a*, 935*b* on the same slit. The orientation of the sliders on the first slit may be different to the orientation of the sliders on the second slit.

For example, the first slit and the respective slider(s) may be arranged so that the first slit is open above and below the slider arrangement 904; and the second slit and the respective slider(s) may be arranged so that the second slit is closed above and below the slider arrangement 904 as the slider arrangement is moved up and down.

While the following description relates to the zipper embodiment, it will be appreciated that the features and functioning for the zip-lock type embodiment will be the same.

Figure 86:
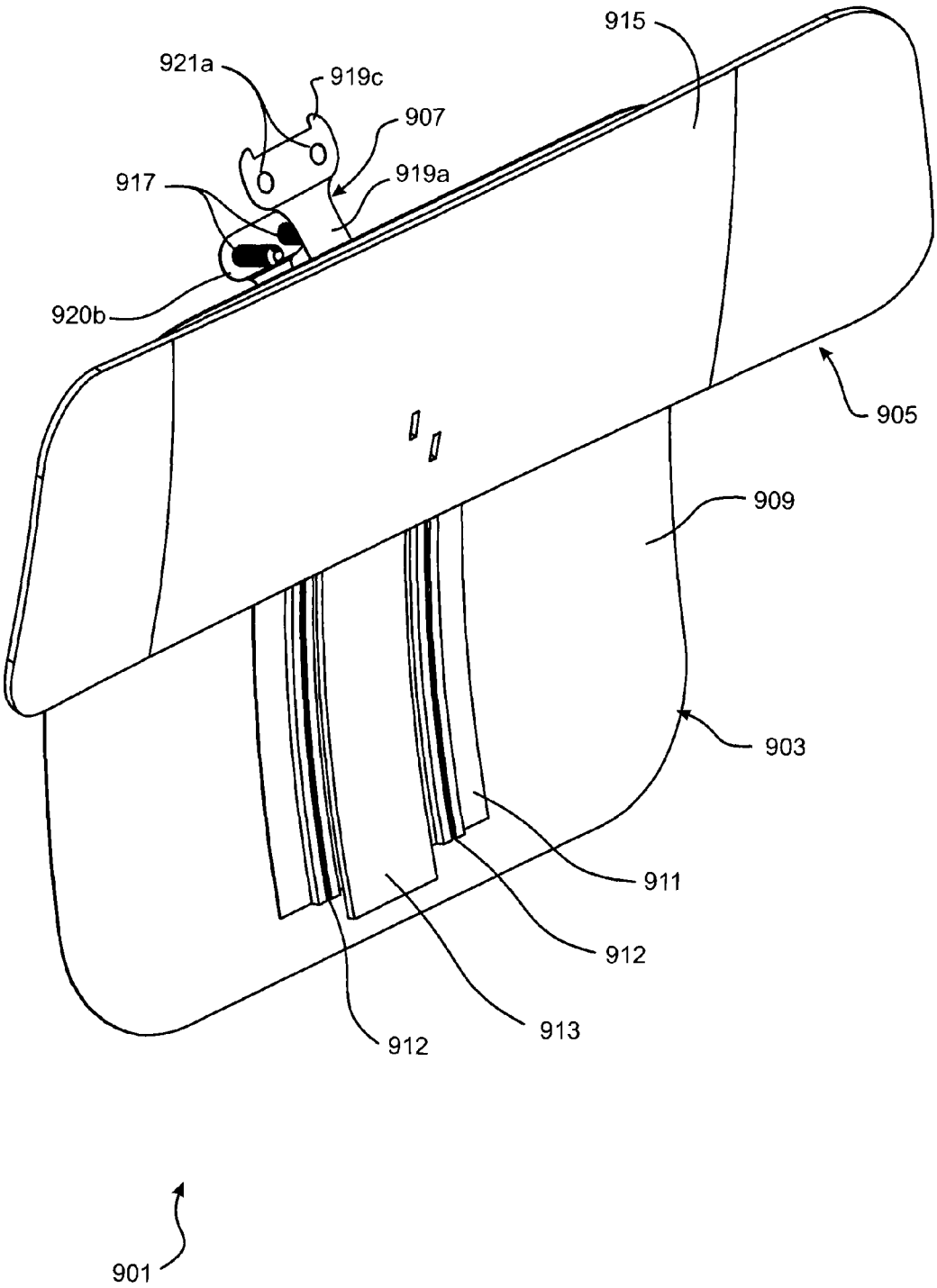
FIG. 86 is a perspective view of a preferred form height adjustable head or neck support assembly for attaching to a high back chair such as that shown in FIGS. 83 and 84, showing the head or neck support member in its highest position.
Figure 87:
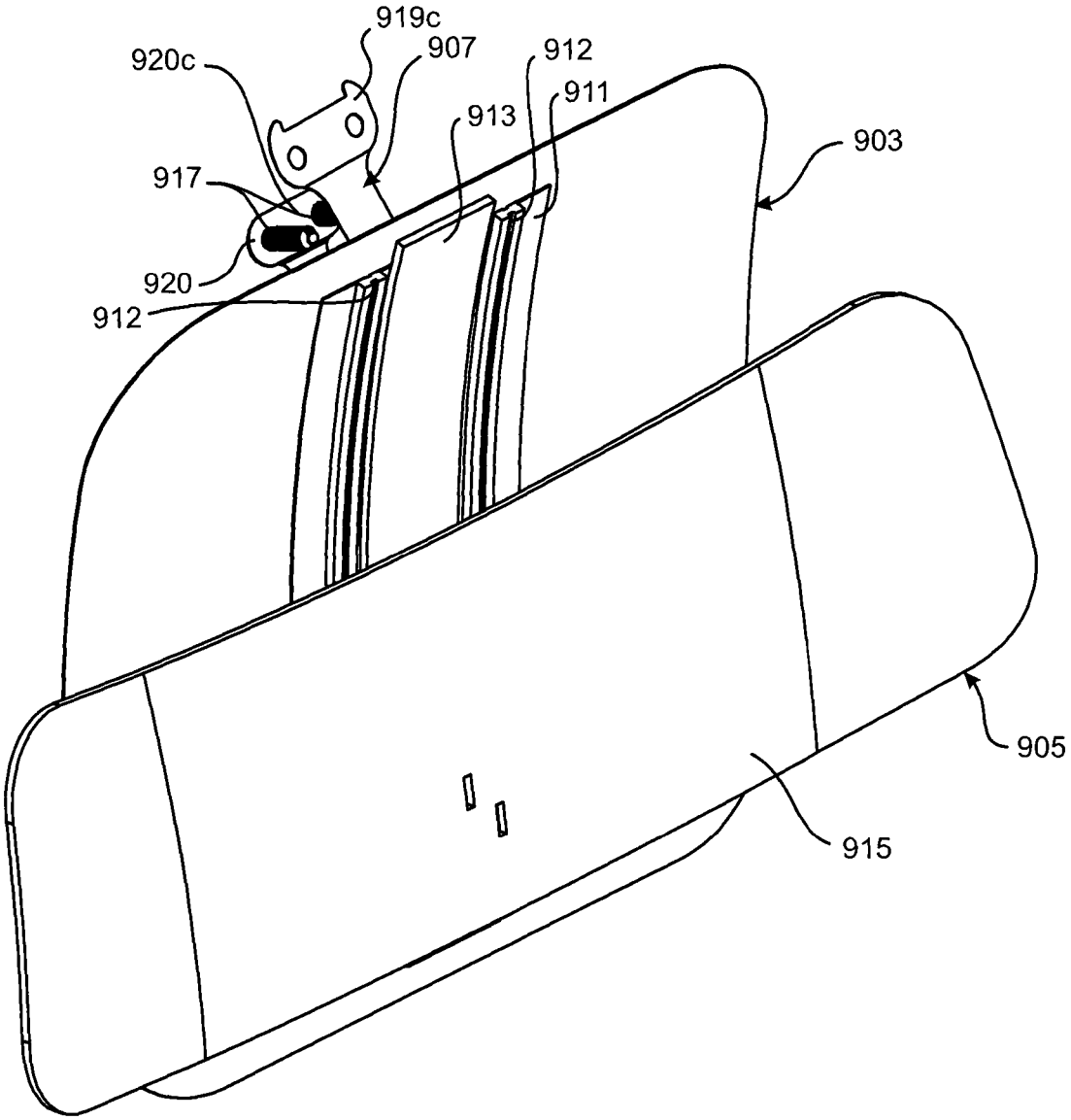
FIG. 87 is a perspective view of the head or neck support assembly shown in FIG. 86, showing the head or neck support member in its lowest position.
Figure 88:
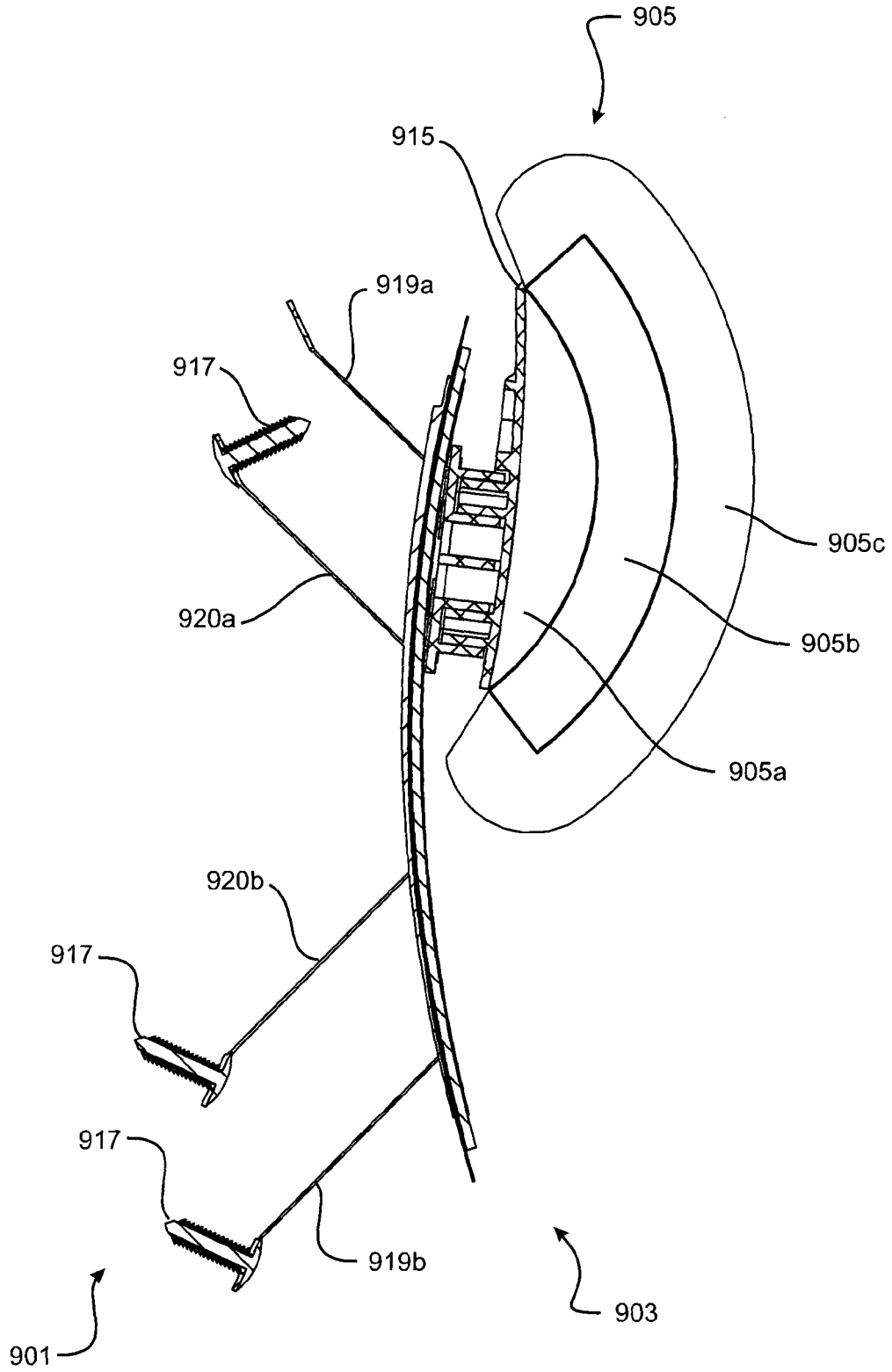
FIG. 88 is a section view of the head or neck support assembly of FIGS. 86 and 87, taken through a vertical centreline of FIG. 86.
Figure 89:
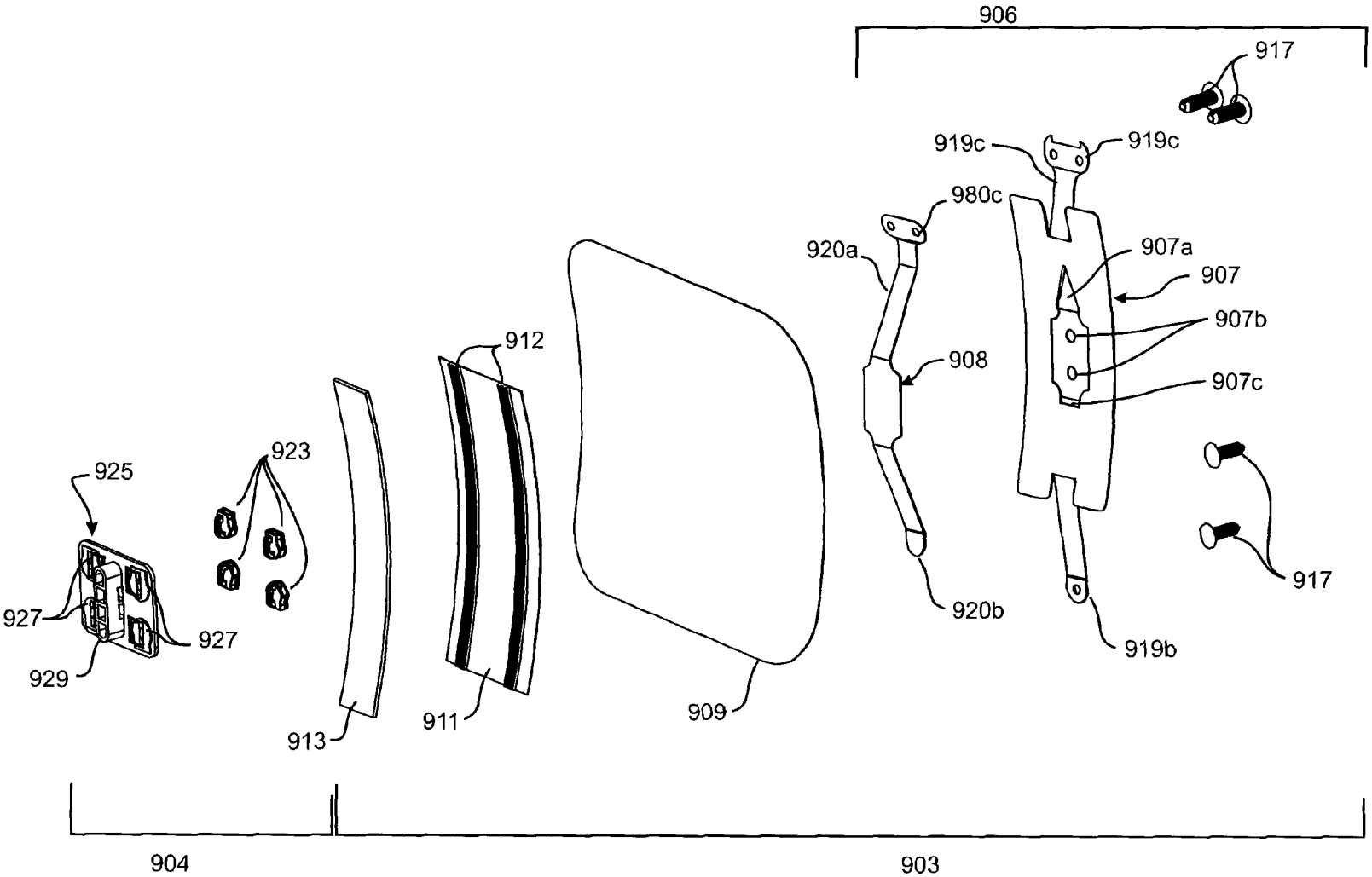
FIG. 89 is an exploded perspective view of the mounting assembly and slider arrangement of the head or neck support assembly of FIGS. 86 to 88.

The support member 905 is adjustable to a plurality of intermediate positions between the upper and lower positions of FIGS. 86 and 87 by sliding the sliders along the respective closures. The engagement between the opposing sides of each slit 912, 912' holds the sliders and the support 905 in place in the absence of an applied force. To adjust the height of the support 905, an upward or downward force must be applied that is sufficient to slide the sliders along the closures 912, 912' closing and opening respective portions of the slits.

Figure 94A:
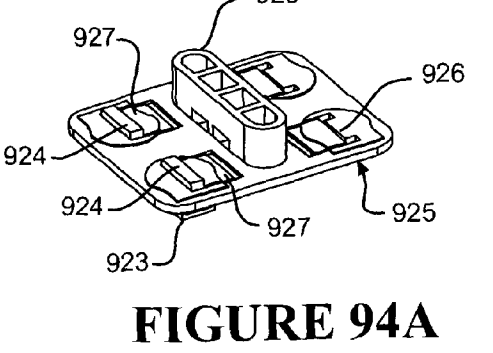
FIG. 94A is a perspective view of the slider carriage of FIGS. 92A to 93C, with the sliders attached to the carriage.
Figure 94B:
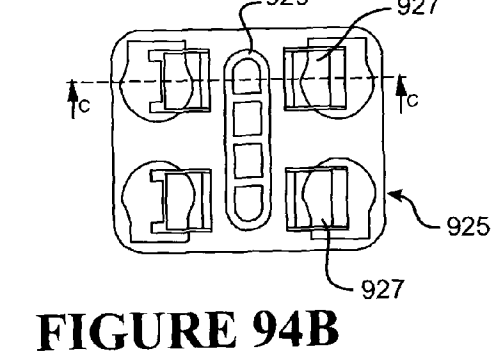
FIG. 94B is a plan view of the slider carriage arrangement in FIG. 94A.
Figure 94C:
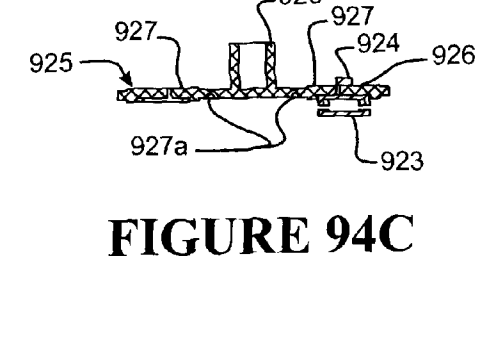
FIG. 94C is a section view taken along C-C of FIG. 94B.
Figure 95A:
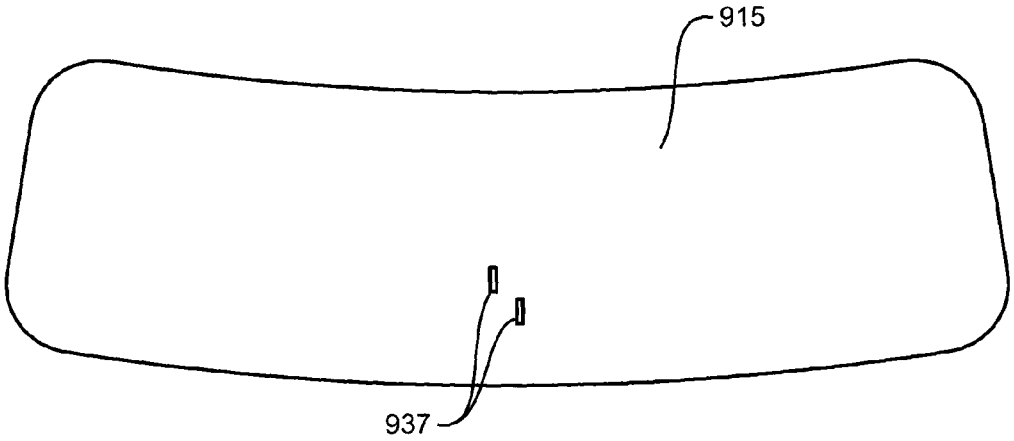
FIG. 95A is a front view of the head or neck support of FIGS. 86 to 88.
Figure 95B:
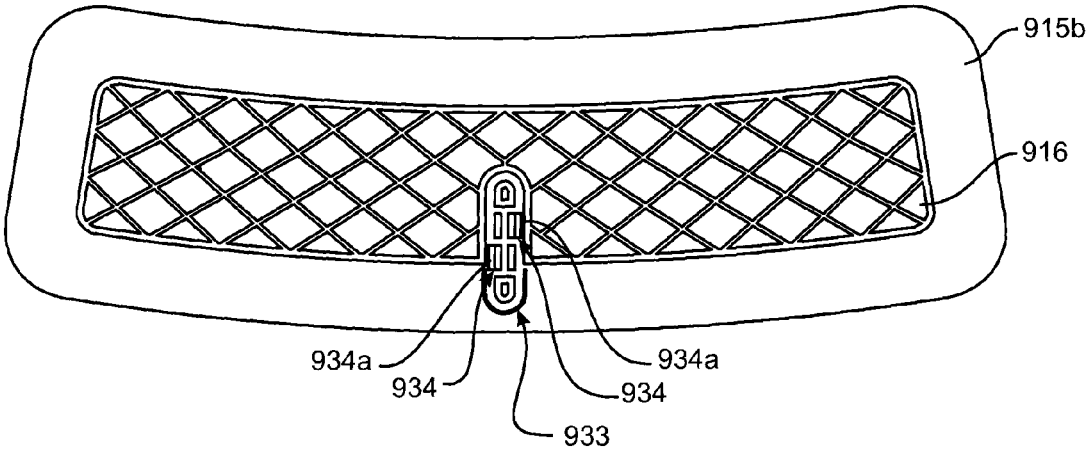
FIG. 95B is a rear view of the head or neck support of FIG. 95A.
Figure 96A:
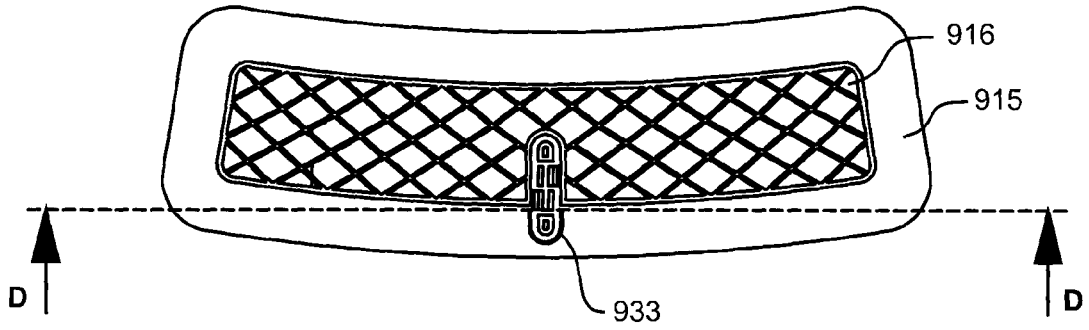
FIG. 96A is the view of FIG. 95B, indicating section line D-D.
Figure 96B:
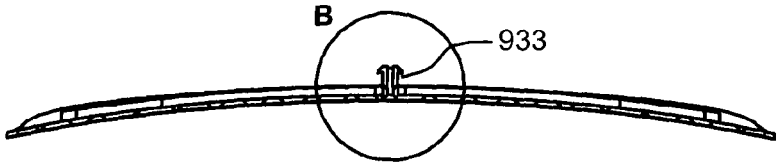
FIG. 96B is section view taken along D-D of FIG. 96A.
Figure 96C:
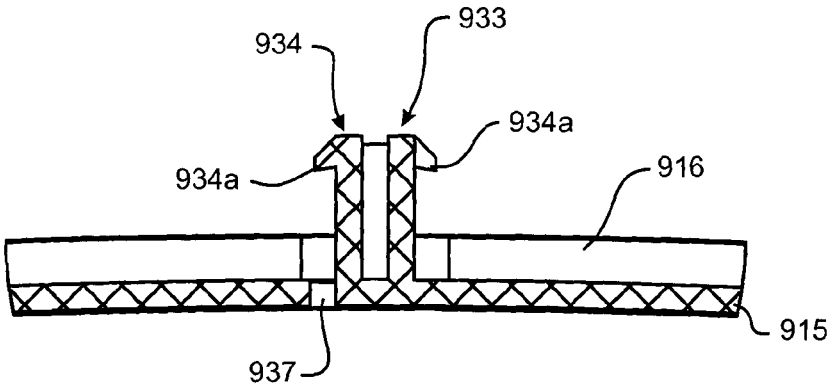
FIG. 96C is an enlargement of the detail B in FIG. 96B.

FIGS. 92A to 94C show the carriage 925 of FIGS. 86 to 89, and attachment of the zipper sliders 923 to the carriage 925. An underside of the carriage 925 comprises four recesses 928 shaped to receive a top portion of the zipper sliders 923. An upper portion of each recess 928 comprises an aperture, a boss 926, and a resilient flap 927. To attach the sliders 923 to the carriage, the sliders 923 are pressed into the carriage recesses. Each zipper slider 923 comprises a crown 924, which in conventional zippers is for attaching a pull tab. The crowns 924 on the sliders push the flaps 927 upwards, as shown in FIGS. 93A to 93C. The slider 923 can then be slid sideways onto the respective boss 926 so that the boss 926 is positioned between the slider crown 924 and the slider body. The respective flap 927 then snaps downwards to lock the slider 923 on the boss 926 to fixing it to the carriage 925, as shown in FIGS. 94A to 94C.

In an alternative embodiment, the carriage and the sliders 923 or 935 may be integral.

The carriage 925 comprises a centrally positioned support connector 929 protruding from an opposite surface of the carriage 925 from the sliders, for attaching the head or neck support 905 to the carriage and thereby to the mounting assembly 903. The support connector 929 comprises four hollow compartments 930 which are open at a front end, for receiving portions of complementary connector(s) on the support 905. The two middle compartments each comprise at least one side aperture 931 at their base.

FIGS. 95A to 96C show the head or neck support member 905. The head or neck support member 905 comprises a support panel 915. A back side of the support panel 915 comprises a ribbed portion 916. The ribbed portion 916 provides additional strength to the support 905 and preferably allows some flexing of the support panel 915. In the embodiment shown, the ribbing in the ribbed portion is in the form of a lattice, but alternatively other ribbing patterns may be used. The back side of the support panel 915 comprises a non-ribbed surface 915*a* around the periphery of the ribbed portion 916, for attaching upholstery.

The head or neck support member 905 may further comprise one or more layers of cushioning, and covering upholstery. The support member 905 shown in FIG. 88 comprises three foam cushioning layers 905*a*, 905*b*, 905*c* of different densities. The first foam layer 905*a* adjacent the support panel 915 has the highest hardness and density, the middle foam layer 905*b* is less dense than the first layer 905*a*, and the outer layer 905*c* has the lowest density and is the softest layer to provide maximum compliance to a user's head or neck. Alternatively, the cushioning may comprise a single moulded foam member.

The support panel 915 comprises a rearwardly projecting carriage connector 933 for connecting the support to the carriage 925. Alternatively, the connector 933 may be a separate member attached to the support panel 915.

The carriage connector 933 comprises a plurality of projections protruding from the main support panel 915 configured to fit into the compartments on the support connector 929 on the carriage 925. Two of the projections 934 for receipt by the two central compartments on the support connector 929 each comprise a lateral lip or catch 934*a*. Apertures 937 in the main support panel 915 adjacent to those two projections 934 enable those projections to be resiliently moved relative to the main support panel 915. The carriage connector 933 and the support connector 929 are connectable by way of a snap-fit. As the support connector 929 and the carriage connector are moved into engagement, the central projections 934 deflect resiliently inwards. When the lips or catches 934*a* reach the base of the respective compartment, the lips or catches move into the apertures 931 at the base of the support connector 929 to engage the support connector 929.

In an alternative embodiment, the head or neck support 905 and the carriage 925 may be integral and/or the carriage 925 and the sliders 923 may be integral.

Figure 97:
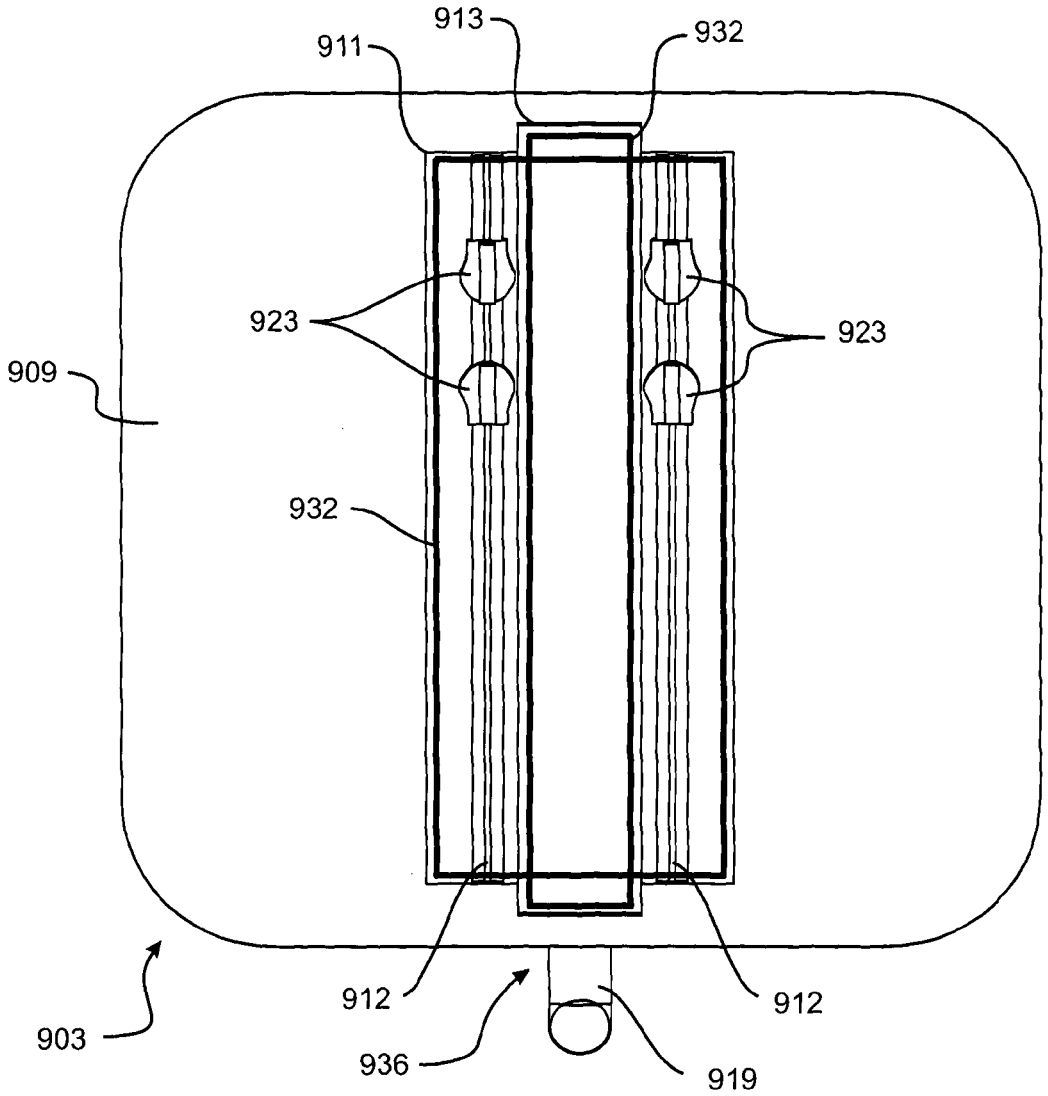
FIG. 97 is a front view of the mounting assembly of FIGS. 86 to 89, illustrating assembly and stitching of the load dispersion panel, double zipper member and trim strip.
Figure 98B:
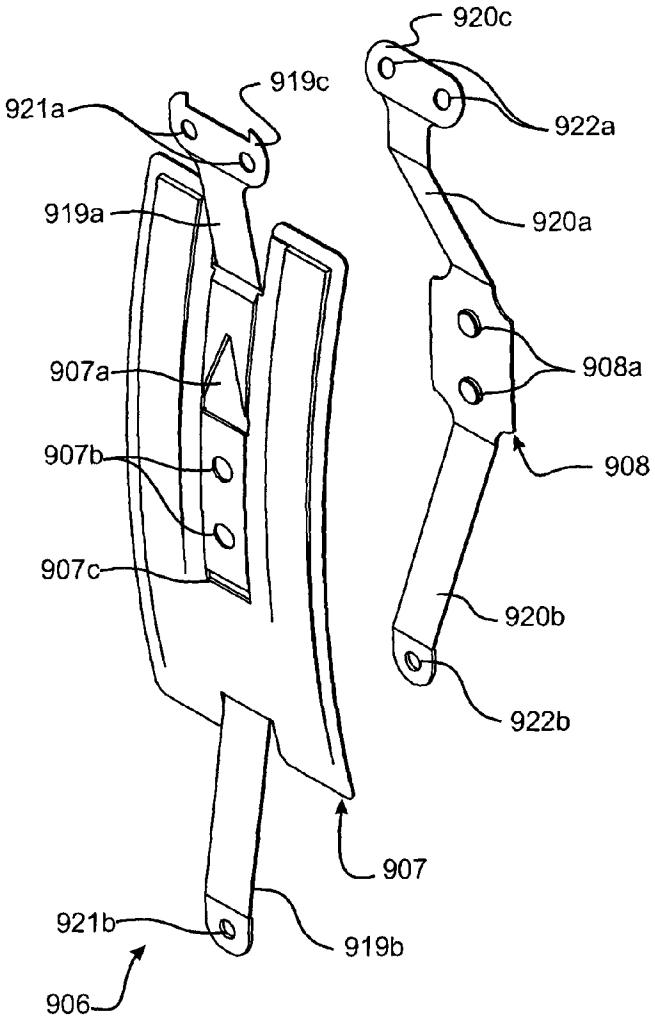
FIG. 98B is an exploded perspective view of the back attachment assembly of FIG. 98A.
Figure 98A:
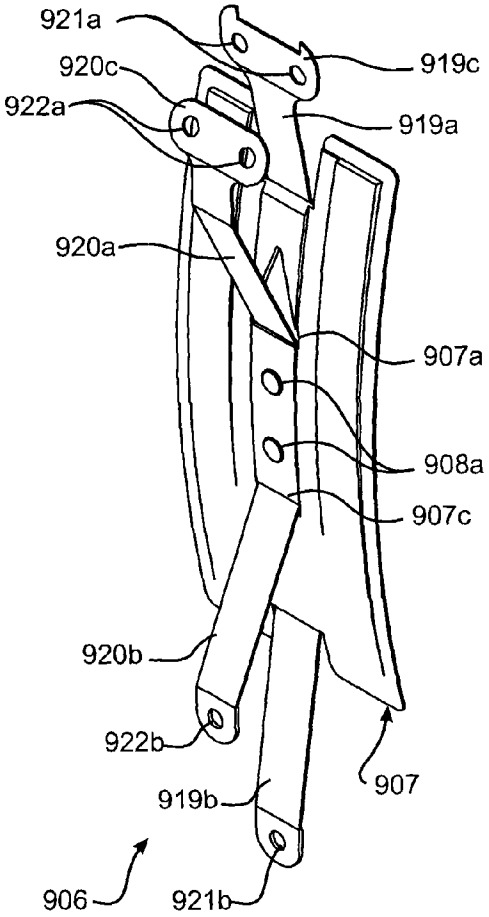
FIG. 98A is a rear perspective view of the back attachment assembly shown in FIGS. 86 to 89.
Figures 99A, 99B, 99C, 99D:
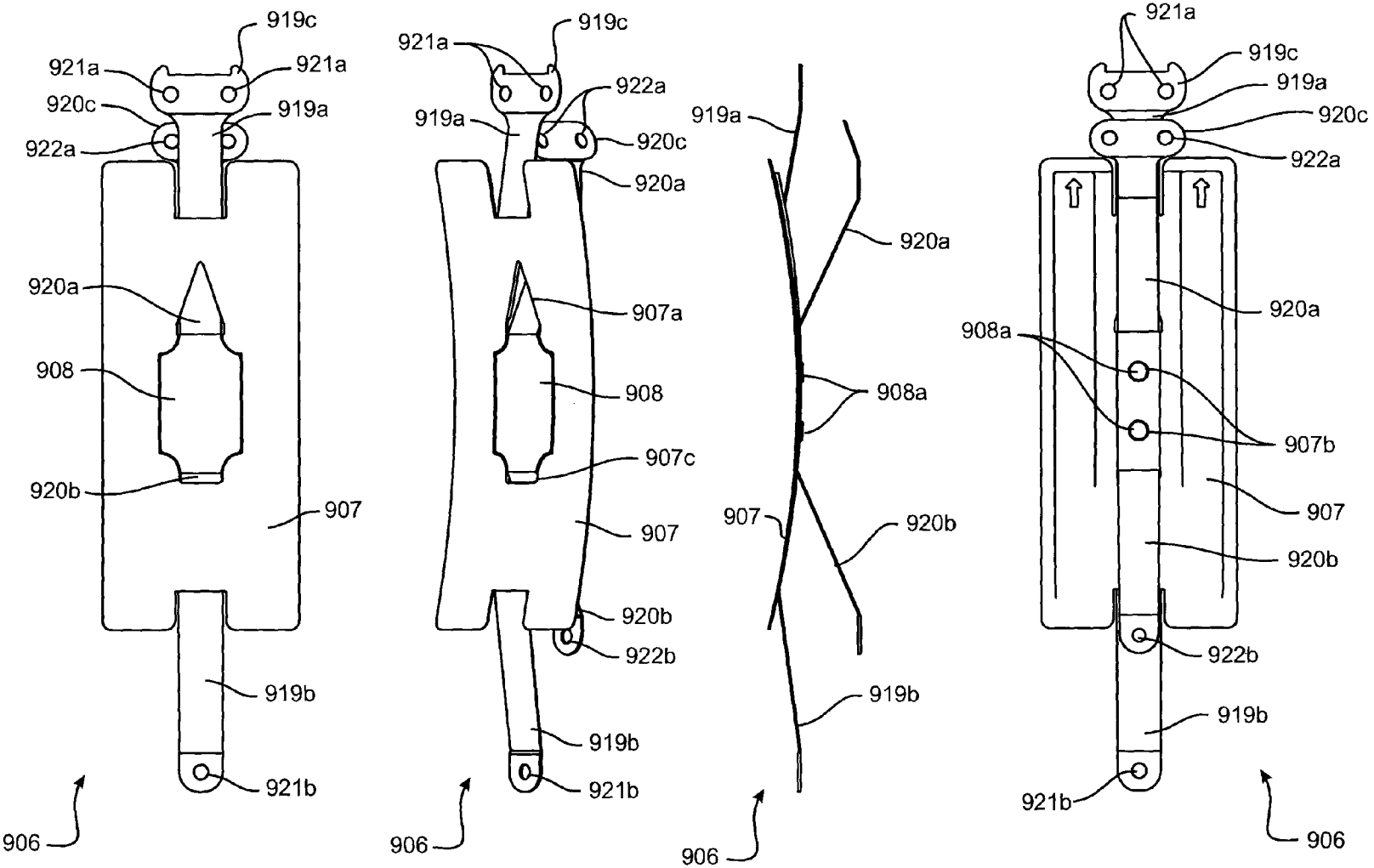
FIG. 99A is a front elevation of the back attachment assembly of FIG. 98A.
FIG. 99B is a front perspective view of the back attachment assembly of FIG. 98A.
FIG. 99C is a side elevation of the back attachment assembly of FIG. 98A.
FIG. 99D is a rear elevation of the back attachment assembly of FIG. 98A.

FIG. 97 shows a front view of the mounting assembly 903. The mounting assembly 903 comprises a double zipper member 911, which comprises the two parallel slits 912, a load dispersion panel 909, and a back attachment assembly 906. The double zipper member 911 and load dispersion panel 909 are both preferably compliant flexible members and the double zipper member 911 is stitched to a front surface of the load dispersion panel 909. The bold lines 932 in FIG. 97 indicate where the double zipper member is stitched.

With reference to FIGS. 98A to 99D, the back attachment assembly 906 comprises a main back attaching member 907 and a retainer 908. The main back attaching member 907 comprises a substantially planar, generally rectangular body with two straps 919*a*, 919*b* for attaching the member 907 to the back portion 201' of a chair. A first one of the two straps 919*a* extends upwardly and rearwardly from a central upper portion of the body. A second one of the two straps 919*b* extends downwardly and rearwardly from a central lower portion of the body. Similarly the retainer 908 comprises a generally rectangular body with two straps 920*a*, 920*b* for attaching the retainer 908 to the back portion 201' of a chair. A first one of the two retainer straps 920*a* extends upwardly and rearwardly from a central upper portion of the retainer body. A second one of the two straps 920*b* extends downwardly and rearwardly from a central lower portion of the retainer body. The upper straps 919*a*, 920*a* on the retainer 908 and the back attaching member 907 each comprise an enlarged portion 919*c*, 920*c* that allow the two upper straps 919*a*, 920*a* to be attached to the back portion with sufficient strength using the same fasteners. The straps act in tension, but are compressible to enable the dispersion panel 909, zippers, carriage, and support member to be moved rearwardly under load. In alternative embodiments, rather than rearwardly extending straps, the back attachment member may comprise any other suitable tension member for example cords or fabric members to attach the back attachment member to the back portion of the chair.

A central portion of the back attaching member 907 comprises two apertures 907*a*, 907*c* for receiving the retainer straps 920*a*, 920*b*. The lower aperture 907*c* is substantially rectangular to receive the lower strap 920*b*. The upper aperture 907*a* is the same width as the lower aperture but comprises an enlarged upper portion to enable the enlarged end 920*c* of the upper retainer strap 920*a* to pass through the aperture 907*a*. When assembled, the main body of the retainer 908 sits against the front surface of the back attachment member 907, and the retainer straps extend through the apertures 907*a* 907*c* and rearward from the back attachment member 907. The retainer body comprises projections 908*a* that are received by complementary locating apertures 907*b* on the back attachment member 907 to correctly position the retainer 908 on the back attachment member 907 and prevent the retainer moving relative to the back attachment member 907.

The back attaching member 907 is flexible about a horizontal axis to allow the assembly 906 to flex rearward upon contact with a user's back, for example when the head or neck support is in its highest position. Preferably, the rectangular portion 907 is thicker at its upper end than at its lower end, so that the flexibility of the back attaching member 907 transitions from relatively stiff at its upper end to relatively flexible at its lower end. The stiffness of the upper end provides stability of the head or neck support while the flexibility of the lower end provides a compliant contact surface for a taller occupant's back when the support member 905 is in the highest position. Preferably the back attaching assembly 906 is less flexible about a substantially vertical axis, to minimise side-to-side rotation of the head or neck support during use. In the embodiment shown, the back attaching assembly 906 is forwardly concave to match the curvature of the chair, for comfort. Alternatively the back attaching assembly 906 could be flat.

The retainer 908 and the back attaching member 907 preferably comprise polypropylene, or an elastomer such as Hytrel from DuPont, and are preferably made of the same materials. Rather than being two separate members, the retainer 908 and the back attaching member 907 may instead be integral.

Figure 100:
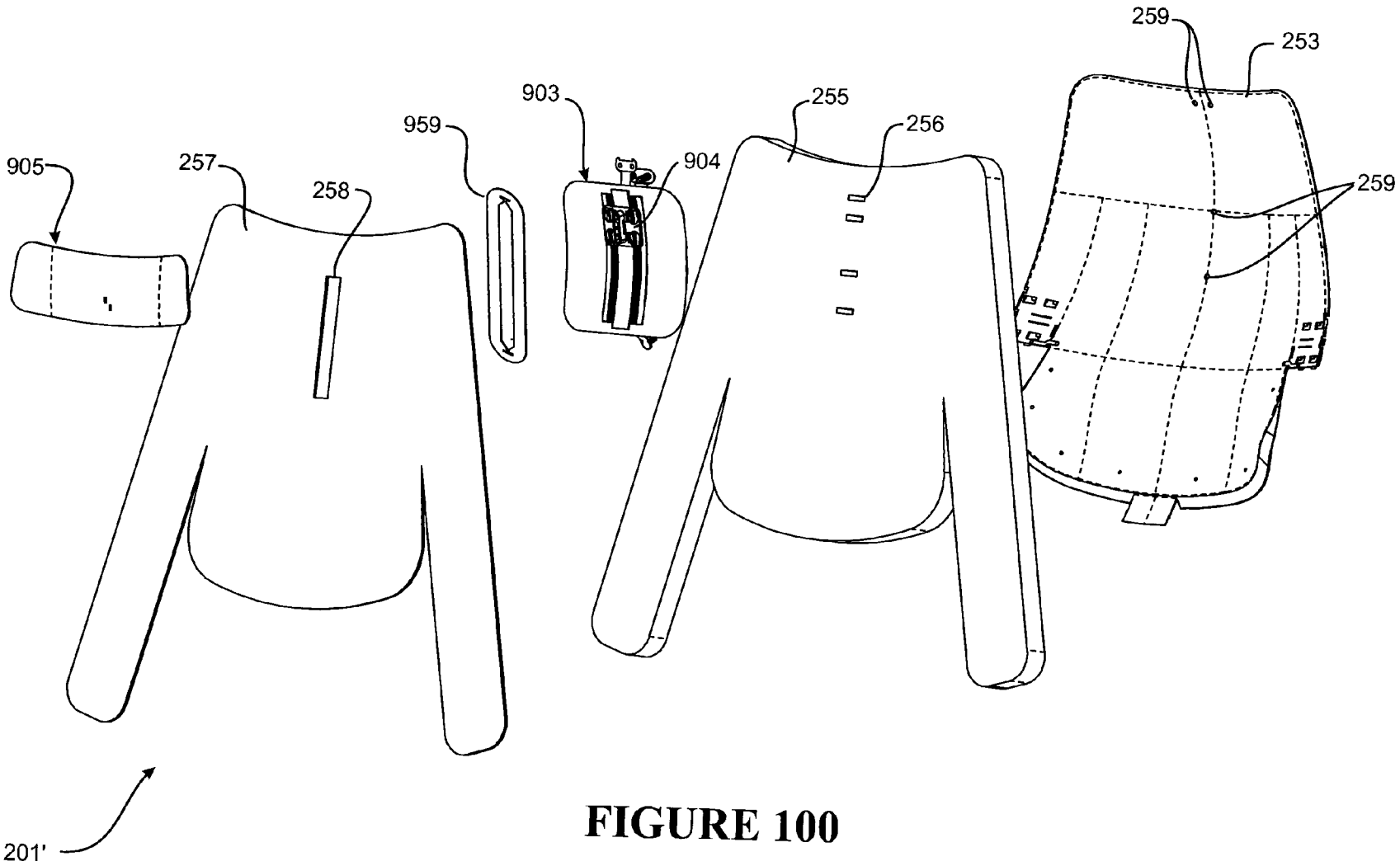
FIG. 100 is an exploded perspective view showing assembly of the head or neck support assembly of FIGS. 86 to 89 to the back portion of the high-back chair of FIGS. 83 and 84.
Figure 102:
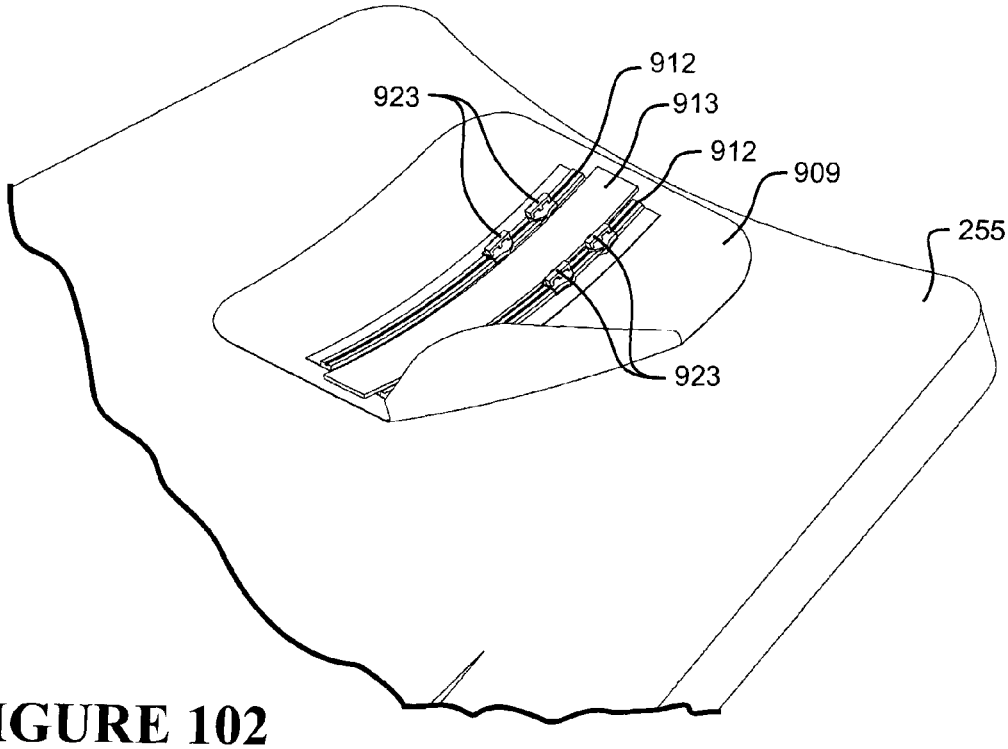
FIG. 102 is a partial front perspective view showing attachment of the load dispersion panel to the back cushion.

Referring to FIG. 100, the back portion 201' of a chair according to one embodiment comprises a relatively rigid portion comprising a back shell or frame 253, a compliant cushion layer 255, and an upholstery layer 257. The upholstery could be any suitable type, such as natural or synthetic leather, fabric, or a polymeric material for example. As discussed above in relation to the preferred form chair, the back shell may be resiliently flexible, but will still be more rigid than the compliant cushion layer 255. The slider arrangement 904 and the mounting assembly 903 are substantially positioned between a front surface of the cushion 255 and a back surface of the upholstery 257. The load dispersion panel 909 is attached to the front surface of the cushion 255 by an adhesive, as shown in FIG. 102. Alternatively, the load dispersion panel 909 may not be fixed to the cushion 255. The load dispersion panel 909 provides a larger area than the double zipper member 911 for transferring the load from the head or neck support 905 to the cushion 255. By dispersing the user's load across the cushion, the load dispersion panel 909 also helps to mask the edge of the retainer 908 from the user's back, improving comfort. Preferably the load dispersion panel comprises a non-woven fabric, for example microsuede, but woven fabrics may also be used.

Figure 101:
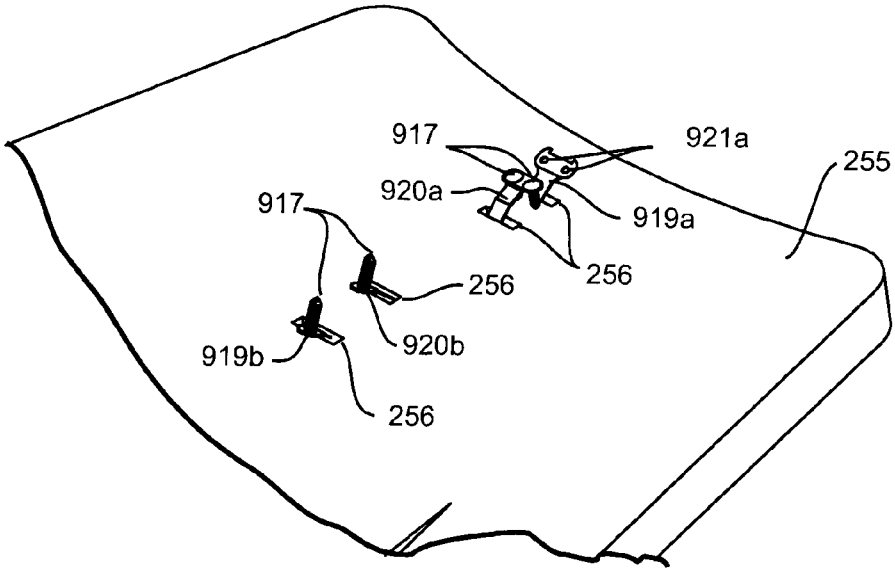
FIG. 101 is a rear perspective view showing the ends of the straps on the back attachment assembly of FIGS. 98A to 99D protruding through the back cushion for attaching to the chair back shell.

The cushion 255 comprises four central apertures 256. The back attachment assembly straps 919*a*, 919*b*, 920*a*, 920*b* extend through these apertures to a rear side of the cushion 255, as shown in FIG. 101. The straps 919*a*, 919*b*, 920*a*, 920*b* comprise apertures 921*a*, 921*b*, 922*a*, 922*b* at their ends. Fasteners 917 such as screws, push fasteners, or the like are placed through these apertures 921*a*, 921*b*, 922*a*, 922*b* and fasten to apertures 259 in the back shell 253 to secure the head or neck support assembly 901 to the back shell 253. Due to limited space on the back portion above the back attaching member 907, the upper strap 919*a* on the back attaching member is shorter than the other straps 919*b*, 920*a*, 920*b*, and attaches to the back portion at the same point as the upper strap 920*a* on the retainer 908. To reinforce the connection, the upper strap 920*a* on the retainer 908 folds over the top and in front of the upper strap 919*a* of the back attaching member 907, so the enlarged portion of the upper strap 919*a* on the back attaching member 907 is positioned nearest the back portion and the apertures 921*a* and 922*a* are aligned.

Two fasteners 917 pass through the two aligned apertures 922*a*, 921*a* on the upper retainer strap 920*a* and the upper back attaching member strap 919*a*, to provide a stronger connection to the back portion than if only one fastener were used. In an alternative embodiment where the back portion has sufficient height above the back attaching member 907, the upper straps 920*a*, 919*a* may each comprise only one aperture and connect to the back portion independently in the same manner as the lower straps 920*b*, 919*b*. The direct attachment of the back attachment assembly 906 to the back shell 253 minimises undesirable rotation of the support about a horizontal axis.

Because the straps 919*a*, 919*b*, 920*a*, 920*b* are flexible, the mounting assembly can move rearward or be tilted or twisted in response to rearward force on the head or neck support and compression of the cushion member 255.

Figure 103:
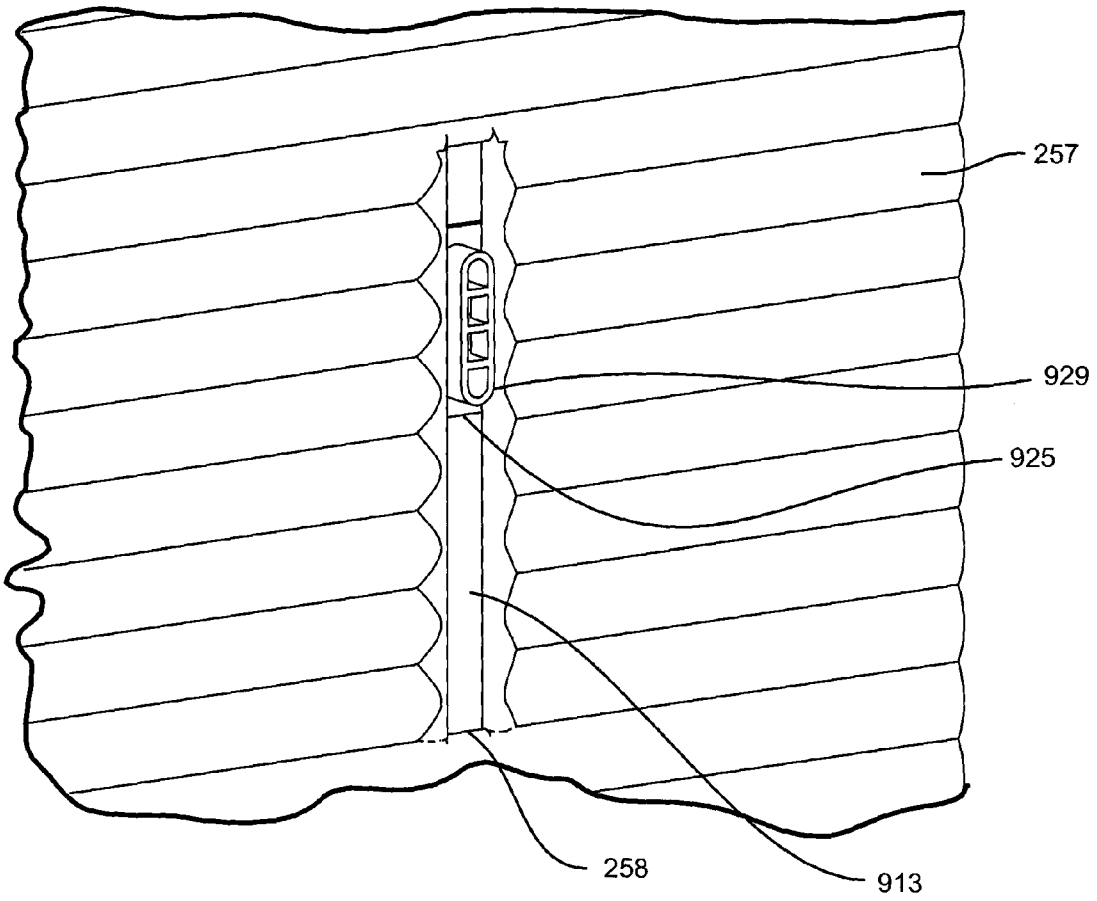
Figure 104B:
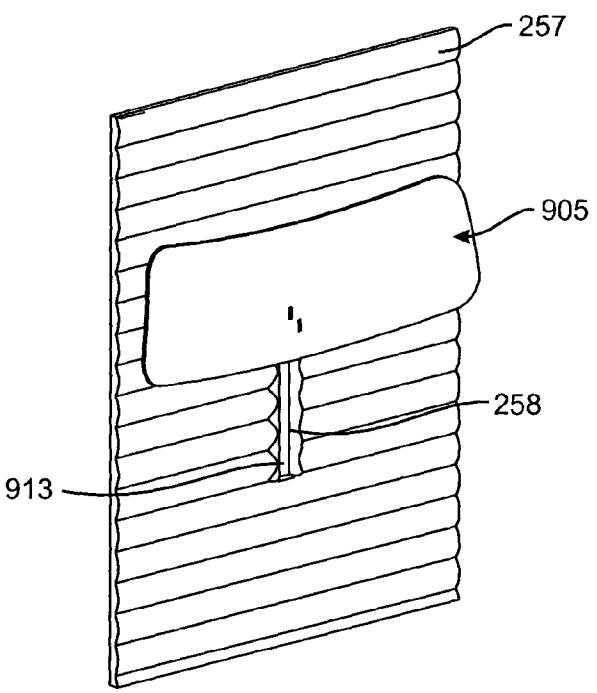
Figure 104A:
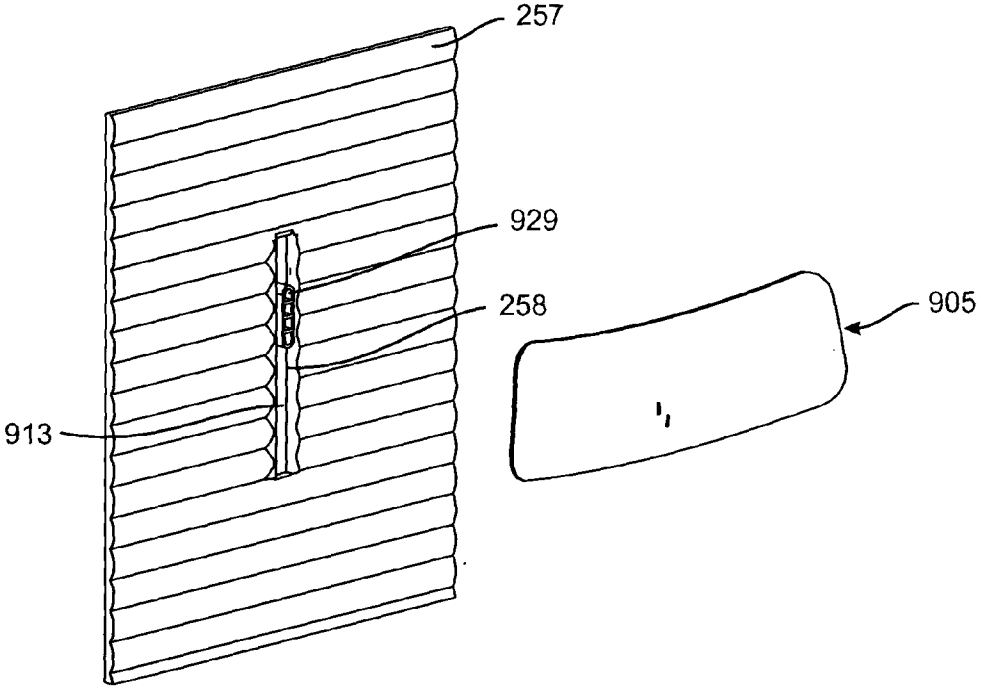

The upholstery 257 comprises an elongate aperture 258 that is substantially parallel to the two slits 912 and is preferably positioned between the two slits 912. The aperture may be an elongate rectangular slot, or alternatively may be a slit in the upholstery. In a preferred embodiment, a polypropylene reinforcement member 959 with a central slot is optionally provided on a back side of the upholstery. The upholstery is wrapped around the slot and stitched to the polypropylene member 959 to reinforce and stiffen the elongate aperture 258. In alternative embodiments, there may be no separate reinforcement member, or the reinforcement member may comprise any suitable material other than polypropylene. The support connector 929 protrudes forwardly through the upholstery aperture 258, as shown in FIG. 103, and the head or neck support 905 attaches to the support connector 929, as shown in FIGS. 104A and 104B. The head or neck support and the sliders 923 are positioned on opposite sides of the upholstery layer 257. The support connector 929 slides in the upholstery aperture 258 during height adjustment of the head or neck support 905.

In a preferred embodiment, the mounting assembly 903 further comprises a trim strip 913 that is made from the same material as the upholstery, or from another fabric or material similar in colour and appearance to the upholstery. The trim strip 913 is positioned between the two slits 912 in the double zipper member and is preferably stitched to the load dispersion panel 909 as illustrated in FIG. 97. The trim strip 913 covers the only part of the mounting assembly 903 that would be visible through the aperture 258 in the upholstery 257 to minimise the visibility of the aperture.

The support assembly has been described above and is shown in the drawings with reference to a height adjustable head or neck support for a chair. Alternatively, the support assembly may be a height adjustable lumbar support, or alternatively a support that is adjustable side-to-side. In an assembly with a side-to-side adjustable support 905, the slits 912 would be oriented substantially horizontally.

Rather than having two spaced-apart elongate closures, a single elongate closure could be provided, with the slider(s) supporting the support panel 905 from the single closure. However, the spaced-apart closures are preferred, as they minimise undesirable rotation of the support panel about a horizontal axis extending forward/rearward through the back portion and twisting about a vertical axis. For the zipper embodiment, rather than having separate sliders 923 that are configured to move together during adjustment of the support member, the sliders in the pair that engage one closure could be integrally formed. Equally, for the zip-lock type embodiment, the sliders 935 could be separately formed and configured to move together during movement of the support member 905. The opposed pairs of sliders (or integrally formed effective opposed pairs) provide four points of stability for the carriage 925 and thereby the support member 905, to thereby minimise undesirable rotation about a horizontal axis extending forward/rearward through the back portion of the chair.

The above describes preferred forms of the present invention, and modifications can be made thereto without departing from the scope of the present invention.

For example, the preferred form features are described and shown with reference to a domestic lounger chair. However, it will be appreciated that many of the features can readily be incorporated into different types of chairs, such as office chairs, vehicle chairs (e.g. aircraft, marine, or motor vehicle chairs), cinema, or theatre chairs for example. The supporting frame could be modified accordingly, so as to be fixed to the ground or a wall panel for example for a cinema or theatre chair. References herein to a chair should be construed sufficiently broadly to encompass these alternative applications.

Additionally, a number of the features described herein can be incorporated into chairs having different features. They need not all be incorporated into the same chair.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting. Where specific integers are mentioned herein which have known equivalents in the art to which this invention relates, such known equivalents are deemed to be incorporated herein as if individually set forth.

The invention claimed is:

1. A chair comprising:

a supporting frame;

a seat portion for supporting an occupant;

a back portion for supporting a back of an occupant when the occupant is seated on the seat portion that has an upper end, a lower end, and is pivotally mounted to the supporting frame at a position above the lower end of the back portion;

and a recline mechanism configured to lift and move the seat portion forward upon a reclining action of the back portion, the recline mechanism comprising an operative connection between the seat portion and the supporting frame, and a drag link pivotally connected to the seat portion and pivotally connected to the back portion at a position below the pivotal mounting of the back portion to the supporting frame, the recline mechanism configured such that as the back portion of the chair is reclined, the lower end of the back portion moves forward and the drag link pulls the seat portion upward and forward relative to the supporting frame;

wherein the operative connection comprises a rear operative connection between a relatively rearward portion of the seat portion and the supporting frame, wherein the rear operative connection comprises a forward link that is pivotally connected to the supporting frame, a rearward link that is pivotally connected to the supporting frame, and a carrier link that is pivotally connected to the forward link and to the rearward link, wherein the carrier link is pivotally connected to the seat portion.

2. The chair as claimed in claim 1, wherein when the back portion is in an upright configuration, the forward link hangs downwardly and rearwardly from its pivot connection to the supporting frame, and the rearward link hangs downwardly and forwardly from its pivot connection to the supporting frame, and when the back portion is fully reclined, the forward link hangs generally downwardly from its pivot connection to the supporting frame, and the rearward link extends generally forwardly from its pivot connection to the supporting frame.

3. The chair as claimed in claim 2, wherein the pivot connection of the carrier link to the seat portion is positioned rearwardly of the pivot connections of the forward link and rearward link to the carrier link.

4. The chair as claimed in claim 2, wherein the pivot connection of the drag link to the seat portion is positioned generally above and generally behind the pivot connection of carrier link and the seat portion, when the back portion of the chair is not reclined.

5. The chair as claimed in claim 4, wherein the pivot connection of the drag link to the seat portion is positioned upwardly and rearwardly of the pivot connection of the carrier link and the seat portion, when the back portion of the chair is fully reclined.

6. The chair as claimed in claim 1, wherein the operative connection between the seat portion and the supporting frame is arranged such that the relatively forward and relatively rearward portions of the seat portion move upward and forward with a substantially linear movement as the back portion is reclined, with the amount of movement of the relatively rearward portion being greater than the amount of movement of the relatively forward portion, to provide a forward tilt of the seat portion as the back portion is reclined.

7. The chair as claimed in claim 1, wherein the supporting frame comprises a main transom, an intermediate support, and a rocker mechanism that operatively connects the main transom and the intermediate support to provide a rocking motion therebetween, wherein the operative connection between the seat portion and the supporting frame is connected to the intermediate support.

8. The chair as claimed in claim 7, further comprising:

an extendable foot or leg support assembly pivotally connected to the seat portion; and a rocking inhibitor arrangement to inhibit forward rocking of the intermediate support relative to the main transom when the foot or leg support assembly is extended.

9. A chair comprising:

a supporting frame;

a seat portion for supporting an occupant;

a back portion for supporting a back of an occupant when the occupant is seated on the seat portion that has an upper end, a lower end, and is pivotally mounted to the supporting frame at a position above the lower end of the back portion;

and a recline mechanism configured to lift and move the seat portion forward upon a reclining action of the back portion, the recline mechanism comprising an operative connection between the seat portion and the supporting frame, and a drag link pivotally connected to the seat portion and pivotally connected to the back portion at a position below the pivotal mounting of the back portion to the supporting frame, the recline mechanism configured such that as the back portion of the chair is reclined, the lower end of the back portion moves forward and the drag link pulls the seat portion upward and forward relative to the supporting frame, wherein the operative connection comprises a rear operative connection between a relatively rearward portion of the seat portion and the supporting frame, wherein the rear operative connection comprises a forward link that is pivotally connected to the supporting frame, a rearward link that is pivotally connected to the supporting frame, and a carrier link that is pivotally connected to the forward link and to the rearward link, wherein the carrier link is pivotally connected to the seat portion, and wherein the operative connection further comprises a front operative connection between a relatively forward portion of the seat portion and the supporting frame, wherein the front operative connection comprises a slide arrangement comprising a track on one of the seat portion and the supporting frame, and a follower on the other of the seat portion and the supporting frame, with the follower arranged to travel in the track as the seat portion is moved upward upon recline of the back portion.

10. The chair as claimed in claim 9, comprising two front operative connections, one at or adjacent each side of the seat portion, and wherein each front operative connection comprises a slide arrangement comprising a track on one of the seat portion and the supporting frame, and a follower on the other of the seat portion and the supporting frame, with the follower arranged to travel in the track as the seat portion is moved upward upon recline of the back portion.

11. A chair comprising:

a supporting frame;

a seat portion for supporting an occupant;

a back portion for supporting a back of an occupant when the occupant is seated on the seat portion that has an upper end, a lower end, and is pivotally mounted to the supporting frame at a position above the lower end of the back portion;

and a recline mechanism configured to lift and move the seat portion forward upon a reclining action of the back portion, the recline mechanism comprising an operative connection between the seat portion and the supporting frame, and a drag link pivotally connected to the seat portion and pivotally connected to the back portion at a position below the pivotal mounting of the back portion to the supporting frame, the recline mechanism configured such that as the back portion of the chair is reclined, the lower end of the back portion moves forward and the drag link pulls the seat portion upward and forward relative to the supporting frame, wherein the operative connection comprises a rear operative connection between a relatively rearward portion of the seat portion and the supporting frame, wherein the rear operative connection comprises a forward link that is pivotally connected to the supporting frame, a rearward link that is pivotally connected to the supporting frame, and a carrier link that is pivotally connected to the forward link and to the rearward link, wherein the carrier link is pivotally connected to the seat portion; and wherein the back portion comprises a central spine, and a compliant support surface supported by the spine for supporting the back of a seated occupant, wherein a lower portion of the spine is pivotally connected to the supporting frame, with a bottom portion of the spine pivotally connected to the drag link.

12. The chair as claimed in claim 11, wherein the compliant support surface comprises a resiliently flexible shell supported by the spine and a cushion supported by the shell.

13. The chair as claimed in claim 12, wherein the spine is resiliently flexible such that an upper end of the spine can be flexed rearwardly relative to a portion of the spine adjacent the pivot connection of the spine to the supporting frame.

14. The chair as claimed in claim 12, wherein the spine is resiliently flexible so it can twist with a torsional action around a longitudinal axis of the spine, upon application of a suitable force by a seated occupant to the compliant support surface.

15. The chair as claimed in claim 11, wherein the supporting frame comprises an intermediate support with a generally horizontally extending portion and a pair of rearward uprights, with the lower portion of the spine positioned between and pivotally connected to the uprights.

16. The chair as claimed in claim 15, wherein the seat portion comprises a seat frame and a support surface mounted to the seat frame for supporting a seated occupant, wherein the operative connection(s) between the seat portion and the supporting frame are connected between the intermediate support and the seat frame.

* * * * *